US006022273A

United States Patent [19]

Gabai et al.

[11] Patent Number: 6,022,273

[45] Date of Patent: Feb. 8, 2000

[54] INTERACTIVE DOLL

[75] Inventors: Oz Gabai; Jacob Gabai; Moshe Cohen, all of Tel Aviv, Israel

[73] Assignee: Creator Ltd., Herzelia, Israel

[21] Appl. No.: 08/975,348

[22] Filed: Nov. 20, 1997

Related U.S. Application Data

[62] Division of application No. 08/561,316, Nov. 20, 1995, Pat. No. 5,752,880.

[51] Int. Cl.[7] ..... A63F 9/22; G06F 9/00

[52] U.S. Cl. ..... 463/39; 463/1; 345/474

[58] Field of Search ..... 463/1, 30, 31, 463/36, 35, 39, 40, 42; 434/307 R, 308, 309; 446/298, 301, 268, 297, 300, 299, 175, 401, 405; 345/474–473, 348; 364/410.1; 901/1; 340/825.06, 825.07, 825.08

[56] References Cited

U.S. PATENT DOCUMENTS

| | | | |
|---|---|---|---|
| 4,334,221 | 6/1982 | Rosenhagen et al. | 463/39 |
| 4,712,184 | 12/1987 | Haugerud | 364/513 |
| 4,729,563 | 3/1988 | Yokoi | 446/175 |
| 4,786,967 | 11/1988 | Smith, III et al. | 358/143 |
| 4,799,171 | 1/1989 | Cummings | 446/175 |
| 4,840,602 | 6/1989 | Rose | 446/175 |
| 4,846,693 | 7/1989 | Baer | 434/308 |
| 4,875,096 | 10/1989 | Baer et al. | 358/143 |
| 4,913,676 | 4/1990 | Koguchi et al. . | |
| 4,923,428 | 5/1990 | Curran | 446/175 |
| 4,930,019 | 5/1990 | Chu | 434/307 R |
| 4,938,483 | 7/1990 | Yavetz | 273/311 |
| 4,940,444 | 7/1990 | Russell | 446/446 |
| 4,942,506 | 7/1990 | Flory | 362/253 |
| 4,964,837 | 10/1990 | Collier | 446/409 |
| 4,968,280 | 11/1990 | Kelley | 446/330 |
| 5,009,626 | 4/1991 | Katz | 446/391 |
| 5,013,276 | 5/1991 | Garfinkle | 446/14 |
| 5,021,878 | 6/1991 | Lang | 358/93 |
| 5,029,214 | 7/1991 | Hollander | 446/175 |
| 5,032,099 | 7/1991 | Chan | 46/175 |
| 5,055,082 | 10/1991 | Varner | 443/308 |
| 5,083,965 | 1/1992 | Mayem | 446/305 |
| 5,085,434 | 2/1992 | Soto . | |
| 5,092,775 | 3/1992 | Wolf | 434/118 |
| 5,114,377 | 5/1992 | Cove Mercuri | 446/487 |
| 5,119,001 | 6/1992 | Moore | 318/257 |
| 5,137,488 | 8/1992 | Yeh | 446/397 |
| 5,142,803 | 9/1992 | Lang | 40/411 |
| 5,145,446 | 9/1992 | Kuo | 446/405 |
| 5,169,156 | 12/1992 | Smollar | 273/312 |
| 5,182,557 | 1/1993 | Lang | 341/120 |
| 5,191,615 | 3/1993 | Aldava et al. | 381/3 |
| 5,195,920 | 3/1993 | Collier | 446/409 |
| 5,203,848 | 4/1993 | Wang | 463/45 |
| 5,213,510 | 5/1993 | Freeman | 434/321 |

(List continued on next page.)

FOREIGN PATENT DOCUMENTS

| | | |
|---|---|---|
| 412278 | 2/1991 | European Pat. Off. . |
| 418730 | 3/1991 | European Pat. Off. . |
| 472365 | 2/1992 | European Pat. Off. . |
| 629987 | 12/1994 | European Pat. Off. . |
| 3009040 | 9/1981 | Germany . |
| 9106090 | 5/1991 | WIPO . |
| 9110490 | 7/1991 | WIPO . |
| 9417886 | 8/1994 | WIPO . |

OTHER PUBLICATIONS

Byte Publication, Feb. 1981, article "A Computer Controlled Tank", by Steve Ciarcia, pp 44–48, 50,52,54–55, 58,60,52 and 64.

*Primary Examiner*—Valencia Martin-Wallace
*Assistant Examiner*—Mark A. Sager
*Attorney, Agent, or Firm*—Ladas & Parry

[57] ABSTRACT

Apparatus for a wireless computer controlled toy system is disclosed, the apparatus including a computer system operative to transmit a first transmission via a first wireless transmitter and at least one toy including a first wireless receiver, the toy receiving the first transmission via the first wireless receiver and operative to carry out at least one action based on said first transmission. A method for controlling the toy system is also disclosed.

36 Claims, 59 Drawing Sheets

U.S. PATENT DOCUMENTS

| | | | |
|---|---|---|---|
| 5,226,822 | 7/1993 | Morris | 434/359 |
| 5,267,734 | 12/1993 | Stampe et al. | 273/148 B |
| 5,270,480 | 12/1993 | Hikawa | 84/645 |
| 5,279,514 | 1/1994 | Lacombe et al. | 446/297 |
| 5,281,143 | 1/1994 | Arad et al. | 434/185 |
| 5,289,273 | 2/1994 | Lang | 348/121 |
| 5,324,225 | 6/1994 | Satoh et al. | 446/175 |
| 5,376,038 | 12/1994 | Arad et al. | 446/297 |
| 5,388,493 | 2/1995 | Curletto | 84/376 A |
| 5,636,994 | 6/1997 | Tong | 434/308 |
| 5,724,074 | 3/1998 | Chainani et al. | 446/465 |

7
6
280
1
VDD
C5
0.1μF
8
3
4
1 DIGITAL
R2
2
U4
MC33174
1K
C6
0.1μF
R3
10K
K1
220
280
J2
J4
SPEAKER OUT
RELAY DPDT
SPEAKER OUT
9
K2
230
J3
J5
LINE IN
RELAY DPDT
LINE IN
8
K3
230
J6
J7
LINE OUT
RELAY DPDT
LINE OUT

INTERACTIVE DOLL

This is a divisional of application Ser. No. 08/561,316 filed on Nov. 20, 1995, now U.S. Pat. No. 5,752,880.

FIELD OF THE INVENTION

The present invention relates to toys in general, and particularly to toys used in conjunction with a computer system.

BACKGROUND OF THE INVENTION

Toys which are remotely controlled by wireless communication and which are not used in conjunction with a computer system are well known in the art. Typically, such toys include vehicles whose motion is controlled by a human user via a remote control device.

U.S. Pat. No. 4,712,184 to Haugerud describes a computer controlled educational toy, the construction of which teaches the user computer terminology and programming and robotic technology. Haugerud describes computer control of a toy via a wired connection, wherein the user of the computer typically writes a simple program to control movement of a robot.

U.S. Pat. No. 4,840,602 to Rose describes a talking doll responsive to an external signal, in which the doll has a vocabulary stored in digital data in a memory which may be accessed to cause a speech synthesizer in the doll to simulate speech.

U.S. Pat. No. 5,021,878 to Lang describes an animated character system with real-time control.

U.S. Pat. No. 5,142,803 to Lang describes an animated character system with real-time control.

U.S. Pat. No. 5,191,615 to Aldava et al. describes an interrelational audio kinetic entertainment system in which movable and audible toys and other animated devices spaced apart from a television screen are provided with program synchronized audio and control data to interact with the program viewer in relationship to the television program.

U.S. Pat. No. 5,195,920 to Collier describes a radio controlled toy vehicle which generates realistic sound effects on board the vehicle. Communications with a remote computer allows an operator to modify and add new sound effects.

U.S. Pat. No. 5,270,480 to Hikawa describes a toy acting in response to a MIDI signal, wherein an instrument-playing toy performs simulated instrument playing movements.

U.S. Pat. No. 5,289,273 to Lang describes a system for remotely controlling an animated character. The system uses radio signals to transfer audio, video and other control signals to the animated character to provide speech, hearing vision and movement in real-time.

U.S. Pat. No. 5,388,493 describes a system for a housing for a vertical dual keyboard MIDI wireless controller for accordionists. The system may be used with either a conventional MIDI cable connection or by a wireless MIDI transmission system.

German Patent DE 3009-040 to Neuhierl describes a device for adding the capability to transmit sound from a remote control to a controlled model vehicle. The sound is generated by means of a microphone or a tape recorder and transmitted to the controlled model vehicle by means of radio communications. The model vehicle is equipped with a speaker that emits the received sounds.

SUMMARY OF THE INVENTION

The present invention seeks to provide an improved toy system for use in conjunction with a computer system.

There is thus provided in accordance with a preferred embodiment of the present invention a wireless computer controlled toy system including a computer system operative to transmit a first transmission via a first wireless transmitter and at least one toy including a first wireless receiver, the toy receiving the first transmission via the first wireless receiver and operative to carry out at least one action based on the first transmission.

The computer system may include a computer game. The toy may include a plurality of toys, and the at least one action may include a plurality of actions.

The first transmission may include a digital signal. The first transmission includes an analog signal and the analog signal may include sound.

Additionally in accordance with a preferred embodiment of the present invention the computer system includes a computer having a MIDI port and wherein the computer may be operative to transmit the digital signal by way of the MIDI port.

Additionally in accordance with a preferred embodiment of the present invention the sound includes music, a prerecorded sound and/or speech. The speech may include recorded speech and synthesized speech.

Further in accordance with a preferred embodiment of the present invention the at least one toy has a plurality of states including at least a sleep state and an awake state, and the first transmission includes a state transition command, and the at least one action includes transitioning between the sleep state and the awake state.

A sleep state may typically include a state in which the toy consumes a reduced amount of energy and/or in which the toy is largely inactive, while an awake state is typically a state of normal operation.

Still further in accordance with a preferred embodiment of the present invention the first transmission includes a control command chosen from a plurality of available control commands based, at least in part, on a result of operation of the computer game.

Additionally in accordance with a preferred embodiment of the present invention the computer system includes a plurality of computers.

Additionally in accordance with a preferred embodiment of the present invention the first transmission includes computer identification data and the second transmission includes computer identification data.

Additionally in accordance with a preferred embodiment of the present invention the at least one toy is operative to transmit a second transmission via a second wireless transmitter and the computer system is operative to receive the second transmission via a second wireless receiver.

Moreover in accordance with a preferred embodiment of the present invention the system includes at least one input device and the second transmission includes a status of the at least one input device.

Additionally in accordance with a preferred embodiment of the invention the at least one toy includes at least a first toy and a second toy, and wherein the first toy is operative to transmit a toy-to-toy transmission to the second toy via the second wireless transmitter, and wherein the second toy is operative to carry out at least one action based on the toy-to-toy transmission.

Further in accordance with a preferred embodiment of the present invention operation of the computer system is controlled, at least in part, by the second transmission.

Moreover in accordance with a preferred embodiment of the present invention the computer system includes a computer game, and wherein operation of the game is controlled, at least in part, by the second transmission.

The second transmission may include a digital signal and/or an analog signal.

Still further in accordance with a preferred embodiment of the present invention the computer system has a plurality of states including at least a sleep state and an awake state, and the second transmission include a state transition command, and the computer is operative, upon receiving the second transmission, to transition between the sleep state and the awake state.

Still further in accordance with a preferred embodiment of the present invention at least one toy includes sound input apparatus, and the second transmission includes a sound signal which represents a sound input via the sound input apparatus.

Additionally in accordance with a preferred embodiment of the present invention the computer system is also operative to perform at least one of the following actions: manipulate the sound signal; and play the sound signal.

Additionally in accordance with a preferred embodiment of the present invention the sound includes speech, and the computer system is operative to perform a speech recognition operation on the speech.

Further in accordance with a preferred embodiment of the present invention the second transmission includes toy identification data, and the computer system is operative to identify the at least one toy based, at least in part, on the toy identification data.

Still further in accordance with a preferred embodiment of the present invention the first transmission includes toy identification data. The computer system may adapt a mode of operation thereof based, at least in part, on the toy identification data.

Still further in accordance with a preferred embodiment of the present invention the at least one action may include movement of the toy, movement of a part of the toy and/or an output of a sound. The sound may be transmitted using a MIDI protocol.

There is also provided in accordance with another preferred embodiment of the present invention a game system including a computer system operative to control a computer game and having a display operative to display at least one display object, and at least one toy in wireless communication with the computer system, the computer game including a plurality of game objects, and the plurality of game objects includes the at least one display object and the at least one toy.

Further in accordance with a preferred embodiment of the present invention the at least one toy is operative to transmit toy identification data to the computer system, and the computer system is operative to adapt a mode of operation of the computer game based, at least in part, on the toy identification data.

The computer system may include a plurality of computers.

Additionally in accordance with a preferred embodiment of the present invention the first transmission includes computer identification data and the second transmission includes computer identification data.

There is also provided in accordance with a preferred embodiment of the present invention a data transmission apparatus including first wireless apparatus including musical instrument data interface (MIDI) apparatus operative to receive and transmit MIDI data between a first wireless and a first MIDI device and second wireless apparatus including MIDI apparatus operative to receive and transmit MIDI data between a second wireless and a second MIDI device, the first wireless apparatus is operative to transmit MIDI data including data received from the first MIDI device to the second wireless apparatus, and to transmit MIDI data including data received from the second wireless apparatus to the first MIDI device, and the second wireless apparatus is operative to transmit MIDI data including data received from the second MIDI device to the first wireless apparatus, and to transmit MIDI data including data received from the first wireless apparatus to the second MIDI device.

Further in accordance with a preferred embodiment of the present invention the second wireless apparatus includes a plurality of wirelesses each respectively associated with one of the plurality of MIDI devices, and each of the second plurality of wirelesses is operative to transmit MIDI data including data received from the associated MIDI device to the first wireless apparatus, and to transmit MIDI data including data received from the first wireless apparatus to the associated MIDI device.

The first MIDI device may include a computer, while the second MIDI device may include a toy.

Additionally in accordance with a preferred embodiment of the present invention the first wireless apparatus also includes analog interface apparatus operative to receive and transmit analog signals between the first wireless and a first analog device, and the second wireless apparatus also includes analog interface apparatus operative to receive and transmit analog signals between the second wireless and a second analog device, and the first wireless apparatus is also operative to transmit analog signals including signals received from the first analog device to the second wireless apparatus, and to transmit analog signal including signals received from the second wireless apparatus to the first analog device, and the second wireless apparatus is also operative to transmit analog signals including signals received from the second analog device to the first wireless apparatus, and to transmit analog signals including data received from the first wireless apparatus to the second analog device.

There is also provided in accordance with another preferred embodiment of the present invention a method for generating control instructions for a computer controlled toy system, the method includes selecting a toy, selecting at least one command from among a plurality of commands associated with the toy, and generating control instructions for the toy including the at least one command.

Further in accordance with a preferred embodiment of the present invention the step of selecting at least one command includes choosing a command, and specifying at least one control parameter associated with the chosen command.

Still further in accordance with a preferred embodiment of the present invention the at least one control parameter includes at least one condition depending on a result of a previous command.

Additionally in accordance with a preferred embodiment of the present invention at least one of the steps of selecting a toy and the step of selecting at least one command includes utilizing a graphical user interface.

Still further in accordance with a preferred embodiment of the present invention the previous command includes a previous command associated with a second toy.

Additionally in accordance with a preferred embodiment of the present invention the at least one control parameter includes an execution condition controlling execution of the command.

The execution condition may include a time at which to perform the command and/or a time at which to cease performing the command. The execution condition may also include a status of the toy.

Additionally in accordance with a preferred embodiment of the present invention the at least one control parameter includes a command modifier modifying execution of the command.

Still further in accordance with a preferred embodiment of the present invention the at least one control parameter includes a condition dependent on a future event.

Additionally in accordance with a preferred embodiment of the present invention the at least one command includes a command to cancel a previous command.

There is also provided for in accordance with a preferred embodiment of the present invention a signal transmission apparatus for use in conjunction with a computer, the apparatus including wireless transmission apparatus; and signal processing apparatus including at least one o f the following analog/digital sound conversion apparatus operative to convert analog sound signals to digital sound signals, to convert digital sound signals to analog sound signals, and to transmit the signals between the computer and a sound device using the wireless transmission apparatus; a peripheral control interface operative to transmit control signals between the computer and a peripheral device using the wireless transmission apparatus; and a MIDI interface operative to transmit MIDI signals between the computer and a MIDI device using the wireless transmission apparatus.

There is also provided in accordance with another preferred embodiment of the present invention a computer system including a computer, and a sound card operatively attached to the computer and having a MIDI connector and at least one analog connecter, wherein the computer is operative to transmit digital signals by means of the MIDI connector and to transmit analog signals by means of the at least one analog connector.

Further in accordance with a preferred embodiment of the present invention the computer is also operative to receive digital signals by means of the MIDI connector and to receive analog signals by means of the at least one analog connector.

In this application the term "radio" includes all forms of "wireless" communication.

BRIEF DESCRIPTION OF THE DRAWINGS

The present invention will be understood and appreciated from the following detailed description, taken in conjunction with the drawings in which.

Figure 8A:
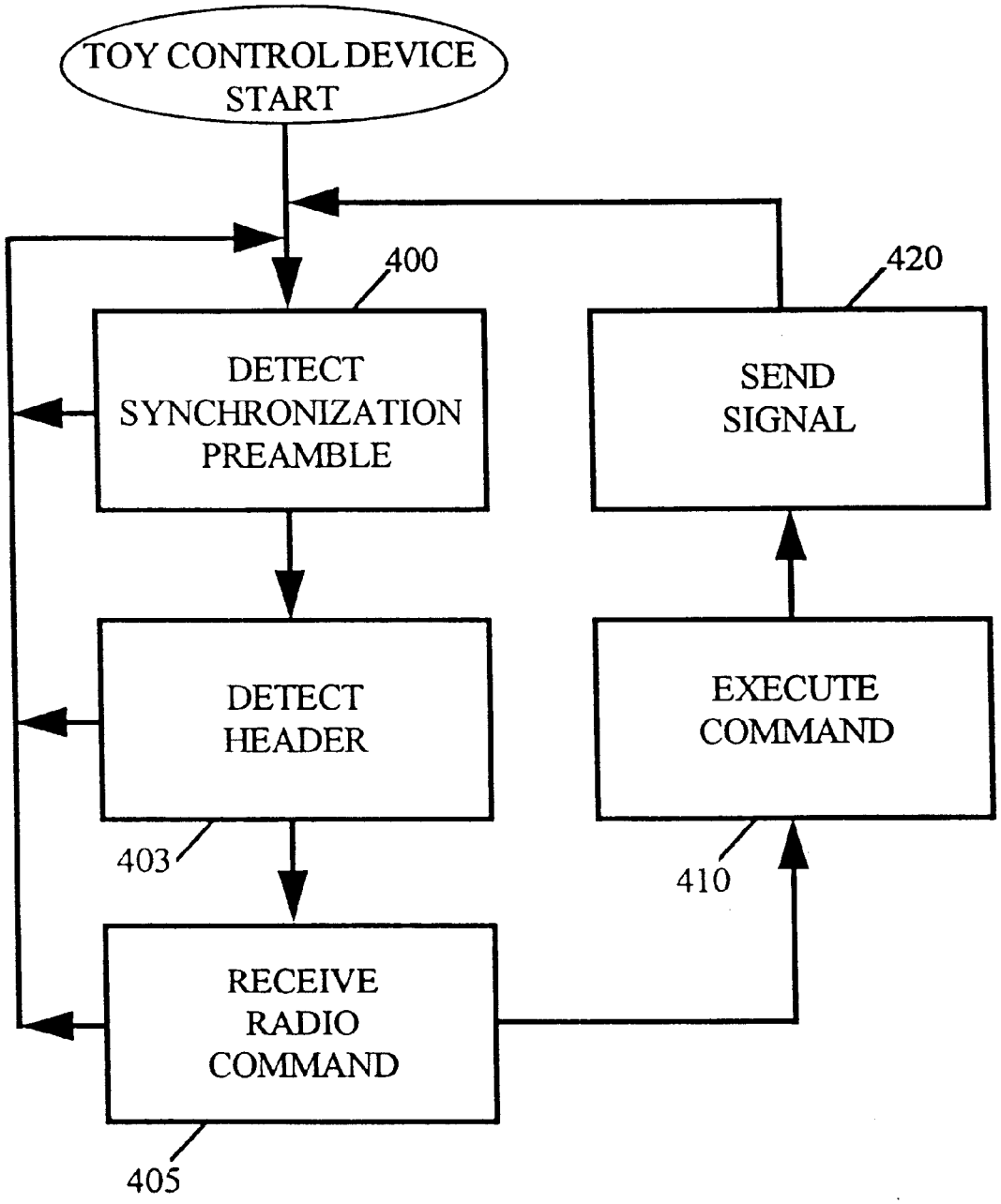
FIG. 8A is a simplified flowchart illustration of a preferred method for receiving radio signals, executing commands comprised therein, and sending radio signals, within the toy control device 130 of FIG. 1A.
Figure 8B:
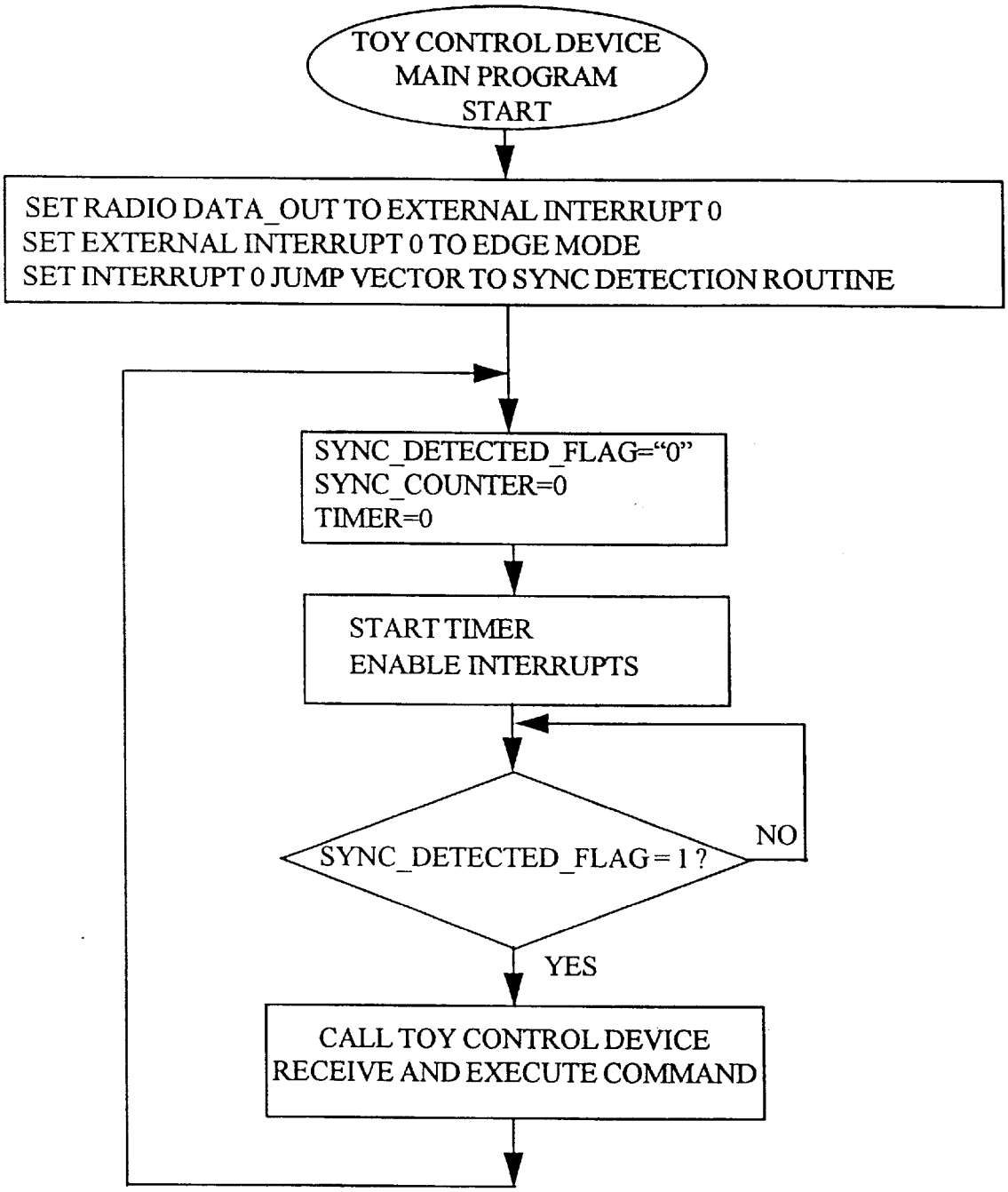
FIGS. 8B–8T, taken together, comprise a simplified flowchart illustration of a preferred implementation of the method of FIG. 8A.
Figure 8C:
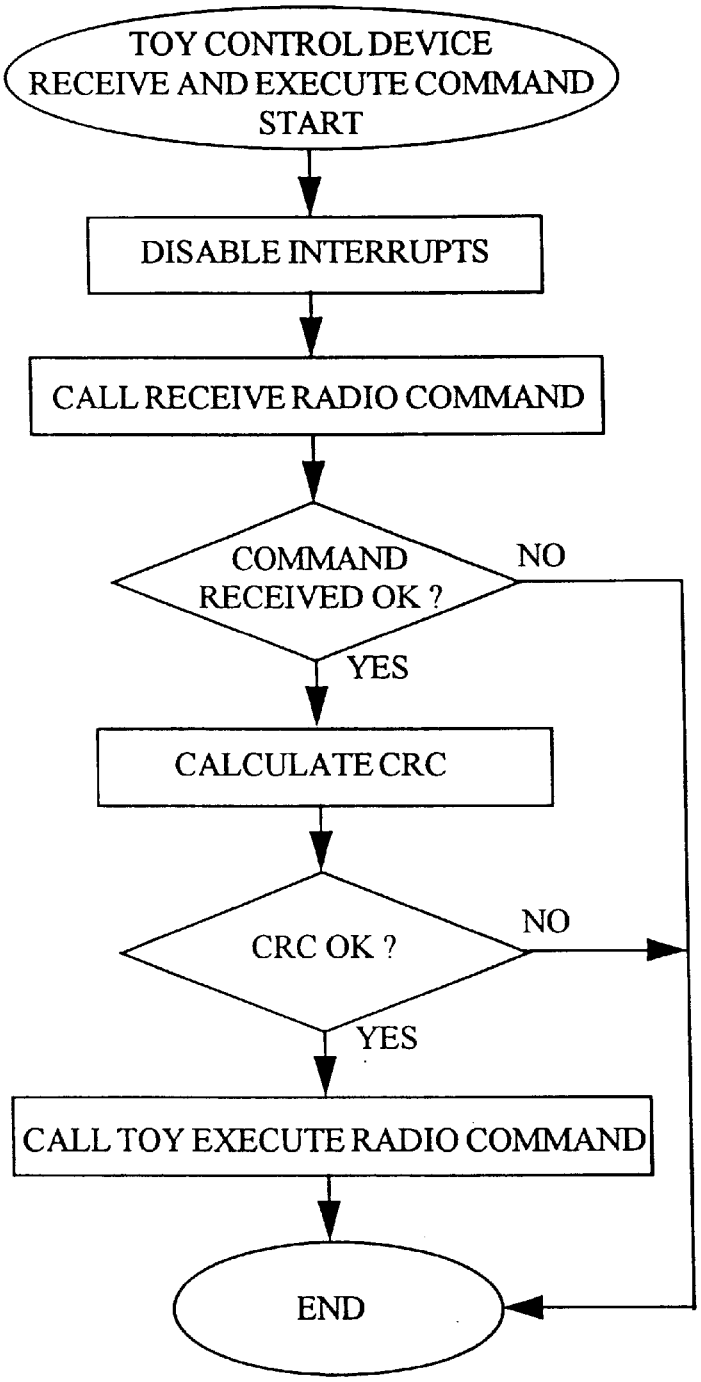
Figure 8D:
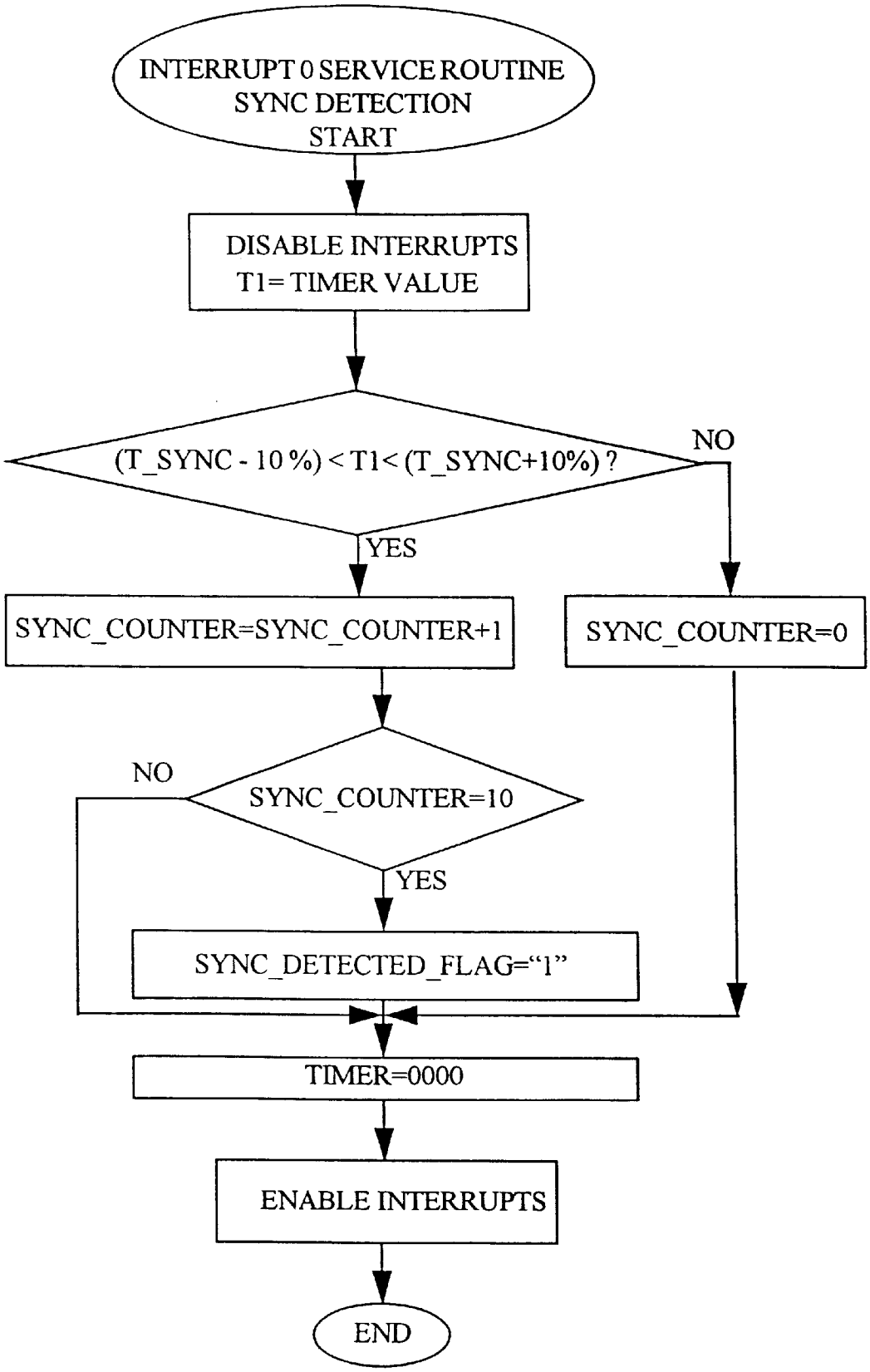
Figure 8E:
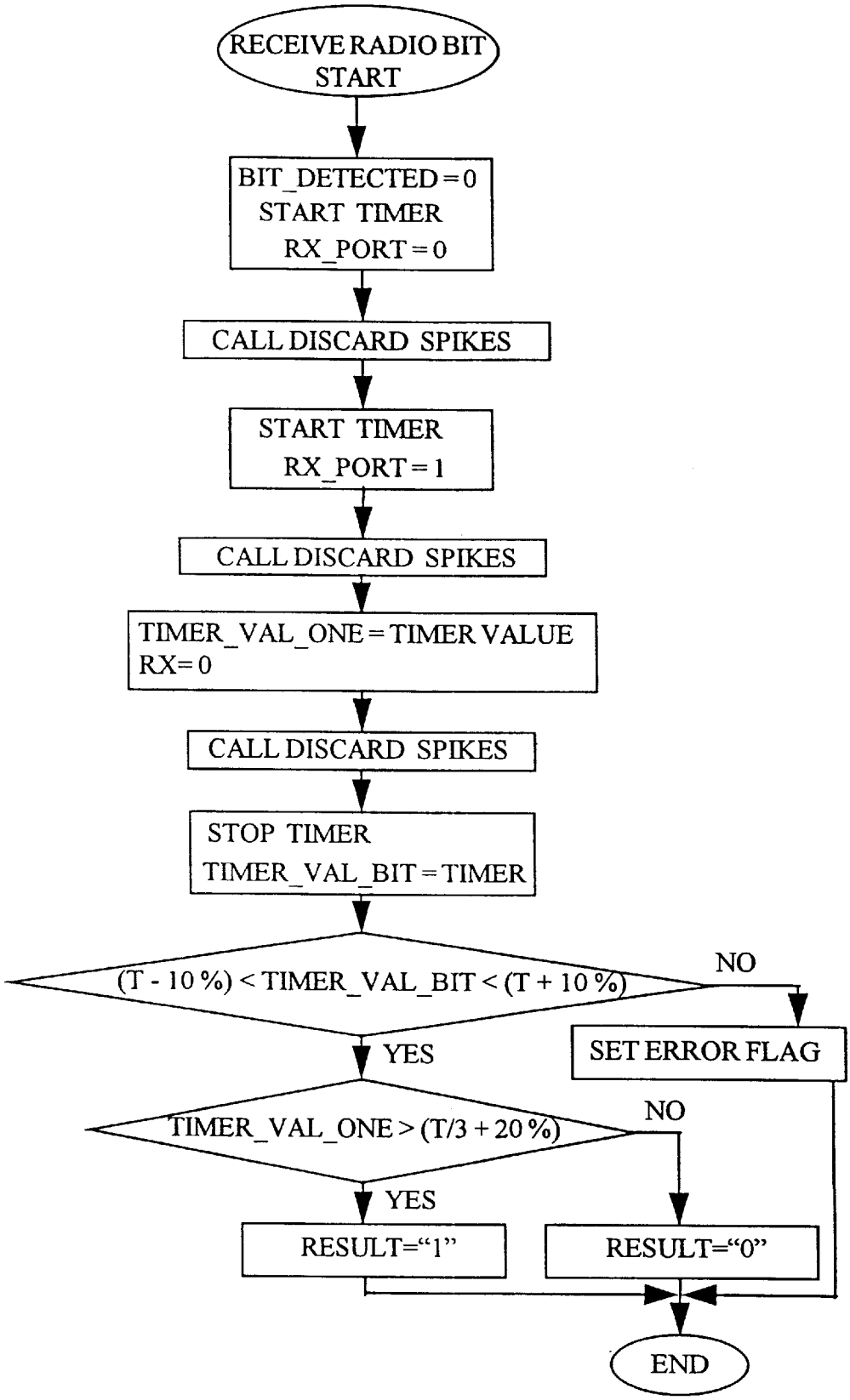
Figure 8F:
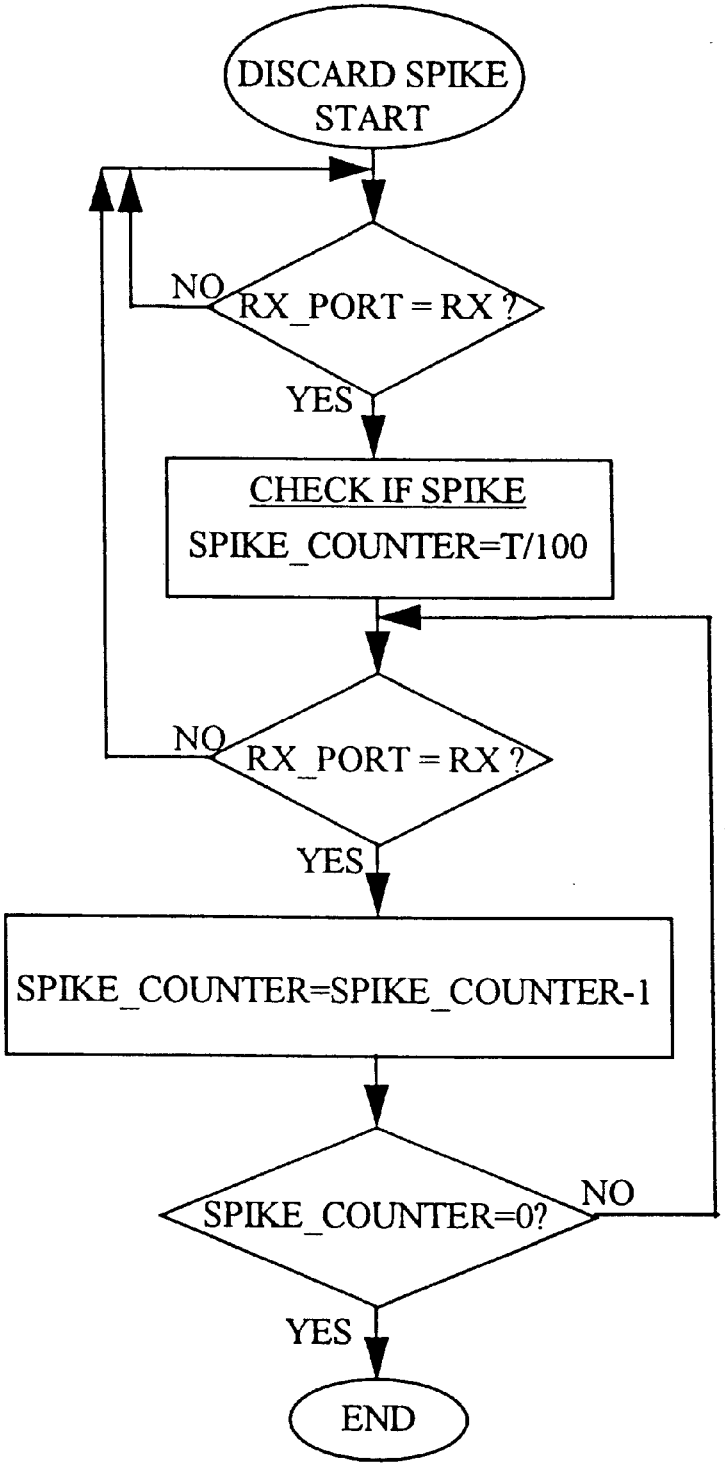
Figure 8G:
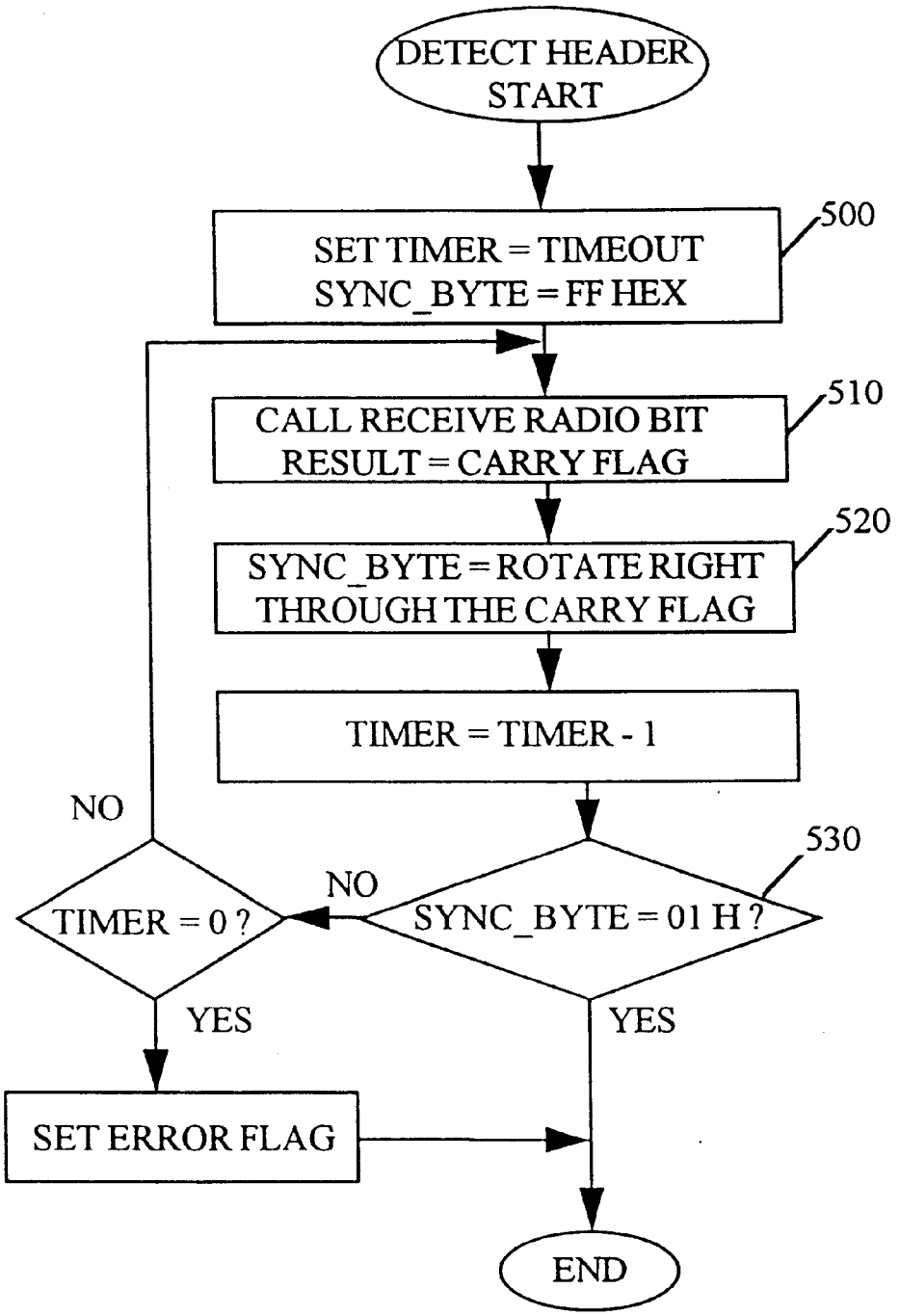
Figure 8H:
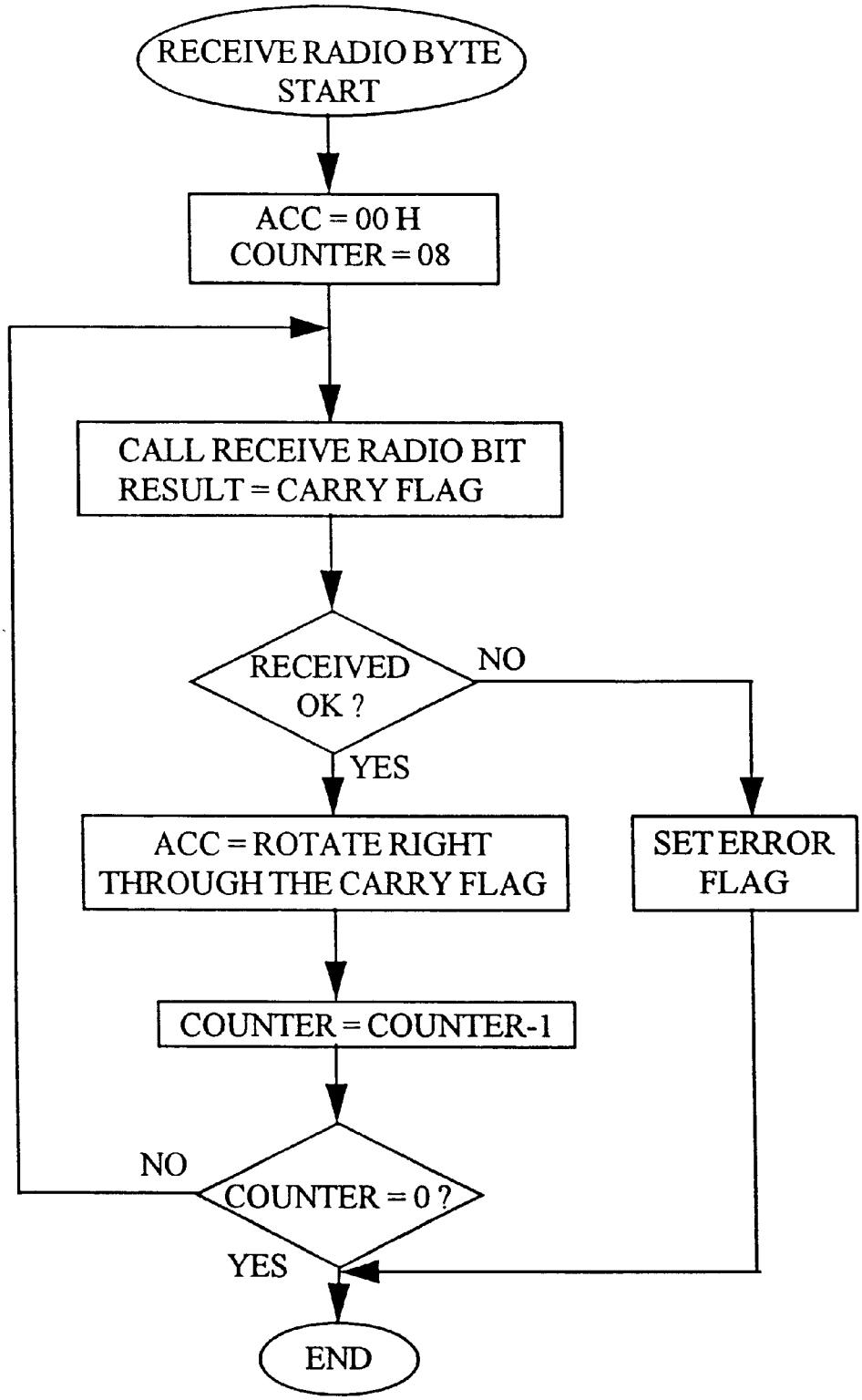
Figure 8I:
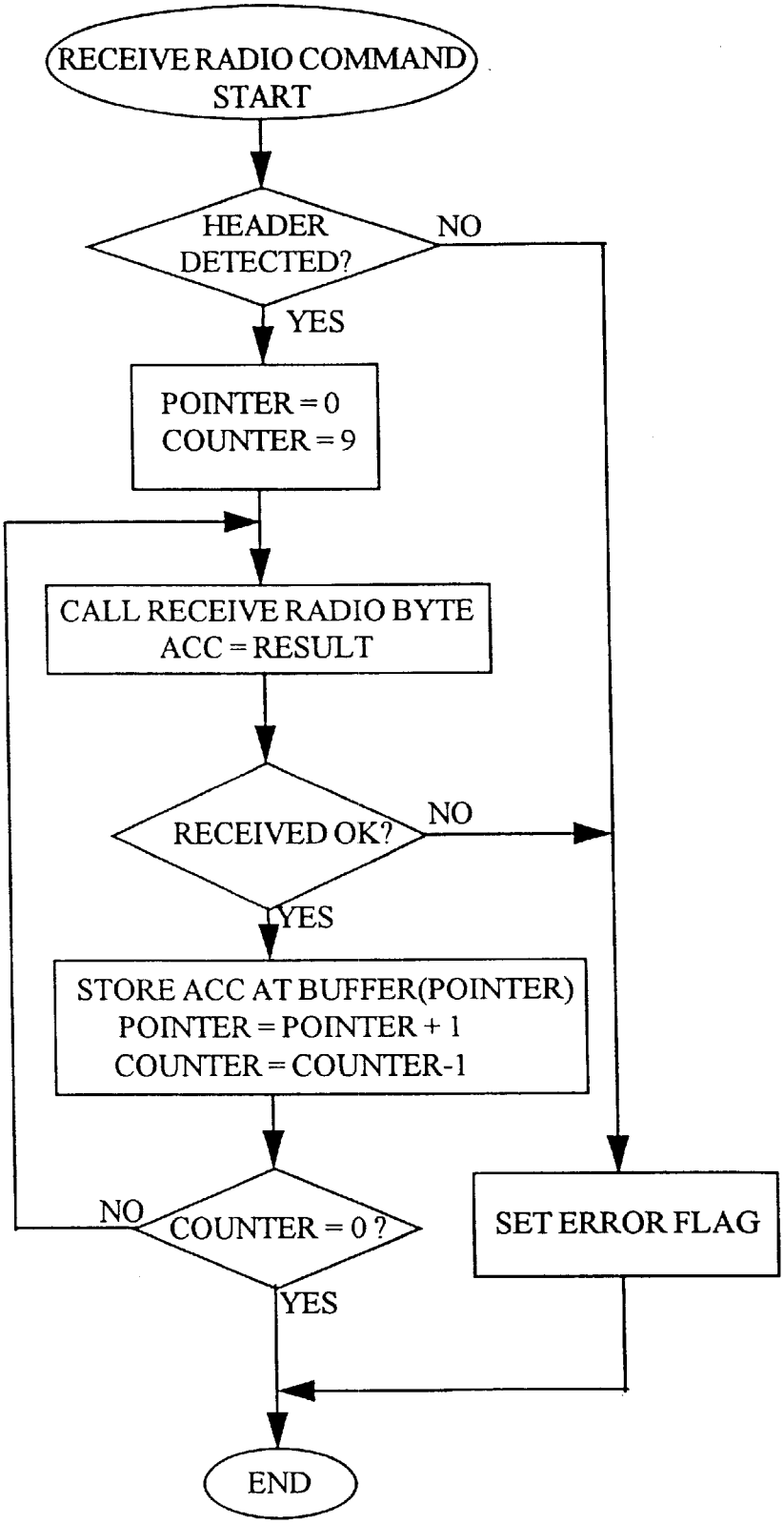
Figure 8J:
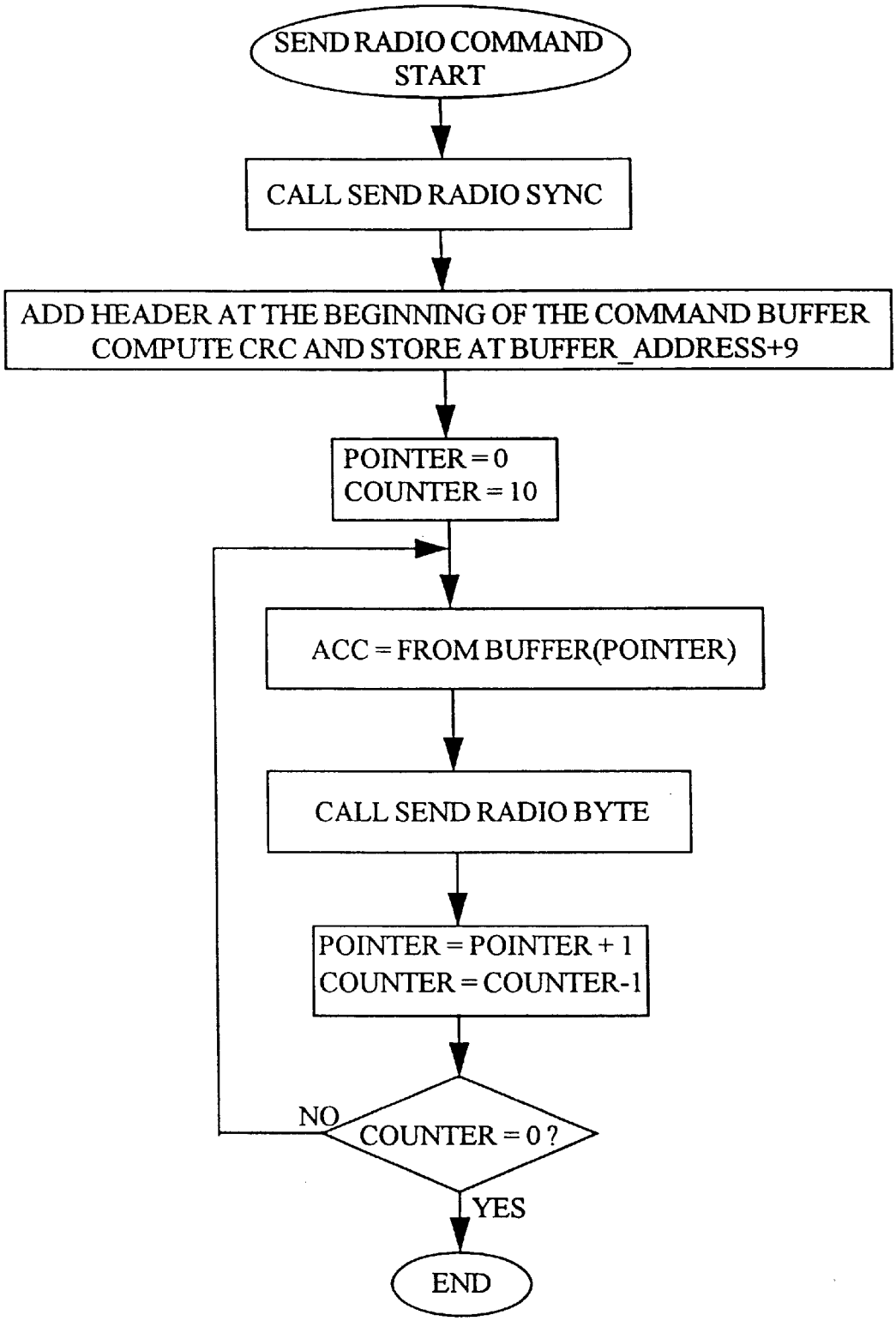
Figure 8K:
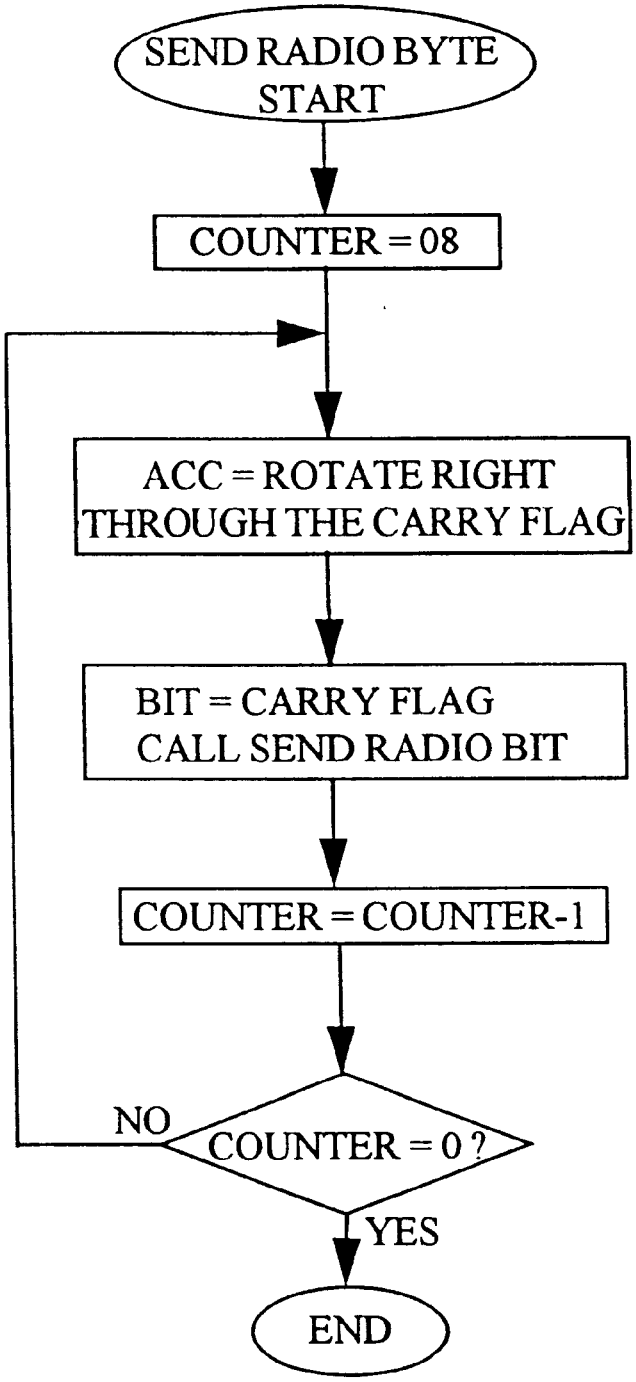
Figure 8L:
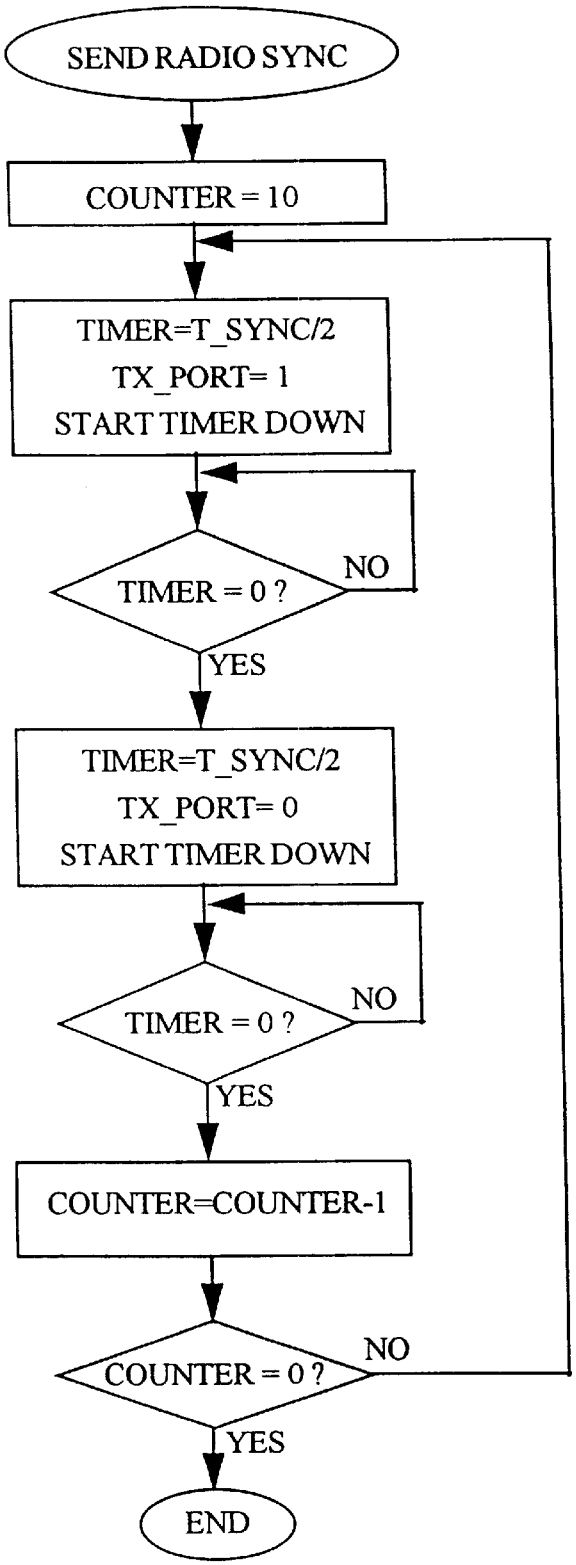
Figure 8M:
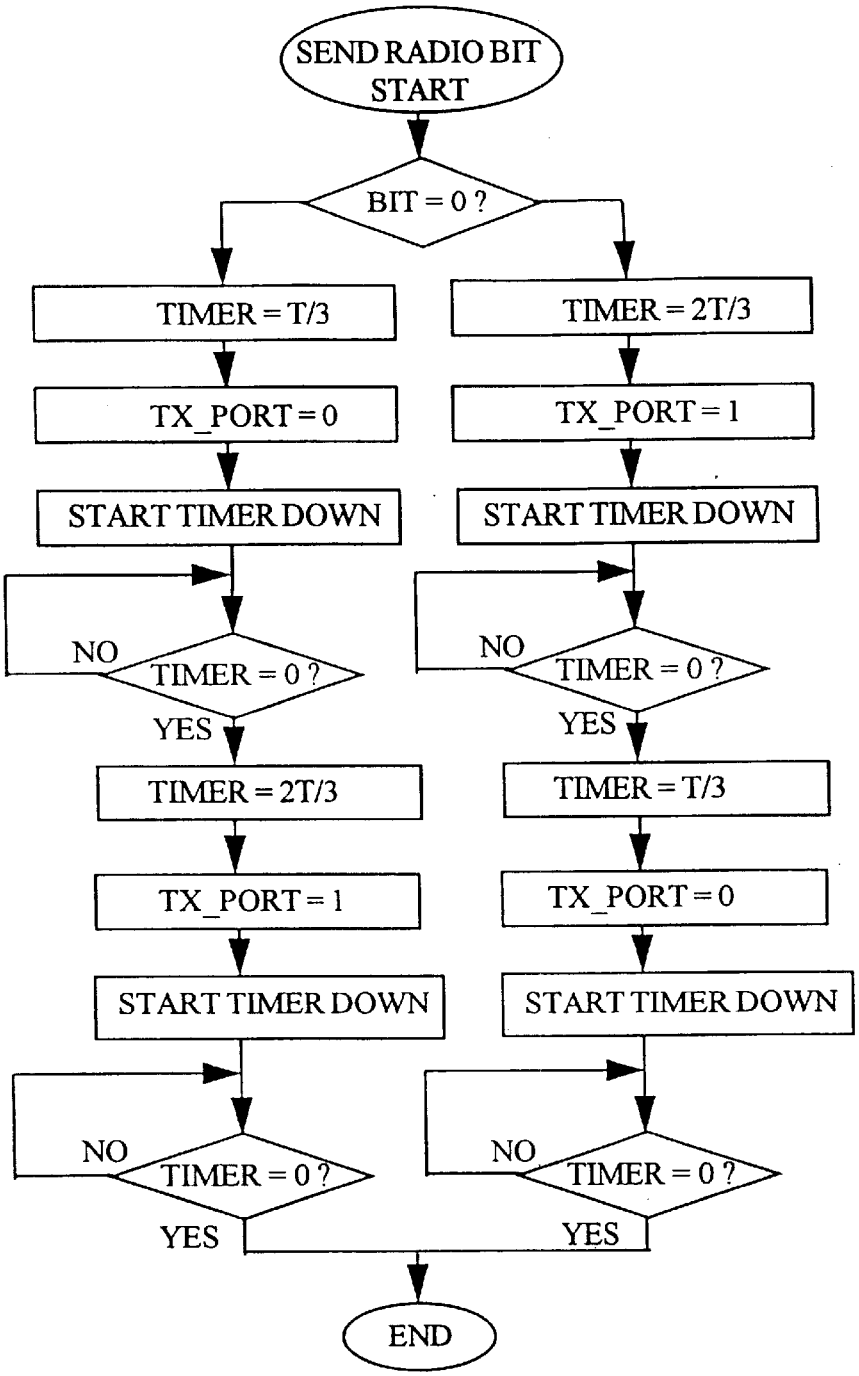
Figure 8N:
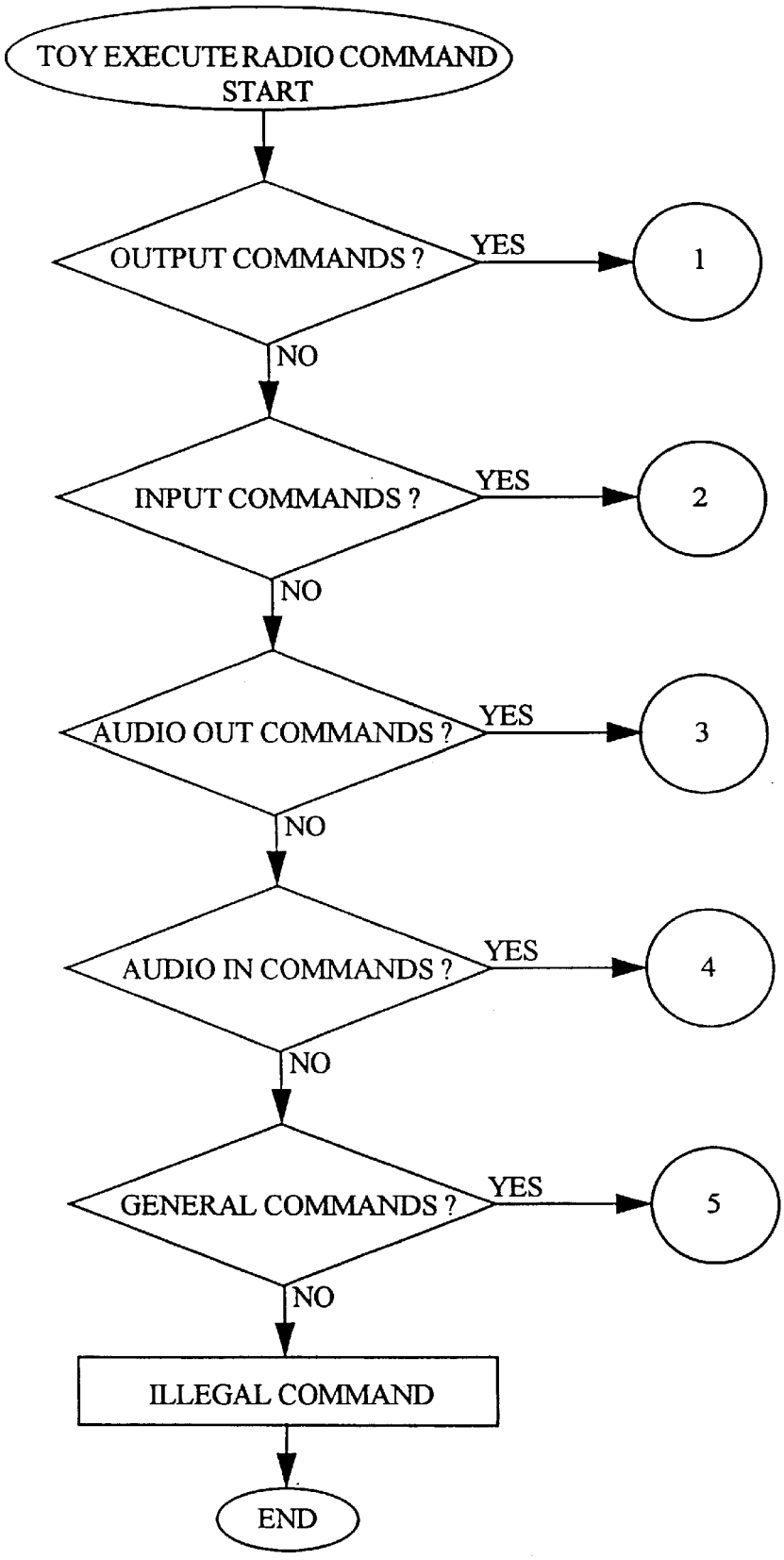
Figure 8O:
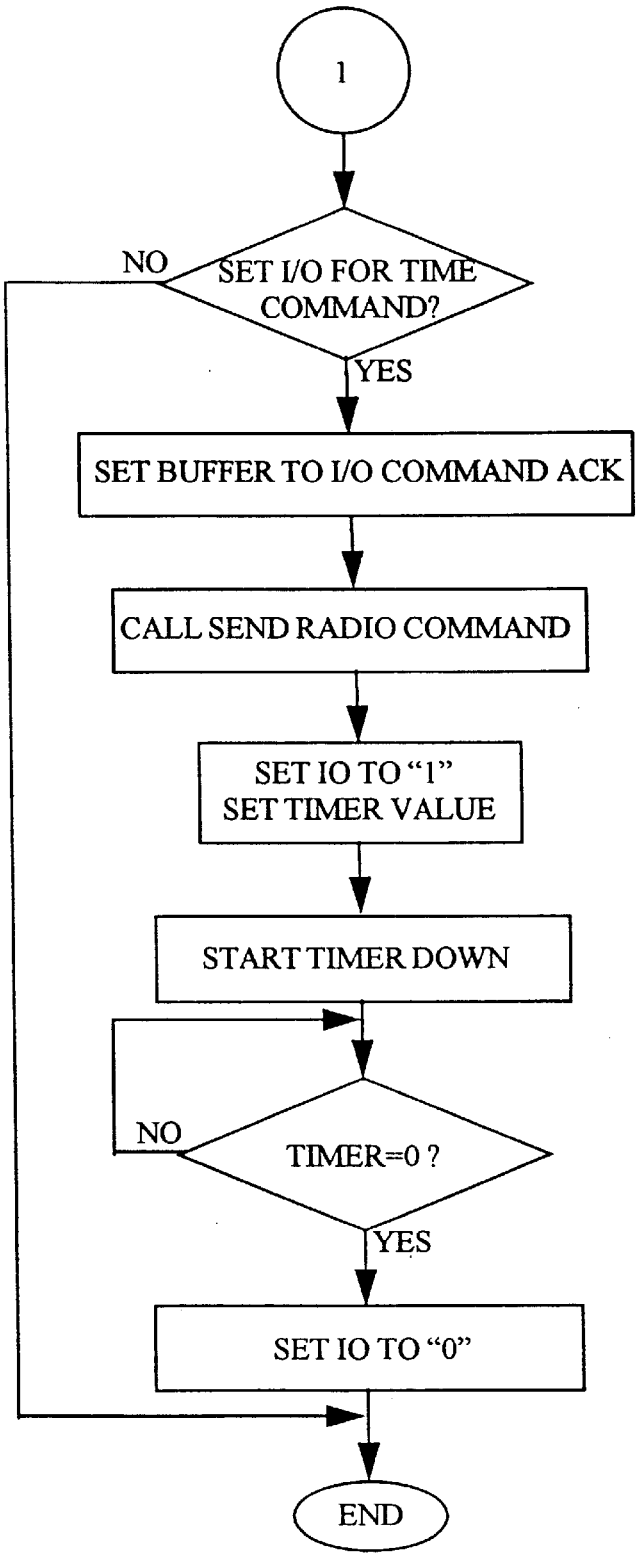
Figure 8P:
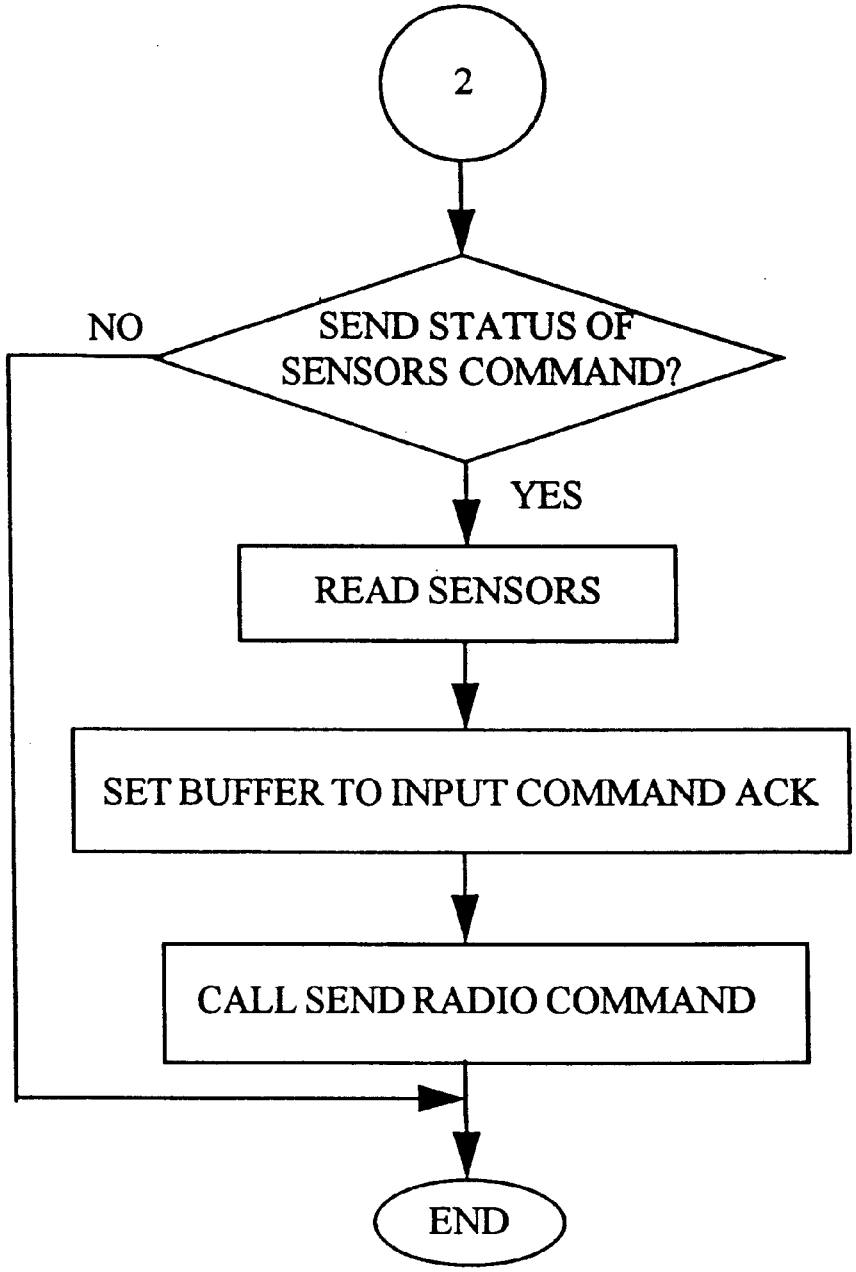
Figure 8Q:
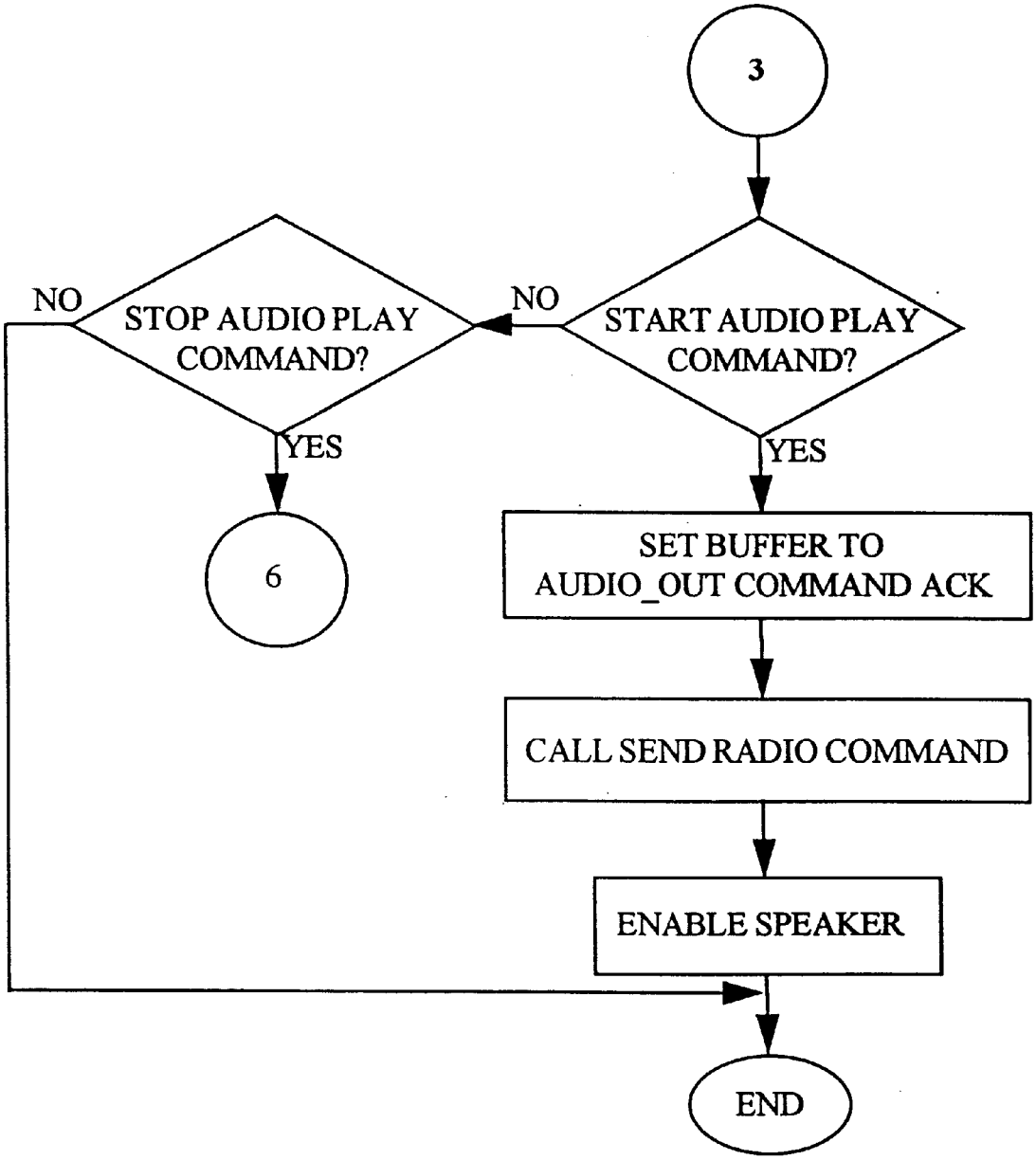
Figure 8R:
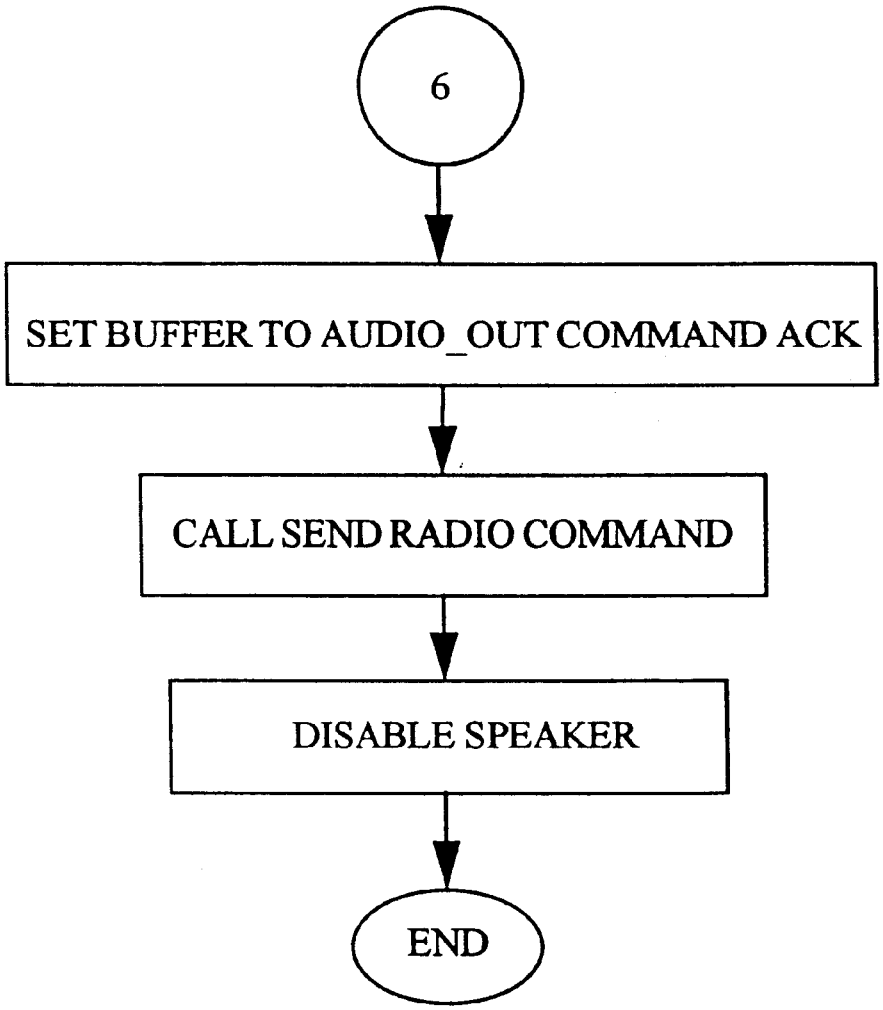
Figure 8S:
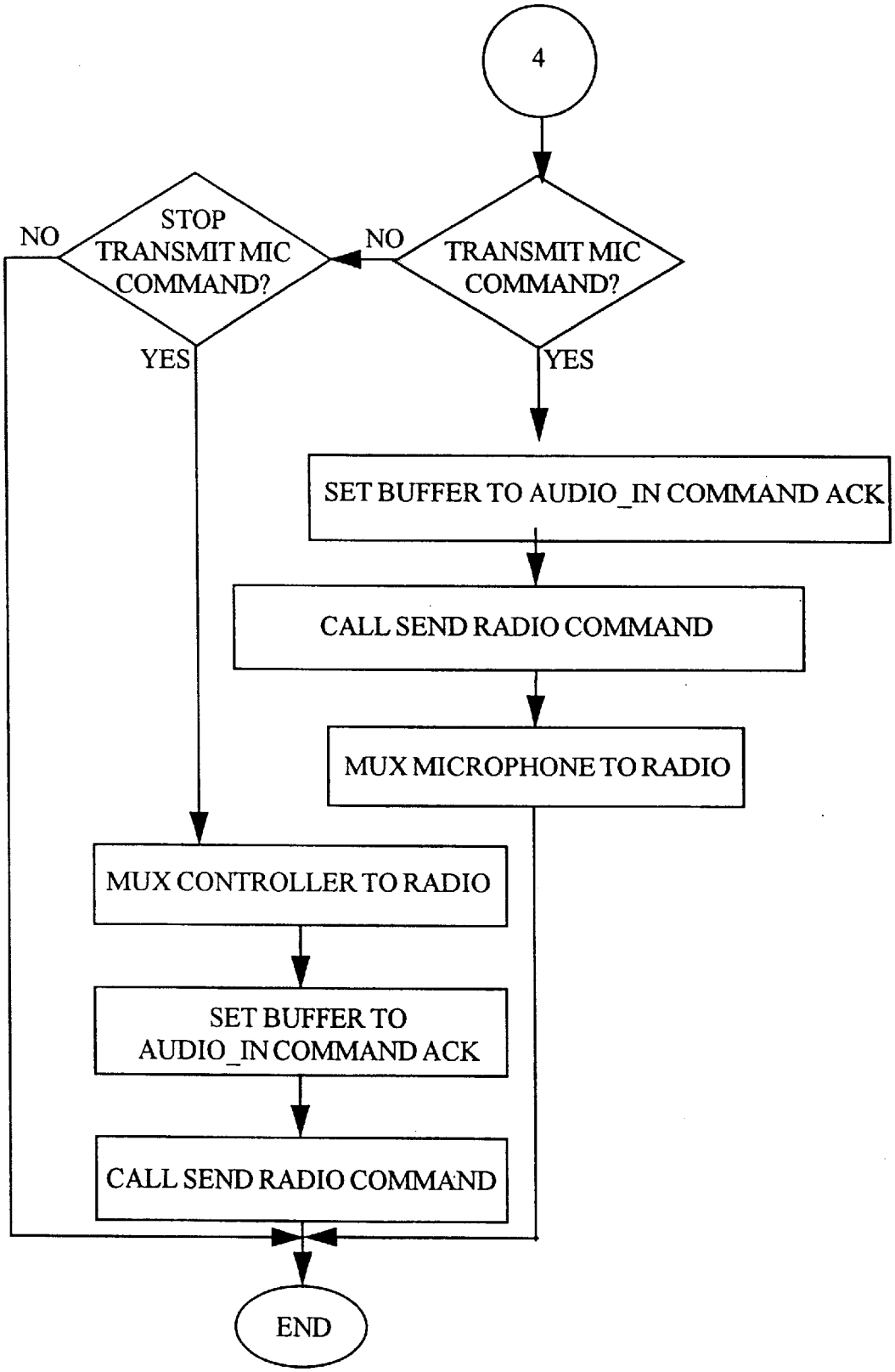
Figure 8T:
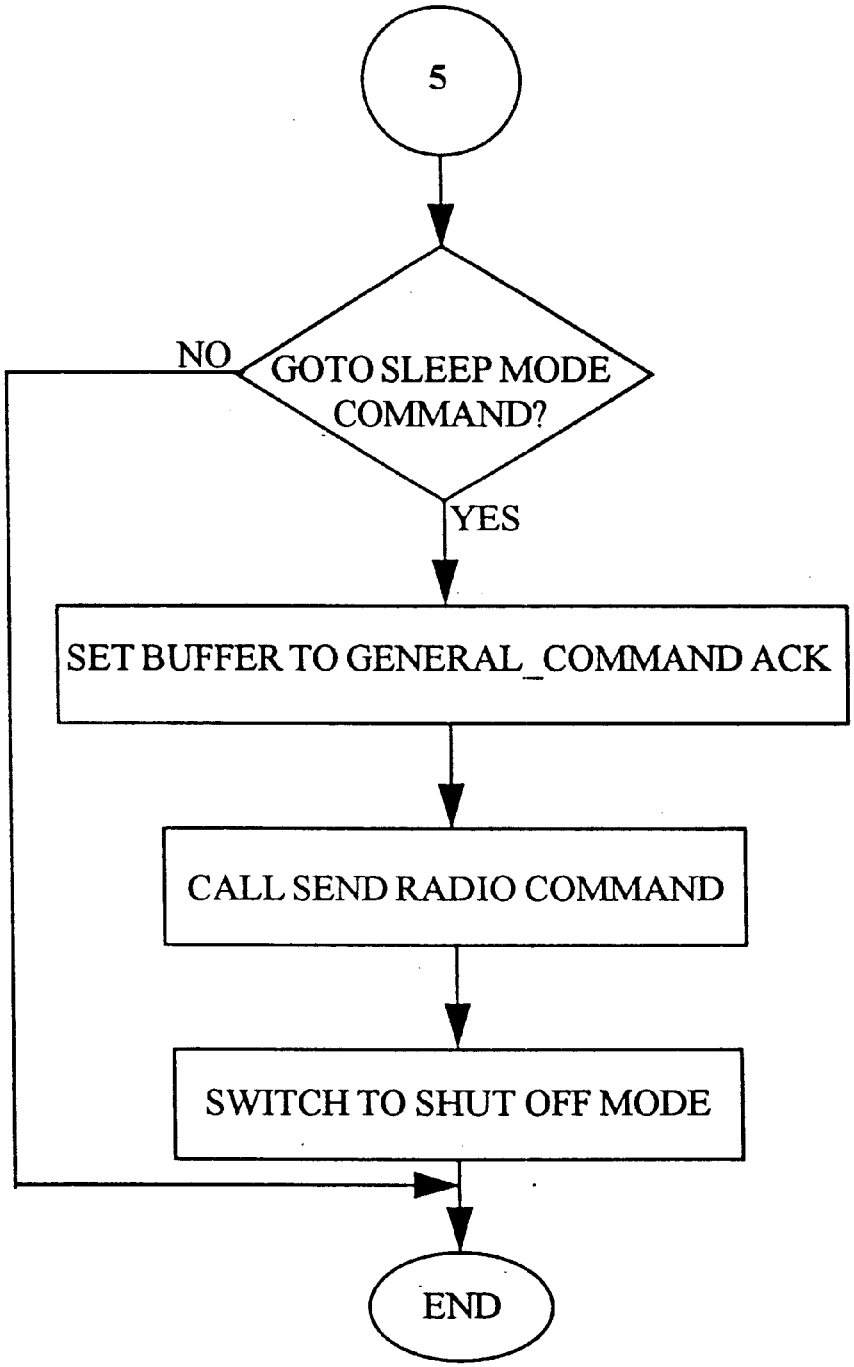
Figure 9A:
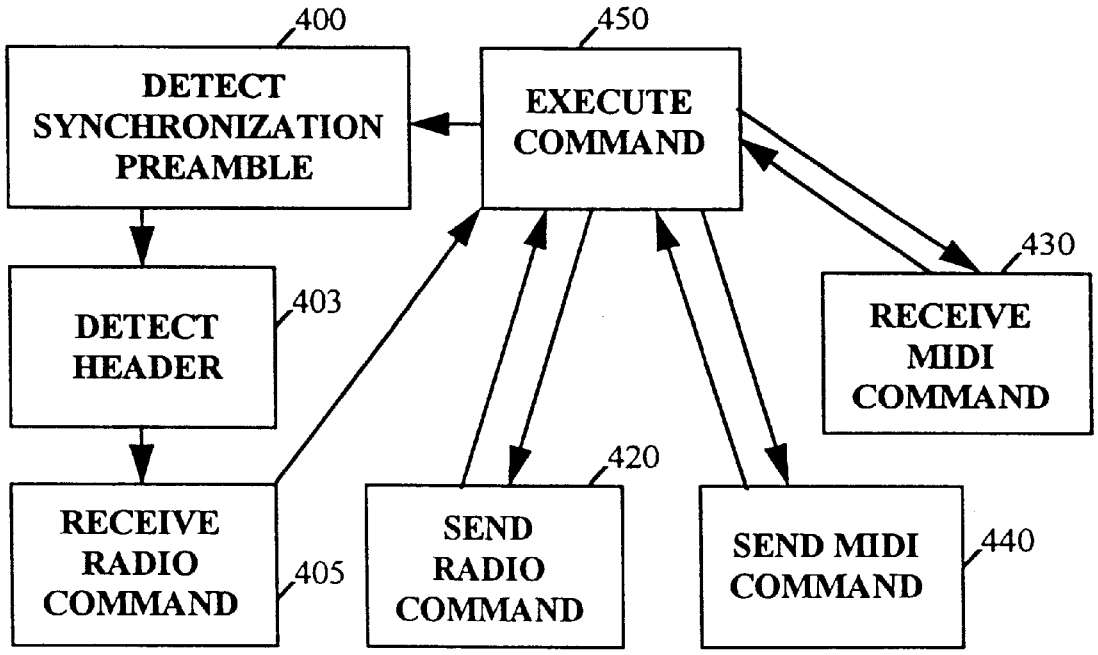
FIG. 9A is a simplified flowchart illustration of a preferred method for receiving MIDI signals, receiving radio signals, executing commands comprised therein, sending radio signals, and sending MIDI signals, within the computer radio interface 110 of FIG. 1A.
Figure 9B:
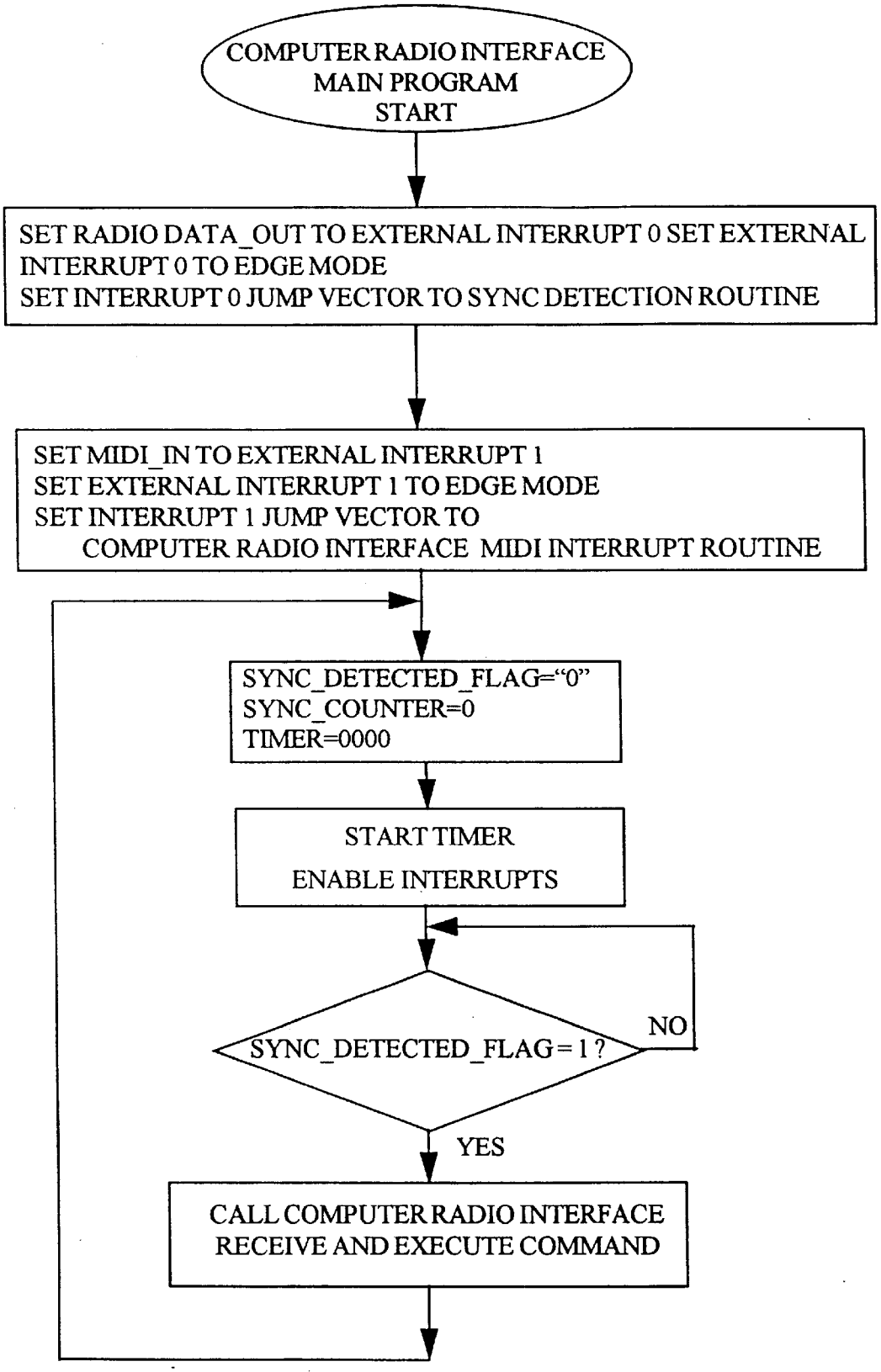
FIGS. 9B–9N, taken together with FIGS. 8D–8M, comprise a simplified flowchart illustration of a preferred implementation of the method of FIG. 9A.
Figure 9C:
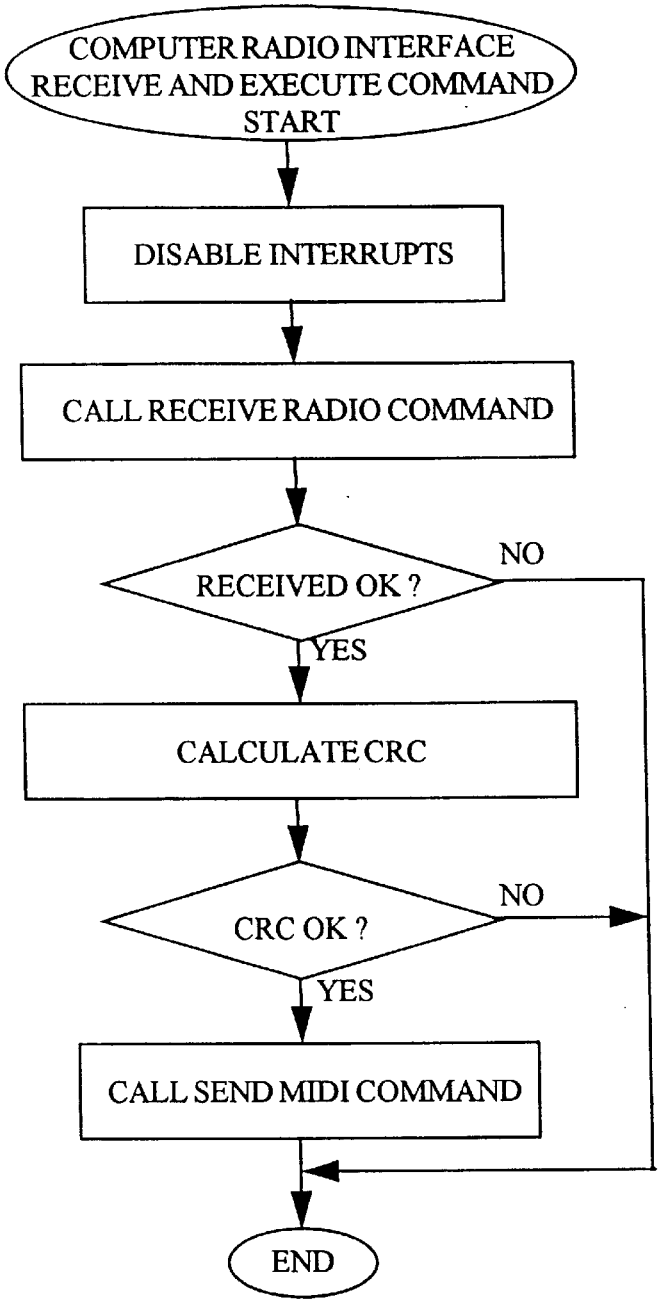
Figure 9D:
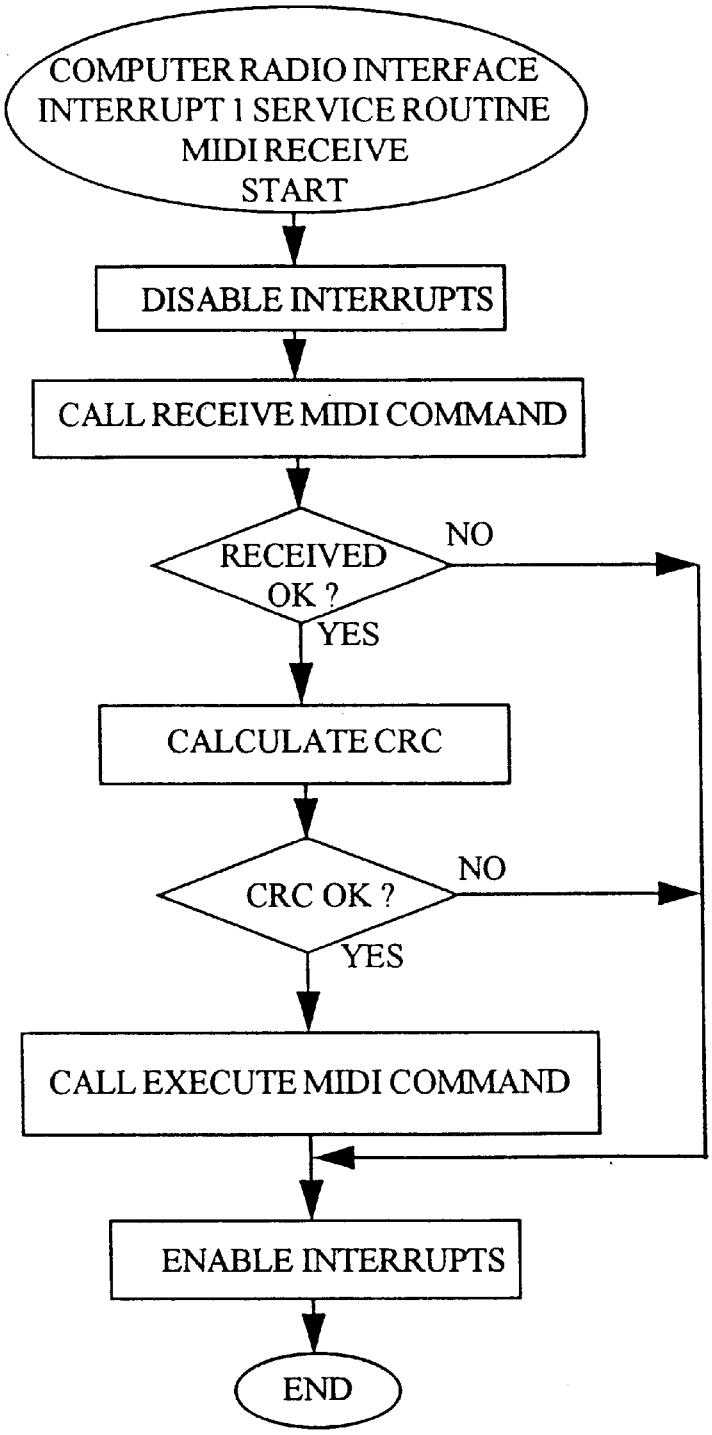
Figure 9E:
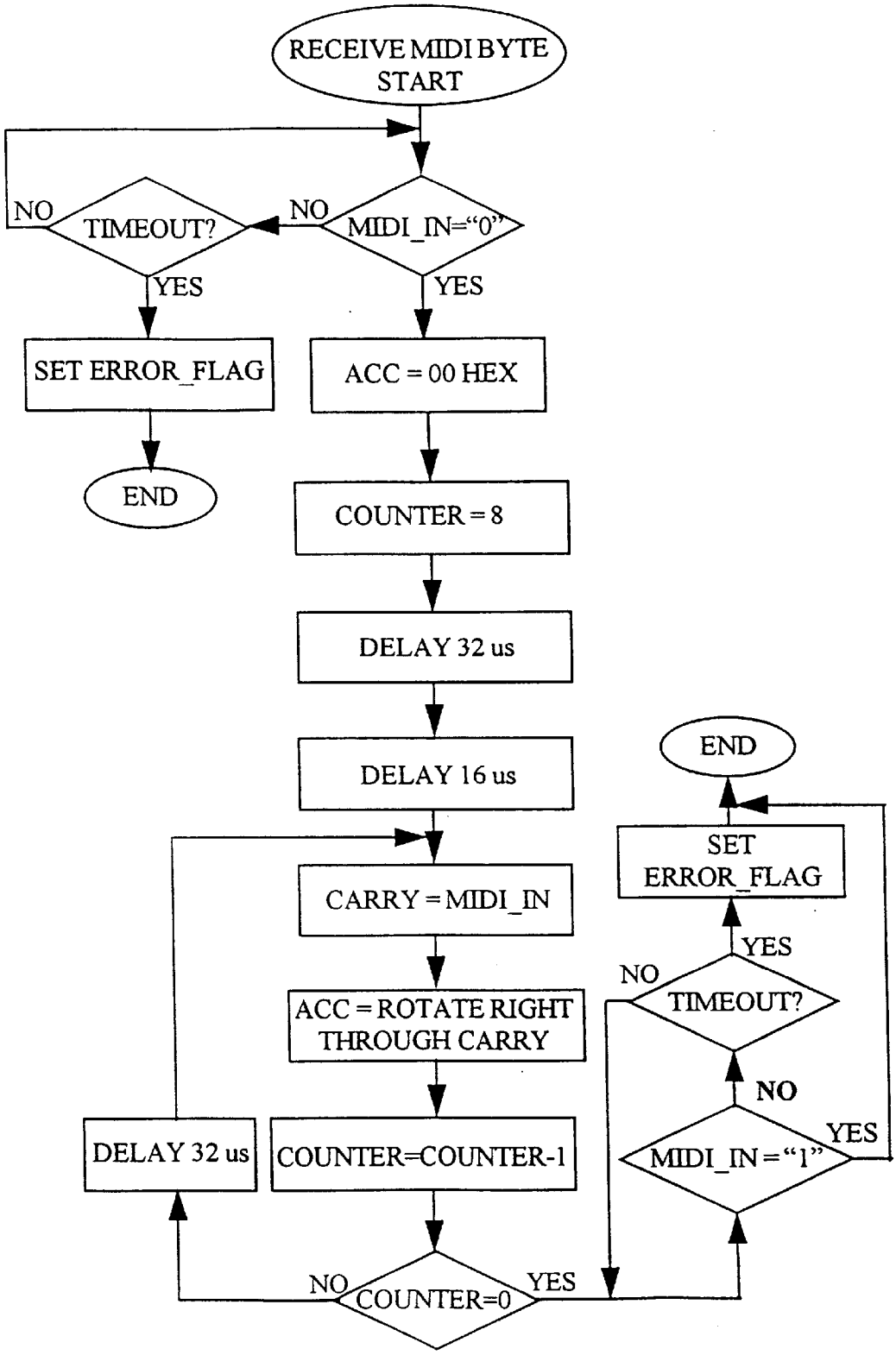
Figure 9F:
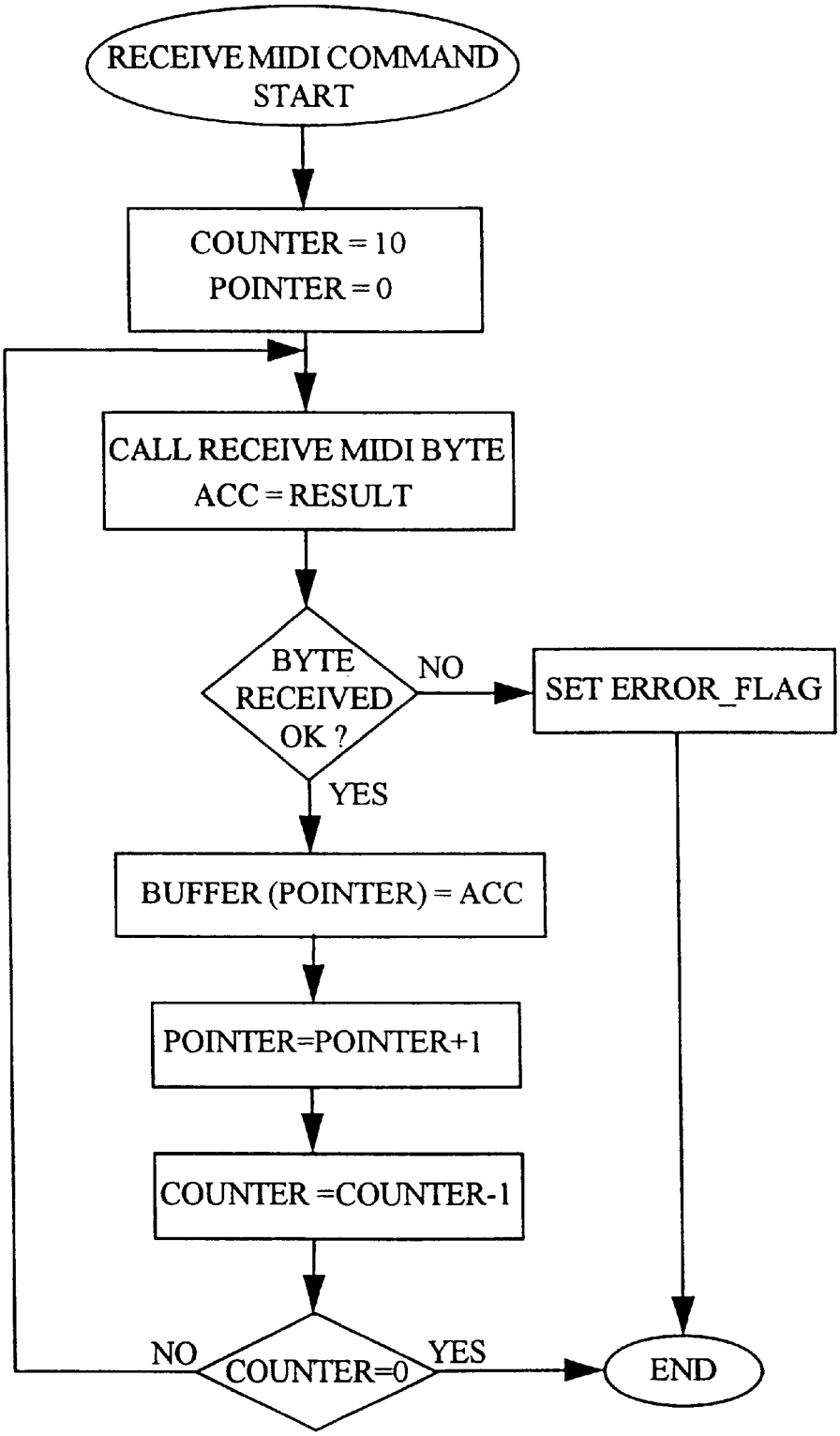
Figure 9G:
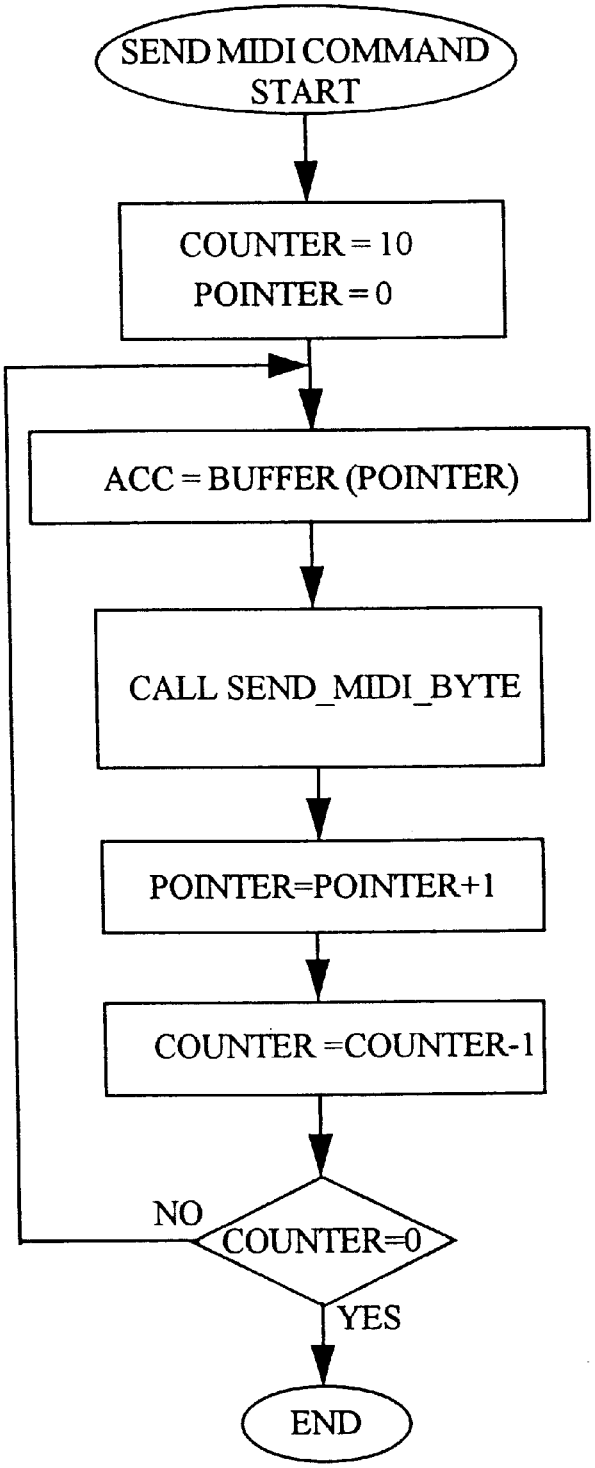
Figure 9H:
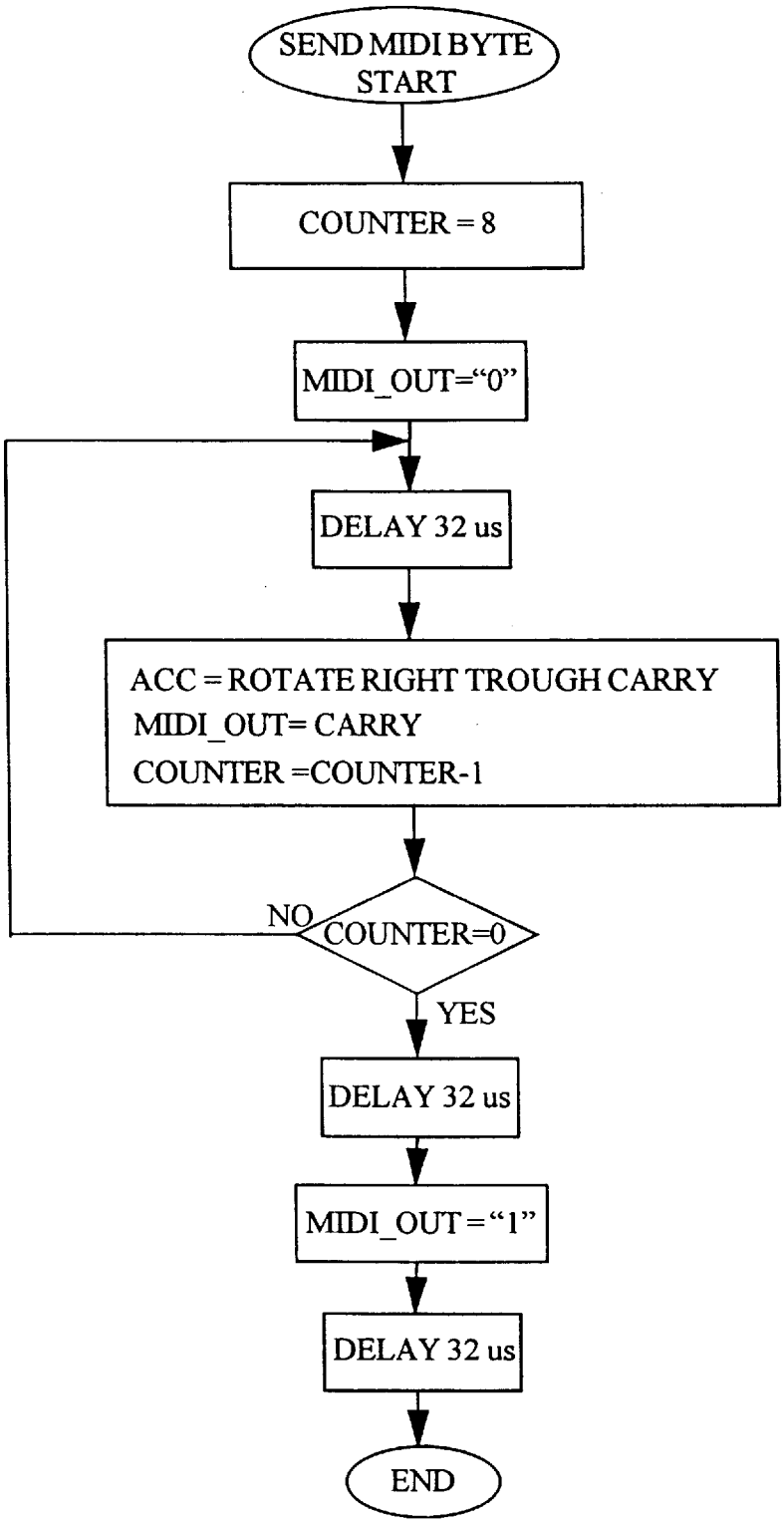
Figure 9I:
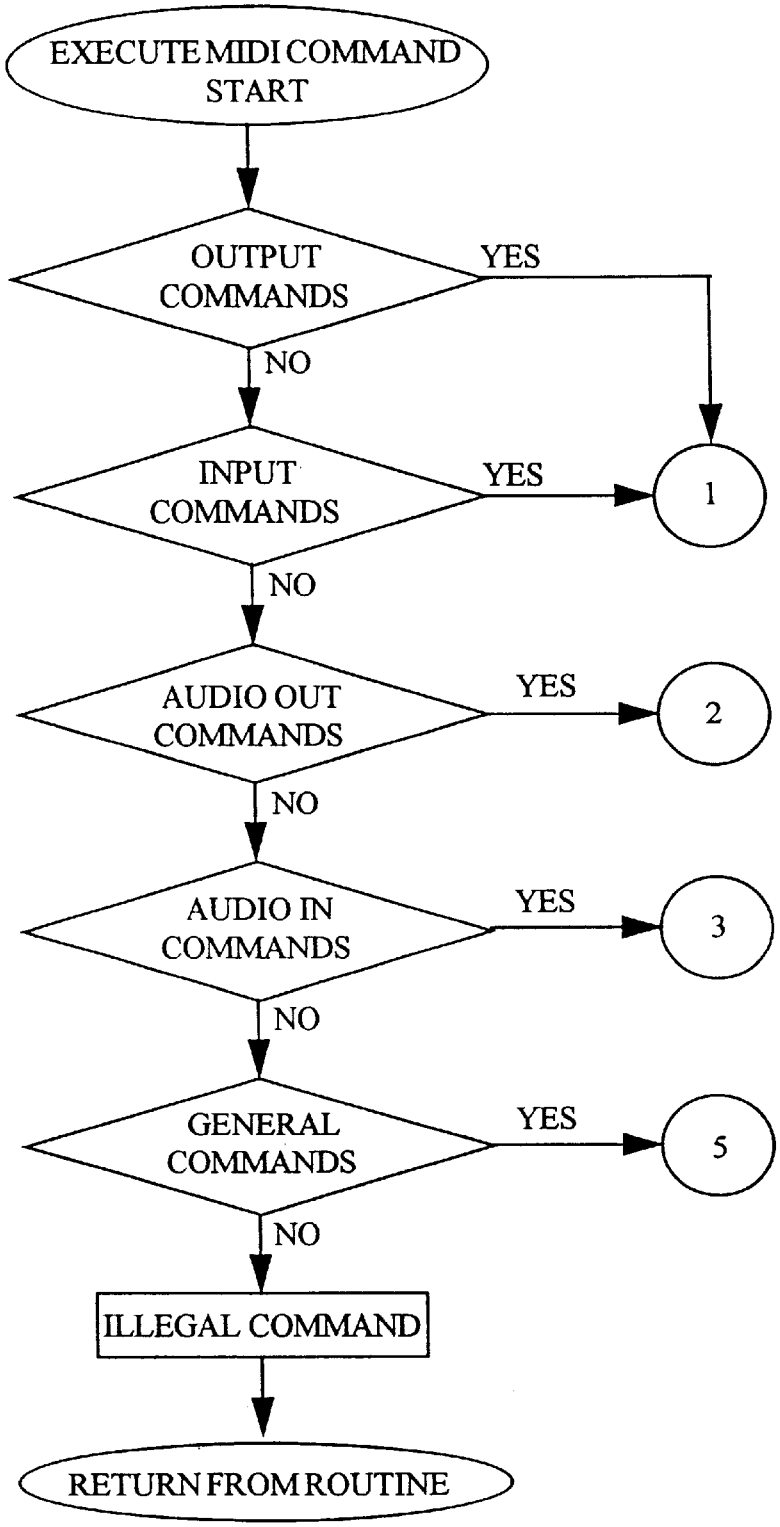
Figure 9J:
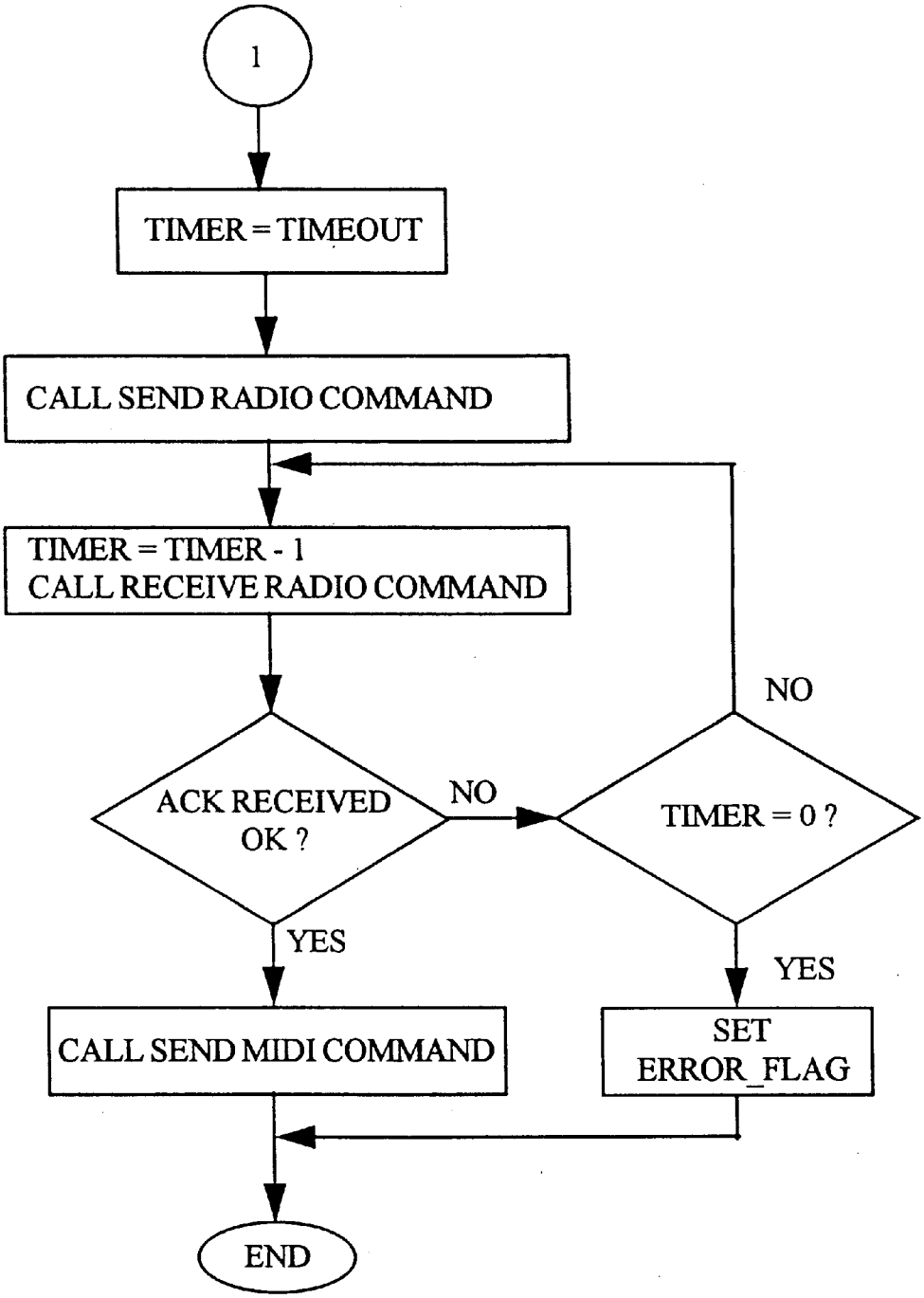
Figure 9K:
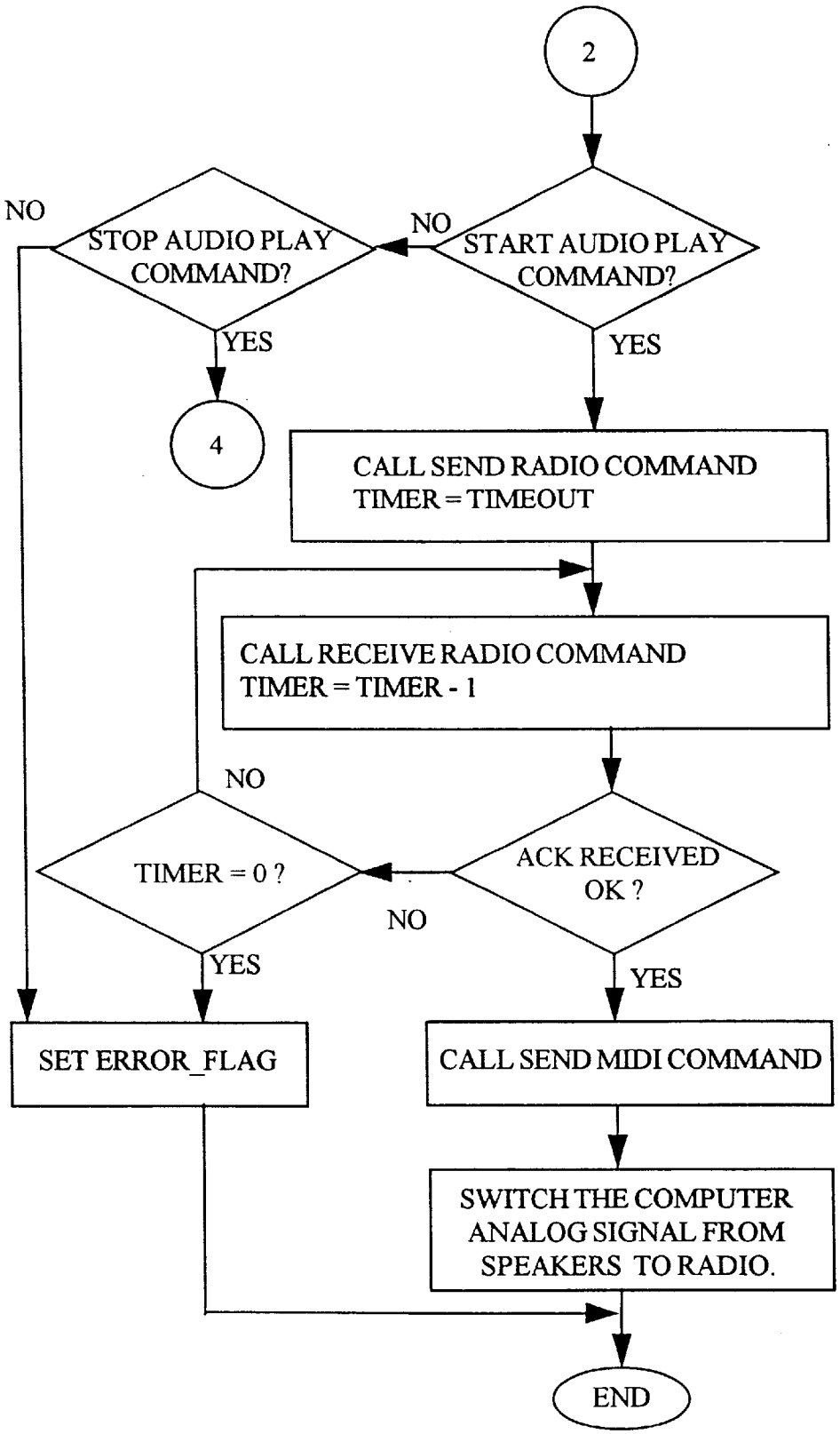
Figure 9L:
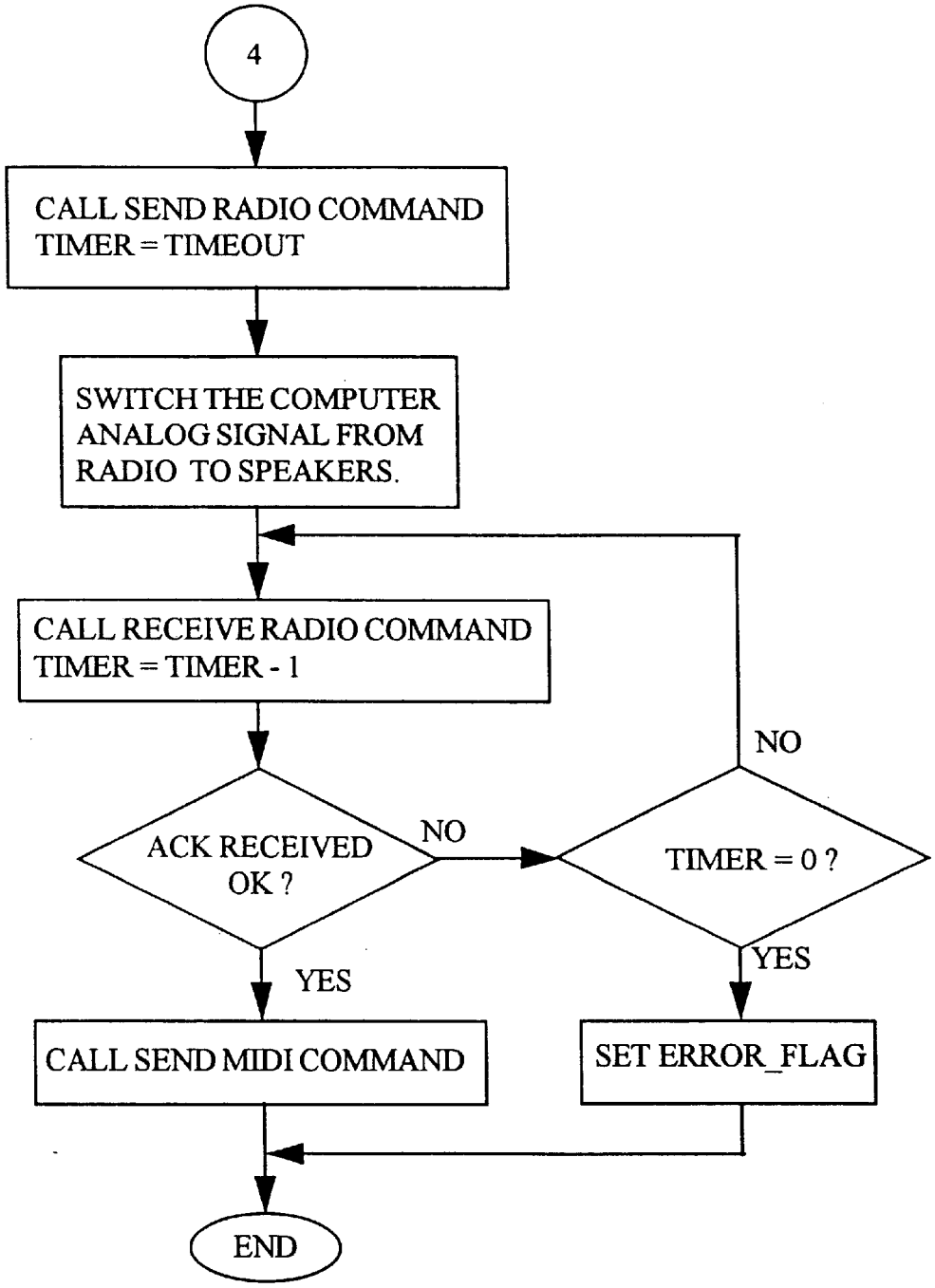
Figure 9M:
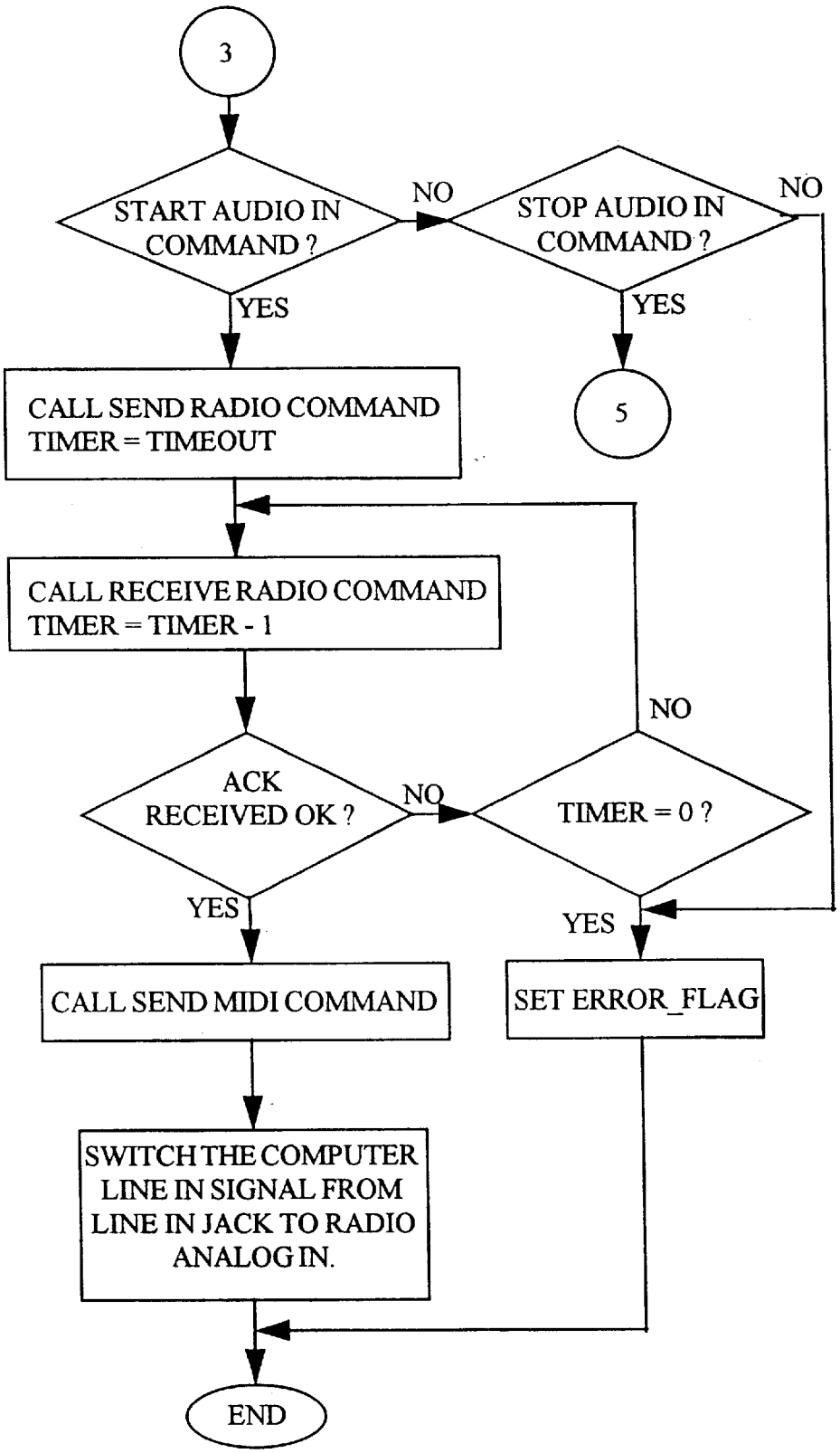
Figure 9N:
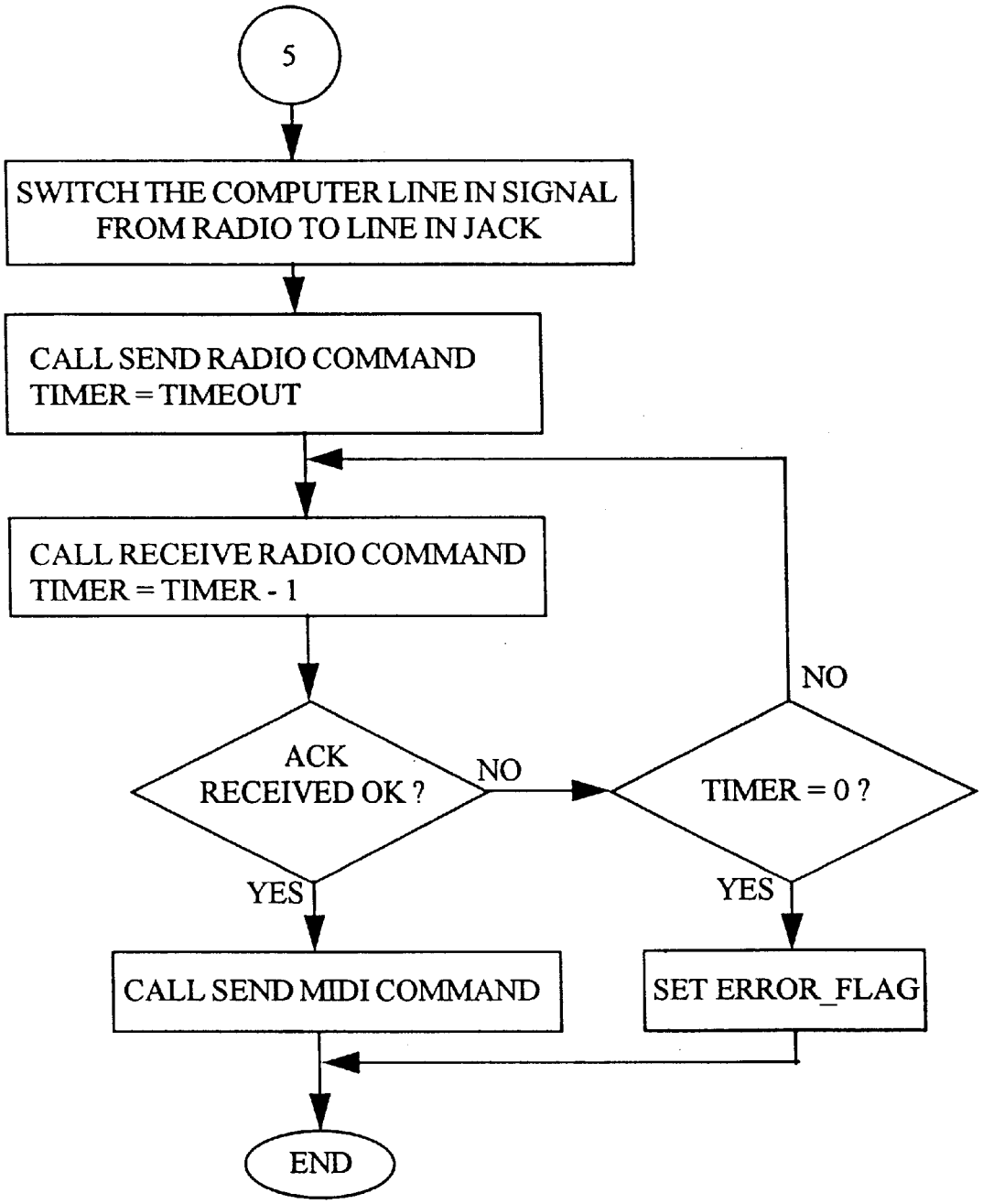

Attached herewith are the following appendices which aid in the understanding and appreciation of one preferred embodiment of the invention shown and described herein:

Appendix A is a computer listing of a preferred software implementation of the method of FIGS. 8A–8T;

Appendix B is a computer listing of a preferred software implementation of the method of FIGS. 9A–9N, together with the method of FIGS. 8D–8M;

Appendix C is a computer listing of a preferred software implementation of an example of a computer game for use in the computer 100 of FIG. 1;

Appendix D is a computer listing of a preferred software implementation of the method of FIG. 11 and FIGS. 12A–12C.

DETAILED DESCRIPTION OF PREFERRED EMBODIMENTS

Figure 1A:
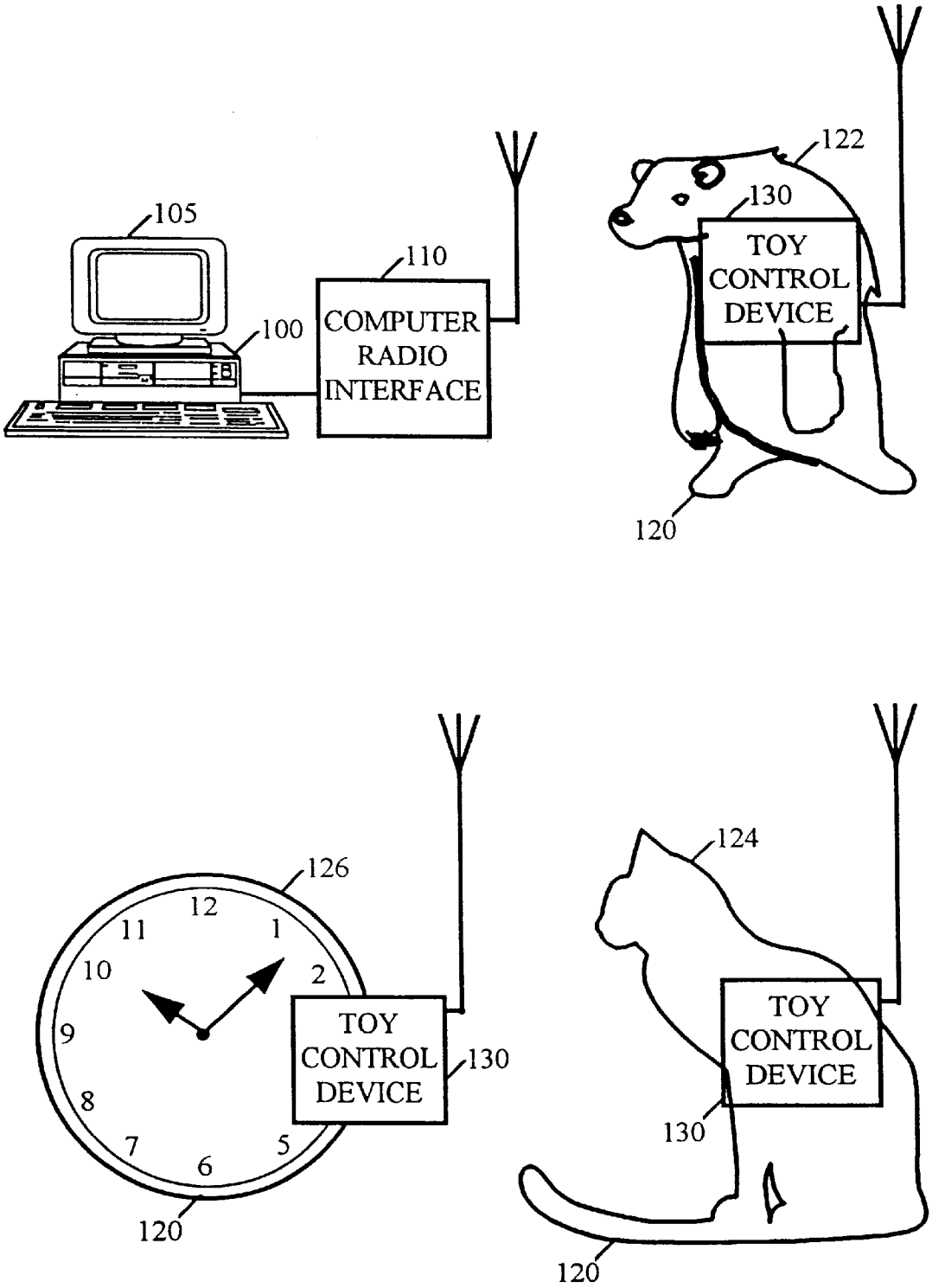
FIG. 1A is a partly pictorial, partly block diagram illustration of a computer control system including a toy, constructed and operative in accordance with a preferred embodiment of the present invention.

Reference is now made to FIG. 1A which is a partly pictorial, partly block diagram illustration of a computer control system including a toy, constructed and operative in accordance with a preferred embodiment of the present invention. The system of FIG. 1A comprises a computer 100, which may be any suitable computer such as, for example, an IBM-compatible personal computer. The computer 100 is equipped with a screen 105. The computer 100 is preferably equipped with a sound card such as, for example, a Sound Blaster Pro card commercially available from Creative Labs, Inc., 1901 McCarthy Boulevard, Milpitas Calif. 95035 or from Creative Technology Ltd., 67

Ayer Rajah Crescent #03-18, Singapore, 0513; a hard disk; and, optionally, a CD-ROM drive.

The computer 100 is equipped with a computer radio interface 110 operative to transmit signals via wireless transmission based on commands received from the computer 100 and, in a preferred embodiment of the present invention, also to receive signals transmitted elsewhere via wireless transmission and to deliver the signals to the computer 100. Typically, commands transmitted from the computer 100 to the computer radio interface 110 are transmitted via both analog signals and digital signals, with the digital signals typically being transmitted by way of a MIDI port. Transmission of the analog and digital signals is described below with reference to FIG. 3.

The transmitted signal may be an analog signal or a digital signal. The received signal may also be an analog signal or a digital signal. Each signal typically comprises a message. A preferred implementation of the computer radio interface 110 is described below with reference to FIG. 3.

The system of FIG. 1A also comprises one or more toys 120. The system of FIG. 1A comprises a plurality of toys, namely three toys 122, 124, and 126 but it is appreciated that, alternatively, either one toy only or a large plurality of toys may be used.

Figure 1B:
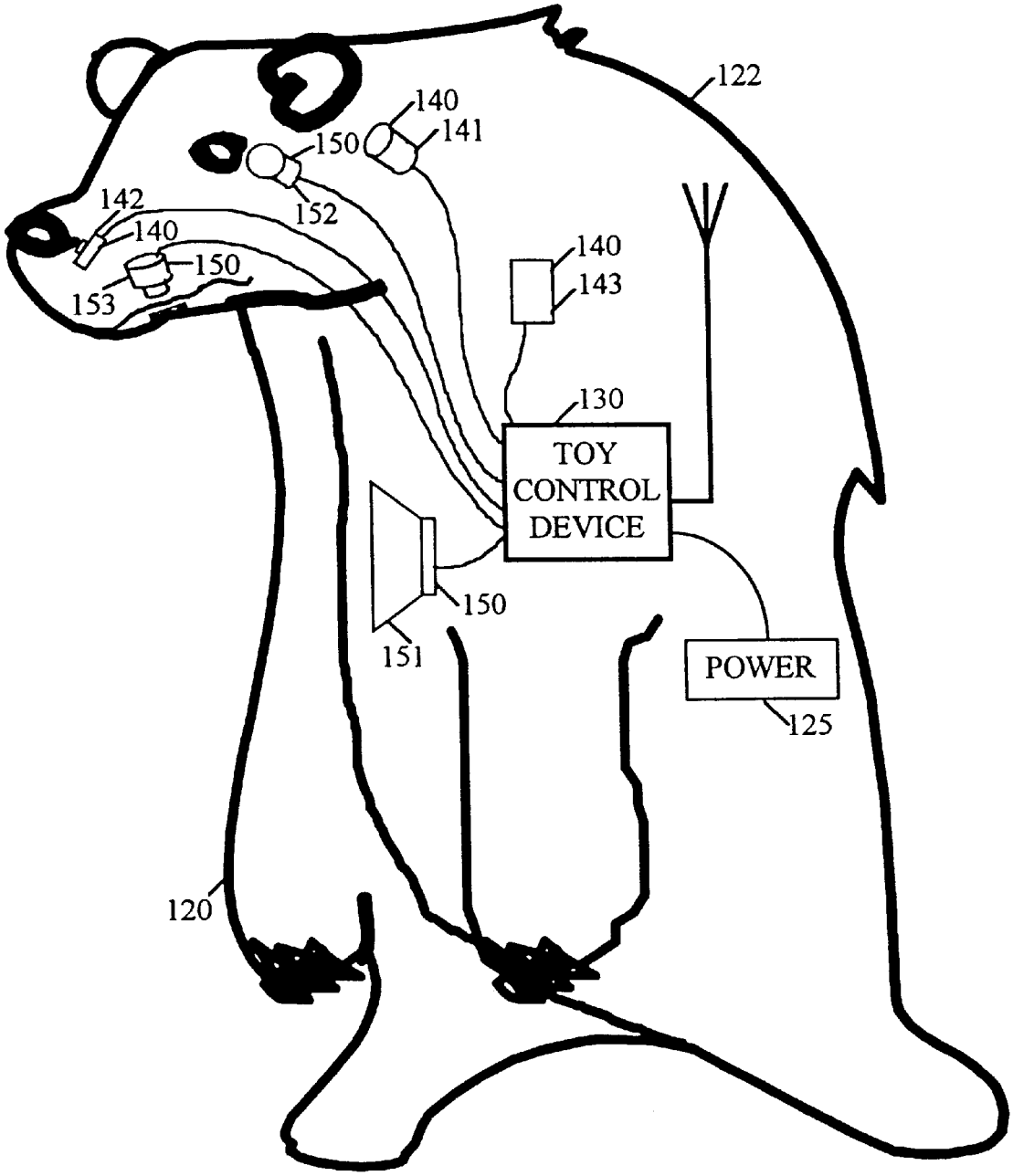
FIG. 1B is a partly pictorial, partly block diagram illustration a preferred implementation of the toy 122 of FIG. 1A.

Reference is now additionally made to FIG. 1B, which is a partly pictorial, partly block diagram illustration of the toy 122 of FIG. 1A.

Each toy 120 comprises a power source 125, such as a battery or a connection to line power. Each toy 120 also comprises a toy control device 130, operative to receive a wireless signal transmitted by the computer 100 and to cause each toy 120 to perform an action based on the received signal. The received signal may be, as explained above, an analog signal or a digital signal. A preferred implementation of the toy control device 130 is described below with reference to FIG. 6.

Each toy 120 preferably comprises a plurality of input devices 140 and output devices 150, as seen in FIG. 1B. The input devices 140 may comprise, for example on or more of the following: a microphone 141; a microswitch sensor 142; a touch sensor (not shown in FIG. 1B); a light sensor (not shown in FIG. 1B); a movement sensor 143, which may be, for example, a tilt sensor or an acceleration sensor. Appropriate commercially available input devices include the following: position sensors available from Hamlin Inc., 612 East Lake Street, Lake Mills, Wis. 53551, USA; motion and vibration sensors available from Comus International, 263 Hillside Avenue, Nutley, N.J. 07110, USA; temperature, shock, and magnetic sensors available from Murata Electronics Ltd., Hampshire, England; and switches available from C & K Components Inc., 15 Riverdale Avenue, Newton, Mass. 02058-1082, USA or from Micro Switch Inc., a division of Honeywell, USA. The output devices 150 may comprise, for example, one or more of the following: a speaker 151; a light 152; a solenoid 153 which may be operative to move a portion of the toy; a motor, such as a stepping motor, operative to move a portion of the toy or all of the toy (not shown in FIG. 1B). Appropriate commercially available output devices include the following: DC motors available from Alkatel (dunkermotoren), Postfach 1240, D-7823, Bonndorf/Schwarzald, Germany; stepping motors and miniature motors available from Haydon Switch and Instruments, Inc. (HSI), 1500 Meriden Road, Waterbury, Conn., USA; and DC solenoids available from Communications Instruments, Inc., P.O Box 520, Fairview, N.C. 28730, USA.

Examples of actions which the toy may perform include the following: move a portion of the toy; move the entire toy; or produce a sound, which may comprise one or more of the following: a recorded sound, a synthesized sound, music including recorded music or synthesized music, speech including recorded speech or synthesized speech.

The received signal may comprise a condition governing the action as, for example, the duration of the action, or the number of repetitions of the action.

Typically, the portion of the received signal comprising a message comprising a command to perform a specific action as, for example, to produce a sound with a given duration, comprises a digital signal. The portion of the received signal comprising a sound, for example, typically comprises an analog signal. Alternatively, in a preferred embodiment of the present invention, the portion of the received signal comprising a sound, including music, may comprise a digital signal, typically a signal comprising MIDI data.

The action the toy may perform also includes reacting to signals transmitted by another toy, such as, for example, playing sound that the other toy is monitoring and transmitting.

In a preferred embodiment of the present invention, the toy control device 130 is also operative to transmit a signal intended for the computer 100, to be received by the computer radio interface 110. In this embodiment, the computer radio interface 110 is preferably also operative to poll the toy control device 130, that is, transmit a signal comprising a request that the toy control device 130 transmit a signal to the computer radio interface 110. It is appreciated that polling is particularly preferred in the case where there are a plurality of toys having a plurality of toy control devices 130.

The signal transmitted by the toy control device 130 may comprise one or more of the following: sound, typically sound captured by a microphone input device 141; status of sensor input devices 140 as, for example, light sensors or micro switch; an indication of low power in the power source 125; or information identifying the toy.

It is appreciated that a sound signal transmitted by the device 130 may also include speech. The computer system is operative to perform a speech recognition operation on the speech signals. Appropriate commercially available software for speech recognition is available from companies such as: Stylus Innovation Inc., One Kendall Square, Building 300, Cambridge, Mass. 02139, USA and A&G Graphics Interface, USA, Telephone No. (617)492-0120, Telefax No. (617)427-3625.

The signal from the radio control interface 110 may also comprise, for example, one or more of the following: a request to ignore input from one or more input devices 140; a request to activate one or more input devices 140 or to stop ignoring input from one or more input devices 140; a request to report the status of one or more input devices 140; a request to store data received from one or more input devices 140, typically by latching a transition in the state of one or more input devices 140, until a future time when another signal from the radio control interface 110 requests the toy control device 130 to transmit a signal comprising the stored data received from the one or more input devices 140; or a request to transmit analog data, typically comprising sound, typically for a specified period of time.

Typically, all signals transmitted in both directions between the computer radio interface 110 and the toy control device 130 include information identifying the toy.

Figure 1C:
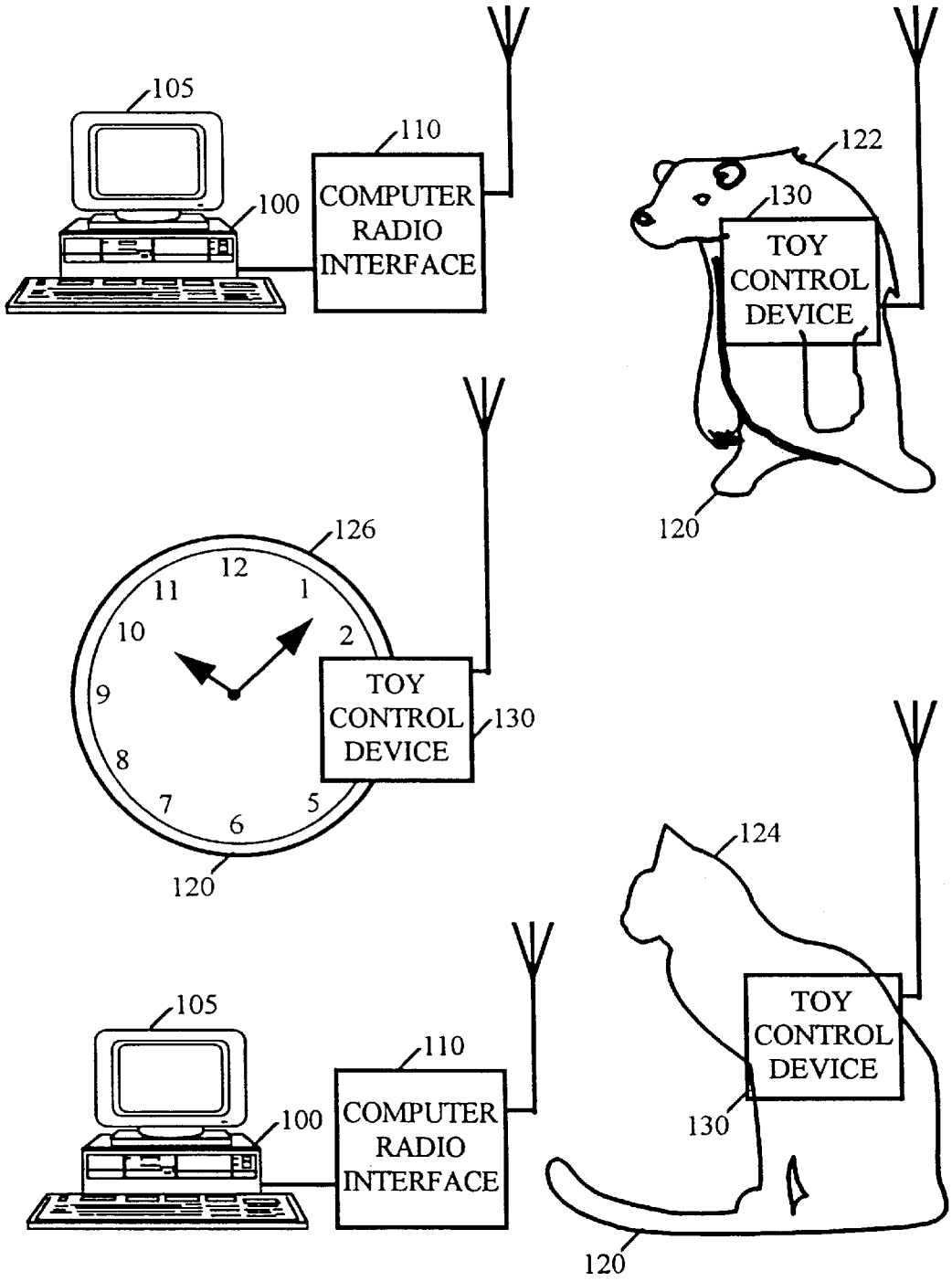
FIG. 1C is a partly pictorial, partly block diagram illustration of a computer control system including a toy, constructed and operative in accordance with an alternative preferred embodiment of the present invention.

Reference is now made to FIG. 1C, which is a partly pictorial, partly block diagram illustration of a computer control system including a toy, constructed and operative in accordance with an alternative preferred embodiment of the present invention. The system of FIG. 1C comprises two computers 100. It is appreciated that, in general, a plurality of computers 100 may be used. In the implementation of FIG. 1C, all signals transmitted in both directions between the computer radio interface 110 and the toy control device 130 typically include information identifying the computer.

The operation of the system of FIG. 1A is now briefly described. Typically, the computer 100 runs software comprising a computer game, typically a game including at least one animated character. Alternatively, the software may comprise educational software or any other interactive software including at least one animated object. As used herein, the term "animated object" includes any object which may be depicted on the computer screen 105 and which interacts with the user of the computer via input to and output from the computer. An animated object may be any object depicted on the screen such as, for example: a doll; an action figure; a toy, such as, for example, an activity toy, a vehicle, or a ride-on vehicle; a drawing board or sketch board; or a household object such as, for example, a clock, a lamp, a chamber pot, or an item of furniture.

Figure 2A:
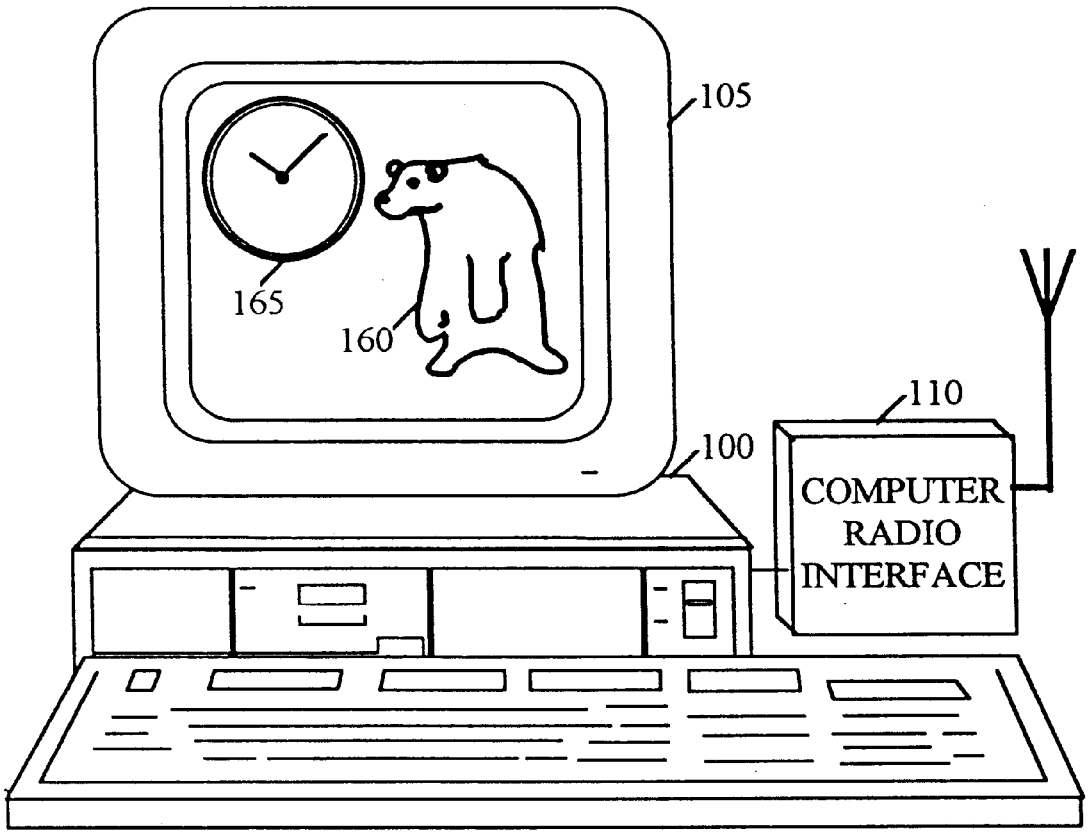
FIGS. 2A–2C are simplified pictorial illustrations of a portion of the system of FIG. 1A in use.
Figure 2B:
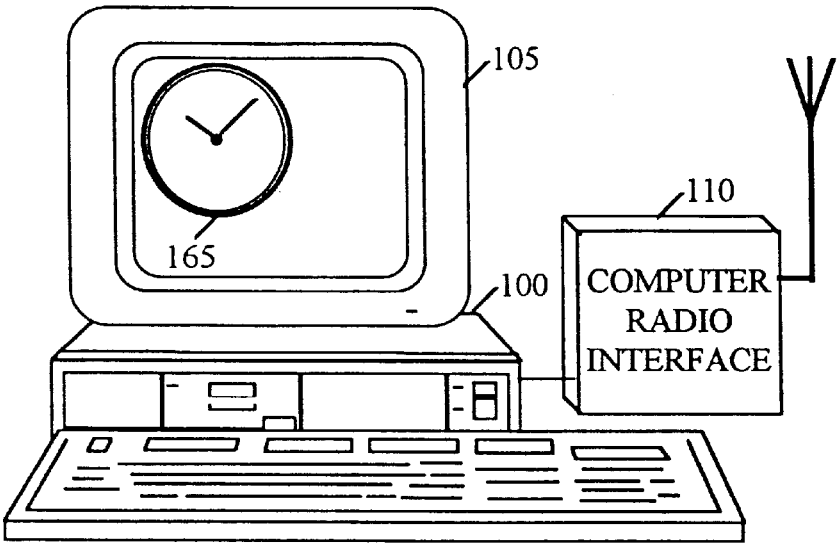
Figure 2B:
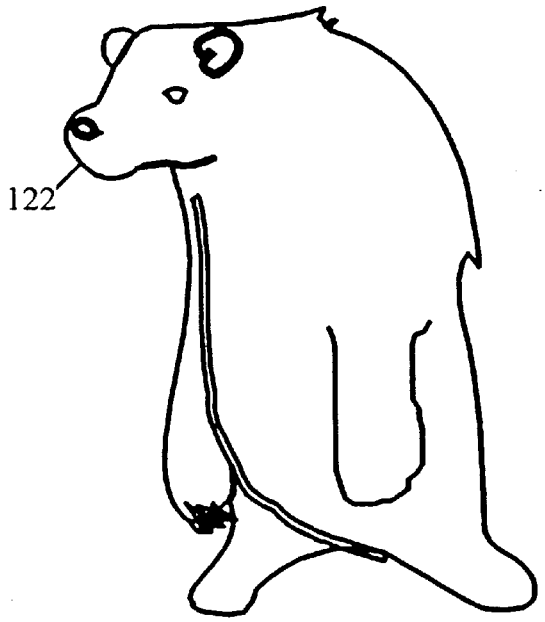
Figure 2C:
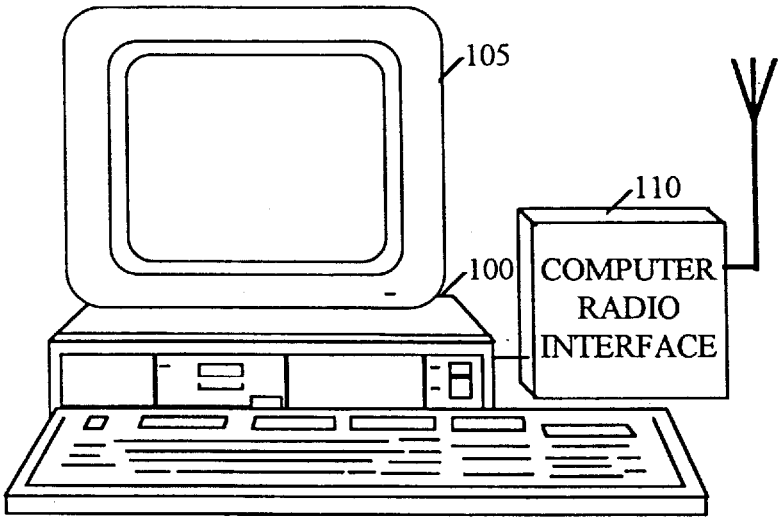
Figure 2C:
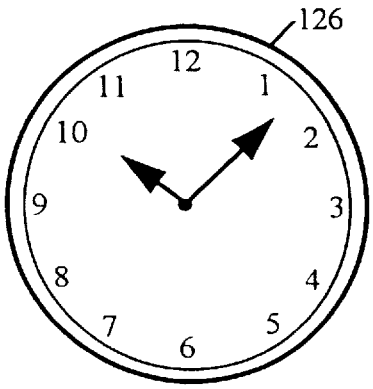
Figure 2C:
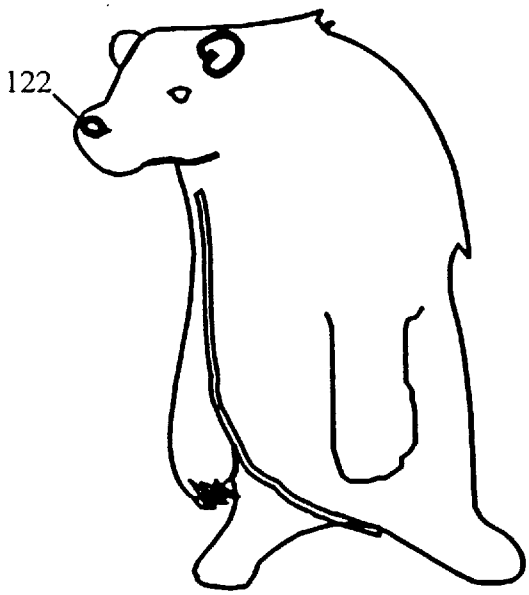

Reference is now additionally made to FIGS. 2A–2C, which depict a portion of the system of FIG. 1A in use. The apparatus of FIG. 2A comprises the computer screen 105 of FIG. 1A. On the computer screen are depicted animated objects 160 and 165.

FIG. 2B depicts the situation after the toy 122 has been brought into range of the computer radio interface 110 of FIG. 1A, typically into the same room therewith. Preferably, the toy 122 corresponds to the animated object 160. For example, in FIG. 2B the toy 122 and the animated object 160, shown in FIG. 2A, are both a teddy bear. The apparatus of FIG. 2B comprises the computer screen 105, on which is depicted the animated object 165. The apparatus of FIG. 2B also comprises the toy 122. The computer 100, having received a message via the computer radio interface 110, from the toy 122, no longer displays the animated object 160 corresponding to the toy 122. The functions of the animated object 160 are now performed through the toy 122, under control of the computer 100 through the computer radio interface 110 and the toy control device 130.

FIG. 2C depicts the situation after the toy 126 has also been brought into range of the computer radio interface 110 of FIG. 1A, typically into the same room therewith. Preferably, the toy 126 corresponds to the animated object 165. For example, in FIG. 2C the toy 126 and the animated object 165, shown in FIGS. 2A and 2B, are both a clock. The apparatus of FIG. 2C comprises the computer screen 105, on which no animated objects are depicted.

The apparatus of FIG. 2C also comprises the toy 126. The computer 100, having received a message via the computer radio interface 110 from the toy 126, no longer displays the animated object 165 corresponding to the toy 126. The functions of the animated object 165 are now performed through the toy 126, under control of the computer 100 through the computer radio interface 110 and the toy control device 130.

In FIG. 2A, the user interacts with the animated objects 160 and 165 on the computer screen, typically using conventional methods. In FIG. 2B the user also interacts with the toy 122, and in FIG. 2C typically with the toys 122 and 126, instead of interacting with the animated objects 160 and 165 respectively. It is appreciated that the user may interact with the toys 122 and 126 by moving the toys or parts of the toys; by speaking to the toys; by responding to movement of the toys which movement occurs in response to a signal received from the computer 100; by responding to a sound produced by the toys, which sound is produced in response to a signal received from the computer 100 and which may comprise music, speech, or another sound; or otherwise.

Figure 3:
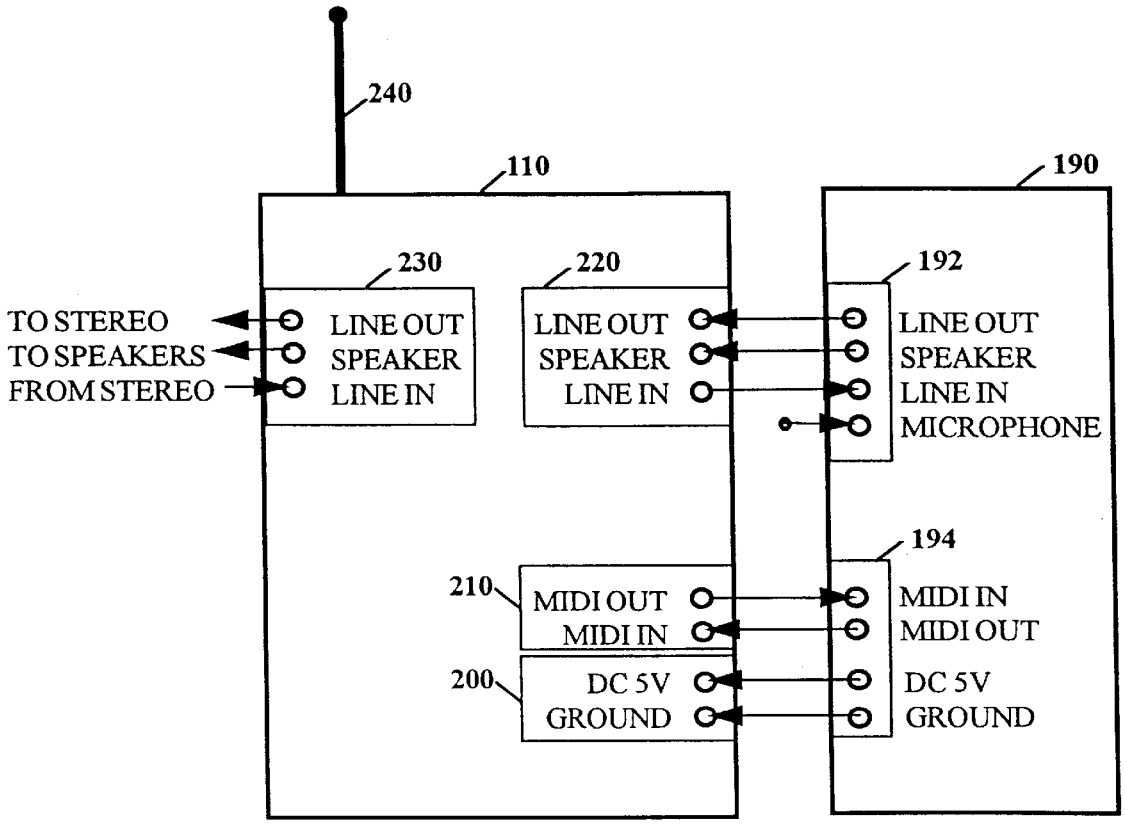
FIG. 3 is a simplified block diagram of a preferred implementation of the computer radio interface 110 of FIG. 1A.

Reference is now made to FIG. 3 which is a simplified block diagram of a preferred embodiment of the computer radio interface 110 of FIG. 1A. The apparatus of FIG. 3 comprises the computer radio interface 110. The apparatus of FIG. 3 also comprises a sound card 190, as described above with reference to FIG. 1A. In FIG. 3, the connections between the computer radio interface 110 and the sound card 190 are shown.

The computer radio interface 110 comprises a DC unit 200 which is fed with power through a MIDI interface 210 from a sound card MIDI interface 194, and the following interfaces: a MIDI interface 210 which connects to the sound card MIDI interface 194; an audio interface 220 which connects to an audio interface 192 of the sound card 190; and a secondary audio interface 230 which preferably connects to a stereo sound system for producing high quality sound under control of software running on the computer 100 (not shown).

The apparatus of FIG. 3 also comprises an antenna 240, which is operative to send and receive signals between the computer radio interface 110 and one or more toy control devices 130.

Figure 4:
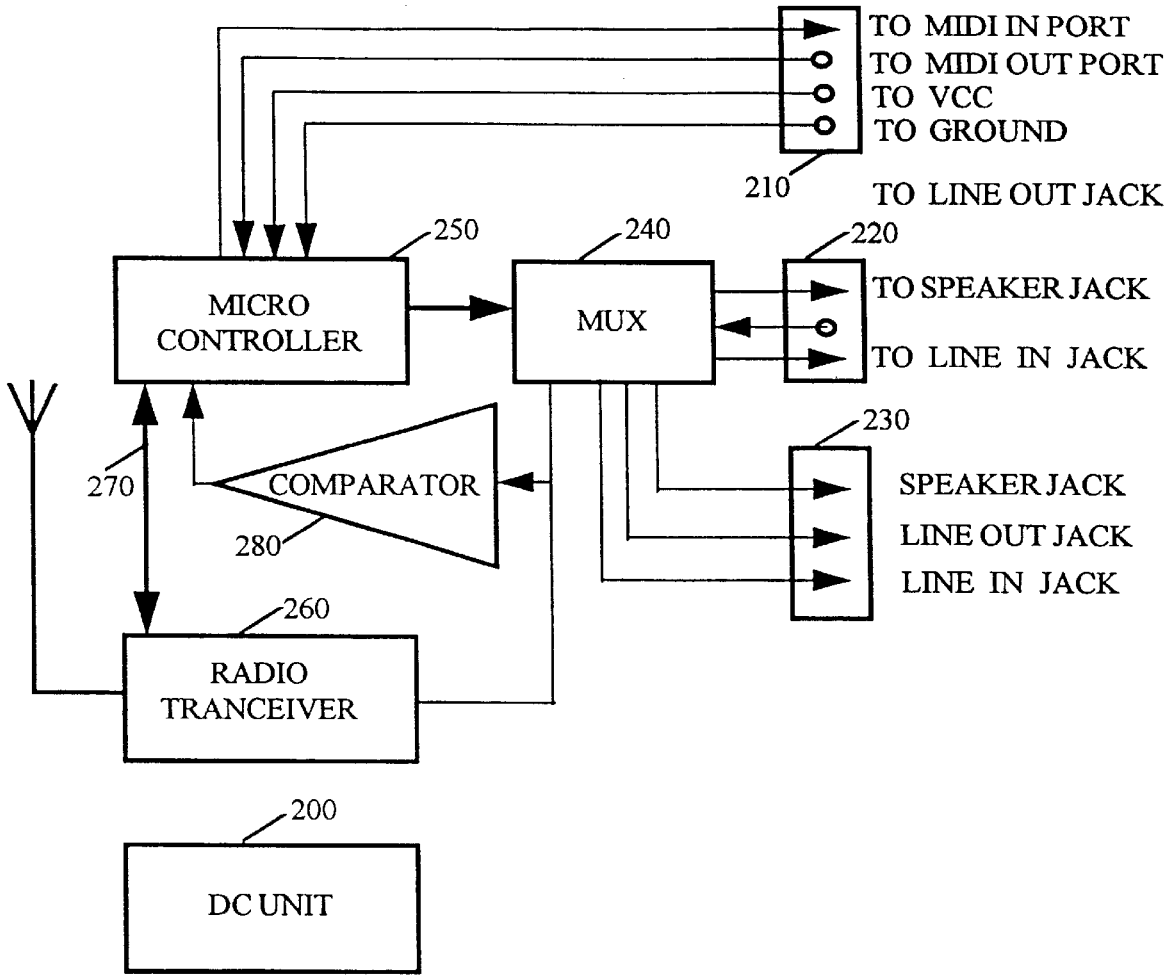
FIG. 4 is a more detailed block diagram of the computer radio interface 110 of FIG. 3.

FIG. 4 is a more detailed block diagram of the computer radio interface 110 of FIG. 3. The apparatus of FIG. 4 comprises the DC unit 200, the MIDI interface 210, the audio interface 220, and the secondary audio interface 230. The apparatus of FIG. 4 also comprises a multiplexer 240, a micro controller 250, a radio transceiver 260, a connection unit 270 connecting the radio transceiver 260 to the micro controller 250, and a comparator 280.

Reference is now made to FIGS. 5A–5D, which taken together comprise a schematic diagram of the apparatus of FIG. 4.

Figure 5A:
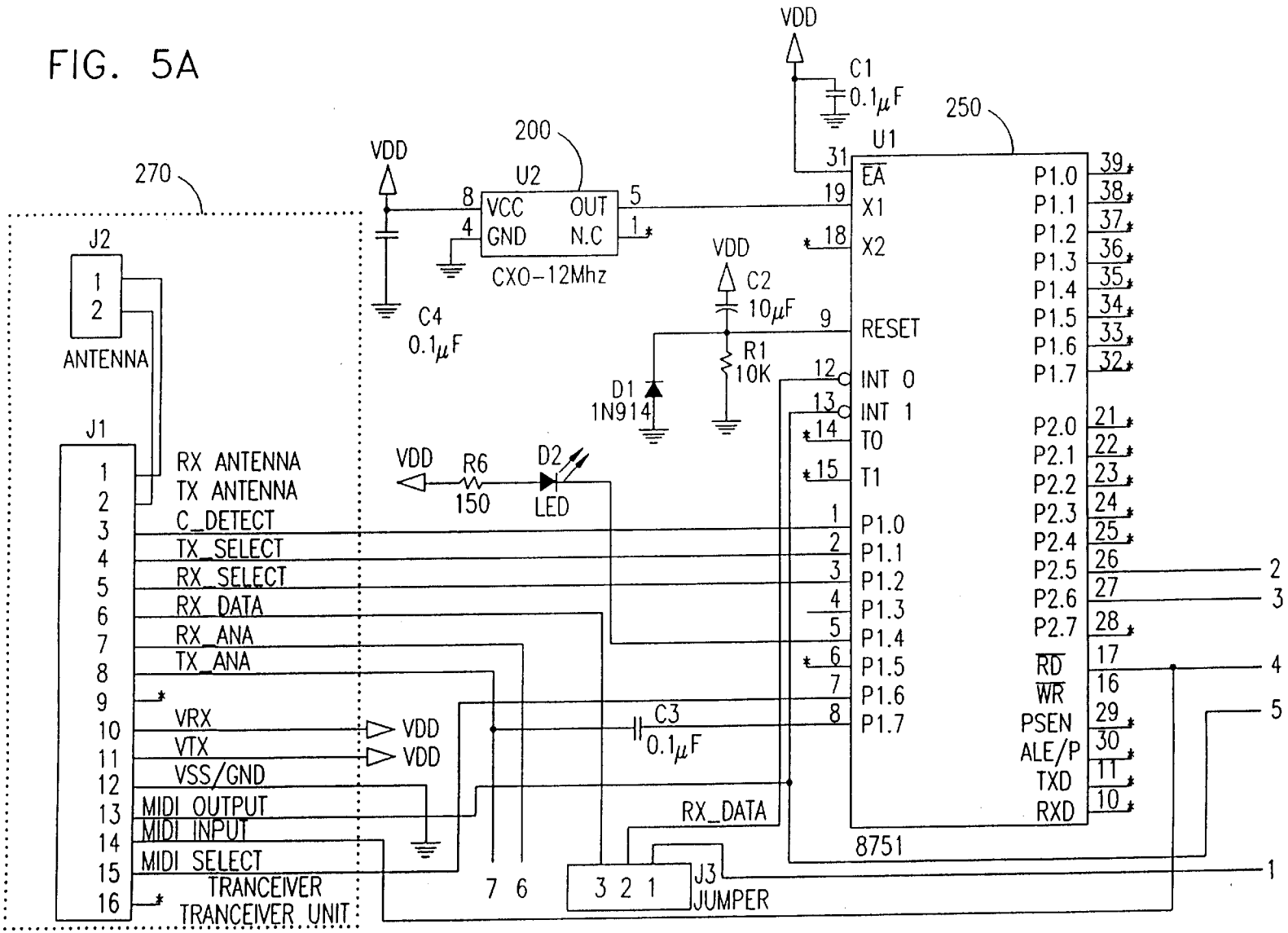
FIGS. 5A–5D taken together comprise a schematic diagram of the apparatus of FIG. 4.
Figure 5B:
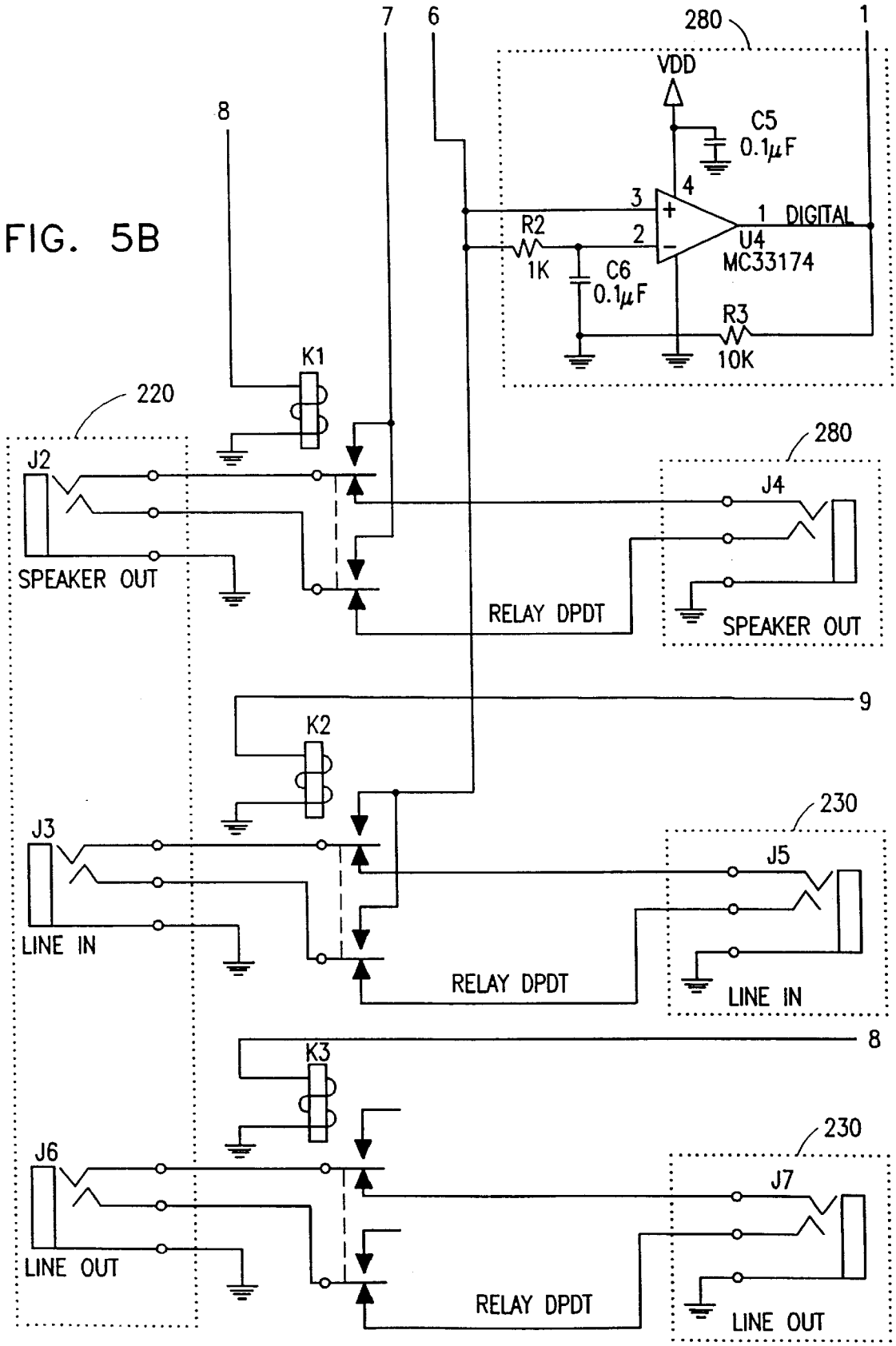
Figure 5C:
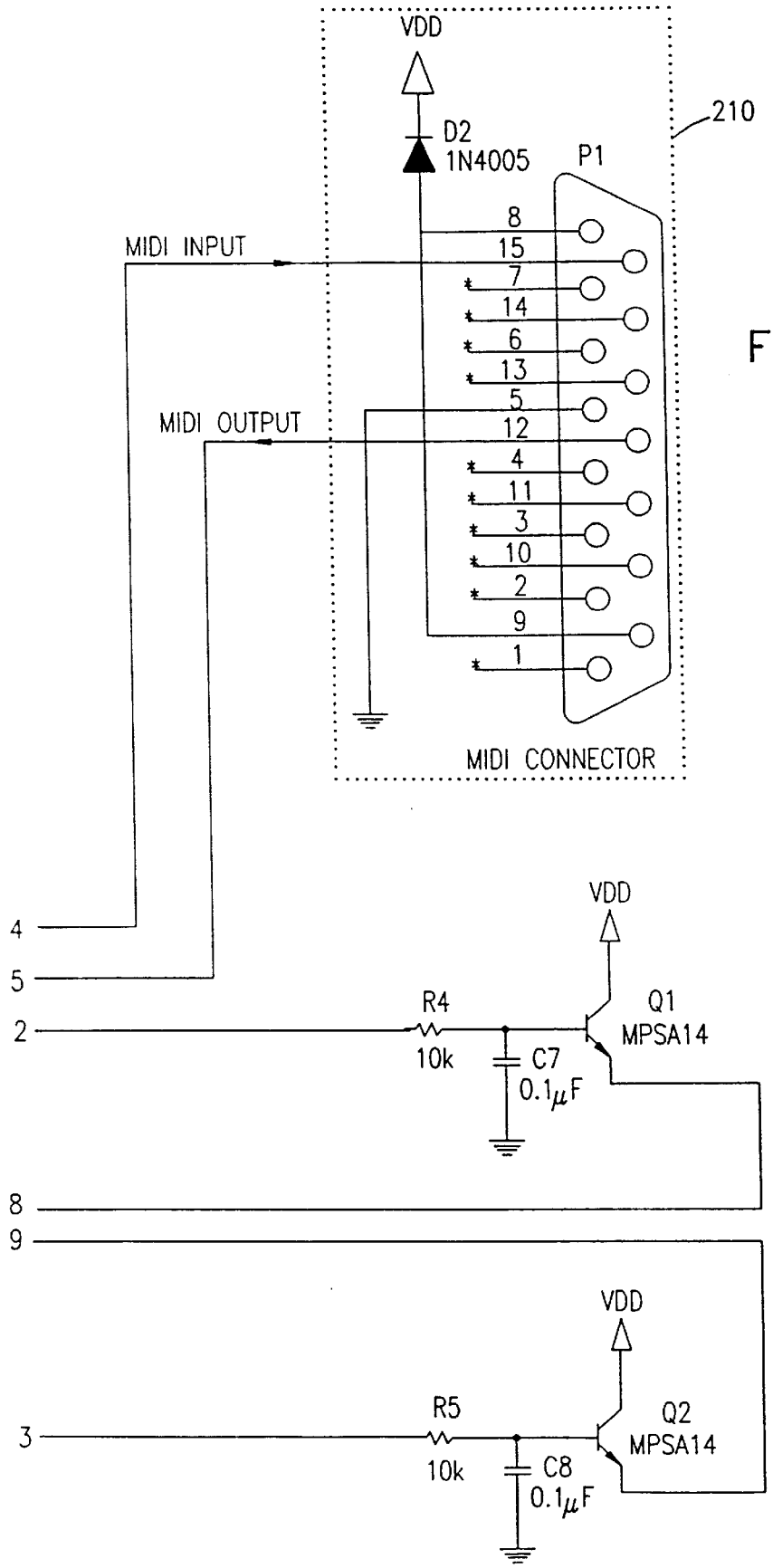

The following is a preferred parts list for the apparatus of FIGS. 5A–5C:

| | |
|---|---|
| 1. K1 | Relay Dept, Idec, 1213 Elco Drive, Sunnyvale, Calif. 94089-2211, USA. |
| 2. U1 | 8751 microcontroller, Intel Corporation, San Tomas 4, 2700 Sun Tomas Expressway, 2nd Floor, Santa Clara 95051, CA USA. |
| 3. U2 | CXO - 12 MHZ (crystal oscillator), Raltron, 2315 N.W. 107th Avenue, Miami, FL 33172, USA. |
| 4. U4 | MC33174, Motorola, Phoenix, AZ USA., Tel. No. (602)897-5056. |
| 5. Diodes | 1N914, Motorola, Phoenix, AZ, USA. Tel. No. (602)897-5056. |
| 6. Transistors | 2N2222 and MPSA14, Motorola, Phoenix, AZ, USA. Tel. No. (602)897-5056. |

Figure 5D:
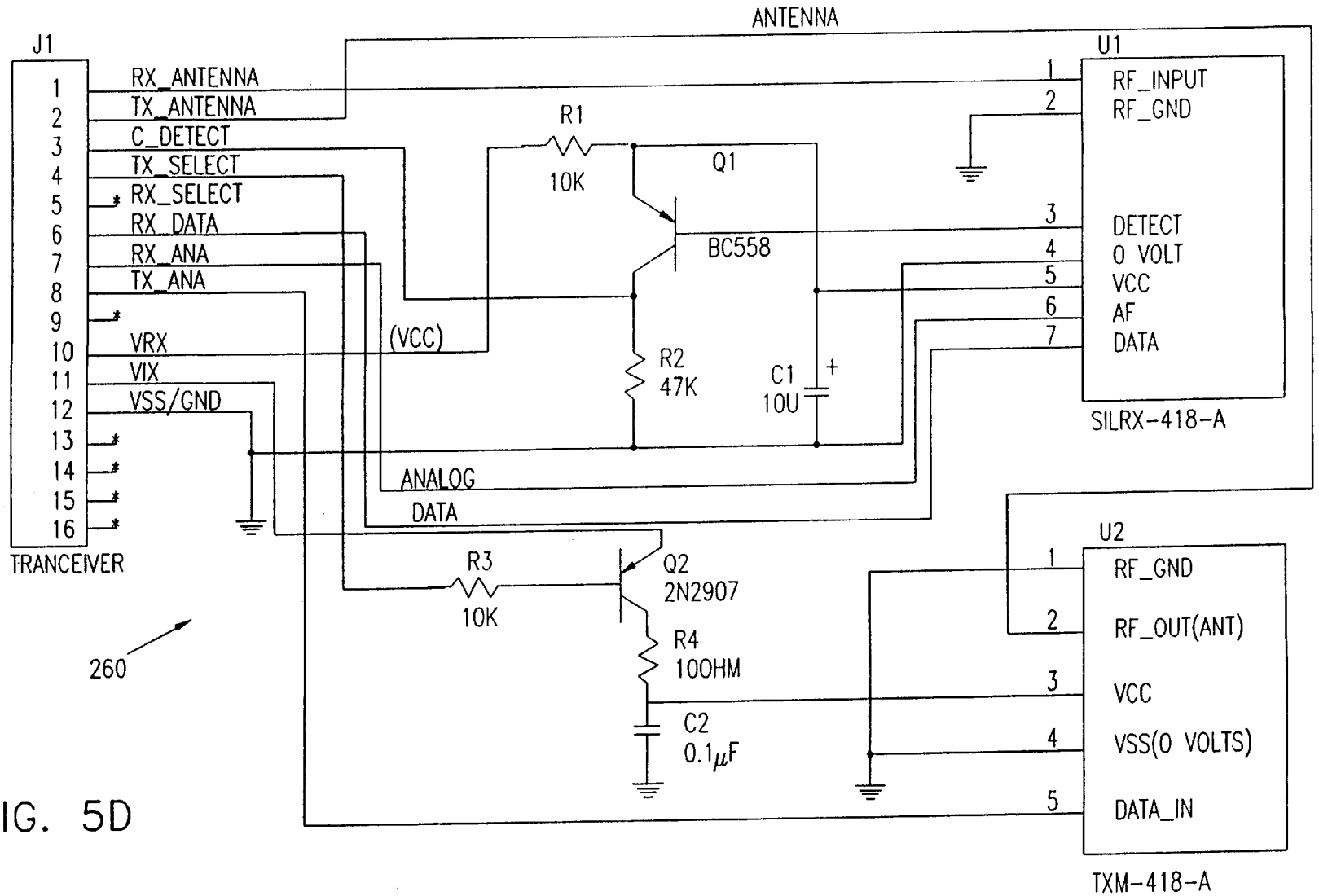

The following is a preferred parts list for the apparatus of FIG. 5D:

| | |
|---|---|
| 1. U1 | SILRAX-418-A UFH radio telemetry receive module, Ginsburg Electronic GmbH, Am Moosfeld 85, D-81829, Munchen, Germany. |

-continued

| | |
|---|---|
| 2. U2 | TXM-418-A low power UHF radio telemetry transmit module, Ginsburg Electronic GmbH, Am Moosfeld 85, D-81829, Munchen, Germany. |

Figure 5E:
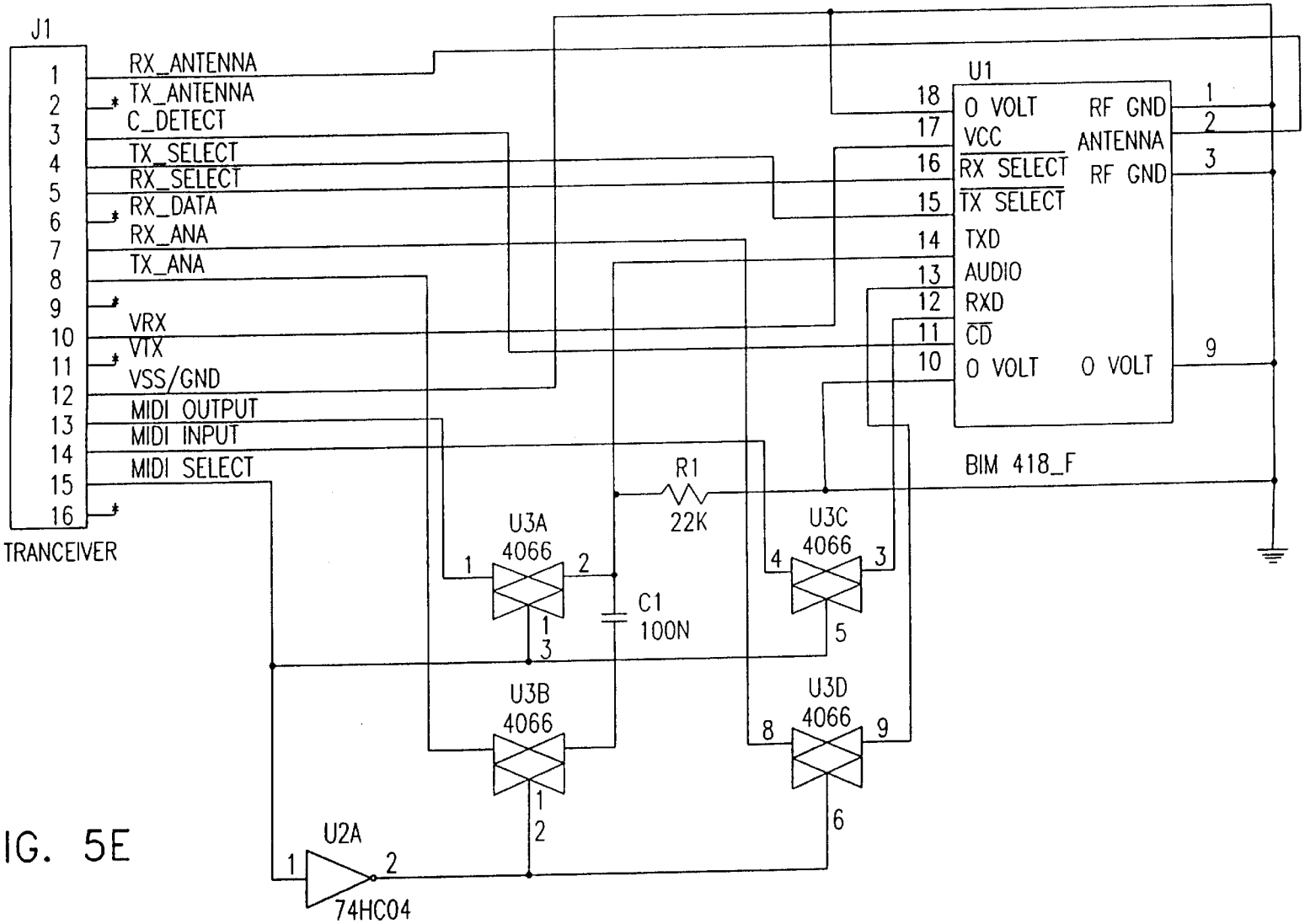
FIG. 5E is an schematic diagram of an alternative implementation of the apparatus of FIG. 5D.

Reference is now additionally made to FIG. 5E, which is a schematic diagram of an alternative implementation of the apparatus of FIG. 5D. The following is a preferred parts list for the apparatus of FIG. 5E:

| | | |
|---|---|---|
| | 1. U1 | BIM-418-F low power UHF data transceiver module, Ginsburg Electronic GmbH, Am Moosfeld 85, D-81829, Munchen, Germany. |
| Alternate | 1. U1 | S20043 spread spectrum full duplex transceiver, AMI Semiconductors - American Microsystems, Inc., Idaho, USA. |
| Alternate | 1. U1 | SDT-300 synthesized transceiver, Circuit Design, Inc., Japan. |

In the parts list for FIG. 5E, one of item 1 or either of the alternate items 1 may be used for U1.

It is appreciated that the appropriate changes will have to be made to the circuit boards for alternate embodiments of the apparatus.

The apparatus of FIG. 5E has similar functionality to the apparatus of FIG. 5D, but has higher bit rate transmission and reception capacity and is, for example, preferred when MIDI data is transmitted and received.

FIGS. 5A–5E are self-explanatory with regard to the above parts lists.

Figure 6:
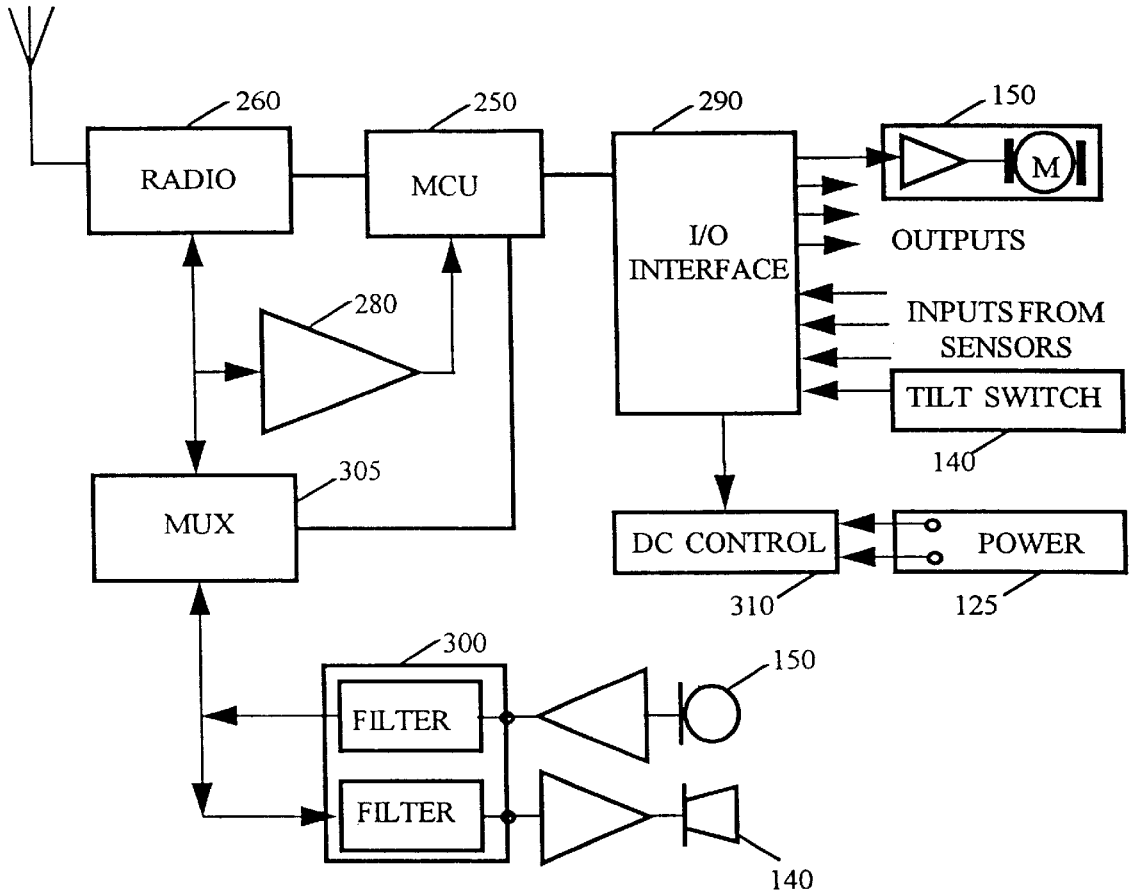
FIG. 6 is a simplified block diagram of a preferred implementation of the toy control device 130 of FIG. 1A.
Figure 7A:
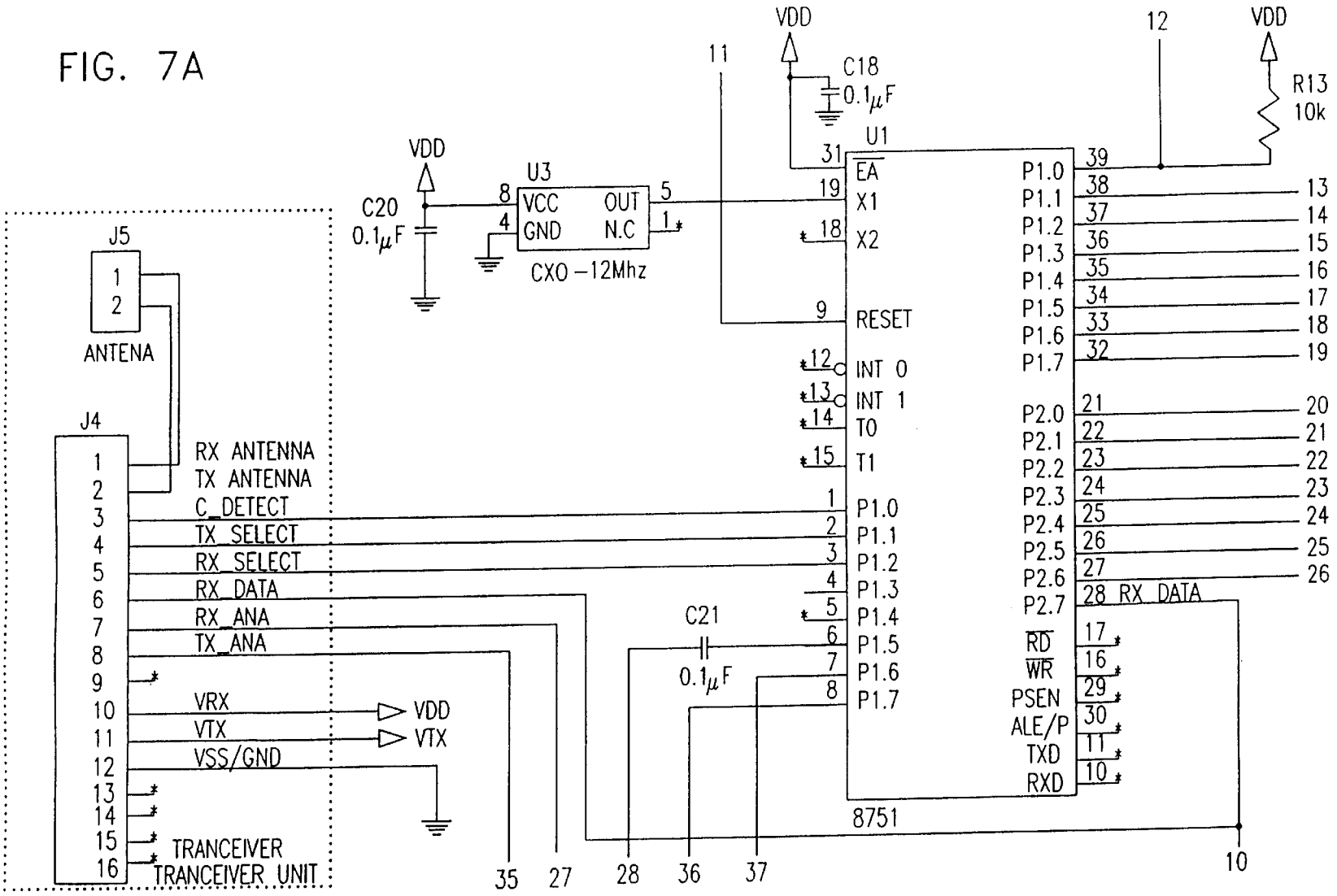
FIGS. 7A–7F, taken together with either FIG. 5D or FIG. 5E, comprise a schematic diagram of the apparatus of FIG. 6.
Figure 7B:
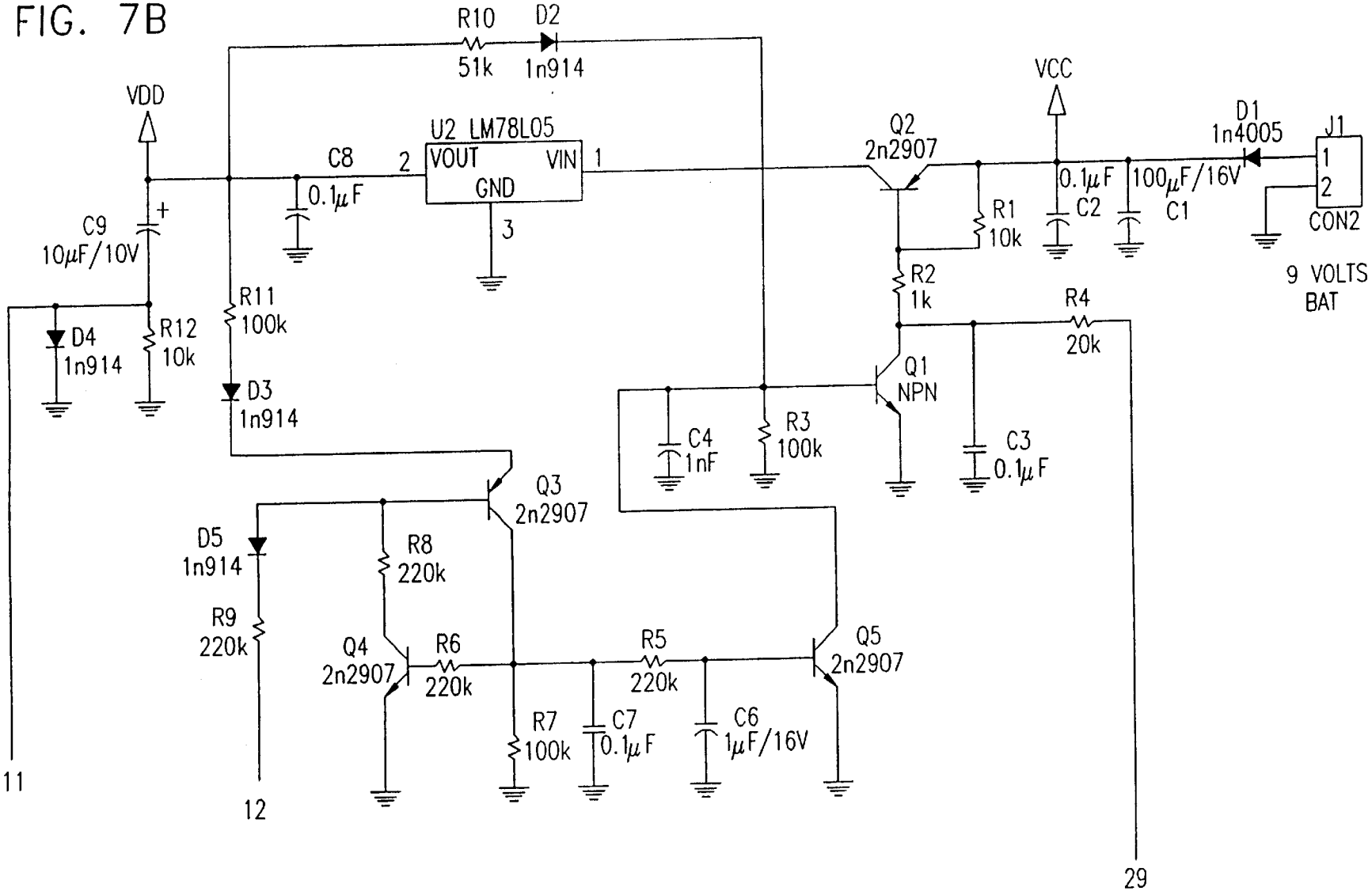
Figure 7C:
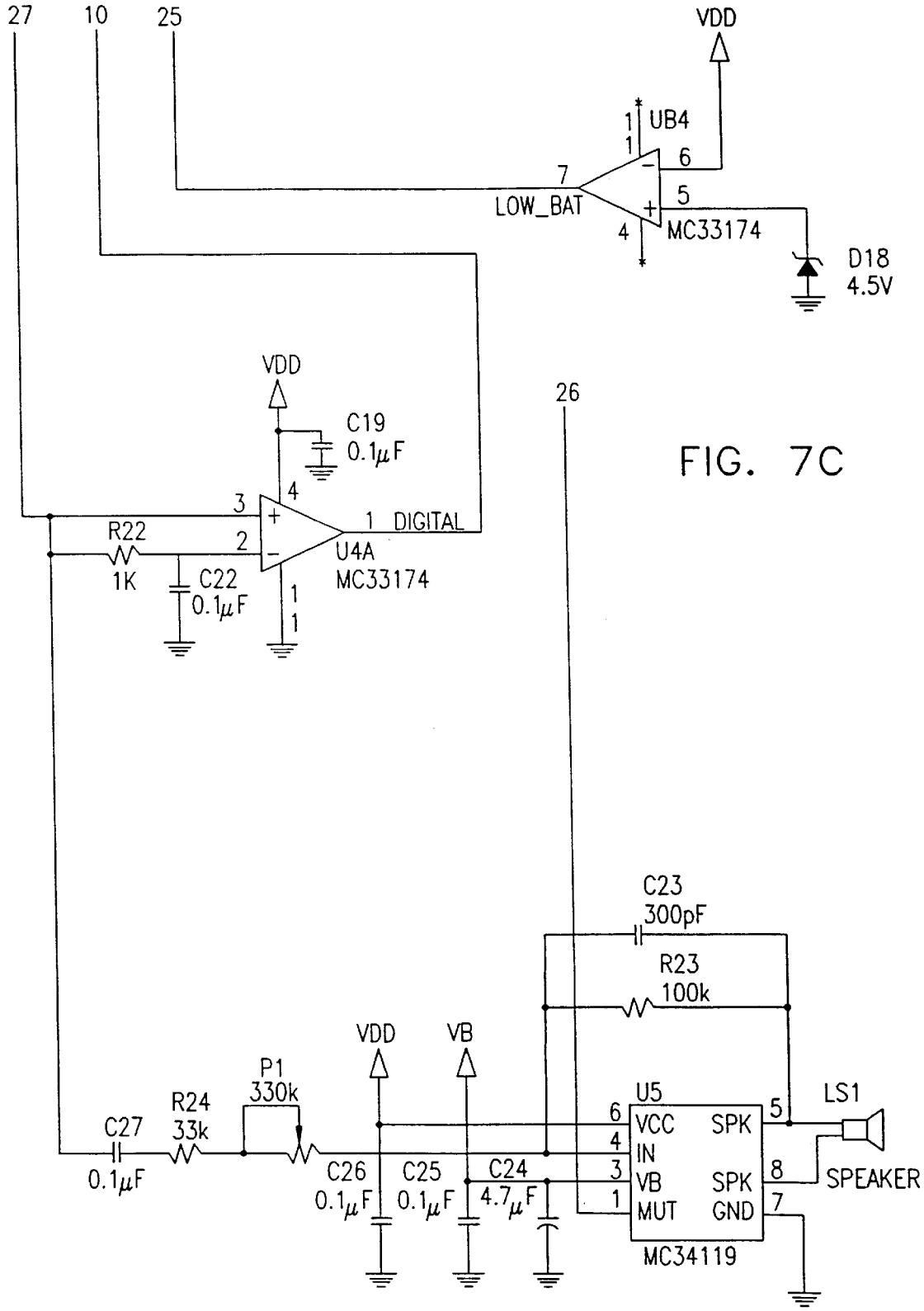
Figure 7D:
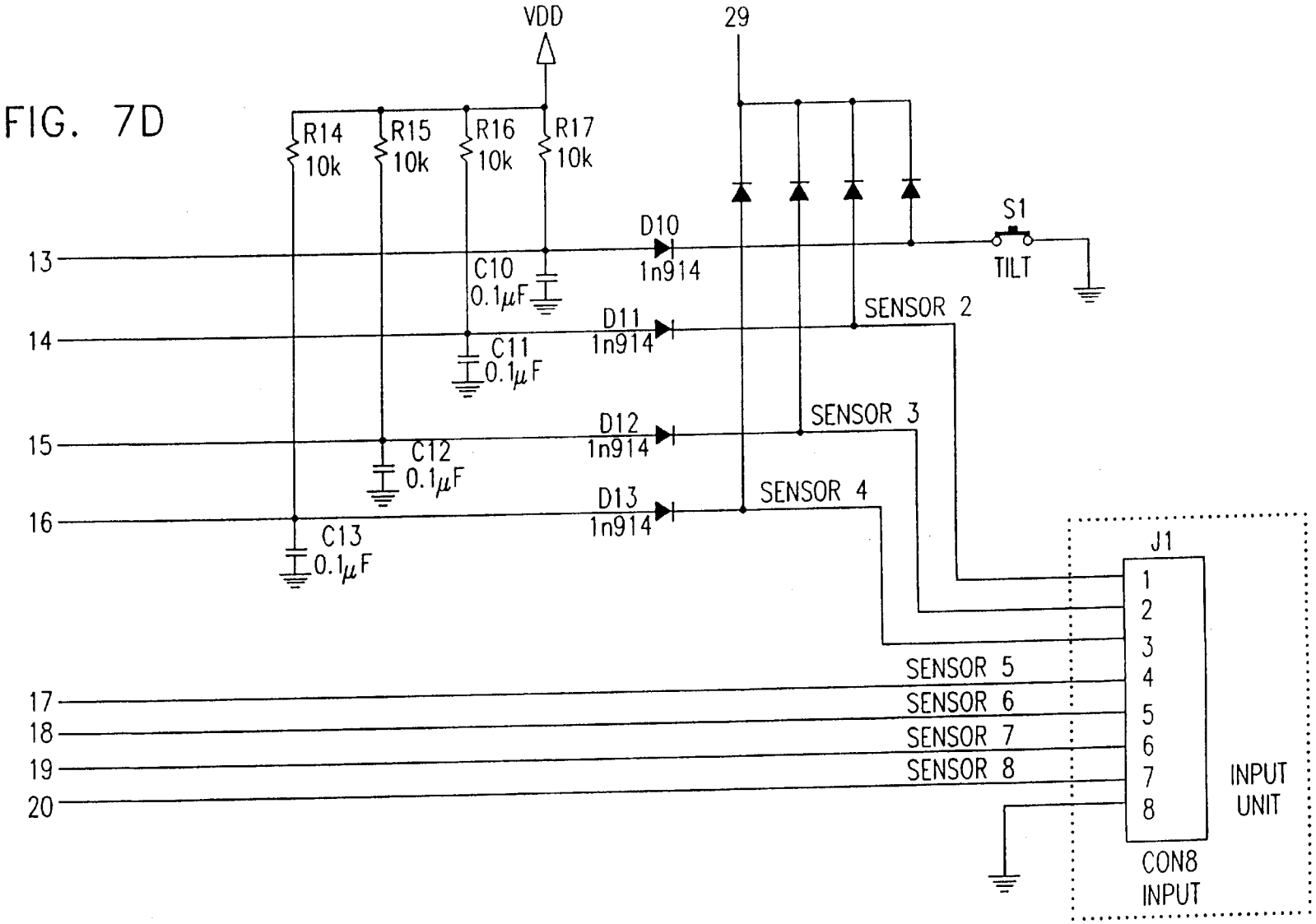
Figure 7E:
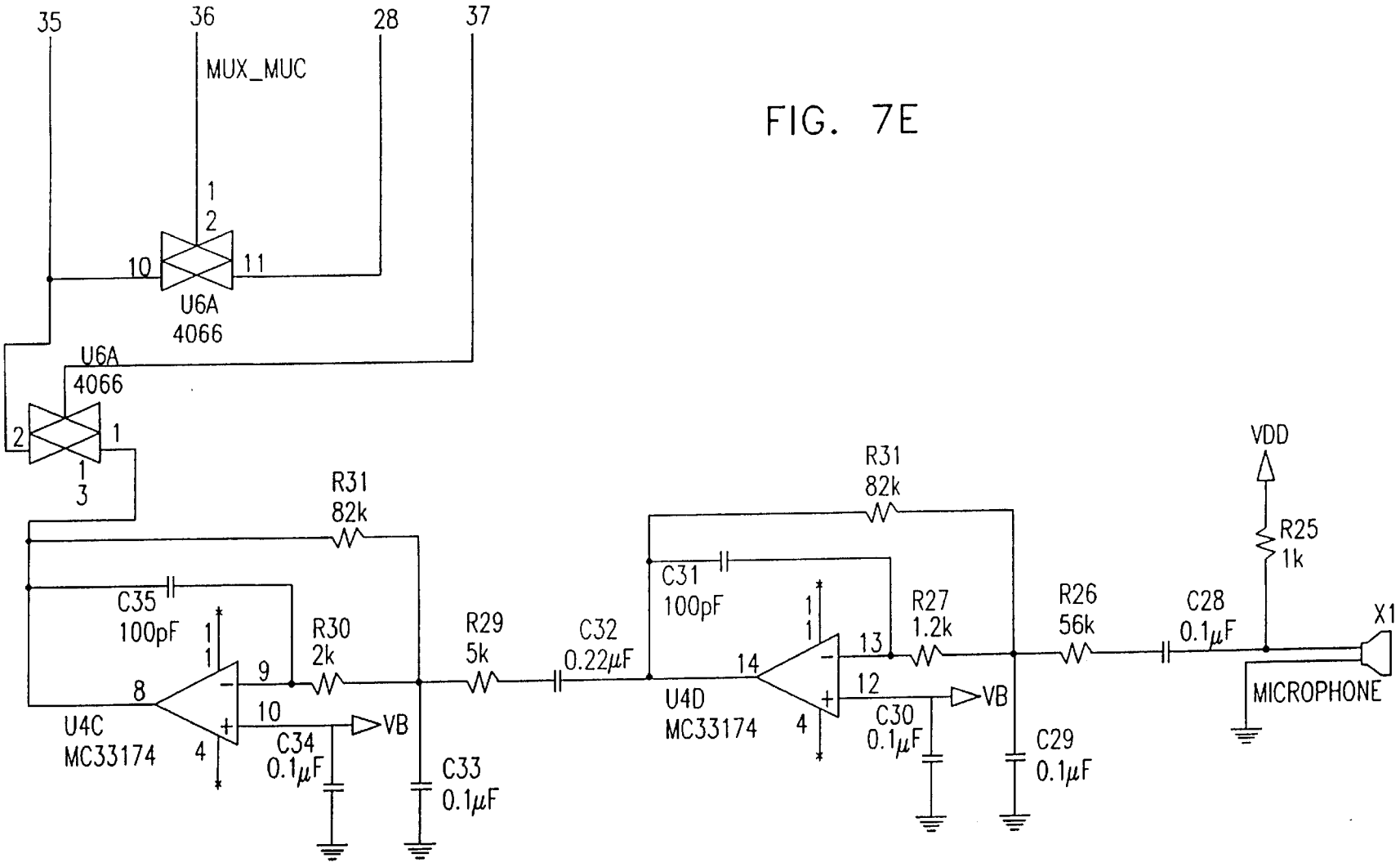
Figure 7F:
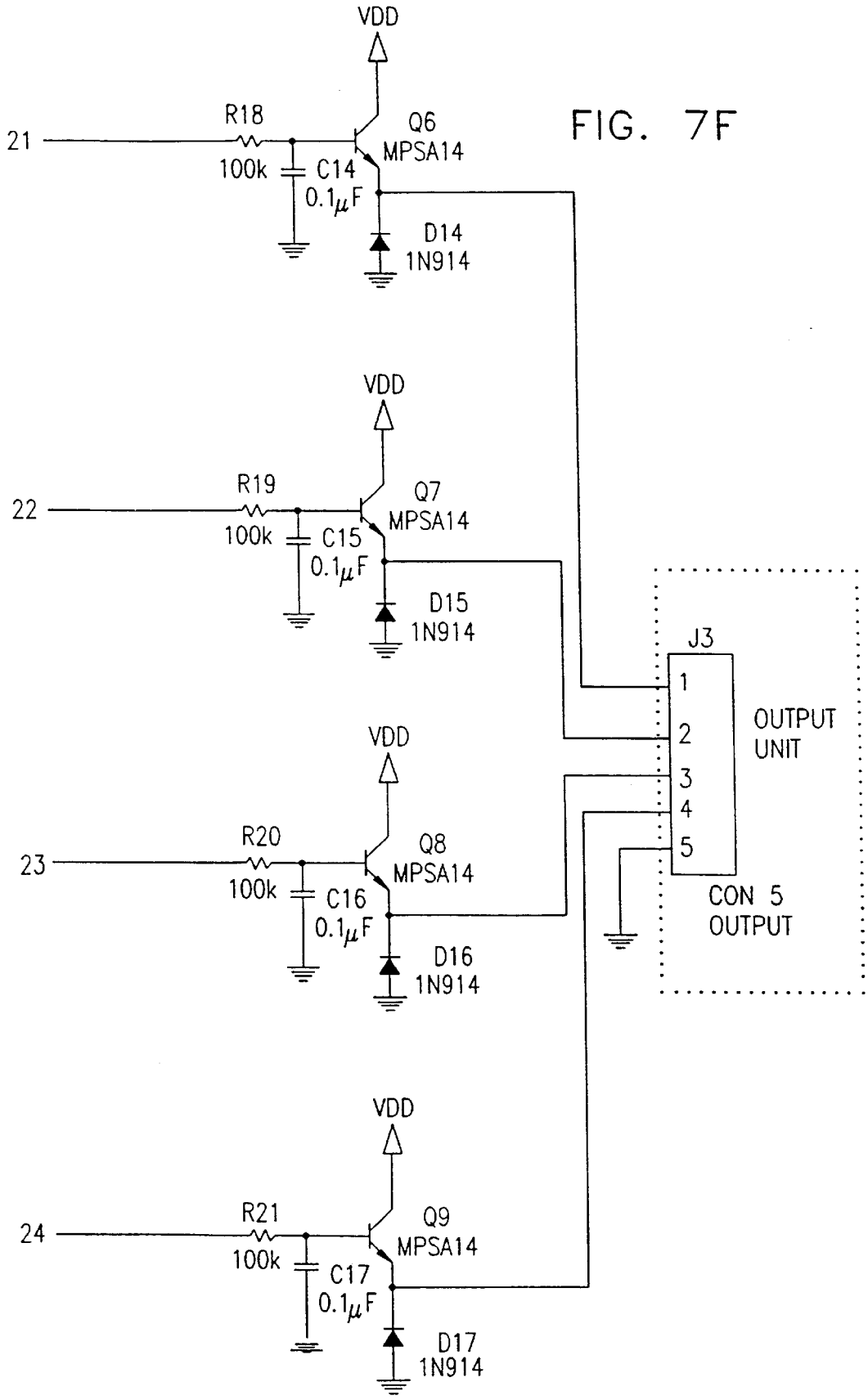

Reference is now made to FIG. 6 which is a simplified block diagram of a preferred embodiment of the toy control device 130 of FIG. 1A. The apparatus of FIG. 6 comprises a radio transceiver 260, similar to the radio transceiver 260 of FIG. 4. The apparatus of FIG. 6 also comprises a microcontroller 250 similar to the microcontroller 250 of FIG. 4.

The apparatus of FIG. 6 also comprises a digital input/output interface (digital I/O interface) 290, which is operative to provide an interface between the microcontroller 250 and a plurality of input and output devices which may be connected thereto such as, for example, four input device and four output devices. A preferred implementation of the digital I/O interface 290 is described in more detail below with reference to FIGS. 7A–7F.

The apparatus of FIG. 6 also comprises an analog input/output interface (analog I/O interface) 300 operatively connected to the radio transceiver 260, and operative to receive signals therefrom and to send signals thereto.

The apparatus of FIG. 6 also comprises a multiplexer 305 which is operative, in response to a signal from the microcontroller 250, to provide output to the analog I/O interface 300 only when analog signals are being transmitted by the radio transceiver 260, and to pass input from the analog I/O interface 300 only when such input is desired.

The apparatus of FIG. 6 also comprises input devices 140 and output devices 150. In FIG. 6, the input devices 140 comprise, by way of example, a tilt switch operatively connected to the digital I/O interface 290, and a microphone operatively connected to the analog I/O interface 300. It is appreciated that a wide variety of input devices 140 may be used.

In FIG. 6, the output devices 150 comprise, by way of example, a DC motor operatively connected to the digital I/O interface 290, and a speaker operatively connected to the analog I/O interface 300. It is appreciated that a wide variety of output devices 150 may be used.

The apparatus of FIG. 6 also comprises a DC control 310, a preferred implementation of which is described in more detail below with reference to FIGS. 7A–7F.

The apparatus of FIG. 6 also comprises a comparator 280, similar to the comparator 280 of FIG. 4.

The apparatus of FIG. 6 also comprises a power source 125, shown in FIG. 6 by way of example as batteries, operative to provide electrical power to the apparatus of FIG. 6 via the DC control 310.

Reference is now made to FIGS. 7A–7F which, taken together with either FIG. 5D or 5E, comprise a schematic diagram of the apparatus of FIG. 6. The following is a preferred parts list for the apparatus of FIGS. 7A–7F:

| | |
|---|---|
| 1. U1 | 8751 microcontroller, Intel corporation, San Tomas 4, 2700 Sun Tomas Expressway, 2nd Floor, Santa Clara 95051, CA. USA. |
| 2. U2 | LM78L05, National Semiconductor, 2900 Semiconductor Drive, Santa Clara, CA 95052, USA. |
| 3. U3 | CXO - 12 MHz (crystal oscillator), Raltron, 2315 N.W. 107th Avenue, Miami, FL 33172, USA. |
| 4. U4 | MC33174, Motorola, Phoenix, AZ USA. Tel. No. (602)897-5056. |
| 5. U5 | MC34119, Motorola, Phoenix, AZ USA. Tel. No. (602)897-5056. |
| 6. U6 | 4066, Motorola, Phoenix, AZ, USA. Tel. No. (602)897-5056. |
| 7. Diode | 1N914, Motorola, Phoenix, AZ USA. Tel. No. (602)897-5056. |
| 8. Transistor | 2N2222, Motorola, Phoenix, AZ USA. Tel. No. (602)897-5056. |
| 7. Transistors | 2N2907 and MPSA14, Motorola, Phoenix, AZ USA. Tel. No. (602)897-5056. |

FIGS. 7A–7F are self-explanatory with reference to the above parts list.

As stated above with reference to FIG. 1A, the signals transmitted between the computer radio interface 110 and the toy control device 130 may be either analog signals or digital signals. It the case of digital signals, the digital signals preferably comprise a plurality of predefined messages, known to both the computer 100 and to the toy control device 130.

Each message sent by the computer radio interface 110 to the toy control device 130 comprises an indication of the intended recipient of the message. Each message sent by the toy control device 130 to the computer radio interface 110 comprises an indication of the sender of the message.

In the embodiment of FIG. 1C described above, messages also comprise the following:

each message sent by the computer radio interface 110 to the toy control device 130 comprises an indication of the sender of the message; and each message sent by the toy control device 130 to the computer radio interface 110 comprises an indication of the intended recipient of the message.

A preferred set of predefined messages is as follows:

COMMAND STRUCTURE

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |

Unit address-24 bits: 8 bits - Computer Radio Interface address (PC address)
16 bits - Toy interface address (Doll address)

COMMANDS LIST

A. OUTPUT COMMANDS

SET_IO

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0001 Hex | 0000 | IO | 0000 | D | | | |

Set an output pin to a digital level D.

| | | |
|---|---|---|
| A: | unit address | |
| IO: | i/o number - | 0000–0111 |
| T1,T2: | time- | 0000,0000–1111,1111 |
| D: | Data- | 0000–0001 |

SET_IO_IF_SENSOR

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0002 Hex | IO | IO_D | S | SD | | | |

Set output pin to a digital Ievel D, if detect a sensors in SD ("I" or "0")

| | | |
|---|---|---|
| A: | unit address | |
| IO: | i/o number- | 0000–0111 |
| IO_D: | i/o data- | 0000–0001 |
| S: | sensor number- | 0000–0111 / 1111 = if one of the sensors |
| SD: | Sensor Data- | 0–1 |

SET_IO_IF_SENSOR_FOR_TIME

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0003 Hex | IO | IO_D | S | S_D | T | | |

Set output pin to a digital level D for a period of time, if detect SD in a sensor.

| | | |
|---|---|---|
| A: | unit address - | |
| IO: | I/O number - | 000–111 |
| IO_D: | Data- | 0–1 |
| S: | sensor number | 0000–0111 |
| S_D: | sensor data | 0000–0001 |
| T: | time- | 0000–1111 |

CLK_IO

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0004 Hex | IO | T | DC | 0000 | | | |

clk the i/o pin for a time T in duty cycle DC

| | | |
|---|---|---|
| A: | unit address | |
| IO: | i/o number - | 0000–1111 |
| T: | time T - | 0000–1111 (sec) |
| DC: | duty cycle | 0000–1111 (×250 mx) |

E. TELEMETRY

Information sent by the TOY, as an ack to the command received.

OK_ACK

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0060 Hex | C1 | | C2 | | P1 | | |

-continued

E. TELEMETRY

Send back an ACK about the command that was received ok.

A: unit address
C1,C2: Received command 16 bit
P1: Extra parameter passed. 0000–1111

TEST_RESULT_ACK

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0061 Hex | TYPE | BAT | P1 | P2 | | | |

Send back a test result after performing a self test.

A: unit address -
Type: each different TOY can have different type 0000–1111
BAT: Send back the remaining power of the batteries. 0000–1111 (<1000 = low bat)
P1: Extra parameter passed. 0000–1111
P2: Extra parameter passed. 0000–1111

TOY_STATUS

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0062 Hex | OUT | IN | P1 | P2 | | | |

Send back the status of the TOY, as requested.

A: unit address
OUT: Outputs status 0000–1111 (output #1–output #4)
IN: Inputs status 0000–1111 (input #1–input #4)
P1: Extra parameter passed. 0000–1111
P2: Extra parameter passed. 0000–1111

E. REQUESTS

Requests sent by the TOY, because of an event.

TOY_AWAKE_REQ

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0070 Hex | OUT | IN | P1 | 0000 | | | |

Send req to the PC if the TOY goes from sleep mode to awake mode, because of change in one of the sensors or the tilt swich (that responds to movement).

A: unit address
OUT: Outputs status 0000–1111 (output #1–output #4)
IN: Inputs status 0000–1111 (input #1–input #4)
P1: Extra parameter passed. 0000–1111

TOY_LOW_BAT_REQ

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0071 Hex | OUT | IN | P1 | 0000 | | | |

Send req to the PC if the batteries of the TOY are week.

A: unit address
P1: Extra parameter passed. 0000–1111

TOY_REQ

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0072 Hex | OUT | IN | P1 | P2 | | | |

If detecting a change in one of the sensors, sending back the status of all Inputs & Outputs.

A: unit address
OUT: Outputs status 0000–1111 (output #1–output #4)

-continued

| E. REQUESTS | | |
|---|---|---|
| IN: | Inputs status | 0000–1111 (input #1–input #4) |
| P1: | Extra parameter passed. | 0000–1111 |
| P2: | Extra parameter passed. | 0000–1111 |

B. INPUT COMMANDS

SEND_STATUS_OF_SENSORS

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0010 Hex | 0000 | 0000 | 0000 | 0000 | | | |

send the status of all inputs/sensors of the toy back to the computer.

A: unit address

WAIT_FOR_CHANGE_IN_SENSORS_AND_SEND_NEW_STATUS

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0011 Hex | S | T | 0000 | 0000 | | | |

send the status of all sensors when there is a change in the status of one sensor.

| | | |
|---|---|---|
| A: | unit address | |
| S: | sensor number | 0000–0111 (1111 = one of the sensors) |
| T: | max time to wait. (sec) | 0001–1111 |

C. AUDIO OUT COMMANDS

START_AUDIO_PLAY_TILL_EOF_OR_TIMEOUT

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0020 Hex | SPK | 0000 | T | 0000 | | | |

Start playing an audio in a speaker.

| | | |
|---|---|---|
| A: | unit address - | |
| SPK: | speaker number | 0001–0010 |
| T: | TIME | 0000–1111 (SEC) (0000 = NO TIMEOUT) |

STOP_AUDIO_PLAY (EOF)

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0021 Hex | SPK | 0000 | 0000 | 0000 | | | |

Stop playing audio in a speaker.

| | | |
|---|---|---|
| A: | unit address | |
| SPK: | speaker number | 0001–0010 |

START_AUDIO_PLAY_TILL_EOF_OR_SENSOR

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0022 Hex | SPK | 0000 | S | SD | | | |

Start playing an audio in a speaker till EOF or till detecting a SD level in a sensor.

| | | |
|---|---|---|
| A: | unit address | |
| SPK: | speaker number | 0001–0010 |
| S: | sensor number | 0000–0111 (1111 = one of the sensors) |
| SD: | sensor data | 0000–0001 (1111 = wait till change) |

D. AUDIO IN COMMANDS

TRANSMIT_MIC_FOR_TIME

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0030 Hex | T | 0000 | 0000 | 0000 | | | |

Transmit mic audio for time T.
A: unit address
T: TIME 0000–1111 (SEC)

STOP_MIC_TRANSMITION

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0031 Hex | T | CH | 0000 | 0000 | | | |

Transmit mic audio for time T.
A: unit address

E. GENERAL COMMANDS

GOTO_AWAKE_MODE

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0040 Hex | P1 | 0000 | 0000 | 0000 | | | |

Tells the TOY to awake from power save mode & to send back an ack.
A: unit address
P1: Extra parameter passed. 0000–1111

GOTO_SLEEP_MODE

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0041 Hex | P1 | 0000 | 0000 | 0000 | | | |

Tells the TOY to go into power power save mode (sleep) & to send back an ack.
A: unit address
P1: Extra parameter passed. 0000–1111

PERFORM_SELF_TEST

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0042 Hex | P1 | 0000 | 0000 | 0000 | | | |

Tells the TOY to perfom a self test & to send back an ack when ready.
A: unit address
P1: Extra parameter passed. 0000–1111

IDENTIFY_ALL_DOLLS

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0043 Hex | 0000 | 0000 | 0000 | 0000 | | | |

Command to tell each doll to send a status message so that the computer can know if it exists (each doll will send the the staus message after a time set by its unit address).

USE NEW_RF_CHANNEL

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |

-continued

E. GENERAL COMMANDS

| | | | | | | | |
|---|---|---|---|---|---|---|---|
| 00 | 1 | A | 0044 Hex | P1 | 0000 | 0000 | 0000 |

Tells the TOY to switch into a new RF channel.

| | | |
|---|---|---|
| A: | unit address | |
| CH: | New RF channel selected | 0000–0011 (0–3) |
| P1: | Extra parameter passed. | 0000–1111 |

Note: This command is available only with enhanced radic modules (alternate UI of FIG. 5E).

F. TELEMETRY

Information sent by the TOY, as an ack to the command received.

OK_ACK

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0060 Hex | C1 | | C2 | | P1 | | |

Send back an ACK about the command that was received ok.

| | | |
|---|---|---|
| A: | unit address | |
| C1,C2: | Received command | 16 bit |
| P1: | Extra parameter passed. | 0000–1111 |

TEST_RESULT_ACK

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0061 Hex | TYPE | BAT | P1 | P2 | | | |

Send back a test result after performing a self test.

| | | |
|---|---|---|
| A: | unit address - | |
| Type: | each different TOY can have different type | 0000–1111 |
| BAT: | Send back the remaining power of the batteries. | 0000–1111 (<1000 = low bat) |
| P1: | Extra parameter passed. | 0000–1111 |
| P2: | Extra parameter passed. | 0000–1111 |

40

G. REQUESTS

Requests sent by the TOY, as a result of an event.

TOY_AWAKE_REQ

| Header | Startbit | Unit Address | Command | 16 bits | | | | 8 bits | | CRC |
|---|---|---|---|---|---|---|---|---|---|---|
| 7 bit | 1 bit | 24 bits | 16 bits | Dat1 | Dat2 | Dat3 | Dat4 | Dat5 | Dat6 | 8 bits |
| 00 | 1 | A | 0070 Hex | OUT | IN | P1 | 0000 | | | |

Send req to the PC if the TOY goes from sleep mode to awake mode, because of change in one of the sensors or the tilt swich (that responds to movement).

| | | |
|---|---|---|
| A: | unit address | |
| OUT: | Outputs status | 0000–1111 (output #1–output #4) |
| IN: | Inputs status | 0000–1111 (input #1–input #4) |
| P1: | Extra parameter passed. | 0000–1111 |

-continued

| G. REQUESTS | | | | | | | | | | |
|---|---|---|---|---|---|---|---|---|---|---|
| TOY_LOW_BAT_REQ | | | | | | | | | | |
| Header | Startbit | Unit Address | Command | 16 bits | | | | 8 bits | | CRC |
| 7 bit | 1 bit | 24 bits | 16 bits | Dat1 | Dat2 | Dat3 | Dat4 | Dat5 | Dat6 | 8 bits |
| 00 | 1 | A | 0071 Hex | OUT | IN | P1 | 0000 | | | |

Send req to the PC if the batteries ofthe TOY are week.
A: unit address
P1: Extra parameter passed. 0000–1111

Reference is now made to FIG. 8A, which is a simplified flowchart illustration of a preferred method for receiving radio signals, executing commands comprised therein, and sending radio signals, within the toy control device 130 of FIG. 1A. Typically, each message as described above comprises a command, which may include a command to process information also comprised in the message. The method of FIG. 8A preferably comprises the following steps:

A synchronization signal or preamble is detected (step 400). A header is detected (step 403).

A command contained in the signal is received (step 405).

The command contained in the signal is executed (step 410). Executing the command may be as described above with reference to FIG. 1A.

A signal comprising a command intended for the computer radio interface 110 is sent (step 420).

Reference is now made to FIGS. 8B–8T which, taken together, comprise a simplified flowchart illustration of a preferred implementation of the method of FIG. 8A. The method of FIGS. 8B–8T is self-explanatory.

Reference is now made to FIG. 9A, which is a simplified flowchart illustration of a preferred method for receiving MIDI signals, receiving radio signals, executing commands comprised therein, sending radio signals, and sending MIDI signals, within the computer radio interface 110 of FIG. 1A. Some of the steps of FIG. 9A are identical to steps of FIG. 8A, described above. FIG. 9A also preferably comprises the following steps:

A MIDI command is received from the computer 100 (step 430). The MIDI command may comprise a command intended to be transmitted to the toy control device 130, may comprise an audio in or audio out command, or may comprise a general command.

A MIDI command is sent to the computer 100 (step 440). The MIDI command may comprise a signal received from the toy control device 130, may comprise a response to a MIDI command previously received by the computer radio interface 110 from the computer 100, or may comprise a general command.

The command contained in the MIDI command or in the received signal is executed (step 450). Executing the command may comprise, in the case of a received signal, reporting the command to the computer 100, whereupon the computer 100 may typically carry out any appropriate action under program control as, for example, changing a screen display or taking any other appropriate action in response to the received command. In the case of a MIDI command received from the computer 100, executing the command may comprise transmitting the command to the toy control device 130. Executing a MIDI command may also comprise switching audio output of the computer control device 110 between the secondary audio interface 230 and the radio transceiver 260. Normally the secondary audio interface 230 is directly connected to the audio interface 220 preserving the connection between the computer sound board and the peripheral audio devices such as speakers, microphone and stereo system.

Reference is now made to FIGS. 9B–9N, and additionally reference is made back to FIGS. 8D–8M, all of which, taken together, comprise a simplified flowchart illustration of a preferred implementation of the method of FIG. 9A. The method of FIGS. 9B–9M, taken together with FIGS. 8D–8M, is self-explanatory.

Figure 10A:
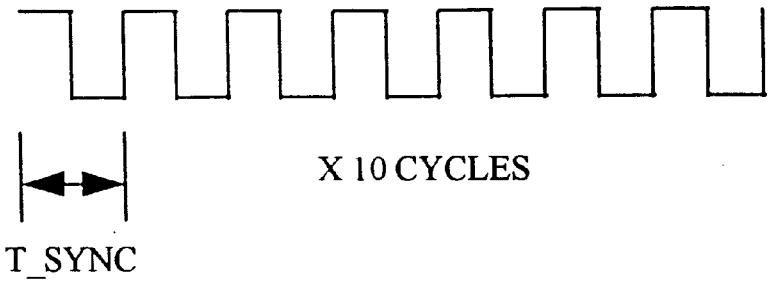
FIGS. 10A–10C are simplified pictorial illustrations of a signal transmitted between the computer radio interface 110 and the toy control device 130 of FIG. 1A.
Figure 10B:
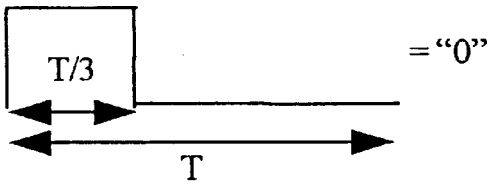
Figure 10C:
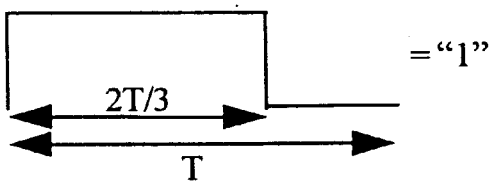

Reference is now additionally made to FIGS. 10A–10C, which are simplified pictorial illustrations of a signal transmitted between the computer radio interface 110 and the toy control device 130 of FIG. 1A. FIG. 10A comprises a synchronization preamble. The duration T_SYNC of the synchronization preamble is preferably 0.500 millisecond, being preferably substantially equally divided into on and off components.

FIG. 10B comprises a signal representing a bit with value 0, while FIG. 10C comprises a signal representing a bit with value 1.

It is appreciated that FIGS. 10B and 10C refer to the case where the apparatus of FIG. 5D is used. In the case of the apparatus of FIG. 5E, functionality corresponding to that depicted in FIGS. 10B and 10C is provided within the apparatus of FIG. 5E.

Preferably, each bit is assigned a predetermined duration T, which is the same for every bit. A frequency modulated carrier is transmitted, using the method of frequency modulation keying as is well known in the art. An "off" signal (typically less than 0.7 Volts) presented at termination 5 of U2 in FIG. 5D causes a transmission at a frequency below the median channel frequency. An "on" signal (typically over 2.3 Volts) presented at pin 5 of U2 in FIG. 5D causes a transmission at a frequency above the median frequency. These signals are received by the corresponding receiver U1. Output signal from pin 6 of U1 is fed to the comparator 280 of FIGS. 4 and 6 that is operative to determine whether the received signal is "off" or "on", respectively.

It is also possible to use the comparator that is contained within U1 by connecting pin 7 of U1 of FIG. 5D, through pin 6 of the connector J1 of FIG. 5D, pin 6 of connector J1 of FIG. 5A, through the jumper to pin 12 of U1 of FIG. 5A.

Preferably, receipt of an on signal or spike of duration less than 0.01*T is ignored. Receipt of an on signal as shown in FIG. 10B, of duration between 0.01*T and 0.40*T is preferably taken to be a bit with value 0. Receipt of an on signal as shown in FIG. 10C, of duration greater than 0.40*T is preferably taken to be a bit with value 1. Typically, T has a value of 1.0 millisecond.

Furthermore, after receipt of an on signal, the duration of the subsequent off signal is measured. The sum of the durations of the on signal and the off signal must be between 0.90 T and 1.10 T for the bit to be considered valid. Otherwise, the bit is considered invalid and is ignored.

Figure 11:
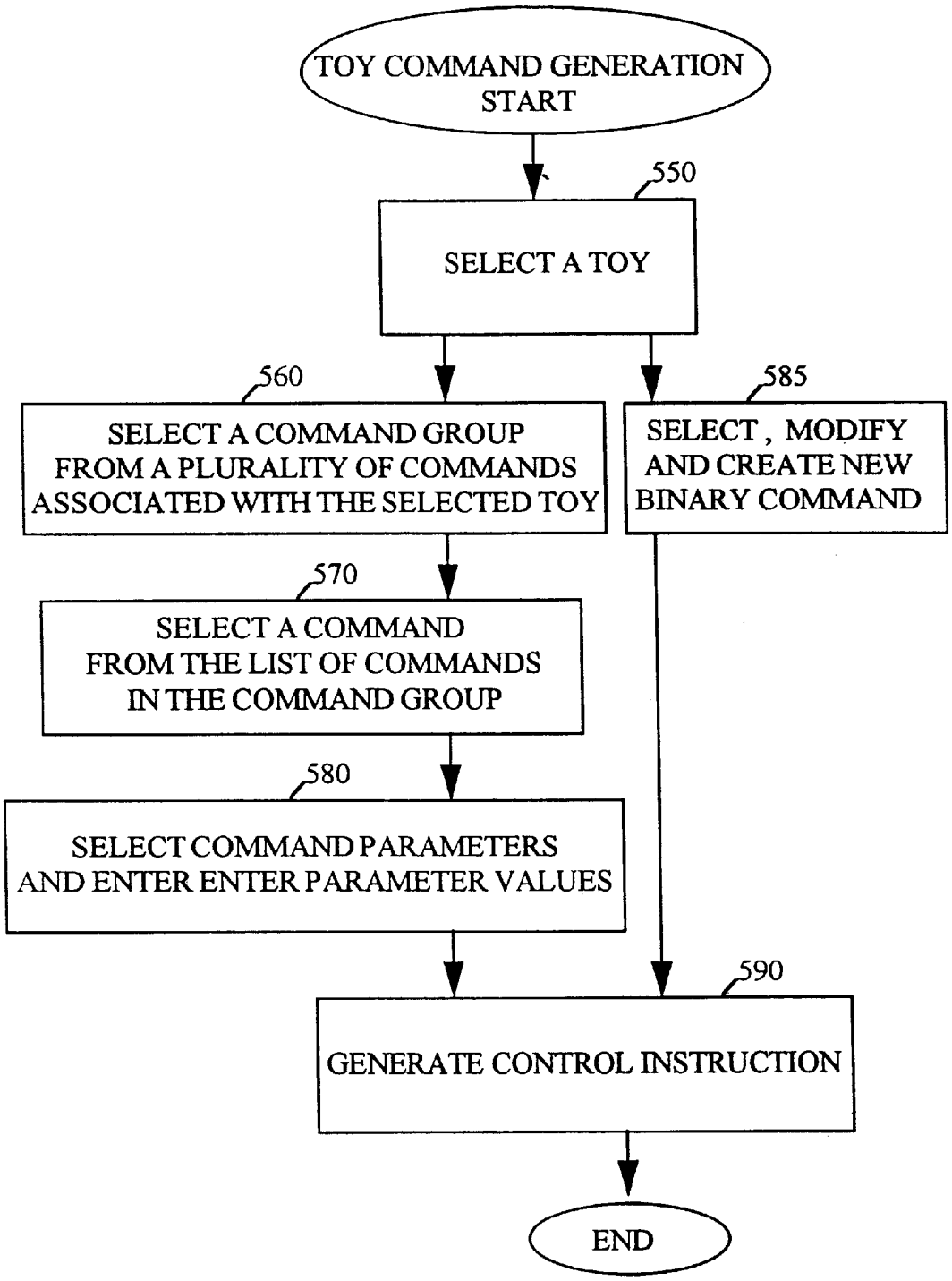
FIG. 11 is a simplified flowchart illustration of a preferred method for generating control instructions for the apparatus of FIG. 1A.

Reference is now made to FIG. 11, which is a simplified flowchart illustration of a method for generating control instructions for the apparatus of FIG. 1A. The method of FIG. 11 preferably includes the following steps:

A toy is selected (step 550). At least one command is selected, preferably from a plurality of commands associated with the selected toy (steps 560–580). Alternatively, a command may be entered by selecting, modifying, and creating a new binary command (step 585).

Typically, selecting a command in steps 560–580 may include choosing a command and specifying one or more control parameters associated with the command. A control parameter may include, for example, a condition depending on a result of a previous command, the previous command being associated either with the selected toy or with another toy. A control parameter may also include an execution condition governing execution of a command such as, for example: a condition stating that a specified output is to occur based on a status of the toy, that is, if and only if a specified input is received; a condition stating that the command is to be performed at a specified time; a condition stating that performance of the command is to cease at a specified time; a condition comprising a command modifier modifying execution of the command, such as, for example, to terminate execution of the command in a case where execution of the command continues over a period of time; a condition dependent on the occurrence of a future event; or another condition.

The command may comprise a command to cancel a previous command.

The output of the method of FIG. 11 typically comprises one or more control instructions implementing the specified command, generated in step 590. Typically, the one or more control instructions are comprised in a command file. Typically, the command file is called from a driver program which typically determines which command is to be executed at a given point in time and then calls the command file associated with the given command.

Figure 12A:
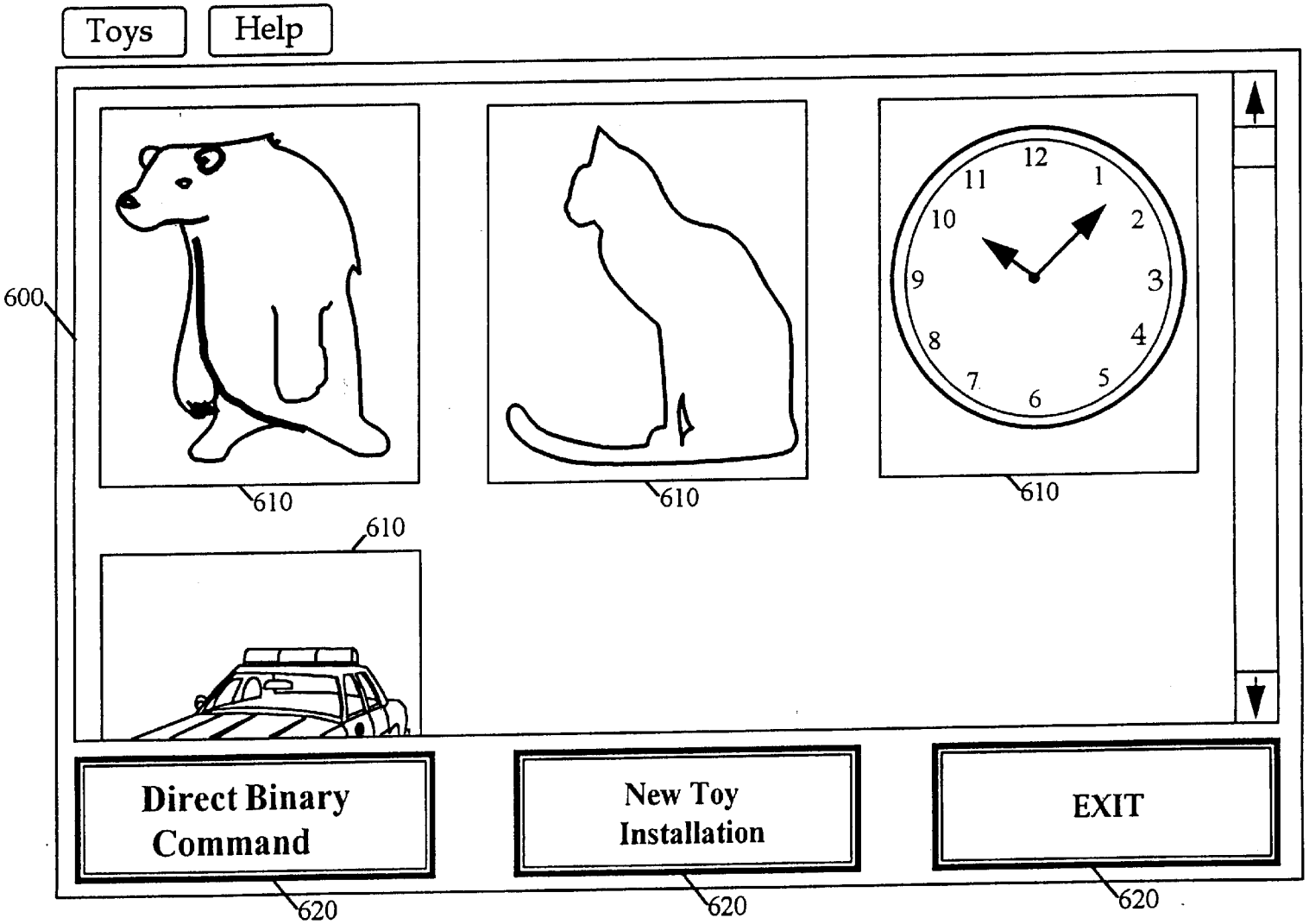
FIGS. 12A–12C are pictorial illustrations of a preferred implementation of a graphical user interface implementation of the method of FIG. 11.
Figure 12B:
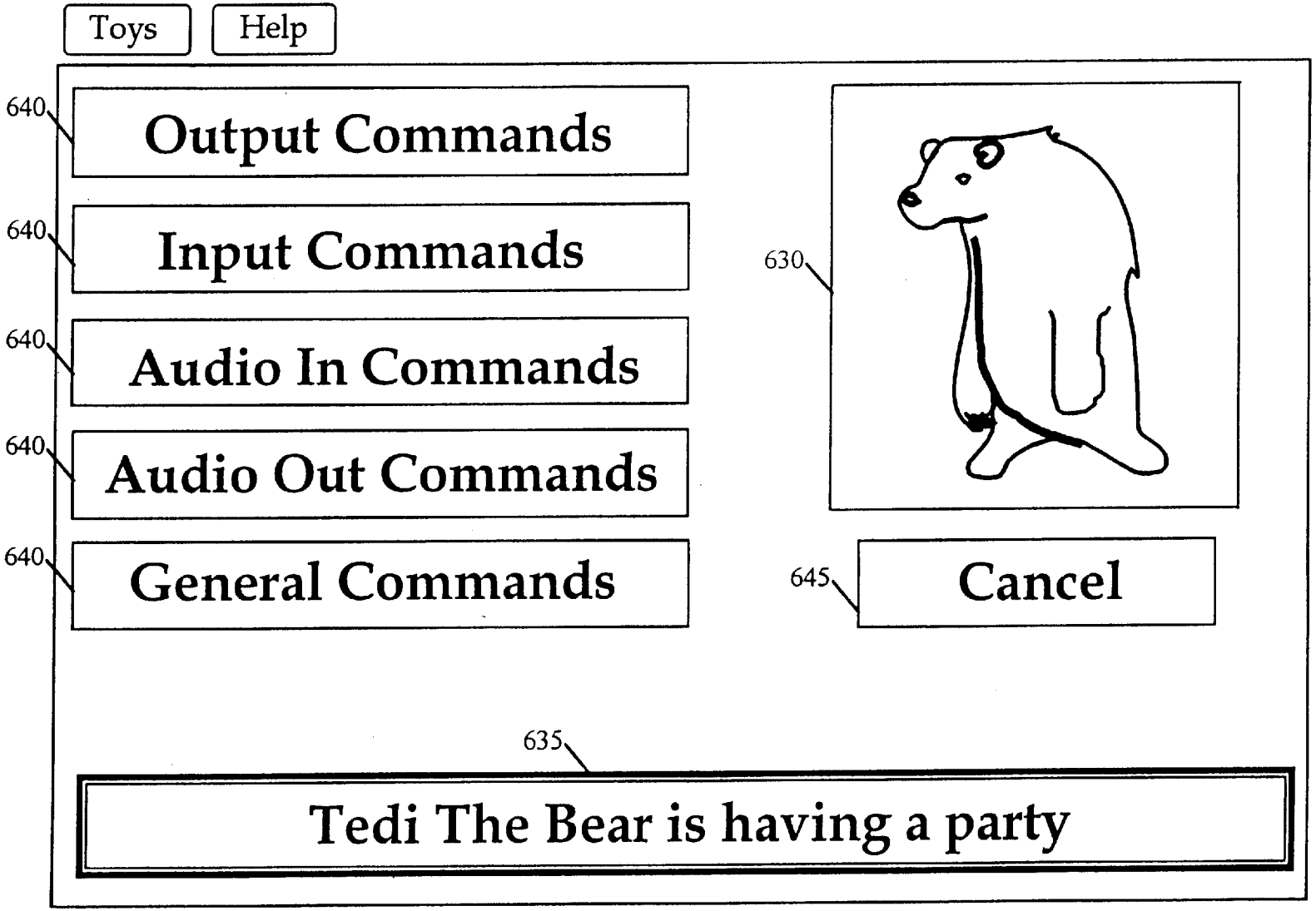
Figure 12C:
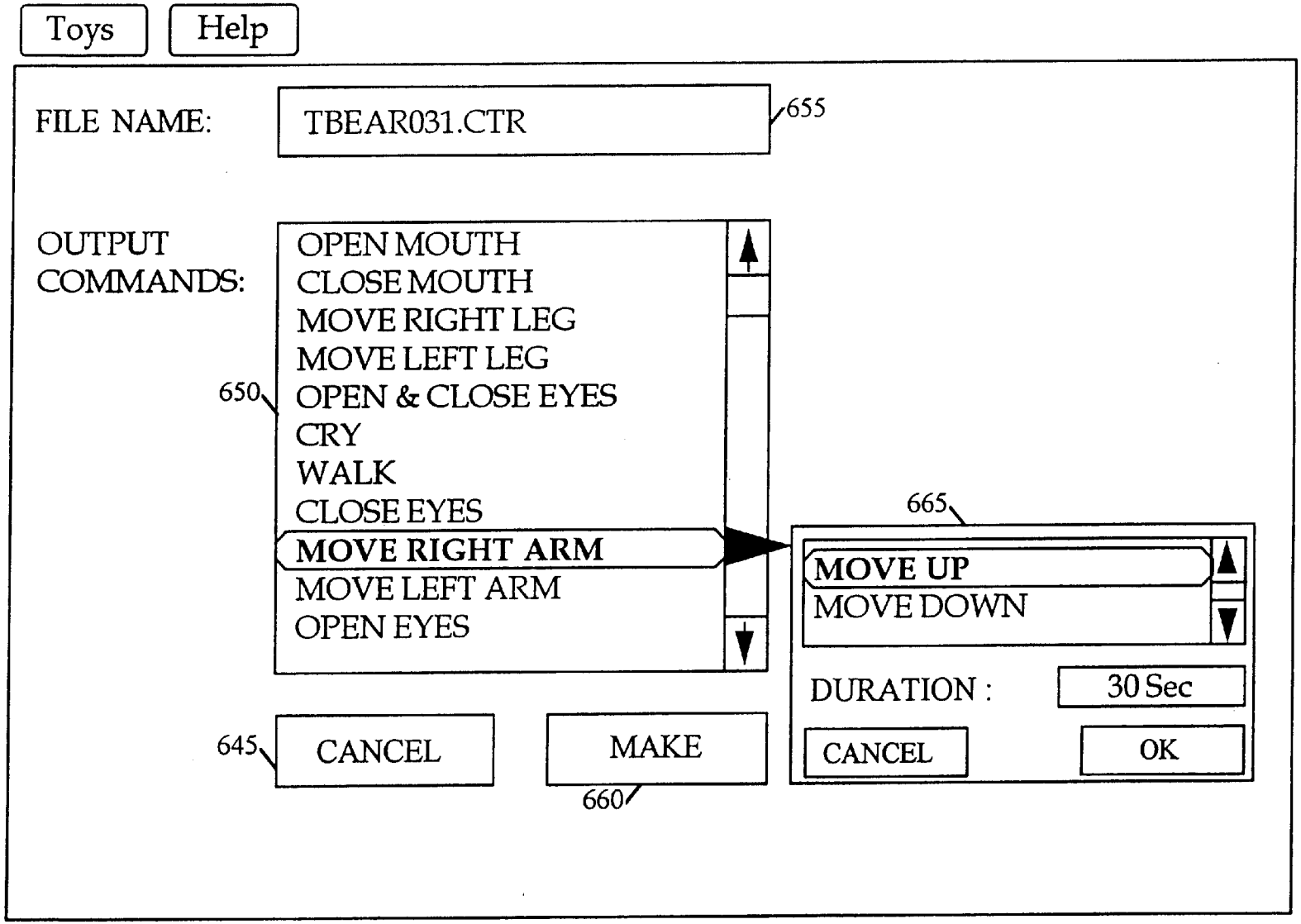

Preferably, a user of the method of FIG. 11 performs steps 550 and 560 using a computer having a graphical user interface. Reference is now made to FIGS. 12A–12C, which are pictorial illustrations of a preferred embodiment of a graphical user interface implementation of the method of FIG. 11.

FIG. 12A comprises a toy selection area 600, comprising a plurality of toy selection icons 610, each depicting a toy. The user of the graphical user interface of FIGS. 12A–12C typically selects one of the toy selection icons 610, indicating that a command is to be specified for the selected toy.

FIG. 12A also typically comprises action buttons 620, typically comprising one or more of the following:

- a button allowing the user, typically an expert user, to enter a direct binary command implementing an advanced or particularly complex command not otherwise available through the graphical user interface of FIGS. 12A–12C;
- a button allowing the user to install a new toy, thus adding a new toy selection icon 610; and
- a button allowing the user to exit the graphical user interface of FIGS. 12A–12C.

FIG. 12B depicts a command generator screen typically displayed after the user has selected one of the toy selection icons 610 of FIG. 12A. FIG. 12B comprises an animation area 630, preferably comprising a depiction of the selected toy selection icon 610, and a text area 635 comprising text describing the selected toy.

FIG. 12B also comprises a plurality of command category buttons 640, each of which allow the user to select a category of commands such as, for example: output commands; input commands; audio in commands; audio out commands; and general commands.

FIG. 12B also comprises a cancel button 645 to cancel command selection and return to the screen of FIG. 12A.

FIG. 12C comprises a command selection area 650, allowing the user to specify a specific command. A wide variety of commands may be specified, and the commands shown in FIG. 12C are shown by way of example only.

FIG. 12C also comprises a file name area 655, in which the user may specify the name of the file which is to receive the generated control instructions. FIG. 12C also comprises a cancel button 645, similar to the cancel button 645 of FIG. 12B. FIG. 12C also comprises a make button 660. When the user actuates the make button 660, the control instruction generator of FIG. 11 generates control instructions implementing the chosen command for the chosen toy, and writes the control instructions to the specified file.

FIG. 12C also comprises a parameter selection area 665, in which the user may specify a parameter associated with the chosen command.

Reference is now made to Appendix A, which is a computer listing of a preferred software implementation of the method of FIGS. 8A–8T.

Appendix A is an INTEL hex format file. The data bytes start from character number 9 in each line. Each byte is represented by 2 characters. The last byte (2 characters) in each line, should be ignored.

For example, for a sample line:

The original line reads—:0700000002010002032032 9F

The data bytes—02010002032032 (02,01,00,02,03,20,32)

Starting address of the data bytes—0000 (00,00)

Appendix A may be programmed into the memory of microcontroller 250 of FIG. 6.

Appendix B is a computer listing of a preferred software implementation of the method of FIGS. 9A–9N, together with the method of FIGS. 8D–8M.

Appendix B is an INTEL hex format file. The data bytes start from character number 9 in each line. Each byte is represented by 2 characters. The last byte (2 characters) in each line, should be ignored.

For example, for a sample line:

The original line reads—:0700000002010002 05A73216

The data bytes—0201000205A732 (02,01,00,02,05,A7,32) Starting address of the data bytes—0000 (00,00) Appendix B may be programmed into the memory of microcontroller 250 of FIG. 4.

Appendix C is a computer listing of a preferred software implementation of an example of a computer game for use in the computer 100 of FIG. 1.

Appendix D is a computer listing of a preferred software implementation of the method of FIG. 11 and FIGS. 12A–12C.

For Appendices C and D, these programs were developed using VISUAL BASIC. To run the programs you need to install the VISUAL BASIC environment first. The application needs a Visual Basic custom control for performing MIDI I/O similar to the one called MIDIVBX.VBX. VISUAL BASIC is manufactured by Microsoft Corporation, One Microsoft Way, Redmond, Wash. 98052-6399, USA. MIDIVBX.VBX is available from Wayne Radinsky, electronic mail address a-wayner@microsoft.com.

The steps for programming the microcontrollers of the present invention include the use of a universal programmer, such as the Universal Programmer, type EXPRO 60/80, manufactured by Sunshine Electronics Co. Ltd., Taipei, Japan.

The method for programming the microcontrollers with the data of Appendices A and B, includes the following steps:

1. Run the program EXPRO.EXE, which is provided with the EXPRO 60/80".
2. Choose from the main menu the EDIT/VIEW option.
3. Choose the EDIT BUFFER option.
4. Enter the string E 0000.
5. Enter the relevant data (given in Appendices A or B), byte after byte, starting from the address 0000. In each line there is a new starting address for each data byte which appears in this line.
6. Press ESC.
7. Enter the letter Q.
8. Choose from the main menu the DEVICE option.
9. Choose the MPU/MCU option.
10. Choose the INTEL option.
11. Choose the 87C51.
11. Choose from the main menu the RUNFUNC option.
12. Choose the PROGRAM option.
13. Place the 87C51 chip in the programmer's socket.
14. Enter Y and wait until the OK message.
15. The chip is now ready to be installed in the board.

The method for creating the relevant files for the computer 100, with the data of Appendices C and D, includes using a HEX EDITOR which is able to edit DOS formatted files. A typical HEX and ASCII editor is manufactured by Martin Doppelbauer, Am Spoerkel 17, 44227 Dortmund, Germany, UET401 at electronic mail address hrz.unidozr.uni-dortmund.de.

The steps necessary for creating the files by means of a HEX editor, such as by the Martin Doppelbauer editor include the following:

1. Copy any DOS file to a new file with the desired name and with the extension .EXE. (For example, write COPY AUTOEXEC.BAT TOY1.EXE).
2. Run the program ME.EXE.
3. From the main menu press the letter L(load file).
4. Write the main menu of the new file (for example TOY1.EXE).
5. From the main menu, press the letter (insert).
6. Enter the relevant data (written in Appendices C or D), byte after byte, starting from the address 0000.
7. Press ESC.
8. From the main menu, enter the letter W(write file).
9. Press the RETURN key and exit from the editor by pressing the letter Q.

It is appreciated that the software components of the present invention may, if desired, be implemented in ROM (read-only memory) form. The software components may, generally, be implemented in hardware, if desired, using conventional techniques.

It is appreciated that the particular embodiment described in the Appendices is intended only to provide an extremely detailed disclosure of the present invention and is not intended to be limiting.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

U 011510-6

Appendix A

69350 U.S. PTO
08/975348
11/20/97

```
:0700000002010002032 0329F
:01000B0032C2
:040013001205793227
:01001B0032B2
:0100230032AA
:01005300327A
:1001000000C2AFC2A8C2AAC28CC28E758125758EEC
:1001100001120831C22574AB120545000012031B01
:10012000120571C2211203660012014F12016D20E7
:1001300093081207290012083100302106001 2012D
:100140008A80D930250280B880E5D2A5C2A722C214
:10015000A5D2A72220A707D2A7740A1208AC223082
:10016000A707C2A7740A1208AC22D2A622C2A622EE
:10017000C2AFC2A8C2AAC2A9C2AB22D2AFD2A8D271
:10018000AAD2A9D2ABD28CD28E22C000C001C002AA
:10019000C2A02021251205761203 1B120366D2B8D5
:1001A000C2A1C221C22078FF79FF7A0A20210BD890
:1001B000FBD9F9DAF71203958017C22100120395D3
:1001C000001202E330200A1206110012074000D28A
:1001D0002000D2A0D2A1C2B8D002D001D00022C04B
:1001E00000C001C002D22020901B78FF79FF7A0264
:1001F00020900AD8FBD9F9DAF7C2208008740112DE
:1002000008AC3090EBD002D001D00022C000C00179
:10021000C002D22030901978FF79FF7A1430900A0A
:10022000D8FBD9F9DAF7C22080061208572090EDE2
:10023000D002D001D00022C000C00131DF30202E1A
:1002400031541203167402 1208AC1202741202B274
:1002500074021208AC781A790AE61202907402123B
:1002600008AC08D9F40012086912031B315F00D0F2
:1002700001D00022C000781ED297120857120857EA
:10028000120857C297120857120857D8EBD000220D
:10029000C0E0C0001202CC78081350051202B580ED
:1002A000031202CCD8F31202B500D000D0E022D263
:1002B0009722C29722C000D2977808120857D8FB1D
:1002C000C2977804120857D8FBD00022C000D297FA
:1002D0007804120857D8FBC2977808120857D8FB41
:1002E000D00022001203A730201778107401F608FE
:1002F000790912043A00302008F608D9F5D2208096
:10030000010000220031 70C297002200C297003124
:100310007B1203660022C297C29122C297D2912219
:10032000209042C0D0C0E0C083C082C28C858C08BF
:10033000858A09758C00758A00D28C90019012050F
:100340002C3023139002581205 2C20230AD50F0DB0
:10035000750F06D2218006750F06C22100D082D00B
:1003600083D0E0D0D032750A00750B00750C007593
:100370000D00758911C2A9C2AB758C00758A00D2B7
```

:100380008C758D00758B00D28ED288D2A8D2AF2208
:10039000D288D2A822C2A822D2A030B2FD220071F7
:1003A00098001203A70022C0007195C2A0C2207558
:1003B0000EFF7832750E00C222C2A2C2A11204FD45
:1003C00030206FD2A2C28C758C00758A00D28C123C
:1003D00004CE30205D85080C85090DC2A21204FDF3
:1003E00030204FC28C758C00758A00D28CD2A290BE
:1003F00003E812052C30233590051412052C202318
:100400002C00850C08850D0990022612052C30233E
:1004100004D2228002C222A22292A1E50E13F50E7E
:10042000B4010D1204CE302009D2208007750EFFD2
:10043000D89DC220D2A000D00022C000C2A0C220FD
:10044000750E007809750E00C222C2A2C2A1120464
:10045000FD302072D2A2C28C758C00758A00D28CBD
:100460001204CE30206085080C85090DC2A212044A
:10047000FD302052C28C758C00758A00D28CD2A2BD
:100480009003E812052C30233D90051412052C2012
:10049000233400850C08850D0990022612052C30A6
:1004A0002304D2228002C222A22292A1E50E13F5D9
:1004B0000EE8B4090320220ED8A61204CE3020067E
:1004C000E50ED2208002C220D2A000D00022C000BF
:1004D000C001C002C220790A78FF30B206D8FBD929
:1004E000F98013C28C858C08858A09D28C7A0A20FF
:1004F000B2E8DAFBD220D002D001D00022C000C086
:1005000001C002C220790A78FF20B206D8FBD9F9CF
:100510008013C28C858C08858A09D28C7A0A30B205
:10052000E8DAFBD220D002D001D00022C223E508B5
:10053000B583028004400D8009E509B5820280027E
:100540004002D22322C000C001C002FA790A74001E
:10055000781AF608D9FC781A7401F608EAF608F653
:1005600008F61208940012074000D002D001D00013
:1005700022D2AAD2AF22C2AA22C0E0C0D0C2A1D247
:10058000A0C29412079030200D001205A100743211
:100590001208AC71900000D294B17100D0D0D0E0BC
:1005A00022C0001205F7007810E6B401467814E680
:1005B000B4000900513700318A008037B4010900C6
:1005C000513700318A00802BB402070012062B003D
:1005D0008021B40307001206A4008017B4040900A8
:1005E000513700318A00800BB40C07001206CB0093
:1005F00080010000D00022C000C001C00278107944
:100600001A7A0AE6F70809DAFA00D002D001D00017
:1006100022C000C001C0027810791A7A0AE6F708F1
:1006200009DAFA00D002D001D00022C0007815E625
:10063000B4001100513700318A30206400314A0083
:100640007116805CB4011900711B00314F316D745B
:10065000641208AC00513700318A302043008040DA
:10066000B4021100513700318A30203400314A0081
:100670007116802CB4031900711B00314F316D7459
:10068000641208AC00513700318A3020130080100A

```
:10069000B4040C00513700318A302004008001007E
:1006A00000D00022C0007815E6B4001A00513700CF
:1006B000318A30201200316A7816E61208CD0031F6
:1006C0006D314F0080010000D00022C0007815E697
:1006D000B4000B314A0074ACB14571168026B401E8
:1006E0000B711B0074ACB145314F8018B40204315A
:1006F000548011B40304315F800AB40F02D2257410
:10070000ABB1450000D00022C000C0017808C2B7DC
:10071000790ED9FE1392B7790DD9FED8F7D2B779F1
:100720000ED9FE00D001D00022781A90090D790A66
:10073000740093F608A3D9F812074000513700223D
:10074000C000C001781A790AE654F003030303F1EC
:1007500008E6540FF10808D9EF007400F10800D042
:1007600001D00022C000C001740078087907D9FECA
:1007700000A2B313B2A0D8028006790CD9FE80F192
:10078000D220791420B304D9FBC220D001D000229A
:10079000C000C001C002C22078107914F16430207A
:1007A00020F608D907D2201207CC8018B2A17AFF10
:1007B00030B304DAFB800A20B3FD007A08DAFE8049
:1007C000DBC2200000D002D001D00022C000C00156
:1007D000C002C003781079107A0AE61207F82323C2
:1007E0002323FB08E61207F84BF70809DAEC00D0E0
:1007F00003D002D001D00022B441004005C3943799
:100800008003C394300022C0D0C0E0D0E0D0D0320A
:10081000C0E0C0F0C0E075F0086A13EA5002641846
:1008200013FAD0E003C0E0D5F0EFD0E0D0F0D0E094
:1008300022C000C001C00278FF79FF7A08D8FED933
:10084000FCDAFAD002D001D0002200000022C00061
:100850007814D8FED00022C000782DD8FED0002217
:10086000C000785ED8FED00022C00078FAD8FED052
:100870000022C000C00178FF7902D8FED9FCD00167
:10088000D00022C000C00178FF7914D8FED9FCD076
:1008900001D00022C000C00178FF79C8D8FED9FC81
:1008A000D001D00022D582FDD583FA22C0E0C0005D
:1008B000F81172D8FCD000D0E022C0E0C000B40033
:1008C000028005F81194D8FCD000D0E022C0E0C02E
:1008D00000B400028005F81131D8FCD000D0E0222D
:1008E000C0E0C000C0F075F014A4F8D8FED0F0D07D
:1008F00000D0E022C000C001C00278FF79FF7A0476
:10090000D8FED9FCDAFAD002D001D0002201AABB6D
:07091000CCDDEEFF0F10111A
:00000001FF
```

U 011510-6

Appendix B

```
:070000000201000205A73216
:01000B0032C2
:0100130032BA
:01001B0032B2
:0100230032AA
:01005300327A
:1001000000C2AFC2A8C2AAC28CC28ED2B875812862
:10011000120169120192120180120 5A2C238C2397D
:10012000D2B1C23778031208DEC2311205ED1201D6
:10013000791201 8074CA1201E90030310FC2310016
:1001400012061C00120221001206170000 3038149B
:10015000E580B4FF02800D1201AF2039051204358D
:100160008002C23820379980D1C2A1C2A2C2A3C2E4
:10017000A422D296C295C2B122C296D295D2B12201
:10018000D2A622C2A622120495303002C2A622C2F2
:10019000A722D2A722C2AFC2A8C2AAC2A9C2AB22BA
:1001A000D2AFD2A8D2AAD2A9D2ABD28CD28E22C040
:1001B00000C0017401781AF6087406F608F608748F
:1001C00005F608740AF6087400F6087914E7F608CC
:1001D00009E7F608E580F6087400F60012086500E5
:1001E0001204C000D001D00022C000C001C002FA39
:1001F0007401781AF6087406F608F6087405F6080D
:10020000740AF6087400F608EAF608F608F67400B0
:1002100008F6120865001204C000D002D001D00018
:1002200022C000A2A6923600120568A23692A6301D
:10023000304D007813E6B405477814E6B4000D009D
:1002400031AF0012028930303600 8032B40107002D
:10025000 12030E008028B4020A0031AF00120342DC
:1002600000801BB4030A0031AF001203ED00800EC2
:10027000B4040A0031AF0012041100800100000034
:100280007801 1208DE00D00022C000C2307815E6E6
:10029000B401137817E61392347816E6540F12025D
:1002A000D530302D802BB40227007817E613923416
:1002B0007816E6540F1202D5303016007818E61280
:1002C000088B007816E6A23592341202D500800120
:1002D0000000D00022D230B4000AA2A19235A2348C
:1002E00092A18029B4010AA2A29235A23492A280DE
:1002F0001CB4020AA2A39235A23492A3800FB403C5
:100300000AA2A49235A23492A48002C23022C00074
:100310007815E6B400060031AF008022B401083140
:10032000AFD238C2398017B4020831AFD238D239CF
:10033000800CB4030831AFC238C23980010000D04C
:100340000022C000C001C0027815E6B400070031E9
:1003500083000203E5B40107003180000203E5B425
:1003600002100031830078 18E6540FD23451D500C2
:100370008073B4031000318000 7818E6540FC23443
```

```
:1003800051D5008060B4045C31807817E612088B88
:100390007816E6540FF9E603030303540FFA318687
:1003A0003030427818E6540FB40F02802FD2345107
:1003B000D500EA1207F6303012E912089EC234E680
:1003C00051D5EA9912089E3180801A12089E318018
:1003D000E99A12089EC234E651D58009EA12089EB5
:1003E000318080010000D002D001D00022C000780E
:1003F00015E6B4000E0031727816E612089E3179C7
:1004000000800AB40106003179008001000 0D000AC
:1004100022C0007815E6B40006003192008012B4C4
:1004200010600318F008009B40F0500D23780012A
:100430000000D00022C000C001C002D23078FF7995
:10044000FF7A1420311BE580B4FF02800AD8F4D96A
:10045000F2DAF0C230800A746412087DE580B4FFDD
:10046000E2D002D001D00022C000C001C002D230D0
:1004700020B31B78FF79FF7A0220B30AD8FBD9F9A1
:10048000DAF7C230800874011208 7D30B3EBD00275
:10049000D001D00022C000C001C002D23030B31958
:1004A00078FF79FF7A2830B30AD8FBD9F9DAF7C296
:1004B000308006120828 20B3EDD002D001D00022EF
:1004C000C000C001916830302A12059D74021208E4
:1004D0007D1204F9120537740212087D781A790A20
:1004E000E6120515740212087D08D9F40012083AC4
:1004F0001205A200D001D00022C000781ED29712AF
:1005000008281208281208 28C2971208281208285A
:10051000D8EBD00022C0E0C0001205517808 13507B
:100520000512053A8003120551D8F312053A00D09E
:1005300000D0E022D29722C29722C000D29778083A
:10054000120828D8FBC2977804120828D8FBD000DC
:1005500022C000D2977804120828D8FBC2977808E6
:10056000120828D8FBD000220012062E303019D2F3
:10057000A678107401F60879091206C10030300817
:10058000F608D9F5D2308001000022003195C297DB
:10059000002200C2970031A01205ED0022C297C2CE
:1005A0009122C297D2912220B342C0D0C0E0C08332
:1005B000C082C28C858C08858A09758C00758A007A
:1005C000D28C9001901207B3303313900258120767
:1005D000B320330AD50F0D750F06D2318006750F83
:1005E00006C23100D082D083D0E0D0D032750A006C
:1005F000750B00750C00750D00758911C2A9C2AB91
:10060000758C00758A00D28C758D00758B00D28E2A
:10061000D288D2A8D2AF22D288D2A822C2A822D20F
:10062000B030B2FD2200D11F0012062E0022C00001
:10063000D11CC2B0C230750EFF7832750E00C232C6
:10064000C2B6C2B112078430306FD2B6C28C758C7C
:1006500000758A00D28C12075530305D85080C85F4
:10066000090DC2B612078430304FC28C758C0075EC
:100670008A00D28CD2B69003E81207B3303335909B
:1006800005141207B320332C00850C08850D099042
```

```
:1006900002261207B3303304D2328002C232A232B1
:1006A00092B1E50E13F50EB4010D12075530300965
:1006B000D2308007750EFFD89DC230D2B000D00076
:1006C00022C000C2B0C230750E007809750E00C29B
:1006D00032C2B6C2B1120784303072D2B6C28C7543
:1006E0008C00758A00D28C12075530306085080C5A
:1006F00085090DC2B6120784303052C28C758C0049
:10070000758A00D28CD2B69003E81207B330333D1D
:10071009005141207B320333400850C08850D09A9
:10072009002261207B3303304D2328002C232A2C2
:100730003292B1E50E13F50EE8B4090320320ED85B
:10074000A6120755303006E50ED2308002C230D2F4
:10075000B000D00022C000C001C002C230790A78C7
:10076000FF30B206D8FBD9F98013C28C858C08857E
:100770008A09D28C7A0A20B2E8DAFBD230D002D0D1
:1007800001D00022C000C001C002C230790A78FF47
:1007900020B206D8FBD9F98013C28C858C08858AD3
:1007A00009D28C7A0A30B2E8DAFBD230D002D0011A
:1007B000D00022C233E508B583028004400D8009D1
:1007C000E509B5820280024002D23322C0D0C0E0E7
:1007D000D0E0D0D032C0E0C0F0C0E075F0086A13BD
:1007E000EA5002641813FAD0E003C0E0D5F0EFD06D
:1007F000E0D0F0D0E022C230B5010280044002D245
:100800003022C000C001C00278FF79FF7A08D8FE0C
:10081000D9FCDAFAD002D001D0002200000022C0B8
:10082000007814D8FED00022C000782DD8FED00069
:1008300022C000785ED8FED00022C00078FAD8FE30
:10084000D00022C000C00178FF7902D8FED9FCD0C8
:1008500001D00022C000C00178FF7914D8FED9FC75
:10086000D001D00022C000C00178FF79C8D8FED9DD
:10087000FCD001D00022D582FDD583FA22C0E0C091
:1008800000F81143D8FCD000D0E022C0E0C000B492
:100890000028005F81165D8FCD000D0E022C0E04D
:1008A000C000B400028005F81102D8FCD000D0E0EE
:1008B00022C0E0C000C0F075F014A4F8D8FED0F05B
:1008C000D000D0E022C000C001C00278FF79FF7ADA
:1008D00004D8FED9FCDAFAD002D001D0002200C040
:1008E000E0C000C2B47450117DD2B47450117DD8F0
:0608F000F2D000D0E0226E
:00000001FF
```

U 011510-6

Appendix C

```
4D 5A 80 01 05 00 00 00 20 00 00 00 FF FF 00 00 00 00 00 00
00 00 00 00 40 00 00 00 01 00 00 00 00 00 00 00 00 00 00 00
00 00 00 00 00 00 00 00 00 00 00 00 00 00 00 00 00 00 00 00
00 06 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 8C D8 33 DB 8E D0 8B E3
53 50 B8 0F 01 50 CB B1 20 B8 01 00 D3 D8 83 F8 01 74 0D BA
1E 03 B4 09 CD 21 B0 01 B4 4C CD 21 B4 30 CD 21 3C 03 73 05
BA 1E 03 EB E9 8E 06 2C 00 33 C0 8B F8 B9 FF FF 26 81 3D 50
41 75 16 26 81 7D 02 54 48 75 0E 26 80 7D 04 3D 75 07 8D 75
05 89 36 9B 03 26 81 3D 77 69 75 1C 26 81 7D 02 6E 64 75 14
26 81 7D 04 69 72 75 0C 26 80 7D 06 3D 75 05 BA 49 03 EB 9E
F2 AE 26 38 05 75 B9 8D 7D 03 89 3E 9D 03 B4 19 CD 21 04 41
BE D8 02 88 04 46 C6 04 3A 46 C6 04 5C 46 B4 47 B2 00 CD 21
8C D8 8E C0 BF D8 02 32 C0 B9 46 00 F2 AE 4F 80 7D FF 5C 74
04 C6 05 5C 47 BE D0 02 8B 0E CE 02 F3 A4 BA D8 02 B8 00 3D
CD 21 72 0F A3 9F 03 EB 48 8C D0 8E D8 BA 1E 03 E9 3B FF 8B
36 9B 03 83 FE FF 74 ED 8E 1E 2C 00 8B FE 80 3C 00 74 E2 AC
3C 3B 74 04 0A C0 75 F7 8B CE 2B CF 83 F9 01 74 E7 8B F7 BF
D8 02 F3 A4 4F 8C D0 8E D8 89 36 9B 03 EB 9C BA 76 03 E9 FD
FE 8E 06 2C 00 8B 3E 9D 03 32 C0 B9 FF FF F2 AE F7 D1 8B D9
8B D1 8C D8 8E C0 BE 81 00 26 8A 4C FF 8A C1 02 C3 3C 7E 77
D2 26 88 44 FF 32 ED 03 F1 8D 38 41 FD F3 A4 FC BF 81 00 26
C6 05 20 47 8B 36 9D 03 8E 1E 2C 00 8B CB 49 F3 A4 BF D8 02
32 C0 B9 FF FF F2 AE F7 D1 8C D8 8E C0 8C D0 8E D8 A1 9D 03
03 C2 2B D1 73 08 24 0F 04 F1 38 C2 72 89 8B 3E 9D 03 BE D8
02 F3 A4 8C D8 8E C0 8B 1E 9F 03 BE 5C 00 C7 04 BC FE C7 44
```

02 FF CD C7 44 04 21 B4 C7 44 06 3E CD C7 44 08 21 E9 C7 44
0A 98 00 B4 3F B9 FF FF BA 00 01 1E 56 CB 08 00 77 69 6E 2E
63 6F 6D 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 54 68 69 73 20 70
72 6F 67 72 61 6D 20 72 65 71 75 69 72 65 73 20 4D 69 63 72
6F 73 6F 66 74 20 57 69 6E 64 6F 77 73 2E 0D 0A 24 59 6F 75
20 61 72 65 20 61 6C 72 65 61 64 79 20 72 75 6E 6E 69 6E 67
20 4D 69 63 72 6F 73 6F 66 74 20 57 69 6E 64 6F 77 73 2E 0D
0A 24 55 6E 61 62 6C 65 20 74 6F 20 73 74 61 72 74 20 4D 69
63 72 6F 73 6F 66 74 20 57 69 6E 64 6F 77 73 2E 0D 0A 24 FF
FF 00 00 00 00 00 00 00 00 00 00 00 00 00 00 00 00 00 00 00
00

00 00 20 00 2C 00 28 00 A3 31 64 98 CA F5 1C 10 8B 7B 9A F8
C4 8E 68 E6 00 00 00 00 41 4E 49 4D 31 00 00 00 00 00 00 00
00 00 00 00 03 00 A2 31 64 98 CA F5 1C 10 8B 7B 9A F8 C4 8E
68 E6 FF FF FF FF 28 00 30 01 5A 00 00 00 00 00 00 00 00 00
00 00 00 00 00 00 00 00 00 00 00 00 00 00 00 00 00 00 00 00
3C 00 6A 00 52 00 D6 00 68 00 DA 00 04 00 9C 00 B6 00 10 00
DE 00 00 00 00 00 00 00 00 00 00 00 00 00 00 00 7A 00 A2 31
64 98 CA F5 1C 10 8B 7B 9A F8 C4 8E 68 E6 95 31 64 98 CA F5
1C 10 8B 7B 9A F8 C4 8E 68 E6 01 00 68 00 6C 00 A1 31 64 98
CA F5 1C 10 8B 7B 9A F8 C4 8E 68 E6 03 00 20 16 89 E9 DA 45
1B 10 B1 76 08 00 2B 33 6F 60 01 00 03 00 3C 00 40 00 E4 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 97 31 64 98 CA F5 1C 10 8B 7B 9A F8 C4 8E 68 E6 FF FF
FF FF 70 00 00 00 00 00 00 00 00 00 00 00 00 00 00 00 00 00
00 00 00 00 00 00 00 00 00 00 00 00 00 00 00 00 00 00 00 00
00 00 00 00 4E 00 E8 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
FF CC 2D 00 02 43 01 00 00 59 00 00 00 00 05 00 46 6F 72 6D
31 00 0D 05 D0 05 00 00 D8 06 00 00 98 13 00 00 24 03 00 00
FF 00 0D 00 43 52 45 41 54 4F 52 20 20 44 45 4D 4F 00 19 01
00 42 00 23 FF FF FF FF 24 05 00 46 6F 72 6D 31 00 35 D0 05
00 00 36 D8 06 00 00 37 98 13 00 00 38 24 03 00 00 FF 01 93
00 00 00 02 05 00 4D 69 64 69 31 00 FF 08 00 56 42 58 2E 4D
49 44 49 00 02 C8 0A 08 07 50 01 50 01 FF 06 00 0B 02 00 0C
02 00 0D 29 00 56 6F 79 65 74 72 61 20 53 75 70 65 72 20 53
61 70 69 20 46 4D 20 44 72 69 76 65 72 7C 53 42 31 36 20 4D
49 44 49 20 49 6E 00 0E 2A 00 56 6F 79 65 74 72 61 20 53 75
70 65 72 20 53 61 70 69 20 46 4D 20 44 72 69 76 65 72 7C 53
42 31 36 20 4D 49 44 49 20 4F 75 74 00 0F 02 00 10 02 00 11
00 00 12 07 00 FF 03 4F 00 00 00 01 06 00 4C 61 62 65 6C 31
00 01 05 E0 04 F0 00 CC 09 20 01 FF 00 11 00 50 4C 45 41 53
45 20 20 54 4F 55 43 48 20 20 4D 45 00 12 00 00 14 02 18 FF
25 01 01 00 04 BC 02 E0 A5 01 00 0D 4D 53 20 53 61 6E 73 20
53 65 72 69 66 FF 02 04 04 00 02 00 2A 00 04 00 00 00 03 01
09 00 01 00 64 00 02 00 0F 00 03 00 00 00 02 00 02 00 02 00
00 00 00 00 95 31 64 98 CA F5 1C 10 8B 7B 9A F8 C4 8E 68 E6
00 00 00 00 00 00 00 00 00 00 00 00 00 00 00 00 00 00 00 00
00 00 00 00 00 00 00 00 00 00 00 00 00 00 00 00 14 00 48 01
00 00 00 00 14 02 64 00 DE 05 56 42 34 45 4E 31 36 2E 44 4C
4C 00 00 00 7E 00 00 00 00 00 00 00 00 00 00 00 00 00 00 00
00 00 14 00 82 00 08 00 08 00 01 00 06 00 01 00 01 00 00 00
00 00 7A 00 9C 00 FF FF 00 00 76 00 6C 00 FF FF 50 41 54 45
4E 54 31 00 50 41 54 45 4E 54 31 00 00 41 4E 49 4D 31 00 00
6C 31 64 98 CA F5 1C 10 8B 7B 9A F8 C4 8E 68 E6 6D 31 64 98
CA F5 1C 10 8B 7B 9A F8 C4 8E 68 E6 6E 31 64 98 CA F5 1C 10

8B 7B 9A F8 C4 8E 68 E6 6F 31 64 98 CA F5 1C 10 8B 7B 9A F8
C4 8E 68 E6 70 31 64 98 CA F5 1C 10 8B 7B 9A F8 C4 8E 68 E6
00 00 09 00 0C 00 56 42 58 2E 4D 49 44 49 00 4D 49 44 49 56
42 58 2E 56 42 58 00 00 02 00 02 00 7E 00 03 00 00 00 02 00
3E 00 02 00 00 00 00 00 00 00 00 00 A1 31 64 98 CA F5 1C 10
8B 7B 9A F8 C4 8E 68 E6 28 00 62 00 01 00 01 00 40 00 05 00
FF FF 02 00 01 00 12 08 10 00 00 00 00 00 00 00 00 00 00 00
15 00 00 00 00 00 00 00 B9 00 40 3D 33 C9 B8 B6 06 BA 0E 02
EA 71 00 71 00 00 00 00 00 00 B9 72 00 3D 33 C9 B8 C0 00 BA
FF FF EA FF FF FF FF 00 00 00 00 00 B9 6A 00 3D 33 C9 B8 58
02 BA 58 00 EA 5B 00 5B 00 00 00 00 00 00 00 00 D7 35 59 3C
06 00 58 00 BC 36 1C 00 90 FF 14 00 00 00 30 31 30 30 30 30
30 35 30 31 30 31 30 30 30 30 30 30 30 30 00 00 7B 41 7C 42
06 00 6C 30 A0 FF 02 00 03 00 06 00 A6 31 11 00 01 00 A5 25
A0 FF A7 14 04 00 20 00 44 00 14 00 00 00 00 00 08 00 00 00
00 00 00 00 0C 00 00 00 01 00 00 00 A0 FF 02 00 70 2D 0E 00
51 1E 7E FF CD 1E 3F 24 8E FF C0 2C 6E FF 70 2D 0E 00 51 1E
4E FF CD 1E 3F 24 5E FF C0 2C 3E FF 37 2D 2E FF 70 2D 0E 00
51 1E 0E FF CD 1E 3F 24 1E FF C0 2C FE FE 37 2D EE FE 70 2D
0E 00 51 1E CE FE CD 1E 3F 24 DE FE C0 2C BE FE 37 2D AE FE
70 2D 0E 00 51 1E 8E FE CD 1E 3F 24 9E FE C0 2C 7E FE 37 2D
6E FE 85 18 34 00 70 2D 0E 00 51 1E 8E FE CD 1E 3F 24 5E FF
C0 2C 6E FE 3F 24 5E FE E0 36 CE FE 00 00 CD 1E C0 2C 7E FE
32 2D AE FE 85 18 0A 00 3F 24 8E FF D5 1B D1 2D 0E 00 A6 3B
06 00 58 00 68 24 5C FE EB 23 5C FE C7 35 14 00 FD 49 4F 18
84 00 70 2D 16 00 51 1E 8E FE A6 3B 06 00 58 00 DF 1B 2C 3C
06 00 40 00 7C 48 D7 35 3F 24 9E FF C7 35 14 00 CC 26 58 FE
40 00 F5 23 54 FE 6F 1E 8E FE EB 23 9E FF DF 1B 2C 3C 06 00
40 00 96 15 EA 3C 6E FE 2E 19 FF FF FF FF 3F 24 6E FE 9D 4C
7E FE D2 1D AB 43 54 FE AE 25 04 00 6E FE 7E FE 3F 24 9E FF
E7 26 58 FE C0 FF 3F 24 54 FE DB 19 08 00 1C 00 00 00 6E 00
D7 35 59 3C 06 00 58 00 A7 14 38 18 28 00 EB 23 5C FE D7 35
C7 35 13 00 C7 4B 4F 18 18 00 70 2D 16 00 51 1E 8E FE A6 3B
06 00 58 00 DF 1B 2C 3C 06 00 40 00 7C 48 A6 3B 06 00 58 00
D7 35 FB 38 59 3C 06 00 58 00 A7 14 18 00 5C 01 78 01 34 00
00 00 00 00 28 00 00 00 08 00 00 00 8E FF 02 00 54 FE 01 00
A0 FF 02 00 DE FE 02 00 1E FF 02 00 5E FF 02 00 5E FE 02 00
9E FE 02 00 2C 00 00 00 09 00 00 00 6E FE 02 00 7E FE 02 00
AE FE 02 00 BE FE 02 00 EE FE 02 00 FE FE 02 00 2E FF 02 00
3E FF 02 00 6E FF 02 00 7D 2D 0A 00 1F 43 AC FF F5 23 AC FF
7C 36 30 00 2B 00 00 00 20 30 20 31 20 30 20 36 20 30 20 36
20 30 20 35 20 30 20 31 30 20 30 20 30 20 30 20 31 20 30 20
31 20 31 35 20 31 31 20 30 20 30 00 DB 49 4F 18 44 00 BC 36
22 00 8C FF 1A 00 00 00 59 4F 55 20 54 4F 55 43 48 20 20 4D
59 20 20 52 49 47 48 54 20 20 48 41 4E 44 00 00 7B 41 7C 42
06 00 6C 30 9C FF 01 00 03 00 06 00 A6 31 00 00 01 00 A5 25
9C FF 38 18 6E 03 F5 23 AC FF 7C 36 30 00 2A 00 00 00 20 30
20 31 20 30 20 36 20 30 20 36 20 30 20 35 20 30 20 31 30 20
30 20 30 20 30 20 31 20 30 20 31 20 31 35 20 37 20 30 20 30

00 00 DB 49 4F 18 42 00 BC 36 20 00 8C FF 19 00 00 00 59 4F
55 20 54 4F 55 43 48 20 20 4D 59 20 20 4C 45 46 54 20 20 48
41 4E 44 00 7B 41 7C 42 06 00 6C 30 9C FF 01 00 03 00 06 00
A6 31 00 00 01 00 A5 25 9C FF 38 18 EE 02 F5 23 AC FF 7C 36
30 00 2B 00 00 00 20 30 20 31 20 30 20 36 20 30 20 36 20 30
20 35 20 30 20 31 30 20 30 20 30 20 30 20 31 20 30 20 31 20
31 35 20 31 34 20 30 20 30 00 DB 49 4F 18 42 00 BC 36 20 00
8C FF 19 00 00 00 59 4F 55 20 54 4F 55 43 48 20 20 4D 59 20
20 52 49 47 48 54 20 20 4C 45 47 00 7B 41 7C 42 06 00 6C 30
9C FF 01 00 03 00 06 00 A6 31 00 00 01 00 A5 25 9C FF 38 18
6E 02 F5 23 AC FF 7C 36 30 00 2B 00 00 00 20 30 20 31 20 30
20 36 20 30 20 36 20 30 20 35 20 30 20 31 30 20 30 20 30 20
30 20 31 20 30 20 31 20 31 35 20 31 33 20 30 20 30 00 DB 49
4F 18 40 00 BC 36 1E 00 8C FF 17 00 00 00 59 4F 55 20 54 4F
55 43 48 20 20 4D 59 20 4C 45 46 54 20 20 4C 45 47 00 7B 41
7C 42 06 00 6C 30 9C FF 01 00 03 00 06 00 A6 31 00 00 01 00
A5 25 9C FF 38 18 F0 01 F5 23 AC FF 7C 36 30 00 2B 00 00 00
20 30 20 31 20 30 20 36 20 30 20 36 20 30 20 35 20 30 20 31
30 20 30 20 30 20 30 20 31 20 30 20 31 20 31 33 20 31 35 20
30 20 30 00 DB 49 4F 18 42 00 BC 36 20 00 8C FF 19 00 00 00
59 4F 55 20 54 4F 55 43 48 20 20 4D 59 20 20 52 49 47 48 54
20 20 45 41 52 00 7B 41 7C 42 06 00 6C 30 9C FF 01 00 03 00
06 00 A6 31 00 00 01 00 A5 25 9C FF 38 18 70 01 F5 23 AC FF
7C 36 30 00 2B 00 00 00 20 30 20 31 20 30 20 36 20 30 20 36
20 30 20 35 20 30 20 31 30 20 30 20 30 20 30 20 30 20 31 20 30 20
31 20 31 34 20 31 35 20 30 20 30 00 DB 49 4F 18 40 00 BC 36
1E 00 8C FF 17 00 00 00 59 4F 55 20 54 4F 55 43 48 20 20 4D
59 20 4C 45 46 54 20 20 45 41 52 00 7B 41 7C 42 06 00 6C 30
9C FF 01 00 03 00 06 00 A6 31 00 00 01 00 A5 25 9C FF 38 18
F2 00 F5 23 AC FF 7C 36 30 00 2A 00 00 00 20 30 20 31 20 30
20 36 20 30 20 36 20 30 20 35 20 30 20 31 30 20 30 20 30 20
30 20 31 20 30 20 31 20 37 20 31 35 20 30 20 30 00 00 DB 49
4F 18 3C 00 BC 36 1A 00 8C FF 13 00 00 00 59 4F 55 20 54 4F
55 43 48 20 20 4D 59 20 4D 4F 55 54 48 00 7B 41 7C 42 06 00
6C 30 9C FF 01 00 03 00 06 00 A6 31 00 00 01 00 A5 25 9C FF
38 18 78 00 F5 23 AC FF 7C 36 30 00 2B 00 00 00 20 30 20 31
20 30 20 36 20 30 20 36 20 30 20 35 20 30 20 31 30 20 30 20
30 20 30 20 31 20 30 20 31 20 31 31 20 31 35 20 30 20 30 00
DB 49 4F 18 3A 00 BC 36 1C 00 8C FF 15 00 00 00 59 4F 55 20
54 4F 55 43 48 20 20 4D 59 20 46 4F 52 48 45 41 44 00 7B 41
7C 42 06 00 6C 30 9C FF 01 00 03 00 06 00 A6 31 00 00 01 00
A5 25 9C FF CB 25 AC FF A7 14 08 00 24 00 FE 03 18 00 00 00
00 00 0C 00 00 00 01 00 00 00 AC FF 01 00 0C 00 00 00 01 00
00 00 9C FF 02 00 00 00 03 00 03 01 DE 01 01 00 65 02 02 00
42 00 04 00 00 00 03 01 45 00 01 00 C7 00 00 00 00 00 00 00
00 00 00 00 30 01 34 00 56 53 5F 56 45 52 53 49 4F 4E 5F 49
4E 46 4F 00 BD 04 EF FE 00 00 01 00 00 00 01 00 00 00 00 00
00 00 01 00 00 00 00 00 00 00 00 00 00 00 00 00 01 00 01 00
01 00 00 00 00 00 00 00 00 00 00 00 00 00 00 00 24 00 00 00

56 61 72 46 69 6C 65 49 6E 66 6F 00 14 00 04 00 54 72 61 6E
73 6C 61 74 69 6F 6E 00 09 08 E4 04 C4 00 00 00 53 74 72 69
6E 67 46 69 6C 65 49 6E 66 6F 00 00 B0 00 00 00 30 38 30 39
30 34 45 34 00 00 00 00 14 00 02 00 43 6F 6D 70 61 6E 79 4E
61 6D 65 00 20 00 00 00 18 00 08 00 50 72 6F 64 75 63 74 4E
61 6D 65 00 50 41 54 45 4E 54 31 00 18 00 05 00 46 69 6C 65
56 65 72 73 69 6F 6E 00 31 2E 30 30 00 00 00 00 1C 00 05 00
50 72 6F 64 75 63 74 56 65 72 73 69 6F 6E 00 00 31 2E 30 30
00 00 00 00 1C 00 08 00 49 6E 74 65 72 6E 61 6C 4E 61 6D 65
00 00 00 00 50 41 54 45 4E 54 31 00 24 00 0C 00 4F 72 69 67
69 6E 61 6C 46 69 6C 65 6E 61 6D 65 00 00 00 00 50 41 54 45
4E 54 31 2E 45 58 45 00 00 00 01 00 02 00 20 20 02 00 01 00
01 00 30 01 00 00 31 75 20 20 10 00 01 00 04 00 E8 02 00 00
32 75 00 00 00 00 00 00 00 00 00 00 00 00 00 00 28 00 00 00
20 00 00 00 40 00 00 00 01 00 04 00 00 00 00 00 00 80 02 00 00
00 00 00 00 00 00 00 00 00 00 00 00 00 00 00 00 00 00 00 00 00
00 00 80 00 00 80 00 00 00 80 80 00 80 00 00 00 80 00 80 00
80 80 00 00 80 80 80 00 C0 C0 C0 00 00 00 FF 00 00 FF 00 00
00 FF FF 00 FF 00 00 00 FF 00 FF 00 FF FF 00 00 FF FF FF 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 8F FF 07 70 00 00 00 00 00 00 00 00 00 00 8F
FF FF FF 07 77 70 00 00 00 00 00 00 08 FF FF FF FF FF FF 07
77 77 70 00 00 00 00 FF FF FF FF FF FF FF FF 07 77 70 00 00
00 00 00 FF FF FF FF FF FF FF FF 07 70 00 00 00 00 00 00 FF
FF FF FF FF FF FF FF 00 00 00 00 00 00 00 00 FF FF FF FF FF
FF FF FF 00 00 00 00 00 00 00 00 FF FF FF FF FF FF FF FF 00
00 00 00 00 00 00 00 FF FF FF FF FF FF FF FF 00 00 00 00 00
00 00 00 FF FF FF FF FF FF FF FF 00 00 00 00 00 00 00 00 FF
FF FF FF FF FF FF FF 00 00 00 00 00 00 00 00 FF FF FF FF FF
FF FF FF 00 00 00 00 00 00 00 00 FF FF FF FF FF FF 88 88 00
00 00 00 00 00 00 00 FF FF FF FF 88 88 00 00 00 00 00 00 00
00 00 00 FF FF 88 88 00 00 EE EE 00 00 00 00 00 00 00 00 88
88 00 00 EE EE 00 00 00 00 00 00 00 00 00 00 00 00 EE EE 00
00 00 00 00 00 00 00 00 00 00 00 EE EE 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 FF FF FF FF FF FF FF FF
FF FF FF FF FF FF FF FF FF FF FF FF FF FF C1 FF FF FC 00 7F
FF 80 00 1F F8 00 00 07 F8 00 00 1F F8 00 00 7F F8 00 01 FF
F8 00 01 FF F8 00 01 FF F8 00 01 FF F8 00 01 FF F8 00 01 FF
F8 00 01 FF F8 00 01 FF F8 00 01 FF F8 00 01 FF F8 00 01 FF

F8 00 3F FF F8 03 FF FF F8 3F FF FF FB FF FF FF FF FF FF FF
FF FF FF FF FF FF FF FF FF FF FF FF FF FF FF FF FF FF FF FF
00 00 00 00 00 00 00 00 28 00 00 00 20 00 00 00 40 00 00 00
01 00 01 00 00 00 00 00 00 01 00 00 00 00 00 00 00 00 00 00
00 00 00 00 00 00 00 00 00 00 00 00 FF FF FF 00 FF FF FF FF
FF FF FF FF FF FF FF FF FF FF FF FF FF FF FF FF FF FF C1 FF
FF FC 3C 7F FF C3 FC 1F F8 3F FC 07 FB FF FC 1F FB FF FC 7F
FB FF FD FF FB FF FD FF FB FF FD FF FB FF FD FF FB FF FD FF
FB FF FD FF FB FF FD FF FB FF FD FF FB FF C1 FF FB FC 3D FF
FB C3 C1 FF F8 3C 3F FF FB C3 FF FF F8 3F FF FF FB FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF C1 FF FF FC 00 7F FF C0 00 1F F8 00 00 07
F8 00 00 1F F8 00 00 7F F8 00 01 FF F8 00 01 FF F8 00 01 FF
F8 00 01 FF F8 00 01 FF F8 00 01 FF F8 00 01 FF F8 00 01 FF
F8 00 01 FF F8 00 01 FF F8 00 3F FF F8 03 FF FF
F8 3F FF FF FB FF FF FF FF FF FF FF FF FF FF FF FF FF FF FF
FF FF FF FF FF FF FF FF FF FF FF FF 10 00 00 00 A1 31 64 98
CA F5 1C 10 8B 7B 9A F8 C4 8E 68 E6 00 00 00 00 00 00 00 00
00 00 00 00 53 4C 54 47 03 00 09 00 18 00 01 00 FF 04 02 00
00 00 00 00 C0 00 00 00 00 00 00 46 34 00 00 00 00 00 FF FF
DD 00 00 00 0D 00 02 00 36 04 00 00 09 00 00 00 01 43 6F 6D
70 4F 62 6A 00 64 69 72 00 31 31 62 34 34 32 61 63 37 33 00
00 00 00 00 00 00 00 00 00 01 05 22 00 00 00 FF FF FF FF 84
00 00 00 FF FF FF FF 01 00 00 00 00 00 FC FF 82 00 02 03 28
00 00 00 DF 00 FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF 08 00 00 00 01 00 02 80 FF
FF 0A 00 FF FF 01 00 00 00 00 08 00 2A 5C 52 61 38 2A 23 34
DF 05 00 FF FF 01 1A 00 00 00 4A 00 FF FF FF FF 00 80 12 00
00 00 02 40 FE FF FF FF 1D 00 00 00 FF FF FF FF 00 00 00 00
01 00 00 00 FF FF FF FF 00 00 FF FF FF FF 00 00 FF FF FF FF
00 00 00 00 01 00 00 00 04 00 01 00 00 00 00 00 1C 00 FF FF
FF FF FF FF FF FF 01 00 16 00 CC 51 04 00 00 00 FF FF FF FF
FF FF 00 00 00 00 00 00 09 04 00 00 01 00 00 00 01 00 00 00
00 00 00 00 00 00 00 00 00 00 00 00 00 00 00 FF FF FF FF
FF FF FF FF FF FF FF FF FF FF FF FF FF FF FF FF FF FF FF FF
FF FF FF FF FF FF FF FF FF FF FF FF 00 00 FF FF FF FF FF FF
FF FF FF FF FF FF FF FF FF FF FF FF FF FF FF FF FF FF FF FF
01 00 0A 00 31 31 62 34 34 32 61 63 37 33 0A 00 31 30 62 34
34 32 61 63 37 33 FF FF 0E 00 00 00 FF FF 00 00 00 00 FF FF
A1 31 64 98 CA F5 1C 10 8B 7B 9A F8 C4 8E 68 E6 04 00 B2 00
00 00 00 00 00 00 00 00 00 02 01 20 02 00 00 FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF A8
00 FF FF FF FF FF FF FF FF FF FF FF FF FF FF FF FF FF FF FF

FF FF FF FF FF FF FF FF FF FF FF FF FF FF FF FF FF FF FF FF
FF FF FF FF FF FF FF FF FF 00 00 FF FF FF FF FF FF FF FF FF
FF FF FF FF FF FF FF FF FF FF FF FF FF FF FF FF FF FF FF FF
FF FF FF FF FF FF FF FF FF 60 00 FF FF FF FF FF FF FF FF FF
FF FF FF FF FF FF FF FF FF FF FF FF FF FF FF 1C 00 FF FF FF
FF 36 00 FF FF FF FF FF FF FF FF FF FF FF FF FF FF 98 00 FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF 0E 00 FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF 88 00 FF
FF FF FF FF FF FF FF FF FF FF FF FF FF FF FF 70 00 FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF 4A 00 FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF 20 00 FF FF 05 00 00 00 05 07 A7 3D 05
00 00 00 05 07 A4 3D 05 00 00 00 05 07 9E 3D 05 00 00 00 00
00 FF FF 01 0C 01 00 00 43 4C FF FF FF FF C0 FF 41 4E 49 4D
31 00 86 1B FF FF FF FF E2 FF 46 6F 72 6D 31 00 64 6D FF FF
FF FF 20 00 47 65 74 54 79 70 65 49 6E 66 6F 43 6F 75 6E 74
00 00 67 50 FF FF FF FF 20 00 47 65 74 54 79 70 65 49 6E 66
6F 00 D5 11 FF FF FF FF 20 00 47 65 74 49 44 73 4F 66 4E 61
6D 65 73 00 57 F8 FF FF FF FF 20 00 49 6E 76 6F 6B 65 00 07
BE 8E FF FF FF FF 20 00 51 75 65 72 79 49 6E 74 65 72 66 61
63 65 00 0A B5 B8 FF FF FF FF 20 00 41 64 64 52 65 66 00 FF
6F 61 FF FF FF FF 20 00 52 65 6C 65 61 73 65 00 2A 60 FF FF
FF FF C0 FF 2A 5C 47 7B 30 30 30 32 30 34 33 30 2D 30 30 30
30 2D 30 30 30 30 2D 43 30 30 30 2D 30 30 30 30 30 30 30 30
30 30 34 36 7D 23 31 2E 30 23 30 23 43 3A 5C 57 49 4E 44 4F
57 53 5C 53 59 53 54 45 4D 5C 73 74 64 6F 6C 65 2E 74 6C 62
23 4F 4C 45 20 41 75 74 6F 6D 61 74 69 6F 6E 00 01 0C 00 01
20 00 00 00 0F 00 00 00 FF FF FF FF FF FF FF FF 14 00 FF FF
05 07 94 40 05 00 00 00 05 07 8D 40 05 00 00 00 01 00 FF FF
02 00 00 00 01 00 12 00 00 00 00 00 00 00 00 00 20 40 00 00
A0 00 90 80 00 00 01 00 01 00 FE FF 03 0A 00 00 FF FF FF FF
FF 04 02 00 00 00 00 00 C0 00 00 00 00 00 00 46 08 00 00 00
54 59 50 45 4C 49 42 00 FF FF FF FF 00 02 00 00 00 00 00 00
00 00 00 00

U 011510-6

Appendix I

69360 U.S. PTO
08/915348
11/20/97

4D 5A 80 01 05 00 00 00 20 00 00 00 FF FF 00 00 00 00 00 00
00 00 00 00 40 00 00 00 01 00 00 00 00 00 00 00 00 00 00 00
00 00 00 00 00 00 00 00 00 00 00 00 00 00 00 00 00 00 00 00
00 06 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 8C D8 33 DB 8E D0 8B E3
53 50 B8 0F 01 50 CB B1 20 B8 01 00 D3 D8 83 F8 01 74 0D BA
1E 03 B4 09 CD 21 B0 01 B4 4C CD 21 B4 30 CD 21 3C 03 73 05
BA 1E 03 EB E9 8E 06 2C 00 33 C0 8B F8 B9 FF FF 26 81 3D 50
41 75 16 26 81 7D 02 54 48 75 0E 26 80 7D 04 3D 75 07 8D 75
05 89 36 9B 03 26 81 3D 77 69 75 1C 26 81 7D 02 6E 64 75 14
26 81 7D 04 69 72 75 0C 26 80 7D 06 3D 75 05 BA 49 03 EB 9E
F2 AE 26 38 05 75 B9 8D 7D 03 89 3E 9D 03 B4 19 CD 21 04 41
BE D8 02 88 04 46 C6 04 3A 46 C6 04 5C 46 B4 47 B2 00 CD 21
8C D8 8E C0 BF D8 02 32 C0 B9 46 00 F2 AE 4F 80 7D FF 5C 74
04 C6 05 5C 47 BE D0 02 8B 0E CE 02 F3 A4 BA D8 02 B8 00 3D
CD 21 72 0F A3 9F 03 EB 48 8C D0 8E D8 BA 1E 03 E9 3B FF 8B
36 9B 03 83 FE FF 74 ED 8E 1E 2C 00 8B FE 80 3C 00 74 E2 AC
3C 3B 74 04 0A C0 75 F7 8B CE 2B CF 83 F9 01 74 E7 8B F7 BF
D8 02 F3 A4 4F 8C D0 8E D8 89 36 9B 03 EB 9C BA 76 03 E9 FD
FE 8E 06 2C 00 8B 3E 9D 03 32 C0 B9 FF FF F2 AE F7 D1 8B D9
8B D1 8C D8 8E C0 BE 81 00 26 8A 4C FF 8A C1 02 C3 3C 7E 77
D2 26 88 44 FF 32 ED 03 F1 8D 38 41 FD F3 A4 FC BF 81 00 26
C6 05 20 47 8B 36 9D 03 8E 1E 2C 00 8B CB 49 F3 A4 BF D8 02
32 C0 B9 FF FF F2 AE F7 D1 8C D8 8E C0 8C D0 8E D8 A1 9D 03
03 C2 2B D1 73 08 24 0F 04 F1 38 C2 72 89 8B 3E 9D 03 BE D8

EI 5.2.8.0 3.7 4.3 2 US

02 F3 A4 8C D8 8E C0 8B 1E 9F 03 BE 5C 00 C7 04 BC FE C7 44
02 FF CD C7 44 04 21 B4 C7 44 06 3E CD C7 44 08 21 E9 C7 44
0A 98 00 B4 3F B9 FF FF BA 00 01 1E 56 CB 08 00 77 69 6E 2E
63 6F 6D 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 54 68 69 73 20 70
72 6F 67 72 61 6D 20 72 65 71 75 69 72 65 73 20 4D 69 63 72
6F 73 6F 66 74 20 57 69 6E 64 6F 77 73 2E 0D 0A 24 59 6F 75
20 61 72 65 20 61 6C 72 65 61 64 79 20 72 75 6E 6E 69 6E 67
20 4D 69 63 72 6F 73 6F 66 74 20 57 69 6E 64 6F 77 73 2E 0D
0A 24 55 6E 61 62 6C 65 20 74 6F 20 73 74 61 72 74 20 4D 69
63 72 6F 73 6F 66 74 20 57 69 6E 64 6F 77 73 2E 0D 0A 24 FF
FF 00 00 00 00 00 00 00 00 00 00 00 00 00 00 00 00 00 00 00
00

00 00 00 00 09 04 00 00 0E 00 00 00 01 00 02 00 00 00 42 00
0C 00 4A 00 10 00 FF FF 04 00 0E 00 02 00 00 00 00 00 00 00
00 00 00 00 01 00 95 4D 03 00 E4 CA 75 1A A3 F5 1C 10 8B 7B
9A F8 C4 8E 68 E6 0C 00 03 00 10 00 84 08 3E 00 00 00 00 00
00 00 00 00 00 00 00 00 12 03 46 00 00 00 01 00 00 00 20 00
2C 00 28 00 69 CB 75 1A A3 F5 1C 10 8B 7B 9A F8 C4 8E 68 E6
00 00 00 00 42 49 4E 31 00 00 00 00 00 00 00 00 00 00 00 00
1A 00 BC 07 76 00 A4 00 86 00 00 00 00 00 00 00 00 00 06 00
00 00 00 00 42 01 66 CB 75 1A A3 F5 1C 10 8B 7B 9A F8 C4 8E
68 E6 5F CB 75 1A A3 F5 1C 10 8B 7B 9A F8 C4 8E 68 E6 01 00
68 00 6C 00 65 CB 75 1A A3 F5 1C 10 8B 7B 9A F8 C4 8E 68 E6
03 00 68 CB 75 1A A3 F5 1C 10 8B 7B 9A F8 C4 8E 68 E6 FF FF
FF FF 34 00 A0 03 BC 00 00 00 00 00 00 00 00 00 00 00 00 00
00 00 00 00 00 00 00 00 00 00 00 00 00 00 00 00 94 01 C0 00
AA 01 42 01 C0 01 46 01 D6 01 4A 01 EC 01 4E 01 02 02 52 01
07 00 08 01 22 01 00 00 56 01 00 00 00 00 00 00 00 00 0A 00
00 00 04 00 64 00 68 CB 75 1A A3 F5 1C 10 8B 7B 9A F8 C4 8E
68 E6 62 CB 75 1A A3 F5 1C 10 8B 7B 9A F8 C4 8E 68 E6 01 00
68 00 6C 00 67 CB 75 1A A3 F5 1C 10 8B 7B 9A F8 C4 8E 68 E6
03 00 2F 16 89 E9 DA 45 1B 10 B1 76 08 00 2B 33 6F 60 0E 00
03 00 38 00 A4 04 5C 01 00 00 00 00 00 00 00 00 00 00 00 00
28 03 60 01 00 00 00 00 00 00 00 00 00 00 00 00 00 00 00 00
00 00 00 00 00 00 00 00 00 00 00 00 00 00 00 00 00 00 00 00
00 00 00 00 03 00 2F 16 89 E9 DA 45 1B 10 B1 76 08 00 2B 33
6F 60 0D 00 03 00 38 00 A8 01 C2 01 00 00 00 00 00 00 00 00
00 00 00 00 A4 02 D2 01 00 00 00 00 00 00 00 00 00 00 00 00
00 00 00 00 00 00 00 00 00 00 00 00 00 00 00 00 00 00 00 00
00 00 00 00 00 00 00 00 03 00 2F 16 89 E9 DA 45 1B 10 B1 76
08 00 2B 33 6F 60 03 00 03 00 38 00 FC 0C 16 02 00 00 00 00
00 00 00 00 00 00 00 00 90 01 26 02 00 00 00 00 00 00 00 00
00 00 00 00 00 00 00 00 00 00 00 00 00 00 00 00 00 00 00 00
00 00 00 00 00 00 00 00 00 00 00 00 03 00 2F 16 89 E9 DA 45
1B 10 B1 76 08 00 2B 33 6F 60 02 00 03 00 38 00 FC 01 6A 02
00 00 00 00 00 00 00 00 00 00 00 00 BA 02 7A 02 00 00 00 00
00 00 00 00 00 00 00 00 00 00 00 00 00 00 00 00 00 00 00 00
00 00 00 00 00 00 00 00 00 00 00 00 00 00 00 03 00 2F 16
89 E9 DA 45 1B 10 B1 76 08 00 2B 33 6F 60 01 00 03 00 38 00
A4 02 BE 02 00 00 00 00 00 00 00 00 00 00 00 D0 02 CE 02
00 00 00 00 00 00 00 00 00 00 00 00 00 00 00 00 00 00 00 00
00 00 00 00 00 00 00 00 00 00 00 00 00 00 00 00 00 00 00 00
03 00 2F 16 89 E9 DA 45 1B 10 B1 76 08 00 2B 33 6F 60 02 00
03 00 38 00 50 02 12 03 00 00 00 00 00 00 00 00 00 00 00 00
A6 01 22 03 00 00 00 00 00 00 00 00 00 00 00 00 00 00 00 00
00 00 00 00 00 00 00 00 00 00 00 00 00 00 00 00 00 00 00 00
00 00 00 00 03 00 2F 16 89 E9 DA 45 1B 10 B1 76 08 00 2B 33
6F 60 01 00 03 00 38 00 4C 03 66 03 00 00 00 00 00 00 00 00
00 00 00 00 BC 01 76 03 00 00 00 00 00 00 00 00 00 00 00 00
00 00 00 00 00 00 00 00 00 00 00 00 00 00 00 00 00 00 00 00
00 00 00 00 00 00 00 00 03 00 20 16 89 E9 DA 45 1B 10 B1 76

08 00 2B 33 6F 60 11 00 03 00 3C 00 4C 04 BA 03 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 03 00 20 16
89 E9 DA 45 1B 10 B1 76 08 00 2B 33 6F 60 0F 00 03 00 3C 00
F8 02 0E 04 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 20 16 89 E9 DA 45 1B 10 B1 76 08 00 2B 33
6F 60 16 00 03 00 3C 00 64 07 66 04 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 43 16 89 E9 DA 45
1B 10 B1 76 08 00 2B 33 6F 60 04 00 03 00 3C 00 E4 0B BE 04
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 20 16 89 E9 DA 45 1B 10 B1 76 08 00 2B 33 6F 60 15 00
03 00 3C 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 03 00 20 16 89 E9 DA 45 1B 10 B1 76
08 00 2B 33 6F 60 14 00 03 00 3C 00 54 05 16 05 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 03 00 20 16
89 E9 DA 45 1B 10 B1 76 08 00 2B 33 6F 60 13 00 03 00 3C 00
AC 05 C6 05 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 20 16 89 E9 DA 45 1B 10 B1 76 08 00 2B 33
6F 60 12 00 03 00 3C 00 04 06 1E 06 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 20 16 89 E9 DA 45
1B 10 B1 76 08 00 2B 33 6F 60 10 00 03 00 3C 00 5C 06 76 06
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 20 16 89 E9 DA 45 1B 10 B1 76 08 00 2B 33 6F 60 18 00
03 00 3C 00 B4 06 CE 06 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 03 00 20 16 89 E9 DA 45 1B 10 B1 76
08 00 2B 33 6F 60 17 00 03 00 3C 00 0C 07 26 07 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 03 00 66 CB
75 1A A3 F5 1C 10 8B 7B 9A F8 C4 8E 68 E6 FF FF FF FF 40 00

70 0C 7E 07 00 00 00 00 00 00 00 00 00 00 00 00 00 00 00 00
00 00 00 00 00 00 00 00 00 00 00 00 42 03 CA 03 58 03 F6 07
A8 02 FA 07 BE 02 FE 07 D4 02 02 08 EA 02 06 08 00 03 0A 08
16 03 0E 08 2C 03 12 08 03 00 25 16 89 E9 DA 45 1B 10 B1 76
08 00 2B 33 6F 60 0A 00 03 00 50 00 C8 09 D6 07 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 03 00 25 16
89 E9 DA 45 1B 10 B1 76 08 00 2B 33 6F 60 08 00 03 00 50 00
18 08 32 08 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 25 16 89 E9 DA 45 1B 10 B1 76 08 00 2B 33
6F 60 0B 00 03 00 50 00 5C 00 9E 08 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 25 16 89 E9 DA 45
1B 10 B1 76 08 00 2B 33 6F 60 07 00 03 00 50 00 34 0A 0A 09
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 25 16 89 E9 DA 45 1B 10 B1 76 08 00 2B 33 6F 60 09 00
03 00 50 00 5C 09 76 09 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 03 00 25 16 89 E9 DA 45 1B 10 B1 76
08 00 2B 33 6F 60 06 00 03 00 50 00 78 0B E2 09 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 03 00 25 16
89 E9 DA 45 1B 10 B1 76 08 00 2B 33 6F 60 03 00 03 00 50 00
F4 03 4E 0A 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 25 16 89 E9 DA 45 1B 10 B1 76 08 00 2B 33
6F 60 04 00 03 00 50 00 A0 0A BA 0A 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 25 16 89 E9 DA 45
1B 10 B1 76 08 00 2B 33 6F 60 05 00 03 00 50 00 0C 0B 26 0B
00 00 00 00 00 00 00 00 00 00 00 00 00 00 00 00 00 00 00 00

00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 64 CB 75 1A A3 F5 1C 10 8B 7B 9A F8 C4 8E 68 E6 FF FF
FF FF 70 00 00 00 00 00 00 00 00 00 00 00 00 00 00 00 00 00
00 00 00 00 00 00 00 00 00 00 00 00 00 00 00 00 00 00 00 00
00 00 00 00 D2 01 16 08 00 00 00 00 E8 01 26 0C 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 61 CB 75 1A A3 F5 1C 10 8B 7B 9A F8 C4 8E 68 E6 FF FF
FF FF 70 00 F0 08 92 0B 00 00 00 00 00 00 00 00 00 00 00 00
00 00 00 00 00 00 00 00 00 00 00 00 00 00 00 00 00 00 00 00
00 00 00 00 E6 02 2E 0C 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 5D CB 75 1A A3 F5 1C 10 8B 7B 9A F8 C4 8E 68 E6 05 00
03 00 C4 00 FC 04 8A 0C 00 00 00 00 00 00 00 00 00 00 00 00
00 00 00 00 00 00 00 00 00 00 00 00 00 00 00 00 00 00 00 00
00 00 00 00 00 00 00 00 00 00 00 00 FE 01 B2 0C 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 FF CC 2D 00 18 24 05 00 00 7C 00 00 00 00 05 00
46 6F 72 6D 31 00 0D 05 14 01 00 00 54 06 00 00 C8 0D 00 00
1C 14 00 00 FF 00 12 00 43 52 45 41 54 4F 52 20 20 20 20 20
20 20 20 4C 41 42 00 03 C0 C0 C0 00 19 01 00 42 00 23 FF FF
FF FF 24 05 00 46 6F 72 6D 31 00 35 14 01 00 00 36 54 06 00
00 37 C8 0D 00 00 38 1C 14 00 00 40 01 01 00 00 BC 02 B0 30
01 00 0D 4D 53 20 53 61 6E 73 20 53 65 72 69 66 FF 01 2A 00
00 00 01 08 00 43 6F 6D 6D 61 6E 64 33 00 04 04 28 05 68 10
CC 03 74 01 FF 00 07 00 6C 69 62 72 61 72 79 00 11 16 00 FF
03 27 00 00 00 02 08 00 43 6F 6D 6D 61 6E 64 32 00 04 04 78
00 68 10 CC 03 74 01 FF 00 04 00 63 61 6C 63 00 11 15 00 FF
03 2C 00 00 00 03 05 00 54 65 78 74 39 00 02 04 B0 04 60 09
74 01 74 01 FF 02 C0 C0 C0 00 0B 02 00 30 30 00 12 10 00 25
02 00 00 00 FF 03 2C 00 00 00 04 05 00 54 65 78 74 38 00 02
04 B0 04 80 07 74 01 74 01 FF 02 C0 C0 C0 00 0B 02 00 30 30
00 12 0F 00 25 02 00 00 00 FF 03 2C 00 00 00 05 05 00 54 65
78 74 37 00 02 04 B0 04 A0 05 74 01 74 01 FF 02 C0 C0 C0 00
0B 02 00 30 30 00 12 0E 00 25 02 00 00 00 FF 03 2C 00 00 00
06 05 00 54 65 78 74 36 00 02 04 90 06 C0 03 74 01 74 01 FF
02 C0 C0 C0 00 0B 02 00 30 30 00 12 0A 00 25 02 00 00 00 FF
03 2C 00 00 00 07 05 00 54 65 78 74 35 00 02 04 B0 04 C0 03

74 01 74 01 FF 02 C0 C0 C0 00 0B 02 00 30 30 00 12 09 00 25
02 00 00 00 FF 03 2C 00 00 00 08 05 00 54 65 78 74 34 00 02
04 70 08 E0 01 74 01 74 01 FF 02 C0 C0 C0 00 0B 02 00 30 30
00 12 08 00 25 02 00 00 00 FF 03 2C 00 00 00 09 05 00 54 65
78 74 33 00 02 04 90 06 E0 01 74 01 74 01 FF 02 C0 C0 C0 00
0B 02 00 30 30 00 12 07 00 25 02 00 00 00 FF 03 2C 00 00 00
0A 05 00 54 65 78 74 32 00 02 04 B0 04 E0 01 74 01 74 01 FF
02 C0 C0 C0 00 0B 02 00 30 30 00 12 05 00 25 02 00 00 00 FF
03 2C 00 00 00 0B 05 00 54 65 78 74 31 00 02 04 B0 04 00 00
74 01 74 01 FF 02 C0 C0 C0 00 0B 02 00 30 30 00 12 03 00 25
02 00 00 00 FF 03 93 00 00 00 0C 05 00 4D 69 64 69 31 00 FF
08 00 56 42 58 2E 4D 49 44 49 00 02 30 0C 68 10 50 01 50 01
FF 06 00 0B 02 00 0C 02 00 0D 29 00 56 6F 79 65 74 72 61 20
53 75 70 65 72 20 53 61 70 69 20 46 4D 20 44 72 69 76 65 72
7C 53 42 31 36 20 4D 49 44 49 20 49 6E 00 0E 2A 00 56 6F 79
65 74 72 61 20 53 75 70 65 72 20 53 61 70 69 20 46 4D 20 44
72 69 76 65 72 7C 53 42 31 36 20 4D 49 44 49 20 4F 75 74 00
0F 02 00 10 02 00 11 00 00 12 07 00 FF 03 27 00 00 00 0D 08
00 43 6F 6D 6D 61 6E 64 31 00 04 04 60 09 48 12 44 04 74 01
FF 00 04 00 45 78 69 74 00 11 01 00 FF 03 23 00 00 00 0E 04
00 73 65 6E 64 00 04 04 78 00 48 12 7C 08 74 01 FF 00 04 00
73 65 6E 64 00 11 00 00 FF 03 25 00 00 00 0F 07 00 4C 61 62
65 6C 31 30 00 01 05 80 07 88 0E 74 01 74 01 FF 03 C0 C0 C0
00 12 14 00 13 01 FF 03 39 00 00 00 10 06 00 4C 61 62 65 6C
39 00 01 05 78 00 88 0E 24 06 74 01 FF 00 13 00 54 48 45 20
20 43 52 43 20 20 20 20 49 53 20 20 20 20 3A 00 03 C0 C0 C0
00 12 13 00 FF 03 24 00 00 00 11 06 00 4C 61 62 65 6C 38 00
01 05 78 00 30 0C 7C 08 74 01 FF 03 C0 C0 C0 00 12 12 00 13
01 FF 03 3A 00 00 00 12 06 00 4C 61 62 65 6C 37 00 01 05 78
00 40 0B 8C 07 74 01 FF 00 14 00 54 48 45 20 20 43 4F 4D 4D
41 4E 44 20 20 20 49 53 20 20 3A 00 03 C0 C0 C0 00 12 11 00
FF 03 2C 00 00 00 13 06 00 4C 61 62 65 6C 36 00 01 05 78 00
D8 09 CC 03 74 01 FF 00 06 00 44 41 54 33 20 3A 00 03 C0 C0
C0 00 12 0D 00 FF 03 2C 00 00 00 14 06 00 4C 61 62 65 6C 35
00 01 05 78 00 F8 07 CC 03 74 01 FF 00 06 00 44 41 54 32 20
3A 00 03 C0 C0 C0 00 12 0C 00 FF 03 2C 00 00 00 15 06 00 4C
61 62 65 6C 34 00 01 05 78 00 18 06 CC 03 74 01 FF 00 06 00
44 41 54 31 20 3A 00 03 C0 C0 C0 00 12 0B 00 FF 03 30 00 00
00 16 06 00 4C 61 62 65 6C 33 00 01 05 78 00 38 04 44 04 74
01 FF 00 0A 00 43 4F 4D 4D 41 4E 44 20 20 3A 00 03 C0 C0 C0
00 12 06 00 FF 03 30 00 00 00 17 06 00 4C 61 62 65 6C 32 00
01 05 78 00 58 02 44 04 74 01 FF 00 0A 00 41 44 44 52 45 53
53 20 20 3A 00 03 C0 C0 C0 00 12 04 00 FF 03 30 00 00 00 18
06 00 4C 61 62 65 6C 31 00 01 05 78 00 78 00 CC 03 74 01 FF
00 0A 00 48 45 41 44 45 52 20 20 20 3A 00 03 C0 C0 C0 00 12
02 00 FF 02 04 00 00 00 04 00 02 00 22 00 05 00 00 00 03 01
15 00 01 00 64 00 02 00 1B 00 03 00 00 00 02 00 02 00 02 00
00 00 00 00 00 00 00 00 DE 05 56 42 34 45 4E 31 36 2E 44 4C
4C 00 00 00 7E 00 00 00 00 00 00 00 00 00 00 00 00 00 00 00

00 00 30 00 FF FF 06 00 05 00 01 00 05 00 02 00 01 00 01 00
C4 00 3A 00 58 00 FF FF 44 01 36 00 88 00 02 01 4F 5A 42 49
4E 00 42 49 4E 31 00 00 42 49 4E 31 00 00 00 00 E1 CA 75 1A
A3 F5 1C 10 8B 7B 9A F8 C4 8E 68 E6 E2 CA 75 1A A3 F5 1C 10
8B 7B 9A F8 C4 8E 68 E6 E3 CA 75 1A A3 F5 1C 10 8B 7B 9A F8
C4 8E 68 E6 E4 CA 75 1A A3 F5 1C 10 8B 7B 9A F8 C4 8E 68 E6
E5 CA 75 1A A3 F5 1C 10 8B 7B 9A F8 C4 8E 68 E6 00 00 09 00
0C 00 56 42 58 2E 4D 49 44 49 00 4D 49 44 49 56 42 58 2E 56
42 58 00 00 5F CB 75 1A A3 F5 1C 10 8B 7B 9A F8 C4 8E 68 E6
00 00 00 00 00 00 00 00 00 00 00 00 00 00 00 00 00 00 00 00
00 00 00 00 00 00 00 00 00 00 00 00 00 00 00 00 C4 00 29 05
00 00 00 00 DC 0D 24 00 62 CB 75 1A A3 F5 1C 10 8B 7B 9A F8
C4 8E 68 E6 00 00 00 00 00 00 00 00 00 00 00 00 00 00 00 00
00 00 00 00 00 00 00 00 00 00 00 00 00 00 00 00 01 00 00 00
28 00 BD 01 00 00 00 00 00 00 FF FF 25 AF A8 C1 57 12 1B 10
8F B0 00 20 AF 03 9C A3 A6 8B 2B 09 0A 00 0A 00 0E 00 00 00
24 00 00 00 00 00 0A 00 98 00 00 00 00 00 26 00 27 AF A8 C1
57 12 1B 10 8F B0 00 20 AF 03 9C A3 26 AF A8 C1 57 12 1B 10
8F B0 00 20 AF 03 9C A3 5A CB 75 1A A3 F5 1C 10 8B 7B 9A F8
C4 8E 68 E6 5B CB 75 1A A3 F5 1C 10 8B 7B 9A F8 C4 8E 68 E6
5C CB 75 1A A3 F5 1C 10 8B 7B 9A F8 C4 8E 68 E6 5D CB 75 1A
A3 F5 1C 10 8B 7B 9A F8 C4 8E 68 E6 5E CB 75 1A A3 F5 1C 10
8B 7B 9A F8 C4 8E 68 E6 69 0A 4D 43 49 31 36 2E 4F 43 58 00
4D 43 49 2E 4D 4D 43 6F 6E 74 72 6F 6C 00 6D 67 6B 67 74 67
6E 6E 6D 6E 6D 6E 69 6E 69 67 74 68 6B 67 6F 67 67 67 76 6D
6B 68 69 6E 6A 67 67 6E 76 6D 00 00 00 00 00 00 00 00 00 00
26 00 00 00 01 00 00 00 02 00 00 00 03 00 00 00 04 00 00 00
05 00 00 00 06 00 00 00 07 00 00 00 08 00 00 00 09 00 00 00
0A 00 00 00 0B 00 00 00 0C 00 00 00 0D 00 00 00 0E 00 00 00
0F 00 00 00 10 00 00 00 11 00 00 00 12 00 00 00 13 00 00 00
14 00 00 00 15 00 00 00 16 00 00 00 17 00 00 00 18 00 00 00
19 00 00 00 1A 00 00 00 1B 00 00 00 1C 00 00 00 1D 00 00 00
1E 00 00 00 1F 00 00 00 20 00 00 00 21 00 00 00 22 00 00 00
23 00 00 00 24 00 00 00 25 00 00 00 4D 4D 43 6F 6E 74 72 6F
6C 00 00 00 03 00 02 00 42 01 04 00 00 00 02 00 3E 00 03 00
00 00 02 00 42 00 02 00 00 00 00 00 00 00 00 00 00 00 00 00
FF CC 2D 00 05 B8 01 00 00 7A 00 00 00 00 05 00 46 6F 72 6D
32 00 0D 05 3C 0F 00 00 60 06 00 00 BC 13 00 00 10 14 00 00
FF 00 10 00 4C 49 53 54 20 4F 46 20 43 4F 4D 4D 41 4E 44 53
00 03 C0 C0 C0 00 19 01 00 42 00 23 FF FF FF FF 24 05 00 46
6F 72 6D 32 00 35 3C 0F 00 00 36 60 06 00 00 37 BC 13 00 00
38 10 14 00 00 40 01 01 00 00 BC 02 B0 30 01 00 0D 4D 53 20
53 61 6E 73 20 53 65 72 69 66 FF 01 2C 00 00 00 01 08 00 43
6F 6D 6D 61 6E 64 33 00 04 04 88 0E 48 12 BC 04 74 01 FF 00
09 00 50 20 20 41 4E 44 20 20 50 00 11 04 00 FF 03 29 00 00
00 02 08 00 43 6F 6D 6D 61 6E 64 32 00 04 04 18 06 48 12 34
05 74 01 FF 00 06 00 43 61 6E 63 65 6C 00 11 02 00 FF 03 26
00 00 00 03 08 00 43 6F 6D 6D 61 6E 64 31 00 04 04 00 00 48
12 34 05 74 01 FF 00 03 00 53 65 74 00 11 01 00 FF 03 21 00

00 00 04 05 00 4C 69 73 74 31 00 08 04 00 00 78 00 44 13 98
10 FF 02 C0 C0 C0 00 11 00 00 FF 03 97 00 00 00 05 0A 00 4D
4D 43 6F 6E 74 72 6F 6C 31 00 FF 0D 00 4D 43 49 2E 4D 4D 43
6F 6E 74 72 6F 6C 00 03 28 05 B0 04 10 0B 74 01 FF 07 00 0F
03 00 2D 18 00 4B 00 00 00 86 E7 78 6A 82 A7 BA 01 86 E7 78
6A 82 A7 BA 01 01 00 25 AF A8 C1 57 12 1B 10 8F B0 00 20 AF
03 9C A3 00 00 01 00 01 00 00 01 00 00 00 00 00 00 01 01 01
01 01 01 01 01 01 00 00 00 00 00 00 01 00 00 00 00 00 00 00
00 00 E8 03 00 00 FF 01 83 13 00 00 90 02 00 00 20 00 00 00
01 00 FF 02 04 00 00 00 08 00 34 00 00 00 00 00 08 00 06 00
00 00 00 00 65 CB 75 1A A3 F5 1C 10 8B 7B 9A F8 C4 8E 68 E6
B5 14 A7 14 04 00 00 00 04 00 14 00 00 00 00 00 08 00 00 00
00 00 00 00 08 00 00 00 00 00 00 00 7C 42 06 00 C9 30 05 00
02 00 00 00 A7 14 04 00 00 00 0E 00 14 00 00 00 00 00 08 00
00 00 00 00 00 00 08 00 00 00 00 00 00 00 00 00 C5 42 0A 00
00 00 11 3B 00 00 94 3E 01 00 00 00 C9 30 04 00 02 00 00 00
A7 14 04 00 00 00 1A 00 14 00 00 00 00 00 08 00 00 00 00 00
00 00 08 00 00 00 00 00 00 00 00 00 48 00 7A 00 02 00 02 00
40 00 05 00 00 00 02 00 01 00 12 08 10 00 00 00 00 00 00 00
00 00 00 00 15 00 00 00 00 00 00 00 58 00 05 00 17 33 02 00
01 00 12 08 10 00 00 00 00 00 00 00 00 00 00 00 15 00 00 00
00 00 00 00 BC 36 0C 00 90 FF 05 00 00 00 43 6C 6F 73 65 00
7B 41 7C 42 06 00 6C 30 A0 FF 05 00 03 00 06 00 A6 31 17 00
00 00 A5 25 A0 FF A7 14 08 00 20 00 2C 00 14 00 00 00 00 00
08 00 00 00 00 00 00 00 0C 00 00 00 01 00 00 00 A0 FF 02 00
BC 36 0C 00 90 FF 04 00 00 00 53 74 6F 70 00 00 7B 41 C5 42
0A 00 00 00 11 3B 00 00 94 3E 01 00 00 00 0C 31 A0 FF 05 00
03 00 1D 25 A6 31 17 00 00 00 A5 25 A0 FF A7 14 04 00 20 00
38 00 14 00 00 00 00 00 08 00 00 00 00 00 00 00 0C 00 00 00
01 00 00 00 A0 FF 02 00 B9 44 00 3D 33 C9 B8 EA 27 BA FF FF
EA 61 03 61 03 00 00 00 00 00 B9 3C 00 3D 33 C9 B8 4E 00 BA
EE 0A EA FF FF FF FF 00 00 00 00 00 B9 34 00 3D 33 C9 B8 C4
20 BA FF FF EA B3 01 B3 01 00 00 00 00 00 B9 5C 00 3D 33 C9
B8 52 04 BA C6 01 EA C9 01 C9 01 00 00 00 00 00 B9 5C 00 3D
33 C9 B8 18 01 BA DC 01 EA DF 01 DF 01 00 00 00 00 00 B9 4C
00 3D 33 C9 B8 C0 18 BA F2 01 EA F5 01 F5 01 00 00 00 00 00
BC 36 0C 00 90 FF 04 00 00 00 50 6C 61 79 00 00 7B 41 C5 42
0A 00 00 00 11 3B 00 00 94 3E 01 00 00 00 0C 31 A0 FF 05 00
03 00 1D 25 A6 31 17 00 00 00 A5 25 A0 FF BC 36 0C 00 90 FF
04 00 00 00 50 72 65 76 00 00 7B 41 C5 42 0A 00 00 00 11 3B
00 00 94 3E 01 00 00 00 0C 31 A0 FF 05 00 03 00 1D 25 A6 31
17 00 00 00 A5 25 A0 FF A7 14 04 00 20 00 6E 00 14 00 00 00
00 00 08 00 00 00 00 00 00 00 0C 00 00 00 01 00 00 00 A0 FF
02 00 00 00 B9 F2 00 3D 33 C9 B8 24 00 BA 08 02 EA 0B 02 0B
02 00 00 00 00 00 B9 EA 00 3D 33 C9 B8 54 37 BA AE 02 EA B1
02 B1 02 00 00 00 00 00 B9 E2 00 3D 33 C9 B8 86 00 BA C4 02
EA C7 02 C7 02 00 00 00 00 00 B9 7A 00 3D 33 C9 B8 EC 11 BA
DA 02 EA DD 02 DD 02 00 00 00 00 00 B9 00 40 3D 33 C9 B8 F6
06 BA F0 02 EA F3 02 F3 02 00 00 00 00 00 B9 8A 00 3D 33 C9

B8 38 0B BA 06 03 EA 09 03 09 03 00 00 00 00 00 B9 FA 00 3D
33 C9 B8 D0 2B BA 1C 03 EA 1F 03 1F 03 00 00 00 00 00 B9 00
40 3D 33 C9 B8 82 02 BA 32 03 EA 35 03 35 03 00 00 00 00 00
B9 00 40 3D 33 C9 B8 70 01 BA 48 03 EA 4B 03 4B 03 00 00 00
00 00 00 00 9D 36 A0 FF 7B 41 7C 42 06 00 6C 30 90 FF 05 00
03 00 06 00 A6 31 18 00 00 00 A5 25 90 FF 99 36 A0 FF 7B 41
7C 42 06 00 6C 30 90 FF 05 00 03 00 06 00 A6 31 19 00 00 00
A5 25 90 FF 9D 36 A0 FF 7B 41 7C 42 06 00 6C 30 90 FF 05 00
03 00 06 00 A6 31 1A 00 00 00 A5 25 90 FF BC 36 10 00 A0 FF
09 00 00 00 57 61 76 65 41 75 64 69 6F 00 7B 41 7C 42 06 00
6C 30 90 FF 05 00 03 00 06 00 A6 31 15 00 00 00 A5 25 90 FF
BC 36 14 00 A0 FF 0C 00 00 00 43 3A 5C 41 4E 47 45 4C 2E 57
41 56 00 00 7B 41 7C 42 06 00 6C 30 90 FF 05 00 03 00 06 00
A6 31 16 00 00 00 A5 25 90 FF BC 36 0C 00 A0 FF 04 00 00 00
4F 70 65 6E 00 00 7B 41 7C 42 06 00 6C 30 90 FF 05 00 03 00
06 00 A6 31 17 00 00 00 A5 25 90 FF A7 14 04 00 20 00 E6 00
14 00 00 00 00 00 08 00 00 00 00 00 00 00 0C 00 00 00 01 00
00 00 90 FF 02 00 00 00 7D 2D 0A 00 1F 43 AC FF F5 23 AC FF
7C 36 24 00 1E 00 00 00 30 31 7C 30 36 7C 30 36 7C 30 35 7C
30 41 7C 30 30 7C 30 32 7C 30 32 7C 46 46 7C 30 30 7C 00 00
DB 49 4F 18 5A 00 BC 36 14 00 9C FF 0D 00 00 00 53 54 41 52
54 20 50 4C 41 59 49 4E 47 00 19 47 8C FF 3F 24 8C FF AA 36
7C FF AA 36 6C FF AA 36 5C FF AA 36 4C FF 46 19 6C 05 6C 05
51 1E 2C FF 4F 47 3C FF AE 25 0A 00 8C FF 7C FF 6C FF 5C FF
4C FF DB 19 04 00 1C 00 10 00 8E 05 38 18 E8 01 F5 23 AC FF
7C 36 24 00 1E 00 00 00 30 31 7C 30 36 7C 30 36 7C 30 35 7C
30 41 7C 30 30 7C 30 32 7C 30 32 7C 46 46 7C 30 30 7C 00 00
DB 49 4F 18 5A 00 BC 36 14 00 2C FF 0D 00 00 00 53 54 4F 50
20 20 50 4C 41 59 49 4E 47 00 19 47 4C FF 3F 24 4C FF AA 36
5C FF AA 36 6C FF AA 36 7C FF AA 36 8C FF 46 19 EA 05 EA 05
51 1E 9C FF 4F 47 3C FF AE 25 0A 00 4C FF 5C FF 6C FF 7C FF
8C FF DB 19 04 00 20 00 10 00 5E 03 38 18 5C 01 F5 23 AC FF
7C 36 1E 00 19 00 00 00 33 20 31 31 20 31 32 20 31 33 20 31
34 20 31 35 20 37 20 38 20 39 20 31 30 00 DB 49 4F 18 48 00
BC 36 0C 00 2C FF 05 00 00 00 33 33 33 33 33 00 19 47 4C FF
3F 24 4C FF AA 36 5C FF AA 36 6C FF AA 36 7C FF AA 36 8C FF
46 19 60 06 60 06 51 1E 9C FF 4F 47 3C FF AE 25 0A 00 4C FF
5C FF 6C FF 7C FF 8C FF 38 18 E8 00 F5 23 AC FF 7C 36 20 00
1A 00 00 00 20 34 20 31 31 20 31 32 20 31 33 20 31 34 20 31
35 20 37 20 38 20 39 20 31 30 00 00 DB 49 4F 18 48 00 BC 36
0C 00 2C FF 05 00 00 00 34 34 34 34 34 00 19 47 4C FF 3F 24
4C FF AA 36 5C FF AA 36 6C FF AA 36 7C FF AA 36 8C FF 46 19
FF FF FF FF 51 1E 9C FF 4F 47 3C FF AE 25 0A 00 4C FF 5C FF
6C FF 7C FF 8C FF 38 18 72 00 F5 23 AC FF 7C 36 20 00 1A 00
00 00 20 35 20 31 31 20 31 32 20 31 33 20 31 34 20 31 35 20
37 20 38 20 39 20 31 30 00 00 DB 49 4F 18 44 00 BC 36 0C 00
2C FF 05 00 00 00 35 35 35 35 35 00 19 47 4C FF 3F 24 4C FF
AA 36 5C FF AA 36 6C FF AA 36 7C FF AA 36 8C FF 46 19 42 2F
42 2F 51 1E 9C FF 4F 47 3C FF AE 25 0A 00 4C FF 5C FF 6C FF

7C FF 8C FF CB 25 AC FF A7 14 08 00 84 00 82 02 1C 00 00 00
00 00 10 00 00 00 02 00 00 00 AC FF 01 00 3C FF 02 00 1C 00
00 00 05 00 00 00 4C FF 02 00 5C FF 02 00 6C FF 02 00 7C FF
02 00 8C FF 02 00 00 00 70 2D 0E 00 51 1E 7E FF CD 1E 3F 24
8E FF C0 2C 6E FF 70 2D 0E 00 51 1E 4E FF CD 1E 3F 24 5E FF
C0 2C 3E FF 37 2D 2E FF 70 2D 0E 00 51 1E 0E FF CD 1E 3F 24
1E FF C0 2C FE FE 37 2D EE FE 70 2D 0E 00 51 1E CE FE CD 1E
3F 24 DE FE C0 2C BE FE 37 2D AE FE 70 2D 0E 00 51 1E 8E FE
CD 1E 3F 24 9E FE C0 2C 7E FE 37 2D 6E FE 85 18 30 00 70 2D
0E 00 51 1E 8E FE CD 1E 3F 24 5E FF C0 2C 6E FE 70 2D 16 00
CF 35 FD 49 83 1E CE FE 32 2D 7E FE 85 18 0A 00 3F 24 8E FF
D5 1B D1 2D 0E 00 A6 3B 06 00 70 00 68 24 6C FE EB 23 6C FE
C7 35 14 00 FD 49 4F 18 18 03 70 2D 16 00 51 1E 8E FE A6 3B
06 00 70 00 DF 1B 2C 3C 06 00 40 00 7C 48 D7 35 3F 24 9E FF
C7 35 14 00 CC 26 68 FE D4 02 EB 23 9E FF DF 1B 2C 3C 06 00
40 00 65 16 19 47 58 FE 3F 24 58 FE E0 36 8E FE 00 00 CD 1E
C0 2C CE FE 85 18 12 00 7C 36 06 00 01 00 00 00 30 00 1F 43
54 FE 38 18 48 02 3F 24 58 FE E0 36 8E FE 01 00 CD 1E C0 2C
CE FE 85 18 12 00 7C 36 06 00 01 00 00 00 31 00 1F 43 54 FE
38 18 22 02 3F 24 58 FE E0 36 8E FE 02 00 CD 1E C0 2C CE FE
85 18 12 00 7C 36 06 00 01 00 00 00 32 00 1F 43 54 FE 38 18
FC 01 3F 24 58 FE E0 36 8E FE 03 00 CD 1E C0 2C CE FE 85 18
12 00 7C 36 06 00 01 00 00 00 33 00 1F 43 54 FE 38 18 D6 01
3F 24 58 FE E0 36 8E FE 04 00 CD 1E C0 2C CE FE 85 18 12 00
7C 36 06 00 01 00 00 00 34 00 1F 43 54 FE 38 18 B0 01 3F 24
58 FE E0 36 8E FE 05 00 CD 1E C0 2C CE FE 85 18 12 00 7C 36
06 00 01 00 00 00 35 00 1F 43 54 FE 38 18 8A 01 3F 24 58 FE
E0 36 8E FE 06 00 CD 1E C0 2C CE FE 85 18 12 00 7C 36 06 00
01 00 00 00 36 00 1F 43 54 FE 38 18 64 01 3F 24 58 FE E0 36
8E FE 07 00 CD 1E C0 2C CE FE 85 18 12 00 7C 36 06 00 01 00
00 00 37 00 1F 43 54 FE 38 18 3E 01 3F 24 58 FE E0 36 8E FE
08 00 CD 1E C0 2C CE FE 85 18 12 00 7C 36 06 00 01 00 00 00
38 00 1F 43 54 FE 38 18 18 01 3F 24 58 FE E0 36 8E FE 09 00
CD 1E C0 2C CE FE 85 18 12 00 7C 36 06 00 01 00 00 00 39 00
1F 43 54 FE 38 18 F2 00 3F 24 58 FE E0 36 8E FE 0A 00 CD 1E
C0 2C CE FE 85 18 12 00 7C 36 06 00 01 00 00 00 41 00 1F 43
54 FE 38 18 CC 00 3F 24 58 FE E0 36 8E FE 0B 00 CD 1E C0 2C
CE FE 85 18 12 00 7C 36 06 00 01 00 00 00 42 00 1F 43 54 FE
38 18 A6 00 3F 24 58 FE E0 36 8E FE 0C 00 CD 1E C0 2C CE FE
85 18 12 00 7C 36 06 00 01 00 00 00 43 00 1F 43 54 FE 38 18
80 00 3F 24 58 FE E0 36 8E FE 0D 00 CD 1E C0 2C CE FE 85 18
12 00 7C 36 06 00 01 00 00 00 44 00 1F 43 54 FE 38 18 5A 00
3F 24 58 FE E0 36 8E FE 0E 00 CD 1E C0 2C CE FE 85 18 12 00
7C 36 06 00 01 00 00 00 45 00 1F 43 54 FE 38 18 34 00 3F 24
58 FE E0 36 8E FE 0F 00 CD 1E C0 2C CE FE 85 18 12 00 7C 36
06 00 01 00 00 00 46 00 1F 43 54 FE 38 18 0E 00 7C 36 06 00
01 00 00 00 3F 00 1F 43 54 FE A5 25 58 FE F5 23 50 FE F5 23
54 FE 8D 4C AB 43 50 FE EB 23 9E FF 15 1C DF 35 15 1C 6D 3A
E4 38 F6 1C EB 23 9E FF 15 1C DF 35 15 1C 6D 3A F6 1C E9 49

4F 18 14 00 F5 23 50 FE 7C 36 06 00 01 00 00 00 7C 00 8D 4C
AB 43 50 FE 3F 24 9E FF E7 26 68 FE 2C FD 3F 24 50 FE DB 19
08 00 34 00 10 00 02 05 D7 35 59 3C 06 00 70 00 A7 14 38 18
28 00 EB 23 6C FE D7 35 C7 35 13 00 C7 4B 4F 18 18 00 70 2D
16 00 51 1E 8E FE A6 3B 06 00 70 00 DF 1B 2C 3C 06 00 40 00
7C 48 A6 3B 06 00 70 00 D7 35 FB 38 59 3C 06 00 70 00 A7 14
18 00 60 01 08 04 38 00 00 00 00 00 2C 00 00 00 09 00 00 00
58 FE 02 00 8E FF 02 00 54 FE 01 00 50 FE 01 00 A0 FF 02 00
DE FE 02 00 1E FF 02 00 5E FF 02 00 9E FE 02 00 2C 00 00 00
09 00 00 00 6E FE 02 00 7E FE 02 00 AE FE 02 00 BE FE 02 00
EE FE 02 00 FE FE 02 00 2E FF 02 00 3E FF 02 00 6E FF 02 00
BC 36 16 00 90 FF 0F 00 00 00 53 45 54 20 49 2F 4F 20 23 34
20 74 6F 20 31 00 7B 41 C5 42 0A 00 00 00 11 3B 00 00 94 3E
01 00 00 00 0C 31 A0 FF 04 00 03 00 1D 25 C9 30 01 00 02 00
01 00 A5 25 A0 FF BC 36 16 00 90 FF 0F 00 00 00 53 45 54 20
49 2F 4F 20 23 34 20 74 6F 20 30 00 7B 41 C5 42 0A 00 00 00
11 3B 00 00 94 3E 01 00 00 00 0C 31 A0 FF 04 00 03 00 1D 25
C9 30 01 00 02 00 01 00 A5 25 A0 FF BC 36 2C 00 90 FF 25 00
00 00 53 45 54 20 49 2F 4F 20 23 34 20 74 6F 20 31 20 66 6F
72 20 61 20 54 49 4D 45 20 6F 66 20 32 30 48 20 73 65 63 00
7B 41 C5 42 0A 00 00 00 11 3B 00 00 94 3E 01 00 00 00 0C 31
A0 FF 04 00 03 00 1D 25 C9 30 01 00 02 00 01 00 A5 25 A0 FF
BC 36 1C 00 90 FF 15 00 00 00 47 45 54 20 53 54 41 54 55 53
20 4F 46 20 53 45 4E 53 4F 52 53 00 7B 41 C5 42 0A 00 00 00
11 3B 00 00 94 3E 01 00 00 00 0C 31 A0 FF 04 00 03 00 1D 25
C9 30 01 00 02 00 01 00 A5 25 A0 FF BC 36 1C 00 90 FF 14 00
00 00 53 45 4E 53 4F 52 53 20 53 43 41 4E 20 4D 4F 44 45 20
4F 4E 00 00 7B 41 C5 42 0A 00 00 00 11 3B 00 00 94 3E 01 00
00 00 0C 31 A0 FF 04 00 03 00 1D 25 C9 30 01 00 02 00 01 00
A5 25 A0 FF BC 36 22 00 90 FF 1A 00 00 00 53 45 4E 53 4F 52
53 20 53 43 41 4E 20 4D 4F 44 45 20 4F 4E 20 6F 6E 63 65 21
00 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 1C 00 90 FF 15 00 00 00 53 45 4E 53 4F 52 53 20
53 43 41 4E 20 4D 4F 44 45 20 4F 46 46 00 7B 41 C5 42 0A 00
00 00 11 3B 00 00 94 3E 01 00 00 00 0C 31 A0 FF 04 00 03 00
1D 25 C9 30 01 00 02 00 01 00 A5 25 A0 FF BC 36 12 00 90 FF
0B 00 00 00 41 55 44 49 4F 20 50 4C 41 59 20 00 7B 41 C5 42
0A 00 00 00 11 3B 00 00 94 3E 01 00 00 00 0C 31 A0 FF 04 00
03 00 1D 25 C9 30 01 00 02 00 01 00 A5 25 A0 FF BC 36 16 00
90 FF 0F 00 00 00 41 55 44 49 4F 20 53 54 4F 50 20 50 4C 41
59 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 26 00 90 FF 1E 00 00 00 41 55 44 49 4F 20 50 4C
41 59 20 61 6E 64 20 53 45 54 20 49 2F 4F 20 23 34 20 74 6F
20 31 00 00 7B 41 C5 42 0A 00 00 00 11 3B 00 00 94 3E 01 00
00 00 0C 31 A0 FF 04 00 03 00 1D 25 C9 30 01 00 02 00 01 00
A5 25 A0 FF BC 36 2A 00 90 FF 23 00 00 00 41 55 44 49 4F 20
53 54 4F 50 20 50 4C 41 59 20 61 6E 64 20 53 45 54 20 49 2F 4F 20 23 34 20 74 6F 20 30 00 7B 41 C5 42 0A 00 00 00 11 3B
00 00 94 3E 01 00 00 00 0C 31 A0 FF 04 00 03 00 1D 25 C9 30
01 00 02 00 01 00 A5 25 A0 FF BC 36 36 00 90 FF 2E 00 00 00
50 52 45 50 41 52 45 20 46 4F 52 20 41 55 44 49 4F 28 4C 45
4E 47 54 48 20 35 73 29 2C 20 43 4D 44 20 44 45 4C 41 59 28
32 30 30 6D 73 29 00 00 7B 41 C5 42 0A 00 00 00 11 3B 00 00
94 3E 01 00 00 00 0C 31 A0 FF 04 00 03 00 1D 25 C9 30 01 00
02 00 01 00 A5 25 A0 FF BC 36 3A 00 90 FF 32 00 00 00 50 52
45 50 41 52 45 20 46 4F 52 20 41 55 44 49 4F 28 35 73 29 2C
49 2F 4F 20 23 34 28 38 73 29 2C 20 43 4D 44 20 44 45 4C 41
59 28 32 30 30 6D 73 29 00 00 7B 41 C5 42 0A 00 00 00 11 3B
00 00 94 3E 01 00 00 00 0C 31 A0 FF 04 00 03 00 1D 25 C9 30
01 00 02 00 01 00 A5 25 A0 FF BC 36 22 00 90 FF 1A 00 00 00
54 52 41 4E 53 4D 49 54 20 4D 49 43 20 46 4F 52 20 54 49 4D
45 20 28 35 73 29 00 00 7B 41 C5 42 0A 00 00 00 11 3B 00 00
94 3E 01 00 00 00 0C 31 A0 FF 04 00 03 00 1D 25 C9 30 01 00
02 00 01 00 A5 25 A0 FF BC 36 16 00 90 FF 0F 00 00 00 47 4F
54 4F 20 53 4C 45 45 50 20 4D 4F 44 45 00 7B 41 C5 42 0A 00
00 00 11 3B 00 00 94 3E 01 00 00 00 0C 31 A0 FF 04 00 03 00
1D 25 C9 30 01 00 02 00 01 00 A5 25 A0 FF BC 36 10 00 90 FF
09 00 00 00 54 4F 59 20 52 45 53 45 54 00 7B 41 C5 42 0A 00
00 00 11 3B 00 00 94 3E 01 00 00 00 0C 31 A0 FF 04 00 03 00
1D 25 C9 30 01 00 02 00 01 00 A5 25 A0 FF BC 36 30 00 90 FF
28 00 00 00 43 2E 52 2E 49 2E 20 53 57 49 54 43 48 20 41 55
44 49 4F 20 54 4F 20 52 41 44 49 4F 20 26 20 54 52 41 4E 53
4D 49 54 54 00 00 7B 41 C5 42 0A 00 00 00 11 3B 00 00 94 3E
01 00 00 00 0C 31 A0 FF 04 00 03 00 1D 25 C9 30 01 00 02 00
01 00 A5 25 A0 FF BC 36 34 00 90 FF 2C 00 00 00 43 2E 52 2E
49 2E 20 53 57 49 54 43 48 20 41 55 44 49 4F 20 54 4F 20 4A
41 43 4B 20 26 20 53 54 4F 50 20 54 52 41 4E 53 4D 49 54 54
00 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 18 00 90 FF 11 00 00 00 43 2E 52 2E 49 2E 20 4D
55 54 45 20 52 41 44 49 4F 00 7B 41 C5 42 0A 00 00 00 11 3B
00 00 94 3E 01 00 00 00 0C 31 A0 FF 04 00 03 00 1D 25 C9 30
01 00 02 00 01 00 A5 25 A0 FF BC 36 1C 00 90 FF 14 00 00 00
43 2E 52 2E 49 2E 20 55 4E 2D 4D 55 54 45 20 52 41 44 49 4F
00 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 14 00 90 FF 0C 00 00 00 43 2E 52 2E 49 2E 20 52
45 53 45 54 00 00 7B 41 C5 42 0A 00 00 00 11 3B 00 00 94 3E
01 00 00 00 0C 31 A0 FF 04 00 03 00 1D 25 C9 30 01 00 02 00
01 00 A5 25 A0 FF D7 35 59 3C 06 00 70 00 A7 14 04 00 20 00
50 06 14 00 00 00 00 00 08 00 00 00 00 00 00 00 0C 00 00 00
01 00 00 00 A0 FF 02 00 7C 42 06 00 6C 30 A0 FF 05 00 03 00
06 00 0C 31 90 FF 20 00 00 00 A5 25 A0 FF 85 18 94 06 BC 36
0A 00 80 FF 02 00 00 00 30 31 00 00 7B 41 C5 42 06 00 00 00
11 3B 00 00 94 3E 00 00 00 00 0C 31 90 FF 0B 00 03 00 1D 25
A6 31 0B 00 01 00 A5 25 90 FF BC 36 0A 00 80 FF 02 00 00 00

30 30 00 00 7B 41 C5 42 06 00 00 00 11 3B 00 00 94 3E 00 00
00 00 0C 31 90 FF 0A 00 03 00 1D 25 A6 31 0B 00 01 00 A5 25
90 FF BC 36 0A 00 80 FF 02 00 00 00 30 30 00 00 7B 41 C5 42
06 00 00 00 11 3B 00 00 94 3E 00 00 00 00 0C 31 90 FF 09 00
03 00 1D 25 A6 31 0B 00 01 00 A5 25 90 FF BC 36 0A 00 80 FF
02 00 00 00 30 35 00 00 7B 41 C5 42 06 00 00 00 11 3B 00 00
94 3E 00 00 00 00 0C 31 90 FF 08 00 03 00 1D 25 A6 31 0B 00
01 00 A5 25 90 FF BC 36 0A 00 80 FF 02 00 00 00 30 32 00 00
7B 41 C5 42 06 00 00 00 11 3B 00 00 94 3E 00 00 00 00 0C 31
90 FF 07 00 03 00 1D 25 A6 31 0B 00 01 00 A5 25 90 FF BC 36
0A 00 80 FF 02 00 00 00 30 33 00 00 7B 41 C5 42 06 00 00 00
11 3B 00 00 94 3E 00 00 00 00 0C 31 90 FF 06 00 03 00 1D 25
A6 31 0B 00 01 00 A5 25 90 FF BC 36 0A 00 80 FF 02 00 00 00
30 30 00 00 7B 41 C5 42 06 00 00 00 11 3B 00 00 94 3E 00 00
00 00 0C 31 90 FF 05 00 03 00 1D 25 A6 31 0B 00 01 00 A5 25
90 FF BC 36 0A 00 80 FF 02 00 00 00 30 30 00 00 7B 41 C5 42
06 00 00 00 11 3B 00 00 94 3E 00 00 00 00 0C 31 90 FF 04 00
03 00 1D 25 A6 31 0B 00 01 00 A5 25 90 FF BC 36 0A 00 80 FF
02 00 00 00 30 33 00 00 7B 41 C5 42 06 00 00 00 11 3B 00 00
94 3E 00 00 00 00 0C 31 90 FF 03 00 03 00 1D 25 A6 31 0B 00
01 00 A5 25 90 FF C5 42 06 00 00 00 11 3B 00 00 94 3E 00 00
00 00 0C 31 90 FF 0B 00 03 00 1D 25 0C 31 A0 FF 0B 00 01 00
D2 1D A2 43 7C FF 46 19 56 14 56 14 C5 42 06 00 00 00 11 3B
00 00 94 3E 00 00 00 00 0C 31 6C FF 0A 00 03 00 1D 25 0C 31
5C FF 0B 00 01 00 D2 1D A2 43 58 FF 46 19 86 14 86 14 C0 37
C5 42 06 00 00 00 11 3B 00 00 94 3E 00 00 00 00 0C 31 48 FF
09 00 03 00 1D 25 0C 31 38 FF 0B 00 01 00 D2 1D A2 43 34 FF
46 19 B6 14 B6 14 C0 37 C5 42 06 00 00 00 11 3B 00 00 94 3E
00 00 00 00 0C 31 24 FF 08 00 03 00 1D 25 0C 31 14 FF 0B 00
01 00 D2 1D A2 43 10 FF 46 19 E6 14 E6 14 C0 37 C5 42 06 00
00 00 11 3B 00 00 94 3E 00 00 00 00 0C 31 00 FF 07 00 03 00
1D 25 0C 31 F0 FE 0B 00 01 00 D2 1D A2 43 EC FE 46 19 16 15
16 15 C0 37 C5 42 06 00 00 00 11 3B 00 00 94 3E 00 00 00 00
0C 31 DC FE 06 00 03 00 1D 25 0C 31 CC FE 0B 00 01 00 D2 1D
A2 43 C8 FE 46 19 46 15 46 15 C0 37 C5 42 06 00 00 00 11 3B
00 00 94 3E 00 00 00 00 0C 31 B8 FE 05 00 03 00 1D 25 0C 31
A8 FE 0B 00 01 00 D2 1D A2 43 A4 FE 46 19 76 15 76 15 C0 37
C5 42 06 00 00 00 11 3B 00 00 94 3E 00 00 00 00 0C 31 94 FE
04 00 03 00 1D 25 0C 31 84 FE 0B 00 01 00 D2 1D A2 43 80 FE
46 19 FF FF FF FF C0 37 C5 42 06 00 00 00 11 3B 00 00 94 3E
00 00 00 00 0C 31 70 FE 03 00 03 00 1D 25 0C 31 60 FE 0B 00
01 00 D2 1D A2 43 5C FE 46 19 96 31 96 31 C0 37 51 1E 80 FF
4F 47 4C FE C2 25 12 00 7C FF 58 FF 34 FF 10 FF EC FE C8 FE
A4 FE 80 FE 5C FE AE 25 24 00 90 FF A0 FF 6C FF 5C FF 48 FF
38 FF 24 FF 14 FF 00 FF F0 FE DC FE CC FE B8 FE A8 FE 94 FE
84 FE 70 FE 60 FE C5 42 06 00 00 00 11 3B 00 00 94 3E 00 00
00 00 0C 31 60 FE 0B 00 03 00 1D 25 0C 31 70 FE 0B 00 01 00
D2 1D A2 43 5C FE C5 42 06 00 00 00 11 3B 00 00 94 3E 00 00
00 00 0C 31 84 FE 0A 00 03 00 1D 25 0C 31 94 FE 0B 00 01 00

D2 1D A2 43 80 FE 8D 4C A2 43 A4 FE C5 42 06 00 00 00 11 3B
00 00 94 3E 00 00 00 00 0C 31 A8 FE 09 00 03 00 1D 25 0C 31
B8 FE 0B 00 01 00 D2 1D A2 43 C8 FE 8D 4C A2 43 EC FE C5 42
06 00 00 00 11 3B 00 00 94 3E 00 00 00 00 0C 31 CC FE 08 00
03 00 1D 25 0C 31 DC FE 0B 00 01 00 D2 1D A2 43 10 FF 8D 4C
A2 43 34 FF C5 42 06 00 00 00 11 3B 00 00 94 3E 00 00 00 00
0C 31 F0 FE 07 00 03 00 1D 25 0C 31 00 FF 0B 00 01 00 D2 1D
A2 43 58 FF 8D 4C A2 43 7C FF C5 42 06 00 00 00 11 3B 00 00
94 3E 00 00 00 00 0C 31 14 FF 06 00 03 00 1D 25 0C 31 24 FF
0B 00 01 00 D2 1D A2 43 48 FE 8D 4C A2 43 44 FE C5 42 06 00
00 00 11 3B 00 00 94 3E 00 00 00 00 0C 31 38 FF 05 00 03 00
1D 25 0C 31 48 FF 0B 00 01 00 D2 1D A2 43 40 FE 8D 4C A2 43
3C FE C5 42 06 00 00 00 11 3B 00 00 94 3E 00 00 00 00 0C 31
5C FF 04 00 03 00 1D 25 0C 31 6C FF 0B 00 01 00 D2 1D A2 43
38 FE 8D 4C A2 43 34 FE C5 42 06 00 00 00 11 3B 00 00 94 3E
00 00 00 00 0C 31 90 FF 03 00 03 00 1D 25 0C 31 A0 FF 0B 00
01 00 D2 1D A2 43 30 FE 8D 4C A2 43 2C FE 3F 24 4C FE 0A 1C
4B 19 FF FF FF FF A2 43 28 FE 8D 4C A2 43 24 FE F7 35 F0 1E
A2 43 20 FE 8D 4C 6F 1E 00 FE 4F 47 10 FE C2 25 28 00 5C FE
80 FE A4 FE C8 FE EC FE 10 FF 34 FF 58 FF 7C FF 48 FE 44 FE
40 FE 3C FE 38 FE 34 FE 30 FE 2C FE 28 FE 24 FE 20 FE AE 25
24 00 60 FE 70 FE 84 FE 94 FE A8 FE B8 FE CC FE DC FE F0 FE
00 FF 14 FF 24 FF 38 FF 48 FF 5C FF 6C FF 90 FF A0 FF 3F 24
10 FE BE 1D 6F 1E 60 FE 7B 41 C5 42 06 00 00 00 11 3B 00 00
94 3E 00 00 00 00 0C 31 00 FE 11 00 03 00 1D 25 A6 31 00 00
01 00 AE 25 04 00 00 FE 60 FE 3F 24 4C FE 0A 1C 4B 19 56 36
56 36 A2 43 20 FE F7 35 F0 1E A2 43 24 FE 8D 4C 6F 1E 60 FE
7B 41 C5 42 06 00 00 00 11 3B 00 00 94 3E 00 00 00 00 0C 31
00 FE 0F 00 03 00 1D 25 A6 31 00 00 01 00 C2 25 04 00 20 FE
24 FE AE 25 04 00 00 FE 60 FE 3F 24 10 FE BE 1D 6F 1E 60 FE
7B 41 C5 42 06 00 00 00 11 3B 00 00 94 3E 00 00 00 00 0C 31
00 FE 0C 00 03 00 1D 25 A6 31 11 00 01 00 AE 25 04 00 00 FE
60 FE A7 14 08 00 B0 01 B4 06 1C 00 00 00 00 00 10 00 00 00
02 00 00 00 10 FE 02 00 4C FE 02 00 A4 00 00 00 27 00 00 00
20 FE 01 00 24 FE 01 00 28 FE 01 00 2C FE 01 00 30 FE 01 00
34 FE 01 00 38 FE 01 00 3C FE 01 00 40 FE 01 00 44 FE 01 00
48 FE 01 00 5C FE 01 00 80 FE 01 00 A4 FE 01 00 C8 FE 01 00
EC FE 01 00 10 FF 01 00 34 FF 01 00 58 FF 01 00 7C FF 01 00
00 FE 02 00 60 FE 02 00 70 FE 02 00 84 FE 02 00 94 FE 02 00
A8 FE 02 00 B8 FE 02 00 CC FE 02 00 DC FE 02 00 F0 FE 02 00
00 FF 02 00 14 FF 02 00 24 FF 02 00 38 FF 02 00 48 FF 02 00
5C FF 02 00 6C FF 02 00 90 FF 02 00 A0 FF 02 00 BC 36 22 00
A0 FF 1B 00 00 00 49 4E 50 55 54 20 20 50 41 54 48 20 20 4F
46 20 20 57 41 56 20 20 46 49 4C 45 20 00 19 47 90 FF 3F 24
90 FF AA 36 80 FF AA 36 70 FF AA 36 60 FF AA 36 50 FF AA 36
40 FF AA 36 30 FF 4B 19 FF FF FF FF AB 43 2C FF AE 25 0E 00
90 FF 80 FF 70 FF 60 FF 50 FF 40 FF 30 FF F5 23 2C FF 6F 1E
A0 FF 7B 41 7C 42 06 00 6C 30 30 FF 05 00 03 00 06 00 A6 31
16 00 00 00 A5 25 30 FF BC 36 0C 00 A0 FF 04 00 00 00 4F 70

65 6E 00 00 7B 41 7C 42 06 00 6C 30 30 FF 05 00 03 00 06 00
A6 31 17 00 00 00 A5 25 30 FF BC 36 0A 00 A0 FF 02 00 00 00
30 31 00 00 7B 41 C5 42 06 00 00 00 11 3B 00 00 94 3E 00 00
00 00 0C 31 30 FF 0B 00 03 00 1D 25 A6 31 0B 00 01 00 A5 25
30 FF BC 36 0A 00 A0 FF 02 00 00 00 30 30 00 00 7B 41 C5 42
06 00 00 00 11 3B 00 00 94 3E 00 00 00 00 0C 31 30 FF 0A 00
03 00 1D 25 A6 31 0B 00 01 00 A5 25 30 FF BC 36 0A 00 A0 FF
02 00 00 00 30 30 00 00 7B 41 C5 42 06 00 00 00 11 3B 00 00
94 3E 00 00 00 00 0C 31 30 FF 09 00 03 00 1D 25 A6 31 0B 00
01 00 A5 25 30 FF BC 36 0A 00 A0 FF 02 00 00 00 30 35 00 00
7B 41 C5 42 06 00 00 00 11 3B 00 00 94 3E 00 00 00 00 0C 31
30 FF 08 00 03 00 1D 25 A6 31 0B 00 01 00 A5 25 30 FF BC 36
0A 00 A0 FF 02 00 00 00 30 32 00 00 7B 41 C5 42 06 00 00 00
11 3B 00 00 94 3E 00 00 00 00 0C 31 30 FF 07 00 03 00 1D 25
A6 31 0B 00 01 00 A5 25 30 FF BC 36 0A 00 A0 FF 02 00 00 00
30 32 00 00 7B 41 C5 42 06 00 00 00 11 3B 00 00 94 3E 00 00
00 00 0C 31 30 FF 06 00 03 00 1D 25 A6 31 0B 00 01 00 A5 25
30 FF BC 36 0A 00 A0 FF 02 00 00 00 30 30 00 00 7B 41 C5 42
06 00 00 00 11 3B 00 00 94 3E 00 00 00 00 0C 31 30 FF 05 00
03 00 1D 25 A6 31 0B 00 01 00 A5 25 30 FF BC 36 0A 00 A0 FF
02 00 00 00 30 30 00 00 7B 41 C5 42 06 00 00 00 11 3B 00 00
94 3E 00 00 00 00 0C 31 30 FF 04 00 03 00 1D 25 A6 31 0B 00
01 00 A5 25 30 FF BC 36 0A 00 A0 FF 02 00 00 00 30 33 00 00
7B 41 C5 42 06 00 00 00 11 3B 00 00 94 3E 00 00 00 00 0C 31
30 FF 03 00 03 00 1D 25 A6 31 0B 00 01 00 A5 25 30 FF C5 42
06 00 00 00 11 3B 00 00 94 3E 00 00 00 00 0C 31 30 FF 0B 00
03 00 1D 25 0C 31 40 FF 0B 00 01 00 D2 1D A2 43 28 FF 46 19
5A 1C 5A 1C C5 42 06 00 00 00 11 3B 00 00 94 3E 00 00 00 00
0C 31 50 FF 0A 00 03 00 1D 25 0C 31 60 FF 0B 00 01 00 D2 1D
A2 43 24 FF 46 19 8A 1C 8A 1C C0 37 C5 42 06 00 00 00 11 3B
00 00 94 3E 00 00 00 00 0C 31 70 FF 09 00 03 00 1D 25 0C 31
80 FF 0B 00 01 00 D2 1D A2 43 20 FF 46 19 BA 1C BA 1C C0 37
C5 42 06 00 00 00 11 3B 00 00 94 3E 00 00 00 00 0C 31 90 FF
08 00 03 00 1D 25 0C 31 10 FF 0B 00 01 00 D2 1D A2 43 0C FF
46 19 EA 1C EA 1C C0 37 C5 42 06 00 00 00 11 3B 00 00 94 3E
00 00 00 00 0C 31 FC FE 07 00 03 00 1D 25 0C 31 EC FE 0B 00
01 00 D2 1D A2 43 E8 FE 46 19 1A 1D 1A 1D C0 37 C5 42 06 00
00 00 11 3B 00 00 94 3E 00 00 00 00 0C 31 D8 FE 06 00 03 00
1D 25 0C 31 C8 FE 0B 00 01 00 D2 1D A2 43 C4 FE 46 19 4A 1D
4A 1D C0 37 C5 42 06 00 00 00 11 3B 00 00 94 3E 00 00 00 00
0C 31 B4 FE 05 00 03 00 1D 25 0C 31 A4 FE 0B 00 01 00 D2 1D
A2 43 A0 FE 46 19 7A 1D 7A 1D C0 37 C5 42 06 00 00 00 11 3B
00 00 94 3E 00 00 00 00 0C 31 90 FE 04 00 03 00 1D 25 0C 31
80 FE 0B 00 01 00 D2 1D A2 43 7C FE 46 19 AA 1D AA 1D C0 37
C5 42 06 00 00 00 11 3B 00 00 94 3E 00 00 00 00 0C 31 6C FE
03 00 03 00 1D 25 0C 31 5C FE 0B 00 01 00 D2 1D A2 43 58 FE
46 19 28 14 28 14 C0 37 51 1E A0 FF 4F 47 48 FE C2 25 12 00
28 FF 24 FF 20 FF 0C FF E8 FE C4 FE A0 FE 7C FE 58 FE AE 25
24 00 30 FF 40 FF 50 FF 60 FF 70 FF 80 FF 90 FF 10 FF FC FE

EC FE D8 FE C8 FE B4 FE A4 FE 90 FE 80 FE 6C FE 5C FE C5 42
06 00 00 00 11 3B 00 00 94 3E 00 00 00 00 0C 31 5C FE 0B 00
03 00 1D 25 0C 31 6C FE 0B 00 01 00 D2 1D A2 43 58 FE C5 42
06 00 00 00 11 3B 00 00 94 3E 00 00 00 00 0C 31 80 FE 0A 00
03 00 1D 25 0C 31 90 FE 0B 00 01 00 D2 1D A2 43 7C FE 8D 4C
A2 43 A0 FE C5 42 06 00 00 00 11 3B 00 00 94 3E 00 00 00 00
0C 31 A4 FE 09 00 03 00 1D 25 0C 31 B4 FE 0B 00 01 00 D2 1D
A2 43 C4 FE 8D 4C A2 43 E8 FE C5 42 06 00 00 00 11 3B 00 00
94 3E 00 00 00 00 0C 31 C8 FE 08 00 03 00 1D 25 0C 31 D8 FE
0B 00 01 00 D2 1D A2 43 0C FF 8D 4C A2 43 20 FF C5 42 06 00
00 00 11 3B 00 00 94 3E 00 00 00 00 0C 31 EC FE 07 00 03 00
1D 25 0C 31 FC FE 0B 00 01 00 D2 1D A2 43 24 FF 8D 4C A2 43
28 FF C5 42 06 00 00 00 11 3B 00 00 94 3E 00 00 00 00 0C 31
10 FF 06 00 03 00 1D 25 0C 31 30 FF 0B 00 01 00 D2 1D A2 43
44 FE 8D 4C A2 43 40 FE C5 42 06 00 00 00 11 3B 00 00 94 3E
00 00 00 00 0C 31 40 FF 05 00 03 00 1D 25 0C 31 50 FF 0B 00
01 00 D2 1D A2 43 3C FE 8D 4C A2 43 38 FE C5 42 06 00 00 00
11 3B 00 00 94 3E 00 00 00 00 0C 31 60 FF 04 00 03 00 1D 25
0C 31 70 FF 0B 00 01 00 D2 1D A2 43 34 FE 8D 4C A2 43 30 FE
C5 42 06 00 00 00 11 3B 00 00 94 3E 00 00 00 00 0C 31 80 FF
03 00 03 00 1D 25 0C 31 90 FF 0B 00 01 00 D2 1D A2 43 2C FE
8D 4C A2 43 28 FE 3F 24 48 FE 0A 1C 4B 19 46 20 46 20 A2 43
24 FE 8D 4C A2 43 20 FE F7 35 F0 1E A2 43 1C FE 8D 4C 6F 1E
FC FD 4F 47 0C FE C2 25 28 00 58 FE 7C FE A0 FE C4 FE E8 FE
0C FF 20 FF 24 FF 28 FF 44 FE 40 FE 3C FE 38 FE 34 FE 30 FE
2C FE 28 FE 24 FE 20 FE 1C FE AE 25 24 00 5C FE 6C FE 80 FE
90 FE A4 FE B4 FE C8 FE D8 FE EC FE FC FE 10 FF 30 FF 40 FF
50 FF 60 FF 70 FF 80 FF 90 FF 3F 24 0C FE BE 1D 6F 1E 5C FE
7B 41 C5 42 06 00 00 00 11 3B 00 00 94 3E 00 00 00 00 0C 31
FC FD 11 00 03 00 1D 25 A6 31 00 00 01 00 AE 25 04 00 FC FD
5C FE 3F 24 48 FE 0A 1C 4B 19 92 17 92 17 A2 43 1C FE F7 35
F0 1E A2 43 20 FE 8D 4C 6F 1E 5C FE 7B 41 C5 42 06 00 00 00
11 3B 00 00 94 3E 00 00 00 00 0C 31 FC FD 0F 00 03 00 1D 25
A6 31 00 00 01 00 C2 25 04 00 1C FE 20 FE AE 25 04 00 FC FD
5C FE 3F 24 0C FE BE 1D 6F 1E 5C FE 7B 41 C5 42 06 00 00 00
11 3B 00 00 94 3E 00 00 00 00 0C 31 FC FD 0C 00 03 00 1D 25
A6 31 11 00 01 00 AE 25 04 00 FC FD 5C FE A7 14 04 00 B4 01
44 07 20 00 00 00 00 00 14 00 00 00 03 00 00 00 2C FF 01 00
0C FE 02 00 48 FE 02 00 A4 00 00 00 27 00 00 00 1C FE 01 00
20 FE 01 00 24 FE 01 00 28 FE 01 00 2C FE 01 00 30 FE 01 00
34 FE 01 00 38 FE 01 00 3C FE 01 00 40 FE 01 00 44 FE 01 00
58 FE 01 00 7C FE 01 00 A0 FE 01 00 C4 FE 01 00 E8 FE 01 00
0C FF 01 00 20 FF 01 00 24 FF 01 00 28 FF 01 00 FC FD 02 00
5C FE 02 00 6C FE 02 00 80 FE 02 00 90 FE 02 00 A4 FE 02 00
B4 FE 02 00 C8 FE 02 00 D8 FE 02 00 EC FE 02 00 FC FE 02 00
10 FF 02 00 30 FF 02 00 40 FF 02 00 50 FF 02 00 60 FF 02 00
70 FF 02 00 80 FF 02 00 90 FF 02 00 7C 42 06 00 6C 30 A0 FF
0B 00 03 00 06 00 0C 31 90 FF 0B 00 01 00 D2 1D 6F 1E 70 FF
CD 1E 89 36 80 FF C0 2C 60 FF 7C 42 06 00 6C 30 50 FF 0A 00

03 00 06 00 0C 31 40 FF 0B 00 01 00 D2 1D 6F 1E 20 FF CD 1E
89 36 30 FF C0 2C 10 FF 37 2D 00 FF 7C 42 06 00 6C 30 F0 FE
09 00 03 00 06 00 0C 31 E0 FE 0B 00 01 00 D2 1D 6F 1E C0 FE
CD 1E 89 36 D0 FE C0 2C B0 FE 37 2D A0 FE 7C 42 06 00 6C 30
90 FE 08 00 03 00 06 00 0C 31 80 FE 0B 00 01 00 D2 1D 6F 1E
60 FE CD 1E 89 36 70 FE C0 2C 50 FE 37 2D 40 FE 7C 42 06 00
6C 30 30 FE 07 00 03 00 06 00 0C 31 20 FE 0B 00 01 00 D2 1D
6F 1E 00 FE CD 1E 89 36 10 FE C0 2C F0 FD 37 2D E0 FD 7C 42
06 00 6C 30 D0 FD 06 00 03 00 06 00 0C 31 C0 FD 0B 00 01 00
D2 1D 6F 1E A0 FD CD 1E 89 36 B0 FD C0 2C 90 FD 37 2D 80 FD
7C 42 06 00 6C 30 70 FD 05 00 03 00 06 00 0C 31 60 FD 0B 00
01 00 D2 1D 6F 1E 40 FD CD 1E 89 36 50 FD C0 2C 30 FD 37 2D
20 FD 7C 42 06 00 6C 30 10 FD 04 00 03 00 06 00 0C 31 00 FD
0B 00 01 00 D2 1D 6F 1E E0 FC CD 1E 89 36 F0 FC C0 2C D0 FC
37 2D C0 FC 7C 42 06 00 6C 30 B0 FC 03 00 03 00 06 00 0C 31
A0 FC 0B 00 01 00 D2 1D 6F 1E 80 FC CD 1E 89 36 90 FC C0 2C
70 FC 37 2D 60 FC AE 25 36 00 A0 FF 90 FF 70 FF 50 FF 40 FF
20 FF F0 FE E0 FE C0 FE 90 FE 80 FE 60 FE 30 FE 20 FE 00 FE
D0 FD C0 FD A0 FD 70 FD 60 FD 40 FD 10 FD 00 FD E0 FC B0 FC
A0 FC 80 FC 85 18 64 00 BC 36 26 00 90 FC 1F 00 00 00 20 20
59 4F 55 20 44 49 44 4E 27 54 20 50 55 54 20 41 4C 4C 20 54
48 45 20 56 41 4C 55 45 53 00 19 47 60 FC 3F 24 60 FC E0 36
F0 FC 30 00 AA 36 70 FC AA 36 80 FC AA 36 A0 FC 46 19 9A 25
9A 25 51 1E 50 FD 4F 47 50 FC AE 25 08 00 60 FC 70 FC 80 FC
A0 FC A7 14 38 18 3A 04 7C 42 06 00 6C 30 60 FC 0B 00 03 00
06 00 0C 31 70 FC 0B 00 01 00 D2 1D A2 43 4C FC 09 4D 37 36
02 00 00 00 64 4A 7C 42 06 00 6C 30 80 FC 0A 00 03 00 06 00
0C 31 A0 FC 0B 00 01 00 D2 1D A2 43 48 FC 09 4D 37 36 02 00
00 00 64 4A 81 37 7C 42 06 00 6C 30 B0 FC 09 00 03 00 06 00
0C 31 C0 FC 0B 00 01 00 D2 1D A2 43 44 FC 09 4D 37 36 02 00
00 00 64 4A 81 37 7C 42 06 00 6C 30 D0 FC 08 00 03 00 06 00
0C 31 E0 FC 0B 00 01 00 D2 1D A2 43 40 FC 09 4D 37 36 02 00
00 00 64 4A 81 37 7C 42 06 00 6C 30 00 FD 07 00 03 00 06 00
0C 31 10 FD 0B 00 01 00 D2 1D A2 43 3C FC 09 4D 37 36 02 00
00 00 64 4A 81 37 7C 42 06 00 6C 30 20 FD 06 00 03 00 06 00
0C 31 30 FD 0B 00 01 00 D2 1D A2 43 38 FC 09 4D 37 36 02 00
00 00 64 4A 81 37 7C 42 06 00 6C 30 40 FD 05 00 03 00 06 00
0C 31 60 FD 0B 00 01 00 D2 1D A2 43 34 FC 09 4D 37 36 02 00
00 00 64 4A 81 37 7C 42 06 00 6C 30 70 FD 04 00 03 00 06 00
0C 31 80 FD 0B 00 01 00 D2 1D A2 43 30 FC 09 4D 37 36 02 00
00 00 64 4A 81 37 7C 42 06 00 6C 30 90 FD 03 00 03 00 06 00
0C 31 A0 FD 0B 00 01 00 D2 1D A2 43 2C FC 09 4D 37 36 02 00
00 00 64 4A 81 37 C2 25 12 00 4C FC 48 FC 44 FC 40 FC 3C FC
38 FC 34 FC 30 FC 2C FC AE 25 24 00 60 FC 70 FC 80 FC A0 FC
B0 FC C0 FC D0 FC E0 FC 00 FD 10 FD 20 FD 30 FD 40 FD 60 FD
70 FD 80 FD 90 FD A0 FD 4F 18 70 00 BC 36 32 00 90 FC 2A 00
00 00 20 20 59 4F 55 20 44 49 44 4E 27 54 20 50 55 54 20 32
20 43 48 41 52 20 49 4E 20 41 4C 4C 20 54 48 45 20 50 4C 41
43 45 53 20 00 00 19 47 60 FC 3F 24 60 FC E0 36 F0 FC 30 00

AA 36 70 FC AA 36 80 FC AA 36 A0 FC 46 19 C0 27 C0 27 51 1E
50 FD 4F 47 50 FC AE 25 08 00 60 FC 70 FC 80 FC A0 FC A7 14
38 18 22 02 7C 42 06 00 6C 30 60 FC 0B 00 03 00 06 00 0C 31
70 FC 0B 00 01 00 D2 1D A2 43 2C FC 46 19 FE 25 FE 25 C7 35
46 00 36 4B 7C 42 06 00 6C 30 80 FC 0A 00 03 00 06 00 0C 31
A0 FC 0B 00 01 00 D2 1D A2 43 30 FC 46 19 28 26 28 26 C7 35
46 00 36 4B 81 37 7C 42 06 00 6C 30 B0 FC 09 00 03 00 06 00
0C 31 C0 FC 0B 00 01 00 D2 1D A2 43 34 FC 46 19 52 26 52 26
C7 35 46 00 36 4B 81 37 7C 42 06 00 6C 30 D0 FC 08 00 03 00
06 00 0C 31 E0 FC 0B 00 01 00 D2 1D A2 43 38 FC 46 19 7C 26
7C 26 C7 35 46 00 36 4B 81 37 7C 42 06 00 6C 30 00 FD 07 00
03 00 06 00 0C 31 10 FD 0B 00 01 00 D2 1D A2 43 3C FC 46 19
A6 26 A6 26 C7 35 46 00 36 4B 81 37 7C 42 06 00 6C 30 20 FD
06 00 03 00 06 00 0C 31 30 FD 0B 00 01 00 D2 1D A2 43 40 FC
46 19 D0 26 D0 26 C7 35 46 00 36 4B 81 37 7C 42 06 00 6C 30
40 FD 05 00 03 00 06 00 0C 31 60 FD 0B 00 01 00 D2 1D A2 43
44 FC 46 19 FA 26 FA 26 C7 35 46 00 36 4B 81 37 7C 42 06 00
6C 30 70 FD 04 00 03 00 06 00 0C 31 80 FD 0B 00 01 00 D2 1D
A2 43 48 FC 46 19 24 27 24 27 C7 35 46 00 36 4B 81 37 7C 42
06 00 6C 30 90 FD 03 00 03 00 06 00 0C 31 A0 FD 0B 00 01 00
D2 1D A2 43 4C FC 46 19 F8 27 F8 27 C7 35 46 00 36 4B 81 37
C2 25 12 00 2C FC 30 FC 34 FC 38 FC 3C FC 40 FC 44 FC 48 FC
4C FC AE 25 24 00 60 FC 70 FC 80 FC A0 FC B0 FC C0 FC D0 FC
E0 FC 00 FD 10 FD 20 FD 30 FD 40 FD 60 FD 70 FD 80 FD 90 FD
A0 FD 4F 18 68 00 BC 36 2E 00 90 FC 27 00 00 00 20 20 4E 4F
54 20 41 20 56 41 4C 49 44 20 20 56 41 4C 55 45 20 28 30 20
2D 20 39 20 20 4F 52 20 20 41 20 2D 20 46 29 00 19 47 60 FC
3F 24 60 FC E0 36 F0 FC 30 00 AA 36 70 FC AA 36 80 FC AA 36
A0 FC 46 19 E0 04 E0 04 51 1E 50 FD 4F 47 50 FC AE 25 08 00
60 FC 70 FC 80 FC A0 FC A7 14 7C 42 06 00 6C 30 60 FC 0B 00
03 00 06 00 0C 31 70 FC 0B 00 01 00 D2 1D A2 43 2C FC 46 19
1A 28 1A 28 7C 42 06 00 6C 30 80 FC 0A 00 03 00 06 00 0C 31
A0 FC 0B 00 01 00 D2 1D A2 43 30 FC 46 19 3E 28 3E 28 C0 37
7C 42 06 00 6C 30 B0 FC 09 00 03 00 06 00 0C 31 C0 FC 0B 00
01 00 D2 1D A2 43 34 FC 46 19 62 28 62 28 C0 37 7C 42 06 00
6C 30 D0 FC 08 00 03 00 06 00 0C 31 E0 FC 0B 00 01 00 D2 1D
A2 43 38 FC 46 19 86 28 86 28 C0 37 7C 42 06 00 6C 30 00 FD
07 00 03 00 06 00 0C 31 10 FD 0B 00 01 00 D2 1D A2 43 3C FC
46 19 AA 28 AA 28 C0 37 7C 42 06 00 6C 30 20 FD 06 00 03 00
06 00 0C 31 30 FD 0B 00 01 00 D2 1D A2 43 40 FC 46 19 CE 28
CE 28 C0 37 7C 42 06 00 6C 30 40 FD 05 00 03 00 06 00 0C 31
60 FD 0B 00 01 00 D2 1D A2 43 44 FC 46 19 F2 28 F2 28 C0 37
7C 42 06 00 6C 30 70 FD 04 00 03 00 06 00 0C 31 80 FD 0B 00
01 00 D2 1D A2 43 48 FC 46 19 16 29 16 29 C0 37 7C 42 06 00
6C 30 90 FD 03 00 03 00 06 00 0C 31 A0 FD 0B 00 01 00 D2 1D
A2 43 4C FC 46 19 2C 1C 2C 1C C0 37 51 1E 90 FC 4F 47 1C FC
C2 25 12 00 2C FC 30 FC 34 FC 38 FC 3C FC 40 FC 44 FC 48 FC
4C FC AE 25 24 00 60 FC 70 FC 80 FC A0 FC B0 FC C0 FC D0 FC
E0 FC 00 FD 10 FD 20 FD 30 FD 40 FD 60 FD 70 FD 80 FD 90 FD

A0 FD 7C 42 06 00 6C 30 60 FC 0B 00 03 00 06 00 0C 31 70 FC
0B 00 01 00 D2 1D A2 43 2C FC 7C 42 06 00 6C 30 80 FC 0A 00
03 00 06 00 0C 31 A0 FC 0B 00 01 00 D2 1D A2 43 30 FC 8D 4C
A2 43 34 FC 7C 42 06 00 6C 30 B0 FC 09 00 03 00 06 00 0C 31
C0 FC 0B 00 01 00 D2 1D A2 43 38 FC 8D 4C A2 43 3C FC 7C 42
06 00 6C 30 D0 FC 08 00 03 00 06 00 0C 31 E0 FC 0B 00 01 00
D2 1D A2 43 40 FC 8D 4C A2 43 44 FC 7C 42 06 00 6C 30 00 FD
07 00 03 00 06 00 0C 31 10 FD 0B 00 01 00 D2 1D A2 43 48 FC
8D 4C A2 43 4C FC 7C 42 06 00 6C 30 20 FD 06 00 03 00 06 00
0C 31 30 FD 0B 00 01 00 D2 1D A2 43 18 FC 8D 4C A2 43 14 FC
7C 42 06 00 6C 30 40 FD 05 00 03 00 06 00 0C 31 60 FD 0B 00
01 00 D2 1D A2 43 10 FC 8D 4C A2 43 0C FC 7C 42 06 00 6C 30
70 FD 04 00 03 00 06 00 0C 31 80 FD 0B 00 01 00 D2 1D A2 43
08 FC 8D 4C A2 43 04 FC 7C 42 06 00 6C 30 90 FD 03 00 03 00
06 00 0C 31 A0 FD 0B 00 01 00 D2 1D A2 43 00 FC 8D 4C A2 43
FC FB 3F 24 1C FC 0A 1C 4B 19 56 2B 56 2B A2 43 F8 FB 8D 4C
A2 43 F4 FB F7 35 F0 1E A2 43 F0 FB 8D 4C A2 43 EC FB 2C 3C
06 00 2C 00 CB 3D 14 00 C2 25 2A 00 2C FC 30 FC 34 FC 38 FC
3C FC 40 FC 44 FC 48 FC 4C FC 18 FC 14 FC 10 FC 0C FC 08 FC
04 FC 00 FC FC FB F8 FB F4 FB F0 FB EC FB AE 25 24 00 60 FC
70 FC 80 FC A0 FC B0 FC C0 FC D0 FC E0 FC 00 FD 10 FD 20 FD
30 FD 40 FD 60 FD 70 FD 80 FD 90 FD A0 FD 2C 3C 06 00 2C 00
9F 3D 14 00 36 3D EC FB 4A 20 08 40 7C 42 06 00 6C 30 60 FC
11 00 03 00 06 00 A6 31 00 00 01 00 F5 23 EC FB 2C 3C 06 00
2C 00 CB 3D 14 00 CB 25 EC FB A5 25 60 FC 3F 24 1C FC 0A 1C
4B 19 96 1F 96 1F A2 43 EC FB F7 35 F0 1E A2 43 F0 FB 8D 4C
6F 1E 70 FC 7B 41 7C 42 06 00 6C 30 60 FC 0F 00 03 00 06 00
A6 31 00 00 01 00 C2 25 04 00 EC FB F0 FB AE 25 04 00 60 FC
70 FC 2C 3C 06 00 2C 00 9F 3D 14 00 36 3D EC FB 4A 20 08 40
7C 42 06 00 6C 30 60 FC 0C 00 03 00 06 00 A6 31 11 00 01 00
F5 23 EC FB 2C 3C 06 00 2C 00 CB 3D 14 00 CB 25 EC FB A5 25
60 FC A7 14 04 00 C4 03 48 0A 1C 00 00 00 00 00 10 00 00 00
02 00 00 00 50 FC 02 00 1C FC 02 00 0C 01 00 00 41 00 00 00
EC FB 01 00 F0 FB 01 00 F4 FB 01 00 F8 FB 01 00 FC FB 01 00
00 FC 01 00 04 FC 01 00 08 FC 01 00 0C FC 01 00 10 FC 01 00
14 FC 01 00 18 FC 01 00 2C FC 01 00 30 FC 01 00 34 FC 01 00
38 FC 01 00 3C FC 01 00 40 FC 01 00 44 FC 01 00 48 FC 01 00
4C FC 01 00 60 FC 02 00 70 FC 02 00 80 FC 02 00 A0 FC 02 00
B0 FC 02 00 C0 FC 02 00 D0 FC 02 00 E0 FC 02 00 00 FD 02 00
10 FD 02 00 20 FD 02 00 30 FD 02 00 40 FD 02 00 60 FD 02 00
70 FD 02 00 80 FD 02 00 90 FD 02 00 A0 FD 02 00 C0 FD 02 00
D0 FD 02 00 E0 FD 02 00 F0 FD 02 00 00 FE 02 00 20 FE 02 00
30 FE 02 00 40 FE 02 00 50 FE 02 00 60 FE 02 00 80 FE 02 00
90 FE 02 00 A0 FE 02 00 B0 FE 02 00 C0 FE 02 00 E0 FE 02 00
F0 FE 02 00 00 FF 02 00 10 FF 02 00 20 FF 02 00 40 FF 02 00
50 FF 02 00 60 FF 02 00 70 FF 02 00 90 FF 02 00 A0 FF 02 00
BC 36 0A 00 90 FF 02 00 00 00 30 31 00 00 7B 41 7C 42 06 00
6C 30 A0 FF 0B 00 03 00 06 00 A6 31 0B 00 01 00 A5 25 A0 FF
BC 36 0A 00 90 FF 02 00 00 00 30 35 00 00 7B 41 7C 42 06 00

6C 30 A0 FF 08 00 03 00 06 00 A6 31 0B 00 01 00 A5 25 A0 FF
7C 42 06 00 6C 30 A0 FF 0B 00 03 00 06 00 0C 31 80 FF 0B 00
01 00 D2 1D 6F 1E 70 FF CD 1E 89 36 90 FF C0 2C 60 FF 7C 42
06 00 6C 30 50 FF 0A 00 03 00 06 00 0C 31 40 FF 0B 00 01 00
D2 1D 6F 1E 20 FF CD 1E 89 36 30 FF C0 2C 10 FF 37 2D 00 FF
7C 42 06 00 6C 30 F0 FE 09 00 03 00 06 00 0C 31 E0 FE 0B 00
01 00 D2 1D 6F 1E C0 FE CD 1E 89 36 D0 FE C0 2C B0 FE 37 2D
A0 FE 7C 42 06 00 6C 30 90 FE 08 00 03 00 06 00 0C 31 80 FE
0B 00 01 00 D2 1D 6F 1E 60 FE CD 1E 89 36 70 FE C0 2C 50 FE
37 2D 40 FE 7C 42 06 00 6C 30 30 FE 07 00 03 00 06 00 0C 31
20 FE 0B 00 01 00 D2 1D 6F 1E 00 FE CD 1E 89 36 10 FE C0 2C
F0 FD 37 2D E0 FD 7C 42 06 00 6C 30 D0 FD 06 00 03 00 06 00
0C 31 C0 FD 0B 00 01 00 D2 1D 6F 1E A0 FD CD 1E 89 36 B0 FD
C0 2C 90 FD 37 2D 80 FD 7C 42 06 00 6C 30 70 FD 05 00 03 00
06 00 0C 31 60 FD 0B 00 01 00 D2 1D 6F 1E 40 FD CD 1E 89 36
50 FD C0 2C 30 FD 37 2D 20 FD 7C 42 06 00 6C 30 10 FD 04 00
03 00 06 00 0C 31 00 FD 0B 00 01 00 D2 1D 6F 1E E0 FC CD 1E
89 36 F0 FC C0 2C D0 FC 37 2D C0 FC 7C 42 06 00 6C 30 B0 FC
03 00 03 00 06 00 0C 31 A0 FC 0B 00 01 00 D2 1D 6F 1E 80 FC
CD 1E 89 36 90 FC C0 2C 70 FC 37 2D 60 FC AE 25 36 00 A0 FF
80 FF 70 FF 50 FF 40 FF 20 FF F0 FE E0 FE C0 FE 90 FE 80 FE
60 FE 30 FE 20 FE 00 FE D0 FD C0 FD A0 FD 70 FD 60 FD 40 FD
10 FD 00 FD E0 FC B0 FC A0 FC 80 FC 85 18 64 00 BC 36 26 00
90 FC 1F 00 00 00 20 20 59 4F 55 20 44 49 44 4E 27 54 20 50
55 54 20 41 4C 4C 20 54 48 45 20 56 41 4C 55 45 53 00 19 47
60 FC 3F 24 60 FC E0 36 F0 FC 30 00 AA 36 70 FC AA 36 80 FC
AA 36 A0 FC 46 19 5A 31 5A 31 51 1E 50 FD 4F 47 50 FC AE 25
08 00 60 FC 70 FC 80 FC A0 FC A7 14 38 18 3A 04 7C 42 06 00
6C 30 60 FC 0B 00 03 00 06 00 0C 31 70 FC 0B 00 01 00 D2 1D
A2 43 4C FC 09 4D 37 36 02 00 00 00 64 4A 7C 42 06 00 6C 30
80 FC 0A 00 03 00 06 00 0C 31 A0 FC 0B 00 01 00 D2 1D A2 43
48 FC 09 4D 37 36 02 00 00 00 64 4A 81 37 7C 42 06 00 6C 30
B0 FC 09 00 03 00 06 00 0C 31 C0 FC 0B 00 01 00 D2 1D A2 43
44 FC 09 4D 37 36 02 00 00 00 64 4A 81 37 7C 42 06 00 6C 30
D0 FC 08 00 03 00 06 00 0C 31 E0 FC 0B 00 01 00 D2 1D A2 43
40 FC 09 4D 37 36 02 00 00 00 64 4A 81 37 7C 42 06 00 6C 30
00 FD 07 00 03 00 06 00 0C 31 10 FD 0B 00 01 00 D2 1D A2 43
3C FC 09 4D 37 36 02 00 00 00 64 4A 81 37 7C 42 06 00 6C 30
20 FD 06 00 03 00 06 00 0C 31 30 FD 0B 00 01 00 D2 1D A2 43
38 FC 09 4D 37 36 02 00 00 00 64 4A 81 37 7C 42 06 00 6C 30
40 FD 05 00 03 00 06 00 0C 31 60 FD 0B 00 01 00 D2 1D A2 43
34 FC 09 4D 37 36 02 00 00 00 64 4A 81 37 7C 42 06 00 6C 30
70 FD 04 00 03 00 06 00 0C 31 80 FD 0B 00 01 00 D2 1D A2 43
30 FC 09 4D 37 36 02 00 00 00 64 4A 81 37 7C 42 06 00 6C 30
90 FD 03 00 03 00 06 00 0C 31 A0 FD 0B 00 01 00 D2 1D A2 43
2C FC 09 4D 37 36 02 00 00 00 64 4A 81 37 C2 25 12 00 4C FC
48 FC 44 FC 40 FC 3C FC 38 FC 34 FC 30 FC 2C FC AE 25 24 00
60 FC 70 FC 80 FC A0 FC B0 FC C0 FC D0 FC E0 FC 00 FD 10 FD
20 FD 30 FD 40 FD 60 FD 70 FD 80 FD 90 FD A0 FD 4F 18 70 00

BC 36 32 00 90 FC 2A 00 00 00 20 20 59 4F 55 20 44 49 44 4E
27 54 20 50 55 54 20 32 20 43 48 41 52 20 49 4E 20 41 4C 4C
20 54 48 45 20 50 4C 41 43 45 53 20 00 00 19 47 60 FC 3F 24
60 FC E0 36 F0 FC 30 00 AA 36 70 FC AA 36 80 FC AA 36 A0 FC
46 19 80 33 80 33 51 1E 50 FD 4F 47 50 FC AE 25 08 00 60 FC
70 FC 80 FC A0 FC A7 14 38 18 22 02 7C 42 06 00 6C 30 60 FC
0B 00 03 00 06 00 0C 31 70 FC 0B 00 01 00 D2 1D A2 43 2C FC
46 19 BE 31 BE 31 C7 35 46 00 36 4B 7C 42 06 00 6C 30 80 FC
0A 00 03 00 06 00 0C 31 A0 FC 0B 00 01 00 D2 1D A2 43 30 FC
46 19 E8 31 E8 31 C7 35 46 00 36 4B 81 37 7C 42 06 00 6C 30
B0 FC 09 00 03 00 06 00 0C 31 C0 FC 0B 00 01 00 D2 1D A2 43
34 FC 46 19 12 32 12 32 C7 35 46 00 36 4B 81 37 7C 42 06 00
6C 30 D0 FC 08 00 03 00 06 00 0C 31 E0 FC 0B 00 01 00 D2 1D
A2 43 38 FC 46 19 3C 32 3C 32 C7 35 46 00 36 4B 81 37 7C 42
06 00 6C 30 00 FD 07 00 03 00 06 00 0C 31 10 FD 0B 00 01 00
D2 1D A2 43 3C FC 46 19 66 32 66 32 C7 35 46 00 36 4B 81 37
7C 42 06 00 6C 30 20 FD 06 00 03 00 06 00 0C 31 30 FD 0B 00
01 00 D2 1D A2 43 40 FC 46 19 90 32 90 32 C7 35 46 00 36 4B
81 37 7C 42 06 00 6C 30 40 FD 05 00 03 00 06 00 0C 31 60 FD
0B 00 01 00 D2 1D A2 43 44 FC 46 19 BA 32 BA 32 C7 35 46 00
36 4B 81 37 7C 42 06 00 6C 30 70 FD 04 00 03 00 06 00 0C 31
80 FD 0B 00 01 00 D2 1D A2 43 48 FC 46 19 E4 32 E4 32 C7 35
46 00 36 4B 81 37 7C 42 06 00 6C 30 90 FD 03 00 03 00 06 00
0C 31 A0 FD 0B 00 01 00 D2 1D A2 43 4C FC 46 19 B8 33 B8 33
C7 35 46 00 36 4B 81 37 C2 25 12 00 2C FC 30 FC 34 FC 38 FC
3C FC 40 FC 44 FC 48 FC 4C FC AE 25 24 00 60 FC 70 FC 80 FC
A0 FC B0 FC C0 FC D0 FC E0 FC 00 FD 10 FD 20 FD 30 FD 40 FD
60 FD 70 FD 80 FD 90 FD A0 FD 4F 18 68 00 BC 36 2E 00 90 FC
27 00 00 00 20 20 4E 4F 54 20 41 20 56 41 4C 49 44 20 20 56
41 4C 55 45 20 28 30 20 2D 20 39 20 20 4F 52 20 20 41 20 2D
20 46 29 00 19 47 60 FC 3F 24 60 FC E0 36 F0 FC 30 00 AA 36
70 FC AA 36 80 FC AA 36 A0 FC 46 19 82 23 82 23 51 1E 50 FD
4F 47 50 FC AE 25 08 00 60 FC 70 FC 80 FC A0 FC A7 14 7C 42
06 00 6C 30 60 FC 0B 00 03 00 06 00 0C 31 70 FC 0B 00 01 00
D2 1D A2 43 2C FC 46 19 DA 33 DA 33 7C 42 06 00 6C 30 80 FC
0A 00 03 00 06 00 0C 31 A0 FC 0B 00 01 00 D2 1D A2 43 30 FC
46 19 FE 33 FE 33 C0 37 7C 42 06 00 6C 30 B0 FC 09 00 03 00
06 00 0C 31 C0 FC 0B 00 01 00 D2 1D A2 43 34 FC 46 19 22 34
22 34 C0 37 7C 42 06 00 6C 30 D0 FC 08 00 03 00 06 00 0C 31
E0 FC 0B 00 01 00 D2 1D A2 43 38 FC 46 19 46 34 46 34 C0 37
7C 42 06 00 6C 30 00 FD 07 00 03 00 06 00 0C 31 10 FD 0B 00
01 00 D2 1D A2 43 3C FC 46 19 6A 34 6A 34 C0 37 7C 42 06 00
6C 30 20 FD 06 00 03 00 06 00 0C 31 30 FD 0B 00 01 00 D2 1D
A2 43 40 FC 46 19 8E 34 8E 34 C0 37 7C 42 06 00 6C 30 40 FD
05 00 03 00 06 00 0C 31 60 FD 0B 00 01 00 D2 1D A2 43 44 FC
46 19 B2 34 B2 34 C0 37 7C 42 06 00 6C 30 70 FD 04 00 03 00
06 00 0C 31 80 FD 0B 00 01 00 D2 1D A2 43 48 FC 46 19 D6 34
D6 34 C0 37 7C 42 06 00 6C 30 90 FD 03 00 03 00 06 00 0C 31
A0 FD 0B 00 01 00 D2 1D A2 43 4C FC 46 19 D6 25 D6 25 C0 37

51 1E 90 FC 4F 47 1C FC C2 25 12 00 2C FC 30 FC 34 FC 38 FC
3C FC 40 FC 44 FC 48 FC 4C FC AE 25 24 00 60 FC 70 FC 80 FC
A0 FC B0 FC C0 FC D0 FC E0 FC 00 FD 10 FD 20 FD 30 FD 40 FD
60 FD 70 FD 80 FD 90 FD A0 FD 7C 42 06 00 6C 30 60 FC 0B 00
03 00 06 00 0C 31 70 FC 0B 00 01 00 D2 1D A2 43 2C FC 7C 42
06 00 6C 30 80 FC 0A 00 03 00 06 00 0C 31 A0 FC 0B 00 01 00
D2 1D A2 43 30 FC 8D 4C A2 43 34 FC 7C 42 06 00 6C 30 B0 FC
09 00 03 00 06 00 0C 31 C0 FC 0B 00 01 00 D2 1D A2 43 38 FC
8D 4C A2 43 3C FC 7C 42 06 00 6C 30 D0 FC 08 00 03 00 06 00
0C 31 E0 FC 0B 00 01 00 D2 1D A2 43 40 FC 8D 4C A2 43 44 FC
7C 42 06 00 6C 30 00 FD 07 00 03 00 06 00 0C 31 10 FD 0B 00
01 00 D2 1D A2 43 48 FC 8D 4C A2 43 4C FC 7C 42 06 00 6C 30
20 FD 06 00 03 00 06 00 0C 31 30 FD 0B 00 01 00 D2 1D A2 43
18 FC 8D 4C A2 43 14 FC 7C 42 06 00 6C 30 40 FD 05 00 03 00
06 00 0C 31 60 FD 0B 00 01 00 D2 1D A2 43 10 FC 8D 4C A2 43
0C FC 7C 42 06 00 6C 30 70 FD 04 00 03 00 06 00 0C 31 80 FD
0B 00 01 00 D2 1D A2 43 08 FC 8D 4C A2 43 04 FC 7C 42 06 00
6C 30 90 FD 03 00 03 00 06 00 0C 31 A0 FD 0B 00 01 00 D2 1D
A2 43 00 FC 8D 4C A2 43 FC FB 3F 24 1C FC 0A 1C 4B 19 16 37
16 37 A2 43 F8 FB 8D 4C A2 43 F4 FB F7 35 F0 1E A2 43 F0 FB
8D 4C A2 43 EC FB 2C 3C 06 00 2C 00 CB 3D 14 00 C2 25 2A 00
2C FC 30 FC 34 FC 38 FC 3C FC 40 FC 44 FC 48 FC 4C FC 18 FC
14 FC 10 FC 0C FC 08 FC 04 FC 00 FC FC FB F8 FB F4 FB F0 FB
EC FB AE 25 24 00 60 FC 70 FC 80 FC A0 FC B0 FC C0 FC D0 FC
E0 FC 00 FD 10 FD 20 FD 30 FD 40 FD 60 FD 70 FD 80 FD 90 FD
A0 FD 2C 3C 06 00 2C 00 9F 3D 14 00 36 3D EC FB 4A 20 08 40
7C 42 06 00 6C 30 60 FC 11 00 03 00 06 00 A6 31 00 00 01 00
F5 23 EC FB 2C 3C 06 00 2C 00 CB 3D 14 00 CB 25 EC FB A5 25
60 FC 3F 24 1C FC 0A 1C 4B 19 96 2A 96 2A A2 43 EC FB F7 35
F0 1E A2 43 F0 FB 8D 4C 6F 1E 70 FC 7B 41 7C 42 06 00 6C 30
60 FC 0F 00 03 00 06 00 A6 31 00 00 01 00 C2 25 04 00 EC FB
F0 FB AE 25 04 00 60 FC 70 FC A7 14 04 00 C4 03 5C 0A 1C 00
00 00 00 00 10 00 00 00 02 00 00 00 50 FC 02 00 1C FC 02 00
0C 01 00 00 41 00 00 00 EC FB 01 00 F0 FB 01 00 F4 FB 01 00
F8 FB 01 00 FC FB 01 00 00 FC 01 00 04 FC 01 00 08 FC 01 00
0C FC 01 00 10 FC 01 00 14 FC 01 00 18 FC 01 00 2C FC 01 00
30 FC 01 00 34 FC 01 00 38 FC 01 00 3C FC 01 00 40 FC 01 00
44 FC 01 00 48 FC 01 00 4C FC 01 00 60 FC 02 00 70 FC 02 00
80 FC 02 00 A0 FC 02 00 B0 FC 02 00 C0 FC 02 00 D0 FC 02 00
E0 FC 02 00 00 FD 02 00 10 FD 02 00 20 FD 02 00 30 FD 02 00
40 FD 02 00 60 FD 02 00 70 FD 02 00 80 FD 02 00 90 FD 02 00
A0 FD 02 00 C0 FD 02 00 D0 FD 02 00 E0 FD 02 00 F0 FD 02 00
00 FE 02 00 20 FE 02 00 30 FE 02 00 40 FE 02 00 50 FE 02 00
60 FE 02 00 80 FE 02 00 90 FE 02 00 A0 FE 02 00 B0 FE 02 00
C0 FE 02 00 E0 FE 02 00 F0 FE 02 00 00 FF 02 00 10 FF 02 00
20 FF 02 00 40 FF 02 00 50 FF 02 00 60 FF 02 00 70 FF 02 00
80 FF 02 00 A0 FF 02 00 07 00 03 01 C8 19 01 00 54 02 03 01
A6 15 01 00 04 02 03 01 42 18 01 00 19 02 03 01 D6 06 01 00
53 02 02 00 B0 01 05 00 00 00 02 00 9A 01 06 00 00 00 03 01

9D 01 01 00 C7 00 00 00 00 00 00 00 00 00 00 00 7C 42 06 00
6C 30 A0 FF 04 00 03 00 06 00 0C 31 90 FF 13 00 01 00 D5 1B
68 24 8E FF AE 25 04 00 A0 FF 90 FF EB 23 8E FF CF 35 FD 49
4F 18 D8 01 BC 36 0A 00 7E FF 02 00 00 00 30 31 00 00 7B 41
C5 42 06 00 00 00 11 3B 00 00 94 3E 00 00 00 00 0C 31 90 FF
0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 31 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 33 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 03 00 03 00
1D 25 A6 31 0B 00 01 00 A5 25 90 FF 38 18 E0 25 EB 23 8E FF
D7 35 FD 49 4F 18 D8 01 BC 36 0A 00 7E FF 02 00 00 00 30 31
00 00 7B 41 C5 42 06 00 00 00 11 3B 00 00 94 3E 00 00 00 00
0C 31 90 FF 0B 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 0A 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 09 00 03 00 1D 25 A6 31 0B 00 01 00
A5 25 90 FF BC 36 0A 00 7E FF 02 00 00 00 30 35 00 00 7B 41
C5 42 06 00 00 00 11 3B 00 00 94 3E 00 00 00 00 0C 31 90 FF
08 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 07 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 06 00 03 00 1D 25 A6 31 0B 00 01 00 A5 25 90 FF
BC 36 0A 00 7E FF 02 00 00 00 30 33 00 00 7B 41 C5 42 06 00
00 00 11 3B 00 00 94 3E 00 00 00 00 0C 31 90 FF 05 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 04 00 03 00 1D 25 A6 31 0B 00 01 00
A5 25 90 FF BC 36 0A 00 7E FF 02 00 00 00 30 30 00 00 7B 41

C5 42 06 00 00 00 11 3B 00 00 94 3E 00 00 00 00 0C 31 90 FF
03 00 03 00 1D 25 A6 31 0B 00 01 00 A5 25 90 FF 38 18 FC 23
EB 23 8E FF DF 35 FD 49 4F 18 D8 01 BC 36 0A 00 7E FF 02 00
00 00 30 31 00 00 7B 41 C5 42 06 00 00 00 11 3B 00 00 94 3E
00 00 00 00 0C 31 90 FF 0B 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
0A 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 09 00 03 00 1D 25 A6 31
0B 00 01 00 A5 25 90 FF BC 36 0A 00 7E FF 02 00 00 00 30 35
00 00 7B 41 C5 42 06 00 00 00 11 3B 00 00 94 3E 00 00 00 00
0C 31 90 FF 08 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 07 00 03 00
1D 25 A6 31 0B 00 01 00 A5 25 90 FF BC 36 0A 00 7E FF 02 00
00 00 30 32 00 00 7B 41 C5 42 06 00 00 00 11 3B 00 00 94 3E
00 00 00 00 0C 31 90 FF 06 00 03 00 1D 25 A6 31 0B 00 01 00
A5 25 90 FF BC 36 0A 00 7E FF 02 00 00 00 30 33 00 00 7B 41
C5 42 06 00 00 00 11 3B 00 00 94 3E 00 00 00 00 0C 31 90 FF
05 00 03 00 1D 25 A6 31 0B 00 01 00 A5 25 90 FF BC 36 0A 00
7E FF 02 00 00 00 30 31 00 00 7B 41 C5 42 06 00 00 00 11 3B
00 00 94 3E 00 00 00 00 0C 31 90 FF 04 00 03 00 1D 25 A6 31
0B 00 01 00 A5 25 90 FF BC 36 0A 00 7E FF 02 00 00 00 32 30
00 00 7B 41 C5 42 06 00 00 00 11 3B 00 00 94 3E 00 00 00 00
0C 31 90 FF 03 00 03 00 1D 25 A6 31 0B 00 01 00 A5 25 90 FF
38 18 18 22 EB 23 8E FF E7 35 FD 49 4F 18 D8 01 BC 36 0A 00
7E FF 02 00 00 00 30 31 00 00 7B 41 C5 42 06 00 00 00 11 3B
00 00 94 3E 00 00 00 00 0C 31 90 FF 0B 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 0A 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 09 00 03 00
1D 25 A6 31 0B 00 01 00 A5 25 90 FF BC 36 0A 00 7E FF 02 00
00 00 30 35 00 00 7B 41 C5 42 06 00 00 00 11 3B 00 00 94 3E
00 00 00 00 0C 31 90 FF 08 00 03 00 1D 25 A6 31 0B 00 01 00
A5 25 90 FF BC 36 0A 00 7E FF 02 00 00 00 30 31 00 00 7B 41
C5 42 06 00 00 00 11 3B 00 00 94 3E 00 00 00 00 0C 31 90 FF
07 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 06 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 05 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 04 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E 00 00 00 00 0C 31 90 FF 03 00 03 00 1D 25 A6 31 0B 00 01 00
A5 25 90 FF 38 18 34 20 EB 23 8E FF EF 35 FD 49 4F 18 D8 01
BC 36 0A 00 7E FF 02 00 00 00 30 31 00 00 7B 41 C5 42 06 00
00 00 11 3B 00 00 94 3E 00 00 00 00 0C 31 90 FF 0B 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 0A 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
09 00 03 00 1D 25 A6 31 0B 00 01 00 A5 25 90 FF BC 36 0A 00
7E FF 02 00 00 00 30 35 00 00 7B 41 C5 42 06 00 00 00 11 3B
00 00 94 3E 00 00 00 00 0C 31 90 FF 08 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 07 00 03 00 1D 25 A6 31 0B 00 01 00 A5 25 90 FF
BC 36 0A 00 7E FF 02 00 00 00 30 31 00 00 7B 41 C5 42 06 00
00 00 11 3B 00 00 94 3E 00 00 00 00 0C 31 90 FF 06 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 05 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
04 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 03 00 03 00 1D 25 A6 31
0B 00 01 00 A5 25 90 FF 38 18 50 1E EB 23 8E FF F7 35 FD 49
4F 18 D8 01 BC 36 0A 00 7E FF 02 00 00 00 30 31 00 00 7B 41
C5 42 06 00 00 00 11 3B 00 00 94 3E 00 00 00 00 0C 31 90 FF
0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 31 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 32 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 03 00 03 00

1D 25 A6 31 0B 00 01 00 A5 25 90 FF 38 18 6C 1C EB 23 8E FF
FF 35 FD 49 4F 18 D8 01 BC 36 0A 00 7E FF 02 00 00 00 30 31
00 00 7B 41 C5 42 06 00 00 00 11 3B 00 00 94 3E 00 00 00 00
0C 31 90 FF 0B 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 0A 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 09 00 03 00 1D 25 A6 31 0B 00 01 00
A5 25 90 FF BC 36 0A 00 7E FF 02 00 00 00 30 35 00 00 7B 41
C5 42 06 00 00 00 11 3B 00 00 94 3E 00 00 00 00 0C 31 90 FF
08 00 03 00 1D 25 A6 31 0B 00 01 00 A5 25 90 FF BC 36 0A 00
7E FF 02 00 00 00 30 31 00 00 7B 41 C5 42 06 00 00 00 11 3B
00 00 94 3E 00 00 00 00 0C 31 90 FF 07 00 03 00 1D 25 A6 31
0B 00 01 00 A5 25 90 FF BC 36 0A 00 7E FF 02 00 00 00 30 33
00 00 7B 41 C5 42 06 00 00 00 11 3B 00 00 94 3E 00 00 00 00
0C 31 90 FF 06 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 05 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 04 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
03 00 03 00 1D 25 A6 31 0B 00 01 00 A5 25 90 FF 38 18 88 1A
EB 23 8E FF 07 36 FD 49 4F 18 D8 01 BC 36 0A 00 7E FF 02 00
00 00 30 31 00 00 7B 41 C5 42 06 00 00 00 11 3B 00 00 94 3E
00 00 00 00 0C 31 90 FF 0B 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
0A 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 09 00 03 00 1D 25 A6 31
0B 00 01 00 A5 25 90 FF BC 36 0A 00 7E FF 02 00 00 00 30 35
00 00 7B 41 C5 42 06 00 00 00 11 3B 00 00 94 3E 00 00 00 00
0C 31 90 FF 08 00 03 00 1D 25 A6 31 0B 00 01 00 A5 25 90 FF
BC 36 0A 00 7E FF 02 00 00 00 30 32 00 00 7B 41 C5 42 06 00
00 00 11 3B 00 00 94 3E 00 00 00 00 0C 31 90 FF 07 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 06 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
05 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 04 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 03 00 03 00 1D 25 A6 31 0B 00 01 00 A5 25 90 FF 38 18 A4 18 EB 23 8E FF 0F 36 FD 49 4F 18 D8 01 BC 36 0A 00
7E FF 02 00 00 00 30 31 00 00 7B 41 C5 42 06 00 00 00 11 3B
00 00 94 3E 00 00 00 00 0C 31 90 FF 0B 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 0A 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 09 00 03 00
1D 25 A6 31 0B 00 01 00 A5 25 90 FF BC 36 0A 00 7E FF 02 00
00 00 30 35 00 00 7B 41 C5 42 06 00 00 00 11 3B 00 00 94 3E
00 00 00 00 0C 31 90 FF 08 00 03 00 1D 25 A6 31 0B 00 01 00
A5 25 90 FF BC 36 0A 00 7E FF 02 00 00 00 30 32 00 00 7B 41
C5 42 06 00 00 00 11 3B 00 00 94 3E 00 00 00 00 0C 31 90 FF
07 00 03 00 1D 25 A6 31 0B 00 01 00 A5 25 90 FF BC 36 0A 00
7E FF 02 00 00 00 30 31 00 00 7B 41 C5 42 06 00 00 00 11 3B
00 00 94 3E 00 00 00 00 0C 31 90 FF 06 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 05 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 04 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 03 00 03 00 1D 25 A6 31 0B 00 01 00
A5 25 90 FF 38 18 C0 16 EB 23 8E FF 17 36 FD 49 4F 18 D8 01
BC 36 0A 00 7E FF 02 00 00 00 30 31 00 00 7B 41 C5 42 06 00
00 00 11 3B 00 00 94 3E 00 00 00 00 0C 31 90 FF 0B 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 0A 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
09 00 03 00 1D 25 A6 31 0B 00 01 00 A5 25 90 FF BC 36 0A 00
7E FF 02 00 00 00 30 35 00 00 7B 41 C5 42 06 00 00 00 11 3B
00 00 94 3E 00 00 00 00 0C 31 90 FF 08 00 03 00 1D 25 A6 31
0B 00 01 00 A5 25 90 FF BC 36 0A 00 7E FF 02 00 00 00 30 32
00 00 7B 41 C5 42 06 00 00 00 11 3B 00 00 94 3E 00 00 00 00
0C 31 90 FF 07 00 03 00 1D 25 A6 31 0B 00 01 00 A5 25 90 FF
BC 36 0A 00 7E FF 02 00 00 00 30 32 00 00 7B 41 C5 42 06 00
00 00 11 3B 00 00 94 3E 00 00 00 00 0C 31 90 FF 06 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 05 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
04 00 03 00 1D 25 A6 31 0B 00 01 00 A5 25 90 FF BC 36 0A 00
7E FF 02 00 00 00 30 33 00 00 7B 41 C5 42 06 00 00 00 11 3B
00 00 94 3E 00 00 00 00 0C 31 90 FF 03 00 03 00 1D 25 A6 31
0B 00 01 00 A5 25 90 FF 38 18 DC 14 EB 23 8E FF 1F 36 FD 49

4F 18 D8 01 BC 36 0A 00 7E FF 02 00 00 00 30 31 00 00 7B 41
C5 42 06 00 00 00 11 3B 00 00 94 3E 00 00 00 00 0C 31 90 FF
0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 32 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 33 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 33 00 00 7B 41 C5 42 06 00
00 00 11 3B 00 00 94 3E 00 00 00 00 0C 31 90 FF 03 00 03 00
1D 25 A6 31 0B 00 01 00 A5 25 90 FF 38 18 F8 12 EB 23 8E FF
C7 35 0B 00 FD 49 4F 18 D8 01 BC 36 0A 00 7E FF 02 00 00 00
30 31 00 00 7B 41 C5 42 06 00 00 00 11 3B 00 00 94 3E 00 00
00 00 0C 31 90 FF 0B 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 0A 00
03 00 1D 25 A6 31 0B 00 01 00 A5 25 90 FF BC 36 0A 00 7E FF
02 00 00 00 30 30 00 00 7B 41 C5 42 06 00 00 00 11 3B 00 00
94 3E 00 00 00 00 0C 31 90 FF 09 00 03 00 1D 25 A6 31 0B 00
01 00 A5 25 90 FF BC 36 0A 00 7E FF 02 00 00 00 30 35 00 00
7B 41 C5 42 06 00 00 00 11 3B 00 00 94 3E 00 00 00 00 0C 31
90 FF 08 00 03 00 1D 25 A6 31 0B 00 01 00 A5 25 90 FF BC 36
0A 00 7E FF 02 00 00 00 30 32 00 00 7B 41 C5 42 06 00 00 00
11 3B 00 00 94 3E 00 00 00 00 0C 31 90 FF 07 00 03 00 1D 25
A6 31 0B 00 01 00 A5 25 90 FF BC 36 0A 00 7E FF 02 00 00 00
30 34 00 00 7B 41 C5 42 06 00 00 00 11 3B 00 00 94 3E 00 00
00 00 0C 31 90 FF 06 00 03 00 1D 25 A6 31 0B 00 01 00 A5 25
90 FF BC 36 0A 00 7E FF 02 00 00 00 35 30 00 00 7B 41 C5 42
06 00 00 00 11 3B 00 00 94 3E 00 00 00 00 0C 31 90 FF 05 00
03 00 1D 25 A6 31 0B 00 01 00 A5 25 90 FF BC 36 0A 00 7E FF
02 00 00 00 30 32 00 00 7B 41 C5 42 06 00 00 00 11 3B 00 00
94 3E 00 00 00 00 0C 31 90 FF 04 00 03 00 1D 25 A6 31 0B 00
01 00 A5 25 90 FF BC 36 0A 00 7E FF 02 00 00 00 30 46 00 00
7B 41 C5 42 06 00 00 00 11 3B 00 00 94 3E 00 00 00 00 0C 31
90 FF 03 00 03 00 1D 25 A6 31 0B 00 01 00 A5 25 90 FF 38 18
12 11 EB 23 8E FF C7 35 0C 00 FD 49 4F 18 D8 01 BC 36 0A 00

7E FF 02 00 00 00 30 31 00 00 7B 41 C5 42 06 00 00 00 11 3B
00 00 94 3E 00 00 00 00 0C 31 90 FF 0B 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 0A 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 09 00 03 00
1D 25 A6 31 0B 00 01 00 A5 25 90 FF BC 36 0A 00 7E FF 02 00
00 00 30 35 00 00 7B 41 C5 42 06 00 00 00 11 3B 00 00 94 3E
00 00 00 00 0C 31 90 FF 08 00 03 00 1D 25 A6 31 0B 00 01 00
A5 25 90 FF BC 36 0A 00 7E FF 02 00 00 00 30 32 00 00 7B 41
C5 42 06 00 00 00 11 3B 00 00 94 3E 00 00 00 00 0C 31 90 FF
07 00 03 00 1D 25 A6 31 0B 00 01 00 A5 25 90 FF BC 36 0A 00
7E FF 02 00 00 00 30 34 00 00 7B 41 C5 42 06 00 00 00 11 3B
00 00 94 3E 00 00 00 00 0C 31 90 FF 06 00 03 00 1D 25 A6 31
0B 00 01 00 A5 25 90 FF BC 36 0A 00 7E FF 02 00 00 00 35 38
00 00 7B 41 C5 42 06 00 00 00 11 3B 00 00 94 3E 00 00 00 00
0C 31 90 FF 05 00 03 00 1D 25 A6 31 0B 00 01 00 A5 25 90 FF
BC 36 0A 00 7E FF 02 00 00 00 30 32 00 00 7B 41 C5 42 06 00
00 00 11 3B 00 00 94 3E 00 00 00 00 0C 31 90 FF 04 00 03 00
1D 25 A6 31 0B 00 01 00 A5 25 90 FF BC 36 0A 00 7E FF 02 00
00 00 30 33 00 00 7B 41 C5 42 06 00 00 00 11 3B 00 00 94 3E
00 00 00 00 0C 31 90 FF 03 00 03 00 1D 25 A6 31 0B 00 01 00
A5 25 90 FF 38 18 2C 0F EB 23 8E FF C7 35 0D 00 FD 49 4F 18
D8 01 BC 36 0A 00 7E FF 02 00 00 00 30 31 00 00 7B 41 C5 42
06 00 00 00 11 3B 00 00 94 3E 00 00 00 00 0C 31 90 FF 0B 00
03 00 1D 25 A6 31 0B 00 01 00 A5 25 90 FF BC 36 0A 00 7E FF
02 00 00 00 30 30 00 00 7B 41 C5 42 06 00 00 00 11 3B 00 00
94 3E 00 00 00 00 0C 31 90 FF 0A 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 09 00 03 00 1D 25 A6 31 0B 00 01 00 A5 25 90 FF BC 36
0A 00 7E FF 02 00 00 00 30 35 00 00 7B 41 C5 42 06 00 00 00
11 3B 00 00 94 3E 00 00 00 00 0C 31 90 FF 08 00 03 00 1D 25
A6 31 0B 00 01 00 A5 25 90 FF BC 36 0A 00 7E FF 02 00 00 00
30 33 00 00 7B 41 C5 42 06 00 00 00 11 3B 00 00 94 3E 00 00
00 00 0C 31 90 FF 07 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 06 00
03 00 1D 25 A6 31 0B 00 01 00 A5 25 90 FF BC 36 0A 00 7E FF
02 00 00 00 30 35 00 00 7B 41 C5 42 06 00 00 00 11 3B 00 00
94 3E 00 00 00 00 0C 31 90 FF 05 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 04 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 03 00 03 00 1D 25
A6 31 0B 00 01 00 A5 25 90 FF 38 18 46 0D EB 23 8E FF C7 35
0E 00 FD 49 4F 18 D8 01 BC 36 0A 00 7E FF 02 00 00 00 30 31

00 00 7B 41 C5 42 06 00 00 00 11 3B 00 00 94 3E 00 00 00 00
0C 31 90 FF 0B 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 0A 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 09 00 03 00 1D 25 A6 31 0B 00 01 00
A5 25 90 FF BC 36 0A 00 7E FF 02 00 00 00 30 35 00 00 7B 41
C5 42 06 00 00 00 11 3B 00 00 94 3E 00 00 00 00 0C 31 90 FF
08 00 03 00 1D 25 A6 31 0B 00 01 00 A5 25 90 FF BC 36 0A 00
7E FF 02 00 00 00 30 34 00 00 7B 41 C5 42 06 00 00 00 11 3B
00 00 94 3E 00 00 00 00 0C 31 90 FF 07 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 06 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 05 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 04 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
03 00 03 00 1D 25 A6 31 0B 00 01 00 A5 25 90 FF 38 18 60 0B
EB 23 8E FF C7 35 0F 00 FD 49 4F 18 D8 01 BC 36 0A 00 7E FF
02 00 00 00 30 31 00 00 7B 41 C5 42 06 00 00 00 11 3B 00 00
94 3E 00 00 00 00 0C 31 90 FF 0B 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 0A 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 09 00 03 00 1D 25
A6 31 0B 00 01 00 A5 25 90 FF BC 36 0A 00 7E FF 02 00 00 00
30 35 00 00 7B 41 C5 42 06 00 00 00 11 3B 00 00 94 3E 00 00
00 00 0C 31 90 FF 08 00 03 00 1D 25 A6 31 0B 00 01 00 A5 25
90 FF BC 36 0A 00 7E FF 02 00 00 00 30 34 00 00 7B 41 C5 42
06 00 00 00 11 3B 00 00 94 3E 00 00 00 00 0C 31 90 FF 07 00
03 00 1D 25 A6 31 0B 00 01 00 A5 25 90 FF BC 36 0A 00 7E FF
02 00 00 00 30 46 00 00 7B 41 C5 42 06 00 00 00 11 3B 00 00
94 3E 00 00 00 00 0C 31 90 FF 06 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 05 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 04 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 03 00 03 00 1D 25 A6 31 0B 00 01 00 A5 25
90 FF 38 18 7A 09 EB 23 8E FF C7 35 10 00 FD 49 4F 18 D8 01
BC 36 0A 00 7E FF 02 00 00 00 30 31 00 00 7B 41 C5 42 06 00

00 00 11 3B 00 00 94 3E 00 00 00 00 0C 31 90 FF 0B 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 0A 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
09 00 03 00 1D 25 A6 31 0B 00 01 00 A5 25 90 FF BC 36 0A 00
7E FF 02 00 00 00 30 35 00 00 7B 41 C5 42 06 00 00 00 11 3B
00 00 94 3E 00 00 00 00 0C 31 90 FF 08 00 03 00 1D 25 A6 31
0B 00 01 00 A5 25 90 FF BC 36 0A 00 7E FF 02 00 00 00 30 43
00 00 7B 41 C5 42 06 00 00 00 11 3B 00 00 94 3E 00 00 00 00
0C 31 90 FF 07 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 06 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 05 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
04 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 03 00 03 00 1D 25 A6 31
0B 00 01 00 A5 25 90 FF 38 18 94 07 EB 23 8E FF C7 35 11 00
FD 49 4F 18 D8 01 BC 36 0A 00 7E FF 02 00 00 00 30 31 00 00
7B 41 C5 42 06 00 00 00 11 3B 00 00 94 3E 00 00 00 00 0C 31
90 FF 0B 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 0A 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 09 00 03 00 1D 25 A6 31 0B 00 01 00 A5 25
90 FF BC 36 0A 00 7E FF 02 00 00 00 30 35 00 00 7B 41 C5 42
06 00 00 00 11 3B 00 00 94 3E 00 00 00 00 0C 31 90 FF 08 00
03 00 1D 25 A6 31 0B 00 01 00 A5 25 90 FF BC 36 0A 00 7E FF
02 00 00 00 30 43 00 00 7B 41 C5 42 06 00 00 00 11 3B 00 00
94 3E 00 00 00 00 0C 31 90 FF 07 00 03 00 1D 25 A6 31 0B 00
01 00 A5 25 90 FF BC 36 0A 00 7E FF 02 00 00 00 30 31 00 00
7B 41 C5 42 06 00 00 00 11 3B 00 00 94 3E 00 00 00 00 0C 31
90 FF 06 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 05 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 04 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 03 00
03 00 1D 25 A6 31 0B 00 01 00 A5 25 90 FF 38 18 AE 05 EB 23
8E FF C7 35 12 00 FD 49 4F 18 D8 01 BC 36 0A 00 7E FF 02 00
00 00 30 31 00 00 7B 41 C5 42 06 00 00 00 11 3B 00 00 94 3E 00 00 00 00 0C 31 90 FF 0B 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
0A 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 09 00 03 00 1D 25 A6 31
0B 00 01 00 A5 25 90 FF BC 36 0A 00 7E FF 02 00 00 00 30 35
00 00 7B 41 C5 42 06 00 00 00 11 3B 00 00 94 3E 00 00 00 00
0C 31 90 FF 08 00 03 00 1D 25 A6 31 0B 00 01 00 A5 25 90 FF
BC 36 0A 00 7E FF 02 00 00 00 30 43 00 00 7B 41 C5 42 06 00
00 00 11 3B 00 00 94 3E 00 00 00 00 0C 31 90 FF 07 00 03 00
1D 25 A6 31 0B 00 01 00 A5 25 90 FF BC 36 0A 00 7E FF 02 00
00 00 30 32 00 00 7B 41 C5 42 06 00 00 00 11 3B 00 00 94 3E
00 00 00 00 0C 31 90 FF 06 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
05 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 04 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 03 00 03 00 1D 25 A6 31 0B 00 01 00 A5 25 90 FF
38 18 C8 03 EB 23 8E FF C7 35 13 00 FD 49 4F 18 D8 01 BC 36
0A 00 7E FF 02 00 00 00 30 31 00 00 7B 41 C5 42 06 00 00 00
11 3B 00 00 94 3E 00 00 00 00 0C 31 90 FF 0B 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 0A 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 09 00
03 00 1D 25 A6 31 0B 00 01 00 A5 25 90 FF BC 36 0A 00 7E FF
02 00 00 00 30 35 00 00 7B 41 C5 42 06 00 00 00 11 3B 00 00
94 3E 00 00 00 00 0C 31 90 FF 08 00 03 00 1D 25 A6 31 0B 00
01 00 A5 25 90 FF BC 36 0A 00 7E FF 02 00 00 00 30 43 00 00
7B 41 C5 42 06 00 00 00 11 3B 00 00 94 3E 00 00 00 00 0C 31
90 FF 07 00 03 00 1D 25 A6 31 0B 00 01 00 A5 25 90 FF BC 36
0A 00 7E FF 02 00 00 00 30 33 00 00 7B 41 C5 42 06 00 00 00
11 3B 00 00 94 3E 00 00 00 00 0C 31 90 FF 06 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 05 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 04 00
03 00 1D 25 A6 31 0B 00 01 00 A5 25 90 FF BC 36 0A 00 7E FF
02 00 00 00 30 30 00 00 7B 41 C5 42 06 00 00 00 11 3B 00 00
94 3E 00 00 00 00 0C 31 90 FF 03 00 03 00 1D 25 A6 31 0B 00
01 00 A5 25 90 FF 38 18 E2 01 EB 23 8E FF C7 35 14 00 FD 49
4F 18 D4 01 BC 36 0A 00 7E FF 02 00 00 00 30 31 00 00 7B 41
C5 42 06 00 00 00 11 3B 00 00 94 3E 00 00 00 00 0C 31 90 FF 0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 43 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 46 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 03 00 03 00
1D 25 A6 31 0B 00 01 00 A5 25 90 FF A7 14 04 00 32 00 EA 27
14 00 00 00 00 00 08 00 00 00 00 00 00 00 10 00 00 00 02 00
00 00 90 FF 02 00 A0 FF 02 00 00 00 30 01 34 00 56 53 5F 56
45 52 53 49 4F 4E 5F 49 4E 46 4F 00 BD 04 EF FE 00 00 01 00
00 00 01 00 00 00 00 00 00 00 01 00 00 00 00 00 00 00 00 00
00 00 00 00 01 00 01 00 01 00 00 00 00 00 00 00 00 00 00 00
00 00 00 00 24 00 00 00 56 61 72 46 69 6C 65 49 6E 66 6F 00
14 00 04 00 54 72 61 6E 73 6C 61 74 69 6F 6E 00 09 08 E4 04
C4 00 00 00 53 74 72 69 6E 67 46 69 6C 65 49 6E 66 6F 00 00
B0 00 00 00 30 38 30 39 30 34 45 34 00 00 00 00 14 00 02 00
43 6F 6D 70 61 6E 79 4E 61 6D 65 00 20 00 00 00 18 00 05 00
50 72 6F 64 75 63 74 4E 61 6D 65 00 42 49 4E 31 00 00 00 00
18 00 05 00 46 69 6C 65 56 65 72 73 69 6F 6E 00 31 2E 30 30
00 00 00 00 1C 00 05 00 50 72 6F 64 75 63 74 56 65 72 73 69
6F 6E 00 00 31 2E 30 30 00 00 00 00 1C 00 06 00 49 6E 74 65
72 6E 61 6C 4E 61 6D 65 00 00 00 00 4F 5A 42 49 4E 00 00 00
24 00 0A 00 4F 72 69 67 69 6E 61 6C 46 69 6C 65 6E 61 6D 65
00 00 00 00 4F 5A 42 49 4E 2E 45 58 45 00 00 00 00 00 01 00
02 00 20 20 02 00 01 00 01 00 30 01 00 00 31 75 20 20 10 00
01 00 04 00 E8 02 00 00 32 75 00 00 00 00 00 00 00 00 00 00
00 00 00 00 28 00 00 00 20 00 00 00 40 00 00 00 01 00 04 00
00 00 00 00 80 02 00 00 00 00 00 00 00 00 00 00 00 00 00 00
00 00 00 00 00 00 00 00 00 00 80 00 00 80 00 00 00 80 80 00
80 00 00 00 80 00 80 00 80 80 00 00 80 80 80 00 C0 C0 C0 00
00 00 FF 00 00 FF 00 00 00 FF FF 00 FF 00 00 00 FF 00 FF 00
FF FF 00 00 FF FF FF 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00

00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 8F FF 07 70 00 00 00
00 00 00 00 00 00 00 8F FF FF FF 07 77 70 00 00 00 00 00 00
08 FF FF FF FF FF FF 07 77 77 70 00 00 00 00 FF FF FF FF FF
FF FF FF 07 77 70 00 00 00 00 00 FF FF FF FF FF FF FF FF 07
70 00 00 00 00 00 00 FF FF FF FF FF FF FF FF 00 00 00 00 00
00 00 00 FF FF FF FF FF FF FF FF 00 00 00 00 00 00 00 00 FF
FF FF FF FF FF FF FF 00 00 00 00 00 00 00 00 FF FF FF FF FF
FF FF FF 00 00 00 00 00 00 00 00 FF FF FF FF FF FF FF FF 00
00 00 00 00 00 00 00 FF FF FF FF FF FF FF FF 00 00 00 00 00
00 00 00 FF FF FF FF FF FF FF FF 00 00 00 00 00 00 00 00 FF
FF FF FF FF FF 88 88 00 00 00 00 00 00 00 00 FF FF FF FF 88
88 00 00 00 00 00 00 00 00 00 00 FF FF 88 88 00 00 EE EE 00
00 00 00 00 00 00 00 88 88 00 00 EE EE 00 00 00 00 00 00 00
00 00 00 00 00 EE EE 00 00 00 00 00 00 00 00 00 00 00 00 EE
EE 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
FF FF FF FF FF FF FF FF FF FF FF FF FF FF FF FF FF FF FF FF
FF FF C1 FF FF FC 00 7F FF 80 00 1F F8 00 00 07 F8 00 00 1F
F8 00 00 7F F8 00 01 FF F8 00 01 FF F8 00 01 FF F8 00 01 FF
F8 00 01 FF F8 00 01 FF F8 00 01 FF F8 00 01 FF F8 00 01 FF
F8 00 01 FF F8 00 01 FF F8 00 3F FF F8 03 FF FF F8 3F FF FF
FB FF FF FF FF FF FF FF FF FF FF FF FF FF FF FF FF FF FF FF
FF FF FF FF FF FF FF FF 00 00 00 00 00 00 00 00 28 00 00 00
20 00 00 00 40 00 00 00 01 00 01 00 00 00 00 00 00 01 00 00
00 00 00 00 00 00 00 00 00 00 00 00 00 00 00 00 00 00 00 00
FF FF FF 00 FF FF FF FF FF FF FF FF FF FF FF FF FF FF FF FF
FF FF FF FF FF FF C1 FF FF FC 3C 7F FF C3 FC 1F F8 3F FC 07
FB FF FC 1F FB FF FC 7F FB FF FD FF FB FF FD FF FB FF FD FF
FB FF FD FF FB FF FD FF FB FF FD FF FB FF FD FF FB FF FD FF
FB FF C1 FF FB FC 3D FF FB C3 C1 FF F8 3C 3F FF FB C3 FF FF
F8 3F FF FF FB FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF C1 FF FF FC 00 7F
FF C0 00 1F F8 00 00 07 F8 00 00 1F F8 00 00 7F F8 00 01 FF
F8 00 01 FF F8 00 01 FF F8 00 01 FF F8 00 01 FF F8 00 01 FF
F8 00 01 FF F8 00 01 FF F8 00 01 FF F8 00 01 FF F8 00 01 FF
F8 00 3F FF F8 03 FF FF F8 3F FF FF FB FF FF FF FF FF FF FF
FF FF FF FF FF FF FF FF FF FF FF FF FF FF FF FF FF FF FF FF
10 00 00 00 67 CB 75 1A A3 F5 1C 10 8B 7B 9A F8 C4 8E 68 E6
00 00 00 00 00 00 00 00 00 00 00 00 10 00 00 00 65 CB 75 1A
A3 F5 1C 10 8B 7B 9A F8 C4 8E 68 E6 00 00 00 00 00 00 00 00
00 00 00 00 53 4C 54 47 04 00 09 00 23 00 01 00 FF 04 02 00

00 00 00 00 C0 00 00 00 00 00 00 46 34 00 00 00 00 00 FF FF
0D 01 00 00 18 00 02 00 DD 00 00 00 0D 00 03 00 BA 04 00 00
09 00 00 00 01 43 6F 6D 70 4F 62 6A 00 64 69 72 00 31 35 62
34 34 32 34 36 32 38 00 31 34 62 34 34 32 34 36 32 38 00 00
00 00 00 00 00 00 00 00 01 05 22 00 00 00 FF FF FF FF 84 00
00 00 FF FF FF FF 01 00 00 00 00 00 FC FF 82 00 02 03 28 00
00 00 DF 00 FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF 08 00 00 00 01 00 02 80 FF FF
00 00 FF FF 01 00 00 00 00 08 00 2A 5C 52 65 32 2A 23 34 DF
05 00 FF FF 01 4A 00 00 00 4A 00 FF FF FF FF 00 80 12 00 00
00 02 40 FE FF FF FF 1D 00 00 00 4C 12 2C 00 2A 00 9A 00 03
60 FE FF FF FF FF FF 01 80 19 00 1C 00 4C 12 FF FF 40 00 B0
00 03 60 FE FF FF FF FF FF 01 80 19 00 20 00 16 00 FF FF 2C
00 FF FF 02 00 00 00 01 00 00 00 16 00 FF FF 00 00 2C 00 FF
FF 00 00 FF FF FF FF 00 00 00 00 00 00 00 00 04 00 01 00 00
00 00 00 24 00 FF FF FF FF FF FF FF FF 04 00 42 00 01 05 22
00 00 00 FF FF FF FF 84 00 00 00 FF FF FF FF 01 00 00 00 00
00 FC FF 82 00 02 03 28 00 00 00 DF 00 FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF 08
00 00 00 01 00 02 80 FF FF 00 00 FF FF 01 00 00 00 00 08 00
2A 5C 52 65 32 2A 23 34 DF 05 00 FF FF 01 1A 00 00 00 4A 00
FF FF FF FF 00 80 12 00 00 00 02 40 FE FF FF FF 1D 00 00 00
FF FF FF FF 00 00 00 00 01 00 00 00 FF FF FF FF 00 00 FF FF
FF FF 00 00 FF FF FF FF 00 00 00 00 00 00 00 00 04 00 01 00
00 00 00 00 1C 00 FF FF FF FF FF FF FF FF 01 00 16 00 CC 51
04 00 00 00 FF FF FF FF FF FF 00 00 00 00 00 00 09 04 00 00
01 00 00 00 01 00 00 00 00 00 00 00 00 00 00 00 00 00 00 00
00 00 00 00 FF FF FF FF FF FF FF FF FF FF FF FF FF FF FF FF
00 00 FF FF 01 00 FF FF FF FF FF FF FF FF FF FF FF FF FF FF
FF FF FF FF FF FF FF FF FF FF FF FF FF FF FF FF FF FF FF FF
FF FF FF FF FF FF FF FF 02 00 0A 00 31 34 62 34 34 32 34 36
32 38 0A 00 31 31 62 34 34 32 34 36 32 37 FF FF 0E 00 00 00
FF FF 00 00 00 00 FF FF 65 CB 75 1A A3 F5 1C 10 8B 7B 9A F8
C4 8E 68 E6 04 00 0A 00 31 35 62 34 34 32 34 36 32 38 0A 00
31 33 62 34 34 32 34 36 32 37 FF FF 1C 00 00 00 FF FF 00 00
00 00 FF FF 67 CB 75 1A A3 F5 1C 10 8B 7B 9A F8 C4 8E 68 E6
04 00 EA 00 00 00 00 00 00 00 00 00 00 02 01 20 02 00 00 FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF E2 00 FF FF FF FF FF FF FF FF FF FF FF FF FF FF FF
FF FF FF FF FF FF FF FF FF FF FF FF FF FF FF 40 00 FF FF FF
FF FF FF FF FF FF FF FF FF FF FF FF FF FF FF FF FF FF FF FF
FF FF FF FF FF FF FF FF FF FF FF FF FF FF FF FF FF FF FF FF

FF FF FF FF FF FF FF FF FF FF FF FF FF 9A 00 FF FF FF FF FF
FF FF FF FF FF FF FF FF FF FF FF FF FF FF FF FF FF FF FF FF 56
00 FF FF FF FF 70 00 FF FF FF FF FF FF FF FF FF FF FF FF FF FF
FF D2 00 FF FF FF FF FF FF FF FF FF FF FF FF FF FF FF FF FF FF
FF FF FF FF FF FF FF FF FF FF FF FF FF FF FF FF FF FF FF FF FF
FF FF FF 2A 00 FF FF 0E 00 1C 00 FF FF FF FF FF FF FF FF FF FF
FF FF FF FF FF FF FF FF FF FF FF FF FF FF FF FF FF FF FF FF FF
FF FF FF FF FF FF FF FF FF FF FF FF FF FF FF FF FF FF FF FF FF
FF FF FF FF FF FF FF 00 00 FF FF FF FF FF FF FF FF FF FF FF FF
FF FF FF FF FF FF FF FF FF FF FF FF FF FF FF FF FF FF FF FF FF
FF C2 00 FF FF FF FF FF FF FF FF FF FF FF FF FF FF FF FF FF AA
00 FF FF FF FF FF FF FF FF FF FF FF FF FF FF FF FF FF FF FF FF
FF FF FF FF FF FF FF FF FF FF FF FF FF FF FF FF FF FF FF FF FF
FF FF FF FF FF 84 00 FF FF FF FF FF FF FF FF FF FF FF FF FF FF
FF FF FF FF FF FF FF FF FF FF FF FF FF FF FF FF FF FF FF FF FF
FF FF FF FF FF FF FF FF FF FF FF FF FF FF FF FF FF FF FF FF FF
FF FF FF FF FF FF FF FF FF FF FF FF FF FF FF FF FF FF FF FF FF
FF FF FF FF FF FF FF FF FF FF FF FF 20 00 FF FF 67 3D 38 2F 67
3D 1A 24 67 3D 84 20 67 3D 90 21 67 3D 46 92 97 0A DE 94 97
0A 44 99 00 00 FF FF 01 46 01 00 00 A4 D9 FF FF FF FF C0 FF
42 49 4E 31 00 00 86 1B FF FF FF FF E2 FF 46 6F 72 6D 31 00
87 1B FF FF FF FF E2 FF 46 6F 72 6D 32 00 84 F5 FF FF FF FF
20 00 53 54 41 52 54 5F 50 4C 41 59 49 4E 47 00 3A 10 FF FF
FF FF 20 00 73 74 6F 70 5F 70 6C 61 79 69 6E 67 00 69 64 6D
FF FF FF FF 28 00 47 65 74 54 79 70 65 49 6E 66 6F 43 6F 75
6E 74 00 00 67 50 FF FF FF FF 28 00 47 65 74 54 79 70 65 49
6E 66 6F 00 D5 11 FF FF FF FF 28 00 47 65 74 49 44 73 4F 66
4E 61 6D 65 73 00 57 F8 FF FF FF FF 28 00 49 6E 76 6F 6B 65
00 00 BE 8E FF FF FF FF 28 00 51 75 65 72 79 49 6E 74 65 72
66 61 63 65 00 00 B5 B8 FF FF FF FF 28 00 41 64 64 52 65 66
00 00 6F 61 FF FF FF FF 28 00 52 65 6C 65 61 73 65 00 2A 60
FF FF FF FF C0 FF 2A 5C 47 7B 30 30 30 32 30 34 33 30 2D 30
30 30 30 2D 30 30 30 30 2D 43 30 30 30 2D 30 30 30 30 30 30
30 30 30 30 30 34 36 7D 23 31 2E 30 23 30 23 43 3A 5C 57 49 4E
44 4F 57 53 5C 53 59 53 54 45 4D 5C 73 74 64 6F 6C 65 2E 74
6C 62 23 4F 4C 45 20 41 75 74 6F 6D 61 74 69 6F 6E 00 01 18
00 01 20 00 00 00 FF FF FF FF FF FF FF FF FF FF FF FF 0F 00
00 00 FF FF 1D 00 01 00 FF FF 08 00 FF FF 1C D3 10 00 02 00
FF FF 04 00 00 00 01 00 24 00 00 00 10 00 00 00 00 00 20 44
00 00 A0 00 90 80 00 00 01 00 00 00 00 00 00 00 20 40 00 00
A0 00 90 80 00 00 01 00 01 00 FE FF 03 0A 00 00 FF FF FF FF
FF 04 02 00 00 00 00 00 C0 00 00 00 00 00 00 00 46 08 00 00 00
54 59 50 45 4C 49 42 00 FF FF FF FF 00 02 00 00 00 00 00 00

We claim:

1. A method for generating control instructions for a computer controlled toy system, the method comprising:

selecting at least one command from among a plurality of commands associated with a toy;

generating control instructions for the toy comprising said at least one command, said control instructions including at least one command selected from among the following commands:

commands instructing the toy to verbally prompt a user, and commands instructing the toy to await a verbal response from the user and to transmit the verbal response to the computer which controls the toy.

2. A method according to claim 1 wherein at least one of the step of selecting a toy and the step of selecting at least one command comprises utilizing a graphical user interface.

3. A method according to claim 1 wherein the step of selecting at least one command comprises:

choosing a command; and specifying at least one control parameter associated with said chosen command.

4. A method according to claim 3 wherein said at least one control parameter comprises at least one condition depending on a result of a previous command.

5. A method according to claim 4 wherein said previous command comprises a previous command associated with a second toy.

6. A method according to claim 3 wherein said at least one control parameter comprises an execution condition controlling execution of said command.

7. A method according to claim 6 wherein said execution condition comprises a time at which to perform said command.

8. A method according to claim 3 wherein said execution condition comprises a time at which to cease performing said command.

9. A method according to claim 3 wherein said execution condition comprises a status of said toy.

10. A method according to claim 3 wherein said at least one control parameter comprises a command modifier modifying execution of the command.

11. A method according to claim 3 wherein said at least one control parameter comprises a condition dependent on a future event.

12. A method according to claim 1 wherein said at least one command comprises a command to cancel a previous command.

13. A method for generating control instructions for a computer controlled toy system including a computer which controls at least one toy and a computer display, the method comprising:

displaying a menu indicating a plurality of commands which are selectable for the toy, said plurality of commands including commands instructing a toy to verbally prompt a user, instructing the toy to await a verbal response from the user and to transmit the verbal response to the computer which controls the toy, whereby the computer which controls the toy may perform speech recognition on the verbal response;

selecting at least one command from among said plurality of commands, said at least one command including at least one command from among the following commands:

commands instructing the toy to verbally prompt a user, commands instructing the toy to await a verbal response from the user and to transmit the verbal response to the computer which controls the toy;

generating control instructions for the toy comprising said at least one command and transmitting said at least one control instruction to the toy.

14. A method according to claim 13, wherein at least one of the step of selecting a toy and the step of selecting at least one command comprises utilizing a graphical user interface.

15. A method according to claim 13, wherein said at least one command comprises a command to cancel said previous command.

16. A method according to claim 13, wherein the step of selecting at least one command comprises:

choosing a command; and specifying at least one control parameter associated with said chosen command.

17. A method according to claim 16, wherein said at least one control parameter comprises at least one condition depending on a result of a previous command.

18. A method according to claim 17, wherein said condition comprises a time at which to cease performing said command.

19. A method according to claim 17, wherein said condition comprises a status of said toy.

20. A method according to claim 17, wherein said previous command comprises a previous command associated with a second toy.

21. A method according to claim 16, wherein said at least one control parameter comprises an execution condition controlling execution of said command.

22. A method according to claim 21, wherein said execution condition comprises a time at which to perform said command.

23. A method according to claim 16, wherein said at least one control parameter comprises a command modifier modifying execution of the command.

24. A method according to claim 16, wherein said at least one control parameter comprises a condition dependent on a future event.

25. A method for generating control instructions for a computer controlled toy system including a computer and at least one toy, the method comprising:

providing a library of toy control functions, said plurality of toy control functions including functions instructing the toy to verbally prompt a user, instructing the toy to await a verbal response from the user and instructing the toy to transmit the verbal response to the computer which controls the toy, whereby the computer which controls the toy may perform speech recognition on the verbal response;

selecting at least one toy control function from said library, including at least one function selected from functions instructing the toy to verbally prompt a user, instructing the toy to await a verbal response from the user and instructing the toy to transmit the verbal response to the computer which controls the toy, whereby the computer which controls the toy may perform speech recognition on the verbal response;

supplying operational parameters to at least one toy control function selected from said library for operating said at least one toy; and thereafter employing said at least one toy control function selected from said library for operating said at least one toy.

26. A method according to claim 25, wherein the step of selecting at least one command comprises:

choosing a command; and specifying at least one control parameter associated with said chosen command.

27. A method according to claim 26, wherein said at least one control parameter comprises an execution condition controlling execution of said command.

28. A method according to claim 27, wherein said execution condition comprises a time at which to perform said command.

29. A method according to claim 26, wherein said at least one control parameter comprises a command modifier modifying execution of the command.

30. A method according to claim 26, wherein said at least one control parameter comprises a condition dependent on a future event.

31. A method according to claim 26, wherein said at least one control parameter comprises at least one condition depending on a result of a previous command.

32. A method according to claim 31, wherein said previous command comprises a previous command associated with a second toy.

33. A method according to claim 31, wherein said condition comprises a time at which to cease performing said command.

34. A method according to claim 31, wherein said condition comprises a status of said toy.

35. A method according to claim 25, wherein at least one of the step of selecting a toy and the step of selecting at least one command comprises utilizing a graphical user interface.

36. A method according to claim 25, wherein said at least one command comprises a command to cancel said previous command.

* * * * *